US006921631B1

(12) United States Patent
Deguchi et al.

(10) Patent No.: US 6,921,631 B1
(45) Date of Patent: Jul. 26, 2005

(54) SILVER HALIDE COLOR PHOTOGRAPHIC MATERIAL AND METHOD OF FORMING COLOR IMAGE

(75) Inventors: Yasuaki Deguchi, Kanagawa (JP); Hiroyuki Yoneyama, Kanagawa (JP); Kazuaki Yoshida, Kanagawa (JP); Shin Soejima, Kanagawa (JP); Yoshiro Ochiai, Kanagawa (JP); Shinichi Nakahira, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/620,561

(22) Filed: Jul. 17, 2003

(30) Foreign Application Priority Data

Jul. 19, 2002 (JP) ..... P. 2001-211459
Jul. 22, 2002 (JP) ..... P. 2002-212476
Jul. 22, 2002 (JP) ..... 2002-212675
Jul. 22, 2002 (JP) ..... 2002-212676

(51) Int. Cl.[7] ..... G03C 7/46; G03C 1/06

(52) U.S. Cl. ..... 430/374; 430/377; 430/383; 430/567; 430/611; 430/613; 430/600; 430/603

(58) Field of Search ..... 430/374, 377, 430/383, 567, 600, 603, 611, 613

(56) References Cited

U.S. PATENT DOCUMENTS 6,824,964 B1 * 11/2004 Ishizaka et al. ..... 430/376
2003/0228544 A1 * 12/2003 Ohshima et al. ..... 430/383
2004/0038158 A1 * 2/2004 Soejima et al. ..... 430/385

* cited by examiner

*Primary Examiner*—Geraldine Letscher
(74) *Attorney, Agent, or Firm*—Sughrue Mion, PLLC

(57) ABSTRACT

A silver halide color photographic material, which can provide photographs reduced in unevenness of finished image density with high productivity and at low prices even when it undergoes exposure and photographic processing operations under high-speed transport in the form of sheets, and a method of forming images by use of such a photographic material.

6 Claims, No Drawings

SILVER HALIDE COLOR PHOTOGRAPHIC MATERIAL AND METHOD OF FORMING COLOR IMAGE

FIELD OF THE INVENTION

The present invention relates to a silver halide color photographic material and a method of forming a color image by using the same, and more specifically, to a silver halide color photographic material suitable for high-speed transport processing and a method of forming a color image by use of such a material. In particular, the invention is concerned with a silver halide color photographic material, which can ensure reduction of uneven density in high-speed transport processing performed in a sheet form and a method of forming a color image by use of such a material.

BACKGROUND OF THE INVENTION

In the field of photographic processing services, color printing systems for obtaining color prints from color negatives, reversal photosensitive materials and digital cameras have come into widespread use recently in not only laboratories dedicated to print processing (color processing laboratories) but also photo processing shops. As to the exposure methods adopted in these color printing systems, the method of launching rays of light incident on photographic film, such as color negative, into color paper and subjecting the photographic film to mask exposure, or the so-called direct (analog) exposure method, used to be in the mainstream. In recent years, however, printing apparatus utilizing digital exposure capable of obtaining color prints from digital cameras, more specifically the digital exposure system in which images recorded on films are read optoelectronically, the information of the thus read images are converted to digital signals, the digital signals are subjected to image processing, and images are recorded by scanning exposure with recording light modulated in accordance with the image data, has been put to practical use, and further it is becoming pervasive.

In a color printing system utilizing such a digital exposure method, a photosensitive material is wound into a roll and loaded in a cartridge with a taking-out slit, which is referred to as a magazine. At the time of use, the roll-form photosensitive material is pulled out of the slit and transported, subjected to exposure and photographic processing as it kept its roll form without being cut during the transport, and after drying it is cut into sheets with the intended length. In this process, or the so-called roll transport method, color prints has so far been made. This method requires a photosensitive material to form frame information for showing explicitly boundaries for each sheet of print. The areas for frame information become wastes.

Only lately, therefore, color printing systems adopting a sheet transport method wherein a photosensitive material is cut in a print size and formed into sheets, and then subjected to exposure and photographic processing, has entered into practical utilization. In such a sheet transport method, a photosensitive material cut into sheets is transported in a condition that uneven scanning exposure is avoided from occurring by adopting two ways of transporting, one involving the use of transport roller pairs and the other involving the use of a conveyor belt, and thereafter subjected to photographic processing. In the photographic processing, sheet-form photographic materials are transported by transport roller pairs. It is desirable that such a color printing system can deliver prints in great numbers per hour, and it is preferable that this highly productive system is implemented in comparatively compact apparatus. Therefore, the tendency now is proceeding toward replacement of the transport system for photographic processing with a system having a faster transport speed than previous systems.

However, such an increase in the transport speed requires a color photosensitive material, or color paper, to have more suitability for high illumination intensity exposure, higher processing consistency and higher ability to be processed rapidly than ever. In order to satisfy these requirements, the photographic industry has carried out studies on improvements in reciprocity characteristics of silver halide emulsions, improvements of couplers and coupler dispersions with the aim of developing colors by efficient coupling reaction of couplers with oxidized color developing agents, and improvements in the design of a photosensitive material in its entirety, inclusive of the constituents as described above. Although much effort has already been made in order to achieve the aforementioned improvements, it is to be desired that still more improvements from the aspects of both photosensitive material and processing system are made to satisfy further enhanced productivity and operability requirements of color photographic processing systems.

In the photographic processing service industry, photographic light-sensitive materials capable of being processed rapidly and offering high image quality have also been requested in recent years as part of a customer service improvement and as a measure of productivity improvement. In order to meet this request, it is generally carried out at present to subject photographic light-sensitive materials containing emulsions with high silver chloride contents (hereinafter referred to as print materials high in silver chloride content) to color development-processing (e.g., Color Processing CP-48S made by Fuji Photo Film Co., Ltd.). However, even the rapid processing systems using print materials high in silver chloride content are still difficult to say that their processing rapidity is satisfactory and comparable to rapidity of color image formation by other systems (e.g., an electrostatic transfer system, a thermal transfer system, an inkjet system). Therefore, it is desired to reduce the total processing time of a print material high in silver chloride content, extending from the start of development to the end of drying. Further, from the viewpoint of performance consistency in continuous processing, it is hard to say that the system of using print materials high in silver chloride content is superior to other systems for color-image formation. Therefore, improvement in robustness against performance variation by continuous processing has so far been required of such print materials. Furthermore, it sometimes happens that processing solutions are sequenced in poor conditions during continuous processing, and a density variation occurs within each sheet of the prints obtained under such conditions. Accordingly, improvement in robustness of each individual print is also required.

Under these circumstances, various studies and effort to develop methods for improving continuous processing consistency have been made in this industry.

For forming color photographic images, photographic couplers capable of forming three colors, yellow, magenta and cyan, are incorporated into three types of light-sensitive layers differing in color sensitivity, respectively, subjected to imagewise exposure, and then processed with a color developer containing a color developing agent. In this process, the couplers provide color-developed dyes by coupling reaction with the oxidized aromatic primary amine. In general the processing process of silver halide color photosensitive materials includes a color-developing step for forming color images, a desilvering step for removing developed silver and undeveloped silver, and a washing and/or stabilizing step. In the desilvering step for removing developed silver and silver halides, the developed silver is re-oxidized by a bleaching agent and fixation is carried out using an agent for solubilization of silver halides. These operations may be performed in successive steps using a bleaching solution and a fixing solution individually or in one step using a single solution containing a combination of a bleaching agent and a fixing agent. The latter solution is generally referred to as a blix solution.

As a silver bleaching agent in the bleaching solution and the blix solution, iron(III) complex salts of organic acids, especially iron(III) complex salt of ethylenediamine-N,N,N',N'-tetraacetic acid (hereinafter abbreviated as "PDTA"), are generally used. In addition, iron(III) complex salt of 1,3-propanediamine-N,N,N',N'-tetraacetic acid (hereinafter abbreviated as "PDTA") is also widely used from the viewpoints of an increase in processing speed and a reduction of waste ingredients in processing solutions. On the other hand, growing awareness about environmental conservation has aroused a lively concern for discharge of the aforementioned chelating agents having not only low biodegradability in the natural world but also a tendency to render deleterious heavy metal ions soluble. As a result, development of alternatives to the chelating agents mentioned above has been required. In response to this requirement, the chelating agents high in biodegradability are disclosed in JP-A-4-313752, JP-A-5-265159 and JP-A-6-161065.

However, the use of such iron(III) complex salts as bleaching agents for color photography sometimes causes a failure of cyan dye images to have sufficient densities. This phenomenon is generally recognized as reduction discoloration by conversion of cyan dyes into leuco compounds in bleaching or blix solutions (and referred to as blix discoloration). U.S. Pat. No. 4,591,548 indicates that the presence of iron(II) complex salts in bleaching or blix solutions becomes a cause of conversion of cyan dyes into leuco compounds.

The blix solutions are in an oxidative atmosphere, and can more effectively achieve their effect by supplying the processing solution with oxygen from the air. Moreover, oxidation of iron(II) complex salts present in the processing solutions makes it possible to prevent the cyan density from decreasing, or to avoid blix discoloration from occurring. From these points of view, blix discoloration can be lessened by expanding the air-contacted area of the processing solution in a blix processing tank, or the so-called aperture rate. However, the expansion of the aperture rate promotes vaporization of water at the time of continuous processing and heightens concentrations of ingredients in the processing solution; as a result, a precipitation problem occurs in some cases. Therefore, it is required to stabilize the cyan density in a processor having a blix bath low in aperture rate. In this respect, a solution by improvements on the side of a silver halide color photographic material is also awaited.

On the other hand, it has been aimed at in recent years to simplify and speed up photographic processing for color photographs by reductions in replenishment rate and processing time. Decreased replenishment and increased availability rate in the desilvering step give rise to an increase of the iron(II) complex salts and foster a tendency to worsen blix discoloration. In addition, the processing time in the desilvering step can be reduced effectively by lowering the pH of a bleaching solution or a blix solution. However, the lowered pH of the bleaching solution or the blix solution results in a drawback of promoting blix discoloration of cyan dyes, too.

With the intention of overcoming the blix discoloration of cyan dyes, a wide variety of approaches as mentioned below have been proposed. For instance, the improvement by modifying the concentration and the composition of a bleaching solution or a blix solution are disclosed in U.S. Pat. No. 3,706,561. The reduction in the total silver coverage of the layers arranged underneath the cyan dye-forming layer in a color photographic element is proposed in U.S. Pat. No. 4,366,233. The improvements by various compounds in a processing bath are disclosed in U.S. Pat. No. 3,820,997. The addition of water-soluble ionic compounds containing polyvalent elements to a blix bath is proposed in U.S. Pat. No. 3,774,510. The cyan couplers suitable for overcoming the foregoing troubles are disclosed in U.S. Pat. Nos. 4,151,680, 4,374,922 and 4,591,546.

As a method of improving the blix discoloration, the method of making improvement by use of hydroquinone or certain quinone derivatives is disclosed, e.g., in JP-A-63-316857. However, these previous arts have defects that effects thereof are insufficient, or while admitting their effects they sacrifice photographic properties, such as keeping quality of images, or a heavy load is imposed on liquid waste disposal. Further, those previous arts cannot bring about satisfactory solutions in the cases of the blix solutions using not only the EDTA-iron(III) complex salts or the PDTA-iron(III) complex salts but also the iron(III) complex salts of biodegradable chelating agents. Therefore, arts of producing greater effects on prevention of blix discoloration of cyan dyes without attended by the drawbacks as mentioned above have been required in recent years from the viewpoints of speedup of processing and influences upon environments.

On the other hand, attempts to improve blix discoloration of cyan dyes by use of polymer latices have so far been made. For instance, JP-A-64-52136 and JP-A-2-289840 disclose the methods of using polymer latices having alkoxyalkyl groups in side chains of their respective polymers. However, even these polymer latices are insufficient in their effects against blix discoloration. Accordingly, performance enhancement is required, especially in the cases of simple-and-rapid processing carried out under low-replenishment conditions. In addition, the polymer laticies of the foregoing type are of inferior dispersion stability.

Polymer latices prepared by copolymerizing monomers having —COOH groups are also well known in the field of photographic materials. For instance, the copolymer of n-butylacrylate and acrylic or methacrylic acid is disclosed in U.S. Pat. No. 3,287,289. In addition, JP-A-11-84559 discloses that the improving effect is enhanced by rendering the pH of coating compositions acidic. Yet it cannot be said that the improvement attained thereby is on a satisfactory level.

Even into the field of performing color printing by use of color photographic paper, recent years has seen a remarkable penetration of digitization. For instance, digital exposure systems utilizing laser-scanning exposure have enjoyed a leap increase in dissemination rate, compared with traditional analog exposure systems performing direct printing from exposed color negative films by means of a color printer. These digital exposure systems are notable for image quality heightened by image processing, and play an important role in improving the quality of color print using color photographic paper. Further, as digital camera penetration increases explosively, it is also becoming an important factor that color prints of high quality can be obtained with ease from such electronic recording media, and these circumstances are thought to result in a dramatic proliferation of digital exposure systems.

On the other hand, technologies for an inkjet system, a sublimation-type heat-sensitive transfer system and an electrostatic color photographic system each have made their individual progresses and have come to speak of the quality of photographs; as a result, they are being recognized as color printing systems. Of the color printing systems, the digital exposure systems using color photographic paper have features including high quality, high productivity and images with high fastness, and it is to be hoped that these features are further expanded and photographs of higher quality are provided more easily at lower prices. If a rapid finish service that the recording medium of a digital camera is received from a customer over the counter, high-quality prints are finished in a short time of the order of several minutes and the finished prints are instantly handed on to the customer, the so-called one-stop service of color prints, becomes feasible, the superiority of color prints using color photographic paper becomes more pronounced. In addition, if the rapid processing suitability of color photographic paper is enhanced, it becomes feasible to use printing equipment which is highly productive although it is smaller in size and lower in price. As a result, it can be expected that one-stop service of color prints becomes more widely available. In this respect, it is desired to enhance the rapid processing suitability of color photographic paper in particular. Further, the development time shortened by enhancing the rapid processing suitability of color print results in reduction of passage times of color photographic paper through processing solutions, and enables processing tanks to be downsized so long as the setting of the transport speed of color photographic paper is not changed. In order to counter the color printing systems other than the systems of using color photographic paper, the downsizing of equipment becomes important. From this viewpoint also, it is significant to enhance the rapid processing suitability of color photographic paper.

In order to enable one-stop service of color prints using color photographic paper, it is required to conduct studies from various points of view, inclusive of reduction in exposure time, reduction in a time period from the conclusion of exposure to the start of photographic processing, or the so-called latent-image time, and reduction in a time period from photographic processing to drying. Hitherto, proposals have been made from the foregoing viewpoints respectively. Of those points, the time required for exposure of one sheet of print is very short, compared with the other times, so it is no problem in the case of printers of normal power which are generally used in photo processing shops. As to the latent-image time, on the other hand, printers are designed so as to reduce the latent-image time to a minimum. In addition, reduction in the time period from processing to drying has also been tried. Specifically, various proposals have been put forth to effect rapid processing by putting ideas into designing processing compositions and setting processing temperatures and stirring conditions of processing solutions, or by devising ways to squeegee and dry photosensitive materials.

As a usage pattern of color photographic paper, it is common to adopt the so-called roll transport method in which roll-form color photographic paper is exposed and processed as its roll form is kept, and cut into sheets after the processing. In addition to such a transport method, color printing systems adopting a sheet transport method, in which photographic paper is cut into sheets of a print size before exposure and the sheets of photographic paper are exposed and processed, have put to practical use in recent years. Since it is required for photographic paper to form frame information for showing explicitly boundaries between juxtaposed prints, this transport method is undesirable in the sense that the areas for frame information are useless and become wastes. On the other hand, the sheet transport method has an advantage in that the foregoing problem is already settled. However, the sheet transport system requires photographic paper sheets to be transported while nipping them by pairs of transport rollers; as a result, it sometimes occurs that the pressure between a pair of rollers causes image defects, such as fogging in image areas and sensitivity modification streaks (streak-form unevenness in density which arises from increase in density by sensitization and decrease in density by desensitization). As a result of our examination, it has been found that sensitization streaks developed especially by the pressure imposed on the exposed photographic paper in a state of being dipped in a processing solution became more remarkable the more the transport speed was increased and the shorter the time period from the conclusion of exposure to the start of development was made for rapid processing. Further, our examination has revealed that these sensitization streaks were amplified by the use of a highly active developer enabling short-time development at relatively high temperatures and became a serious problem. Furthermore, it has been found that the sensitization streaks became more pronounced in the case of using photosensitive materials stored in an unexposed state after producing them than in the case of using photo sensitive materials just after the production thereof. Therefore, it is desired to develop technologies for improving the pressure sensitization streaks which become more pronounced in the case of subjecting color photographic paper to the rapid processing utilizing a sheet transport system. In addition, it is also hoped that technologies enabling improvement of pressure sensitization streaks not only just after production but also after storage of photosensitive materials will be developed.

In response to the request for rapid processing suitability, silver halide emulsions used in color photographic paper are emulsions having high silver-chloride contents. There is disclosure of incorporation of various metal complexes into such silver halide emulsions as to have high silver chloride contents. For the purpose of improving high illumination intensity failure of silver chloride emulsions and obtaining hard gradation under high illumination, it is known to dope the emulsions with Ir complexes. For instance, JP-B-7-34103 discloses that the problem of latent-image sensitization is solved by providing a localized phase having a high silver bromide content and doping the phase with an Ir complex. U.S. Pat. No. 4,933,272 discloses that low illumination intensity failure can be reduced by incorporation of a metal complex containing NO or NS in its ligands. U.S. Pat. Nos. 5,360,712, 5,457,021 and 5,462,849 disclose that reciprocity law failure can be reduced by incorporating metal complexes containing particular organic ligands as a part of their respective ligands. In addition, U.S. Pat. Nos. 5,372,926, 5,255,630, 5,255,451, 5,597,686, 5,480,771, 5,474,888, 5,500,335, 5,783,373 and 5,783,378 disclose that properties of emulsions having high silver halide contents, including reciprocity law characteristics, can be improved by use of combinations of Ir complexes and metal complexes containing NO in their respective ligands. JP-A-2000-250156, JP-A-2001-92066 and JP-A-2002-31866 disclose the emulsion arts of ensuring excellent latent image stability after exposure by combined use of Ir complexes and Rh complexes.

JP-A-58-95736, JP-A-58-108533, JP-A-60-222844, JP-A-60-222845, JP-A-62-253143, JP-A-62-253144, JP-A-62-253166, JP-A-62-254139, JP-A-63-46440, JP-A-63-46441, JP-A-63-89840, and U.S. Pat. Nos. 4,820,624, 4,865,962, 5,399,475 and 5,284,743 disclose that high sensitivities can be achieved by incorporating phases high in silver bromide content and various in form into emulsions having high chloride contents so that the phases are present in localized states.

U.S. Pat. Nos. 5,726,005 and 5,736,310 disclose that increase in sensitivity and reduction in high illumination intensity failure can be attained with the emulsions having high chloride contents and containing iodide in a state of having the concentration maximum at the sub-surface of emulsion grains. In the examples of EP-A-0928988, it is disclosed that emulsions having excellent characteristics with respect to reciprocity law failure, temperature dependence upon exposure and immunity to pressure can be obtained by incorporating the specified compounds into I-band forming grains at the time when 93% of grain formation is accomplished.

In JP-A-10-123658 and JP-A-11-282114, it is disclosed that the pressure fog developed in the case of imposing pressure on color paper dipped in a developer can be improved by use of the specific disulfide compounds and the photographic emulsions containing silver iodochloride sensitized chemically under the specified condition and further having the specific mercapto or metallic compounds.

However, those known arts are silent on improvement of sensitization streaks developed by pressure imposed on sheet-form color photographic paper after exposure in the case where the sheet-form color photographic paper undergoes color development in a short time falling within 28 seconds as it is transported at a high speed.

SUMMARY OF THE INVENTION

The invention is made against the aforementioned backdrop, and aims to provide a sheet-form high-speed transport color image formation method which can ensure excellent suitability for high illumination intensity exposure and rapid processing suitability in photosensitive materials, especially color paper, and have high productivity of photographic images, especially color prints, and silver halide color photographic materials used in such an image formation method.

More specifically, (1) a first object of the invention is to provide a color image formation method and a silver halide color photographic material which enable color prints having excellent image quality to be formed with little adverse effects, specifically including reduced developer streaks, reduced unevenness of image density and no appreciable deterioration in color developability and image quality, even under a situation that the processing time is shortened for rapid processing, latent images are formed by high illumination intensity exposure, or processing solutions undergo variations caused in their compositions by high-speed transport.

(2) A second object of the invention is to provide an image formation method adopting an automatic processing system of sheet-form high-speed transport type which has excellent operability in exposure and development processes of color photosensitive materials (color paper) and enables exceedingly efficient production, and what is more, capable of deterring defects associated with the adoption of the processing system, specifically deterioration in finished image quality including a drop in developed color density, poor leuco dye reciprocity and insufficient removal of silver, and further to provide a silver halide color photographic material used therein.

In other words, the second object is to provide an image formation method which uses a high-speed sheet transport automatic processing system having easy operability in exposure and development processes and high productivity, yet can ensure excellent image quality without causing a drop in developed color density, poor leuco dye reciprocity and insufficient removal of silver, and further to provide a silver halide color photographic material.

(3) A third object of the invention is to resolve pressure sensitization streaks developing in exposed sheet-form silver halide color photographic materials, especially when the exposed sheet-form photographic materials undergo high-temperature short-time development as they are transported at a high speed. More specifically, the third object is to resolve pressure sensitization streaks developing in silver halide photographic materials after exposure, which become pronounced especially when the transport speed of the photographic materials is not slower than 27.8 mm/sec, the development time is not longer than 27 sec and the temperature of a color developer used is from 43° C. to 60° C. Still another challenge of the invention is to develop an art of enabling such pressure sensitization streaks to be reduced even in the case of using photographic materials after storage in addition to the case of using them immediately after production.

(1) A color image formation method comprising:

cutting a silver halide color photographic material into sheets, the photographic material having on a support photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one light-insensitive hydrophilic colloid layer;

subjecting the photographic material cut into sheets to imagewise exposure; and subjecting the photographic material exposed imagewise to a photographic processing including a color development step, a bleach-fix step and a rinse step while transporting the photographic material with a pair of transport rollers, wherein the transport of the photographic material during the photographic processing is performed at a speed of 27.8 mm/sec to 100 mm/sec, and the silver halide color photographic material satisfies relations $1>Qy\geqq0.7$, $1>Qm\geqq20.5$ and $1>Qc\geqq0.7$ wherein Qy, Qm and Qc are defined by the following equations:

$$Qy=My/Ny$$

$$Qm=Mm/Nm$$

$$Qc=Mc/Nc$$

wherein Qy, Qm and Qc represent coupler utilization rates of the yellow coupler, the magenta coupler and the cyan coupler, respectively, in the silver halide color photographic material; Ny, Nm and Nc represent amounts [mole/I] of the yellow coupler, the magenta coupler and the cyan coupler coated, respectively; and My, Mm and represent amounts [mole/I] of yellow, magenta and cyan dyes, respectively, providing a Status-A gray density of 2.0±0.5.

(2) A silver halide color photographic material comprising on a support photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one light-insensitive hydrophilic colloid layer, wherein a color image is formed by an imagewise exposure and a photographic processing subsequent thereto which includes a color development step, a bleach-fix step and rinse step, in which the photographic processing is performed while transporting the photographic material in a state of sheets at a transport speed of 27.8 mm/sec to 100 mm/sec by means of transport rollers, wherein the silver halide color photographic material satisfies relations $1>Qy\geqq0.7$, $1>Qm\geqq0.5$ and $1>Qc\geqq0.7$, wherein Qy, Qm and Qc have the same meanings as defined in the item (1), respectively.

(3) The silver halide color photographic material according to the item (2), wherein Qm is from 0.50 to 0.80 and Qc is from 0.70 to 0.85.

(4) The silver halide color photographic material according to the item (2), wherein Qy is from 0.70 to 0.80, Qm is from 0.50 to 0.80 and Qc is from 0.70 to 0.85.

(5) The silver halide color photographic material according to the item (2), wherein the red-sensitive emulsion layer has a silver/coupler ratio (Ag/Cp) in the range of 2.87 to 6.41 by mole.

(6) The silver halide color photographic material according to the item (2), wherein the green-sensitive emulsion layer has a silver/coupler ratio (Ag/Cp) in the range of 2.10 to 5.40 by mole.

(7) The silver halide color photographic material according to the item (2), having the total gelatin content of 6.26 $g/m^2$ or below.

(8) The silver halide color photographic material according to the item (2), having the total silver content of from 0.39 to 0.59 $g/m^2$, (9) The silver halide color photographic material according to the item (2), having the total silver content of from 0.39 to 0.49 $g/m^2$.

(10) The silver halide color photographic material according to the item (2), wherein the red-sensitive emulsion layer contains at least one coupler selected from couplers represented by the following formula (PTA-I), couplers represented by the following formula (PTA-II) and couplers represented by the following formula (IA);

(PTA-I)

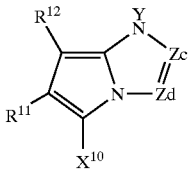

-continued (PTA-II)

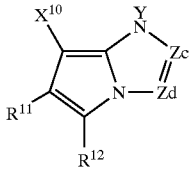

wherein Zc and Zd each represent —C($R^{13}$)=or —N=, provided that, when one of Zc or Zd is —C($R^{13}$)=, the other is —N=; $R^{13}$ represents a hydrogen atom or a substituent group; $R^{11}$ and $R^{12}$ each represent an electron attracting group having a Hammett's σp value of at least 0.2, and the total σp values of $R^{11}$ and $R^{12}$ is at least 0.65; $X_{10}$ represents a hydrogen atom or a group capable of being released by coupling reaction with the oxidation product of an aromatic primary amine color developing agent; Y represents a hydrogen atom or a group being released in the process of color development; any of $R^{11}$, $R^{12}$, $R^{13}$ and $X^{10}$ may be a divalent group to form a polymer of dimer or more, or to bond to a polymer chain to form a homopolymer or a copolymer:

(IA)

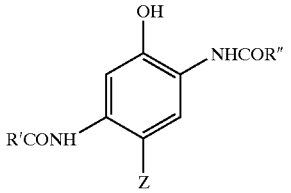

wherein R' and R" each represent a substituent, and Z represents a hydrogen atom or a group capable of being released by coupling reaction with the oxidation product of an aromatic primary amine color developing agent.

(11) The silver halide color photographic material according to the item (2), wherein the support is a reflective support.

(12) The color image formation method according to the item (1), wherein the color development step has a processing time of from 5 to 27 seconds and a processing temperature of from 43° C. to 60° C.

(13) The color image formation method according to the item (1), wherein the bleach-fix step has a processing time from 5 to 30 seconds and a replenishment rate of from 20 to 50 mL per $m^2$ of the photographic material.

(14) A color image formation method comprising:

cutting a silver halide color photographic material into sheets, the photographic material having on a support photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one light-insensitive hydrophilic colloid layer;

subjecting the photographic material cut into sheets to imagewise exposure; and subjecting the photographic material exposed imagewise to a photographic processing including a color development step, a bleach-fix step and a rinse step while transporting the photographic material with a pair of transport rollers, wherein the transport of the photographic material during the photographic processing is performed at a speed of 27.8 mm/sec to 100 mm/sec, the bleach-fix step has a replenishment rate of from 20 to 50 mL per $m^2$ of the photographic material and at least one of the red-sensitive silver halide emulsion layers contains at least one coupler selected from compounds represented by the following formula (IA);

(IA)

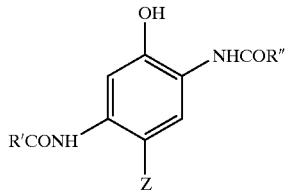

wherein R' and R" each represent a substituent, and Z represents a hydrogen atom or a group capable of being released by coupling reaction with the oxidation product of an aromatic primary amine color developing agent.

(15) The color image formation method according to the item (14), wherein the imagewise exposure is performed with a scanning exposure system having an exposure time per pixel of less than $10^{-3}$ second.

(16) The color image formation method according to the item (14), wherein the silver halide color photographic material has a total silver content of 0.46 g/$m^2$ or below.

(17) The color image formation method according to the item (14), wherein at least one of the green-sensitive silver halide emulsion layers contains at least one selected from compounds represented by the following formula (M-II);

(M-II)

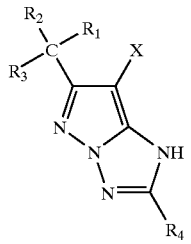

wherein $R_1$, $R_2$, $R_3$ and $R_4$ each represent a hydrogen atom or a substituent, and X represents a hydrogen atom or a group capable of being released by reaction with the oxidation product of an aromatic primary amine developing agent.

(18) The color image formation method according to the item (14), wherein the bleach-fix step has a processing time of from 12 to 30 seconds.

(19) A silver halide color photographic material comprising photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer, wherein a color image is formed by an imagewise exposure and a photographic processing subsequent thereto, which the photographic processing includes a color development step, a bleach-fix step having a replenishment rate of 20 to 50 ml per $m^2$ of the photographic material and a rinse step, in which the photographic processing is performed while transporting the photographic material cut into sheets at a transport speed of from 27.8 mm/sec to 100 mm/sec by means of transporting rollers, and at least one of the red-sensitive silver halide emulsion layers further contains at least one selected from compounds represented by the following formula (IA):

(IA)

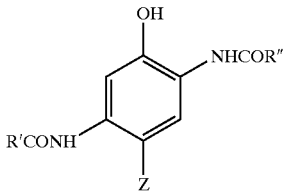

wherein R' and R" each represent a substituent, and Z represents a hydrogen atom or a group capable of being released by coupling reaction with the oxidation product of an aromatic primary amine color developing agent.

(20) The silver halide color photographic material according to the item (19), wherein the imagewise exposure is performed with a scanning exposure system having an exposure time per pixel of less than $10^{-3}$.

(21) The silver halide color photographic material according to the item (19), having a total silver content of 0.46 g/$m^2$ or below.

(22) The silver halide color photographic material according to the item (19), wherein at least one of the green-sensitive silver halide emulsion layers contains at least one selected from compounds represented by the following formula (M-II):

(M-II)

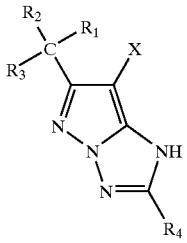

wherein $R_1$, $R_2$, $R_3$ and $R_4$ each represent a hydrogen atom or a substituent, and X represents a hydrogen atom or a group capable of being released by reaction with the oxidation product of an aromatic primary amine developing agent.

(23) The silver halide color photographic material according to the item (19), wherein the bleach-fix step has a processing time of from 12 to 30 seconds.

(24) A color image formation method comprising;

cutting a silver halide color photographic material into sheets, the photographic material having on a support photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one light-insensitive hydrophilic colloid layer;

subjecting the photographic material cut into sheets to imagewise exposure; and subjecting the photographic material exposed imagewise to a photographic processing including a color development step, a bleach-fix step and a rinse step, wherein the transport of the photographic material during the photographic processing is performed at a speed of 27.8 mm/sec to 100 mm/sec, the bleach-fix step has a processing time of 1 to 30 seconds and at least one of the silver halide emulsion layers comprises a silver halide emulsion containing at least one compound represented by the following formula (I) and having a silver chloride content of at least 90 mole %;

(I)

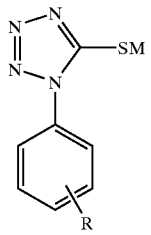

wherein M represents a cation, and R represents an atom having an atomic weight of not more than 100 or a group having a total atomic weight of not more than 100.

(25) The color image formation method according to the item (24), wherein the silver halide emulsion layer contains silver halide grains having a silver chloride content of at least 90 mole % and a silver iodide content of from 0.05 to 1 mole %.

(26) The color image formation method according to the item (24), having a total silver content of from 0.01 to 0.45 g/m$^2$.

(27) A silver halide color photographic material comprising photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer, wherein a color image is formed by an imagewise exposure and a photographic processing subsequent thereto, which the photographic processing includes a color development step, a bleach-fix step having a processing time of 1 to 30 seconds and a rinse step, in which the photographic processing is performed while transporting the photographic material cut into sheets at a transport speed of from 27.8 mm/sec to 100 mm/sec by means of transporting rollers, wherein at least one of the silver halide emulsion layers comprises an silver halide emulsion containing at least one compound represented by the following formula (I) and having a silver chloride content of at least 90 mole %:

(I)

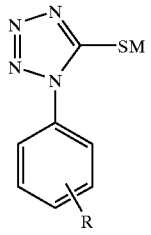

wherein M represents a cation, and R represents an atom having an atomic weight of not more than 100 or a group having a total atomic weight of not more than 100.

(28) The silver halide color photographic material according to the item (27), wherein the silver halide, emulsion layer contains silver halide grains having a silver chloride content of 90 mole % or higher and a silver iodide content of from 0.05 to 1 mole %.

(29) The silver halide color photographic material according to the item (27), having a total silver content of from 0.01 to 0.45 g/m$^2$.

(30) A color image formation method comprising:

cutting a silver halide color photographic material into sheets, the photographic material having on a support photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer;

subjecting the photographic material cut into sheets to imagewise exposure; and subjecting the photographic material exposed imagewise to a photographic processing including a color-development step while transporting them through a color developer, a bleach-fix step and a rince step, wherein the color developer is adjusted to a temperature within the range of 43° C. to 60° C., the color-development step has a processing time of 27 seconds or shorter, the transport of the photographic material through the color developer is performed at a linear speed of 27.8 mm/sec to 100 mm/sec, and at least one of the silver halide emulsion layers comprises the silver halide grains containing silver iodide in a proportion of 0.05 to 1 mole % to one mole of silver halide and having a silver chloride content of at least 90 mole %.

(31) A color image formation method comprising:

cutting a silver halide color photographic material into sheets, the photographic material having on a support photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer;

subjecting the photographic material cut into sheets to imagewise exposure; and subjecting the photographic material exposed imagewise to a photographic processing including a color-development step while transporting through a color developer, a bleaching step and a rince step, wherein the color developer is adjusted to a temperature within the range of 43° C. to 60° C., the color-development step has a processing time of 27 seconds or shorter, the transport of the photographic material through the color developer is performed at a linear speed of 27.8 mm/sec to 100 mm/sec, and at least one of the silver halide emulsion layers comprises silver halide grains containing at least one metal complex represented by the following formula (I) and having a silver chloride content of at least 90 mole %:

$$[IrX^I_nL_{I(6-n)}]^m \quad (I)$$

wherein $X^I$ represents a halogeno ion, or a pseudo halogeno ion other than a cyanato ion, $L^I$ represents any ligand different from $X^I$, n represents 3, 4 or 5, and m represents an integer of −4 to +1.

(32) The color image formation method according to the item (30), wherein the silver halide grains contains silver iodide in a proportion of 0.05 to 1 mole % to one mole of silver halide and has a silver chloride content of at least 90 mole %, in which a maximum content area of silver iodide is localized outside of 50% of the volume of each individual grains.

(33) The color image formation method according to the item (30), wherein the blue-sensitive silver halide emulsion includes the silver halide grains containing silver iodide in a proportion of 0.05 to 1 mole % to one mole of silver halide and having a silver chloride content of at least 90 mole %.

(34) The color image formation method according to the item (30), wherein the silver halide grains containing silver iodide in a proportion of 0.05 to 1 mole % to one mole of silver halide and having a silver chloride content of at least 90 mole %, further contains at least one metal complex represented by the following formula (I);

$$[IrX^I_nL^I_{(6-n)}]^m \quad (I)$$

wherein $X^I$ represents a halogeno ion, or a pseudo halogeno ion other than a cyanato ion, $L^I$ represents any ligand different from $X^I$, n represents 3, 4 or 5, and m represents an integer of −4 to +1.

(35) The color image formation method according to the item (30), wherein the emulsion layer comprising the silver halide grains containing silver iodide in a proportion of 0.05 to 1 mole % to one mole of silver halide and having a silver chloride content of at least 90 mole %, contains a compound represented by the following formula (III) in an amount satisfying a relation $1.0\times10^{-4}<M\cdot1<2.5\times10^{-4}$ wherein M represents a total content by mole of the compounds of formula (III) per mole of silver halide in the emulsion layer and 1 represents a volume weighted average sphere-equivalent diameter (μm) of the silver halide grains in the emulsion layer;

(III)

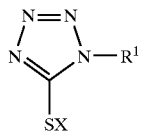

wherein $R^1$ represents an alkyl group, an alkenyl group or an aryl group, and X represents a hydrogen atom, an alkali metal atom, an ammonium group or a precursor thereof.

(36) The color image formation method according to the item (30), wherein the silver halide photographic material has a total silver content of 0.2 g/m$^2$ to 0.48 g/m$^2$.

(37) A silver halide color photographic material comprising on a support photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer, wherein an image is formed by being cut into sheets and transported through a color developer having its temperature within the range of 43° C. to 60° C. for 27 seconds or shorter at a linear speed of at least 27.8 mm/sec by means of either a pair of transporting rollers or belt conveyer, wherein at least one of the silver halide emulsion layers comprises silver halide grains containing silver iodide in a proportion of 0.05 to 1 mole % to one mole of silver halide and having a silver chloride content of at least 90 mole %.

(38) A silver halide color photographic material comprising on a support photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer, wherein the image is formed by being cut into sheets and transported through a color developer having the temperature within the range of 43° C. to 60° C. for 27 seconds or shorter at a linear speed of at least 27.8 mm/sec by means of either a pair of transporting rollers or a belt conveyer, wherein at least one of the silver halide emulsion layers further comprises silver halide grains containing at least one metal complex represented by the following formula (I) and having a silver chloride content of at least 90 mole $$[IrX^I_nL^I_{(6-n)}]^m \quad (I)$$

wherein $X^I$ represents a halogeno ion, or a pseudo halogeno ion other than a cyanato ion, $L^I$ represents any ligand different from $X^I$, n represents 3, 4 or 5, and m represents an integer of −4 to +1.

(39) The silver halide color photographic material according to the item (37), wherein the silver halide grains contains silver iodide in a proportion of 0.05 to 1 mole % to one mole of silver halide and has a silver chloride content of at least 90 mole %, in which a maximum content area of silver iodide is localized outside of 50% of the volume of each individual grains.

(40) The silver halide color photographic material according to the item (37), wherein the blue-sensitive silver halide emulsion comprises the silver halide grains containing silver iodide in a proportion of 0.05 to 1 mole % to one mole of silver halide and having a silver chloride content of at least 90 mole %.

(41) The silver halide color photographic material according to the item (37), wherein the silver halide grains containing silver iodide in a proportion of 0.05 to 1 mole % to one mole of silver halide and having a silver chloride content of at least 90 mole %, further contains at least one metal complex represented by the following formula (I):

$$[IrX^I_nL^I_{(6-n)}]^m \quad (I)$$

wherein $X^I$ represents a halogeno ion, or a pseudo halogeno ion other than a cyanato ion, $L^I$ represents any ligand different from $X^I$, n represents 3, 4 or 5, and m represents an integer of −4 to +1.

(42) The silver halide color photographic material according to the item (37), wherein the emulsion layer comprising the silver halide grains containing silver iodide in a proportion of 0.05 to 1 mole % to one mole of silver halide and having a silver chloride content of at least 90 mole %, further contains a compound represented by the following formula (III) in an amount satisfying a relation $1.0\times10^{-4}<M\cdot1<2.5\times10^{-4}$, wherein M represents a total content by mole of the compounds of formula (III) per mole of silver halide in the emulsion layer and 1 represents a volume weighted average sphere-equivalent diameter (μm) of the silver halide grains in the emulsion layer;

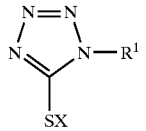

(III)

wherein $R^1$ represents an alkyl group, an alkenyl group or an aryl group, and X represents a hydrogen atom, an alkali metal atom, an ammonium group or a precursor thereof.

(43) The silver halide color photographic material according to the item (37), having a total silver halide content of 0.2 g/m$^2$ to 0.48 g/m$^2$.

DESCRIPTION OF THE PREFERRED EMBODIMENTS

The following are detailed description of the invention.

The invention is achieved by embodiments mentioned below.

The color photographic material according to a first embodiment of the invention is a silver halide color photographic material having on a support photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one light-insensitive hydrophilic colloid layer, and satisfying relations $1>Qy\geqq0.7$, $1>Qm\geqq0.5$ and $1>Qc\geqq0.7$ wherein Qy(=My/Ny), Qm(=Mm/Nm) and Qc(=Mc/Nc) stand for coupler utilization rates of the aforesaid dye-forming couplers, respectively. The color image formation method according to the invention is a color image formation method in which the photographic material as defined above is cut into sheets, and subjected to imagewise exposure and then to photographic processing including a color development step, a blix step and a rinsing step while transporting each sheet by pairs of transport rollers, and besides, a transport speed during the photographic processing is controlled to the range of 27.8 mm/sec to 100 mm/sec.

A primary feature of the color image formation method according to the first embodiment of the invention and the color photographic material used therein is that cyan, magenta and yellow couplers having their respective coupler utilization rates in the high-value ranges defined above are incorporated in the photographic material. By incorporating a coupler having such a high coupler utilization rate in each emulsion layer, the progress of development is expedited, high developed color density is attained speedily even in the case of using high illumination scanning laser beams, developer streaks are suppresses and excellent image quality can be obtained consistently without undergoing influences of variations caused in processing compositions by high-speed transport and low replenishment. Moreover, owing to adoption of the sheet transport mode, savings in the amount of photographic materials consumed (reduction in area consumed per print) and productivity improvement can be achieved.

Additionally, Ny, Nm and Nc in the definitions of the coupler utilization rates Qy, Qm and Qc stand for the amounts [mole/I] of a yellow coupler, a magenta coupler and a cyan coupler coated. My, Mm and Mc in the foregoing definitions stand for the amounts [mole/I] of yellow, magenta and cyan dyes providing a Status-A gray density of 2.0±0.5.

In the silver halide color photographic material and the color image formation method according to the first embodiment of the invention, the following cases (a) to (j) and combinations thereof are preferable.

(a) With respect to the coupler utilization rates of couplers incorporated in the photographic material, Qm is from 0.50 to 0.80 and Qc is from 0.70 to 0.85, particularly preferably $0.57<Qm\geqq0.75$ and $0.70<Qc\geqq0.80$.

(b) Qy is from 0.70 to 0.80, Qm is from 0.50 to 0.80 and Qc is from 0.70 to 0.85.

(c) The red-sensitive emulsion layer has a silver/coupler ratio (Ag/Cp ratio) in the range of 2.87 to 6.41 (by mole), preferably 3.83 to 6.41.

(d) The green-sensitive emulsion layer has a silver/coupler ratio (Ag/Cp ratio) in the range of 2.10 to 5.40 (by mole), preferably 2.75 to 5.04.

(e) The silver halide color photographic material has the total gelatin coverage of at most 6.26 g/m$^2$, preferably from 4.0 to 5.8 g/m$^2$.

(f) The silver halide color photographic material has the total silver coverage of from 0.39 to 0.59 g/m$^2$, preferably from 0.39 to 0.53 g/m$^2$, far preferably from 0.39 to 0.49 g m$^2$, on a silver basis.

(g) The red-sensitive emulsion layer of the silver halide color photographic material contains at least one coupler selected from couplers represented by formula (PTA-I), couplers represented by formula (PTA-II) or couplers represented by formula (IA). These couplers can contribute in particular to raise the coupler utilization rate to the range defined. And they are illustrated in detail hereinafter.

(h) The support of the silver halide color photographic material is a reflective support, which can render the effects of the invention tangible.

(i) In the present color image formation method, high-temperature rapid processing is carried out under conditions that the processing time and the processing temperature in the color development step is from 5 to 27 seconds and from 43° C. to 60° C., respectively.

(j) In the present color image formation method, rapid low-replenishment processing is carried out under conditions that the processing time in the blix processing step is from 5 to 30 seconds and the replenishment rate for a blix bath is from 20 to 50 mL per m$^2$ of the photographic material.

These preferable cases of the first embodiment of the invention are illustrated below in more detail.

Cyan, magenta and yellow couplers used in the invention may be any couplers so far as they can achieve the coupler utilization rates defined above respectively under the rapid and high-temperature or low-replenishment conditions relating to the invention. Couplers satisfying such a requirement and usable in the invention can be selected from the couplers disclosed in JP-A-62-215272, page 91, line 4 on the right upper column, to page 121, line 6 on left upper column, JP-A-2-33144, page 3, line 14 on right upper column, to page 18, end line on left upper column, and page 30, line 6 on right upper column, to page 35, line 11 on right lower column, and EP-A2-0355660, page 4, lines 15–27, page 5, line 30, to page 28, end line, page 45, lines 29–31, and page 47, line 23, to page 63, line 50.

In addition, the compounds of formulae (II) and (III) disclosed in WO-98/33760 and the compounds of formula (D) disclosed in JP-A-10-221825 are also preferable.

However, the couplers used in the invention should not be construed as being limited to those recited above, but other couplers can also be used as far as they can achieve the coupler utilization rates defined above.

As cyan dye-forming couplers (hereinafter simply referred to as "cyan couplers" on occasion) used in the invention, pyrrolotriazole couplers are suitable. Of couplers of such a type, the couplers represented by formulae (I) and (II) in JP-A-5-313324, the couplers represented by formula (I) in JP-A-6-347960 and the couplers exemplified in these laid-open patent applications are preferred in particular.

In addition, couplers of phenol and naphthol types are also suitable. For instance, the cyan couplers represented by formula (ADF) in JP-A-10-333297 are preferable.

As cyan couplers other than those recited above, the pyrroloazole cyan couplers disclosed in European Patent No. 0499248 and EP-A1-0491197, the 2,5-diacylaminophenol couplers disclosed in U.S. Pat. No. 5,888,716, and the pyrazoloazole cyan couplers having electron-attracting groups or hydrogen bond-forming groups in their respective 6-positions, especially pyrazoloazole cyan couplers having carbamoyl groups in their respective 6-positions as disclosed in JP-A-8-171185, JP-A-8-311360 and JP-A-8-339060, are also used to advantage.

Further, not only the diphenylimidazole cyan couplers disclosed in JP-A-2-33144 but also the 3-hydroxypyrizine cyan couplers disclosed in EP-A2-0333185 (Of the couplers exemplified therein, Coupler (42) converted from its four-equivalent form into a two-equivalent one by introduction of a chlorine atom as a splitting-off group, Coupler (6) and Coupler (9) are preferable in particular), the cyclic active methylene cyan couplers disclosed in JP-A-64-32260 (Of the couplers exemplified therein, Couplers 3, 8 and 34 are preferable in particular), the pyrrolopyrazole cyan couplers disclosed in EP-Al-0456226 and the pyrroloimidazole cyan couplers disclosed in European Patent No. 0484909 can also be used.

Examples of cyan couplers usable to advantage in the invention include phenol cyan couplers, naphthol cyan couplers and heterocyclic couplers. Of these couplers, pyrroloazole couplers, especially those represented by the following formulae (PTA-I) and (PTA-I), are preferred over others.

Formula (PTA-I)

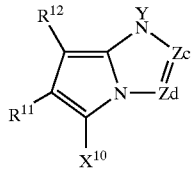

Formula (PTA-II)

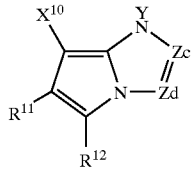

In formulae (PTA-I) and (PTA-II), Zc and Zd each represent —($R^{13}$)=or —N=, provided that either of Zc or Zd is —C($R^{13}$)= and the remainder is —N=. $R^{11}$ and $R^{12}$ each represent an electron attracting group having a Hammett's up value of at least 0.2, and besides, the total σp values of $R^{11}$ and $R^{12}$ is required to be at least 0.65. $R^{13}$ represents a hydrogen atom or a substituent group. $X^{10}$ represents a hydrogen atom or a group capable of being eliminated by coupling reaction with an oxidized aromatic primary amine color developing agent. Y represents a hydrogen atom or a group splitting off in the process of color development.

On the other hand, any of $R^{11}$, $R^{12}$, $R^{13}$ and $X^{10}$ may be a divalent group forming a polymer including dimer or a divalent group bonding to a compound capable of forming a polymer chain to constitute side chains of a homopolymer or a copolymer.

Of these couplers, cyan couplers represented by the following formula (PTA-III) are preferable by far from the viewpoints of rapid processing suitablility, color reproducibility and stability of photosensitive materials in an unexposed state.

Formula (PTA-III)

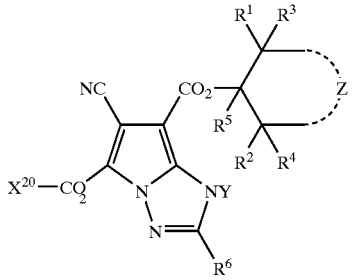

In formula (PTA-III), $R^1$ and $R^2$ each represent an alkyl group or aryl group independently, $R^3$, $R^4$ and $R^5$ each represent a hydrogen atom, an alkyl group or an aryl group independently, Z represents nonmetallic atoms necessary to form a saturated ring, $R^6$ represents a substituent, $X^{20}$ represents a heterocyclic group, a substituted amino group or an aryl group, and Y represents a hydrogen atom or a group splitting off in the process of color development.

The alkyl group represented by $R^1$ to $R^5$ each in formula (PTA-III) is a 1-36C linear, branched or cyclic alkyl group, preferably a 1-22C linear, branched or cyclic alkyl group, particularly preferably a 1-8C linear, branched or cyclic alkyl group. Examples of such an alkyl group include methyl, ethyl, n-propyl, isopropyl, t-butyl, t-amyl, t-octyl, decyl, dodecyl, cetyl, stearyl, cyclohexyl and 2-ethylhexyl groups.

The aryl group represented by $R^1$ to $R^5$ each in formula (PTA-III) is a 6-20C aryl group, preferably a 6-14C aryl group, particularly preferably a 6-1° C. aryl group. Examples of such an aryl group include phenyl, 1-naphthyl, 2-naphthyl and 2-phenanthryl groups.

The nonmetallic atoms represented by Z required to form a saturated ring in formula (PTA-III) are nonmetallic atoms necessary to form a 5- to 8-menbered ring. The ring formed may be substituted, or may be a saturated ring or an unsaturated ring. Examples of nonmetallic atoms forming such a ring include a carbon atom, an oxygen atom, a nitrogen atom and a sulfur atom. Suitable examples of the ring formed include 6-menbered saturated carbon rings, particularly preferably cyclohexane rings having 1-24C alkyl groups in their respective 4-positions. Examples of a substituent represented by $R^6$ in formula (PTA-III) include a halogen atom (e.g., a fluorine atom, a chlorine atom, a bromine atom), an aliphatic group (including a 1-36C linear or branched alkyl group, an aralkyl group, an alkenyl group, alkynyl group, a cycloalkyl group and a cycloalkenyl group, such as methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl and 3-(2,4-di-t-amylphenoxypropyl)), an aryl group (specifically a 6-36C aryl group, such as phenyl, 4-t-butylphenyl, 2,4-di-t-amylphenyl, 4-tetradecanamidophenyl or 2-mthoxyphenyl), a heterocyclic group (specifically a 1-36C heterocyclic group, such as 2-furyl, 2-thienyl, 2-pyrimidinyl or 2-benzothiazolyl), a cyano group, a hydroxyl group, a nitro group, a carboxyl group, a sulfo group, an unsubstituted amino group, an alkoxy group (specifically a 1-36C linear, branched or cyclic alkoxy group, such as methoxy, ethoxy, butoxy, 2-methoxyethoxy, 2-dodecyloxy or 2-methanesulfonylethoxy), an aryloxy group (specifically a 6-36C aryloxy group, such as phenoxy, 2-methylphenoxy, 4-t-butylphenoxy, 3-nitrophenoxy, 3-t-butyloxycarbamoylphenoxy or 3-methoxycarbamoylphenoxy), an acylamino group (specifically 2-36C acylamino group, such as acetamido, benzamido, tetradecanamido, 2-(2,4-di-t-amylphenoxy) butanamido, 4-(3-t-butyl-4-hydroxyphenoxy)butanamido, or 2-{4-(4-hydroxyphenylsulfonyl)phenoxy}decanamido), an alkylamino group (specifically a 1-36C alkylamino group, such as methylamino, butyamino, dodecylaminno, diethylamino or methylbutylamino), an anilino group (specifically a 6-36C anilino group, such as phenylamino, 2-chloroanilino, 2-chloro-5-tetradecanaminoanilino, 2-chloro-5-dodecyloxycarbonylanilino, N-acetylanilino or 2-chloro-5-{2-(3-t-butyl-4-hydroxyphenoxy) dodecanamido}ani lino), an ureido group (specifically a 2-26C ureido group, such as phenylureido, methylureido or N,N-dibutylureido), a sulfamoylamino group (specifically 1-36C sulfamoylamino group, such as N,N-dipropylsulfamoylamino or N-methyl-N-decylsulfamoylamino), an allkylthio group (specifically a 1-36C alkylthio group, such as methylthio, octylthio, tetradecylthio, 2-phenoxyethylthio, 3-phenoxypropylthio or 3-(4-t-butylphenoxy)propylthio), an arylthio group (specifically a 6-36C arylthio group, such as phenylthio, 2-butoxy-5-t-octylphenylthio, 3-pentadecylphenylthio, 2-carboxyphenylthio or 4-tetradecanamidophenylthio), an alkoxycarbonylamino group (specifically a 2-36C alkoxycarbonylamino group, such as methoxycaronylamino or tetradecyloxycarbonylamino), a sulfonamido group (specifically a 1-36C alskylsulfonamido or arylsulfonamido group, such as methanesulfonamido, butanesulfonamido, octanesulfonamido, hexadecanesulfonamido, benzenesulfonamido, p-toluenesulfonamido, octadecanesulfonamido or 2-methoxy-5-t-butylbenzenesulfonamido), a carbamoyl group (specifically a 1-36 C carbamoyl group, such as N-ethylcarbamoyl, N,N-dibutylcarbamoyl, N-(2-dodecyloxyethyl)carbamoyl, N-methyl-N-dodecylcarbamoyl or N-{3-(2,4-di-t-amylphenoxy) propyl}carbamoyl), a sulfamoyl group (specifically a 1-36C sulfamoyl group, such as N-ethylsulfamoyl, N,N-dipropylsulfamoyl, N-(2-dodecyloxyethyl)sulfamoyl, N-ethyl-N-dodecylsulfamoyl or N,N-diethylsulfamoyl), a sulfonyl group (specifically a 1-36C alkylsulfonyl or arylsulfonyl group, such as methanesulfonyl, octanesulfonyl or benzenesulfonyl, toluenesulfonyl), analkoxycarbonyl group (specifically a 2-36C alkoxycarbonyl group, such as methoxycarbonyl, butyloxycarbonyl, dodecyloxycarbonyl or octadecyloxycarbonyl), a heterocyclyloxy group (specifically a 1-36C heterocyclyloxy group, such as 1-phenyltetrazzole-5-oxy or 2-tetrahydropyranyloxy), an azo group (such as phenylazo, 4-methoxyphenylazo, 4-pivaloylaminophenylazo or 2-hydroxy-4-propanoylphenylazo), an acyloxy group (specifically a 2-36C acyloxy group, such as acetoxy), a carbamoyloxy group (specifically a 1-36C carbamoyloxy group, such as N-methylcarbamoyloxy or N-phenylcarbamoyloxy), a silyloxy group (specifically a 3-36C silyloxy group, such as trimethylsilyloxy or dibutylmethylsilyloxy), an aryloxycarbonylamino group (specifically a 7-36C aryloxycarbonylamino group, such as phenoxycarbonylamino), an imido group (specifically a 4-36C imido group, such as N-succinimido, hydantoinyl, N-phthalimido or 3-octadecenylsuccinimido), a heterocyclylthio group (specifically a 1-36C heterocyclylthio group, such as 2-benzothiazolylthio, 2,4-di-phenoxy-1,3,5-triazole-6-thio or 2-pyridylthio), a sulfinyl group (specifically a 1-36C sulfinyl group, such as dodecanesulfinyl, 3-pentadecylphenylsulfinyl or 3-phenoxypropylsulfinyl), an alkyl-, aryl- or heterocyclyl-oxycarbonyl group (such as methoxycarbonyl, butoxycarbonyl, dodecyloxycarbonyl, octadecyloxycarbonyl, phenyloxycarbonyl or 2-pentadecyloxycarbonyl), an alkyl-, aryl- or heterocyclyl-oxycarbonylamino group (such as methoxycarbonylamino, tetradecyloxycarbonylamino, phenoxycarbonylamino or 2,4-d-tert-butylphenoxycarbonylamino), an sulfonamido group (such as methanesulfonamido, hexadecanesulfonamido, benzenesulfonamido, p-toluenesulfonamido, octadecanesulfonamido or 2-methoxy-5-tert-butylbenzenesulfonamido), a carbamoyl group (such as N-ethylcarbamoyl, N,N-dibutylcarbamoyl, N-(2-dodecyloxyethyl)carbamoyl, N-methyl-N-dodecylcarbamoyl or N-[3-(2,4-di-tert-amylphenoxy) propyl]carbamoyl), a sulfamoyl group (such as N-ethylsulfamoyl, N,N-dipropylsulfamoyl, N-(2-dodecyloxyethyl)sulfamoyl, N-ethyl-N-dodecylsulfamoyl or N,N-diethylsulfamoyl), a phosphonyl group (such as phenoxyphosphonyl, octyloxyphosphonyl or phenylphosphonyl), a sulfamido group (such as dipropylsulfamoylamino), an azolyl group (such as imidazolyl, pyrazolyl, 3-chloro-pyrazole-1-yl or triazolyl), a hydroxyl group, a cyano group, a carboxyl group, a nitro group, a sulfo group and an unsubstituted amino group.

Examples of a group suitable as $R^6$ include an alkyl group, an aryl group, a heterocyclyl group, a cyano group, a nitro group, an acylamino group, an arylamino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclyloxy group, an acyloxy group, a carbamoyloxy group, an aryloxycarbonylamino group, an imido group, a heterocyclylthio group, a sulfinyl group, a phosphonyl group, an acyl group and an azolyl group.

Of these groups, an alkyl group and an aryl group are preferred over the others, and an aryl group substituted at least by an alkyl group at the p-position is especially favorable.

$X^{20}$ represents a heterocyclic ring, a substituted amino group or an aryl group. Suitable examples of such a heterocyclic ring include 5-, 6-, 7- and 8-membered rings which each contain 1 to 36 carbon atoms and nitrogen, oxygen or sulfur atom(s) Of these rings, 5- and 6-membered rings having nitrogen atoms at their respective bonding sites are preferred in particular.

Examples of such rings include imidazole, pyrazole, triazole, lactam compounds, piperidine, pyrrolidine, pyrrole, morpholine, pyrazolidine, thiazolidine and pyrazoline. Of these rings, morpholine and piperidine are preferred over the others.

Examples of a substituent the substituted amino group has include an aliphatic group, an aryl group or a heterocyclic group. Examples of such an aliphatic group include the same ones as $R^6$ represents, and these aliphatic groups each may further be substituted with a cyano group, an alkoxy group (e.g., methoxy), an alkoxycarbonyl group (e.g., ethoxycarbonyl), a chlorine atom, a hydroxyl group or a carboxyl group. As to the substituted amino groups, disubstituted ones are preferable to monosubstituted ones. As the aryl group, those containing 6 to 36 carbon atoms are suitable, and monocyclic ones are preferable to the others. Examples of such aryl groups include phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl and 2,4-dichlorophenyl groups.

Suitable examples of a substituted amino group represented by $X^{20}$ are illustrated below.

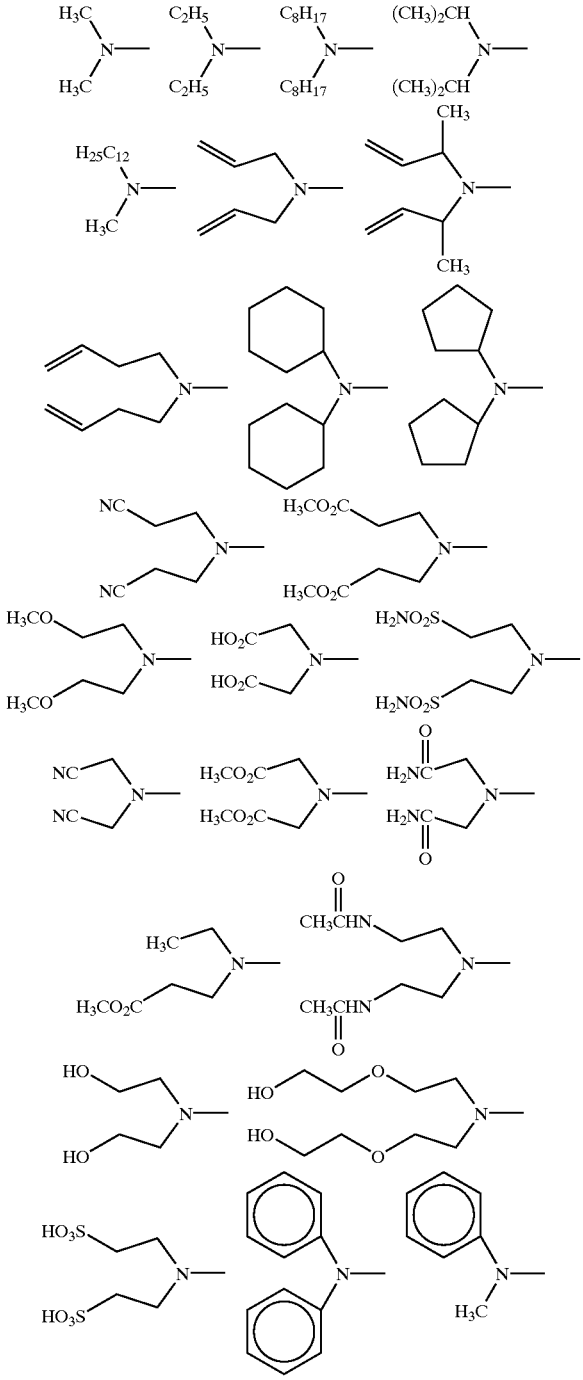

-continued

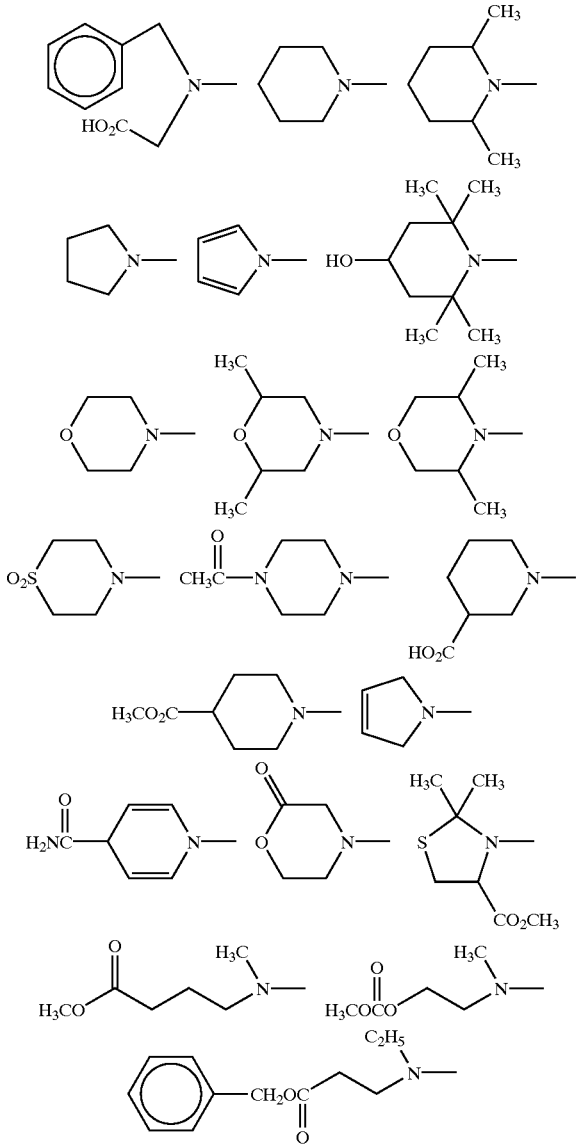

Y is a hydrogen atom or a substituent splitting off in the process of color development. Examples of a substituent represented by Y include the groups capable of splitting off under alkaline conditions as disclosed in JP-A-61-228444 and the substituents coupled off by reaction with developing agents as disclosed in JP-A-56-133734. However, Y is preferably a hydrogen atom.

The coupler represented by formula (PTA-III) may be a polymer, inclusive of a dimer, formed via $R^6$ in which the residue of a coupler represented by formula (PTA-III) is included, or may be a homo- or copolymer having a macromolecular chain to which couplers of formula (PTA-III) are bonded via their respective $R^6$ groups. Typical examples of such a or co-polymer include homo- or copolymers of addition polymerizing ethylenic unsaturated compounds containing the residues of couplers represented by formula (PTA-III). These polymers may contain one or more kinds of cyan color-forming repeating units having the residues of couplers represented by formula (PTA-III). The copolymers may contain as comonomers one or more kinds of ethylenic monomers forming no colors because of their incapability of coupling with the oxidation product of an aromatic primary amine developing agent, such as acrylic acid esters, methacrylic acid esters and maleic acid esters. It is appropriate that the compounds represented by formula (PTA-III) be used in an amount of 0.01 to 1.0 mole, preferably 0.12 to 1.0 mole, particularly preferably 0.25 to 0.5 mole, per mole of light-sensitive silver halide in the same layer as they are used.

Examples of cyan couplers usable in the invention are illustrated below, but these examples should not be construed as limiting the scope of the invention.

(1)

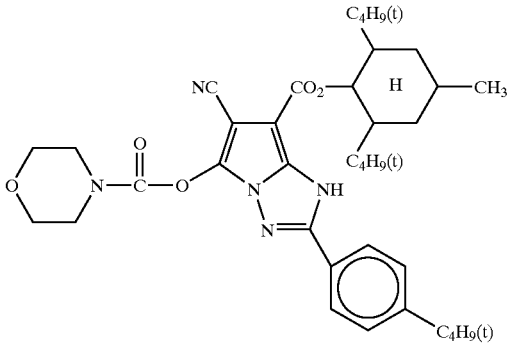

(2)

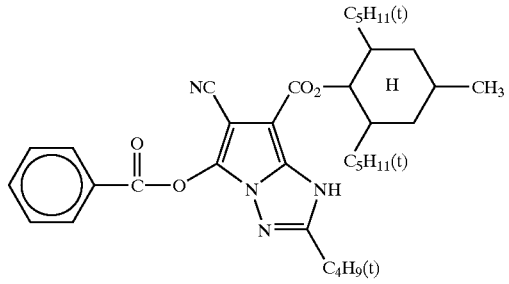

(3)

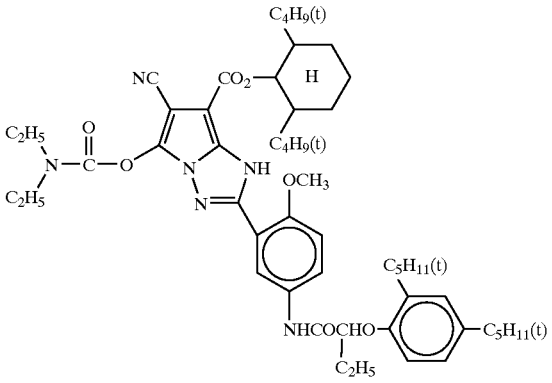

(4)

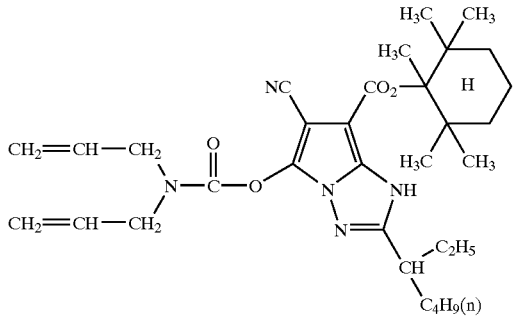

(5)

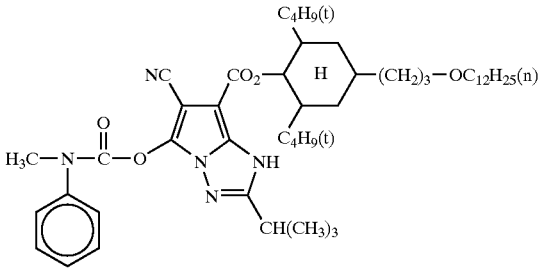

(6)

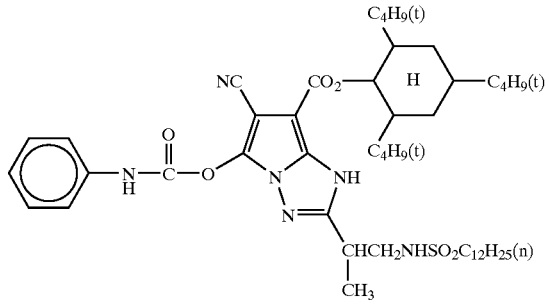

-continued
(7)
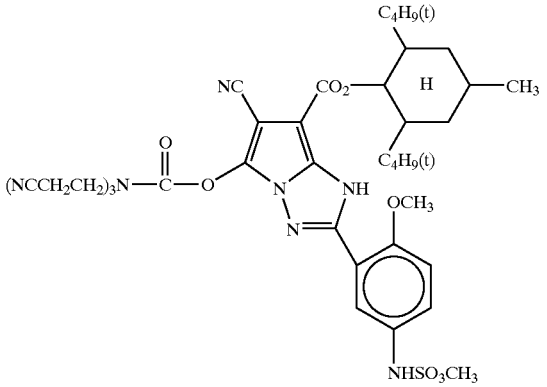
(8)
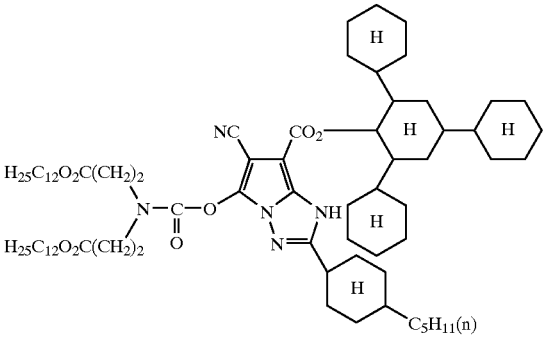
(9)
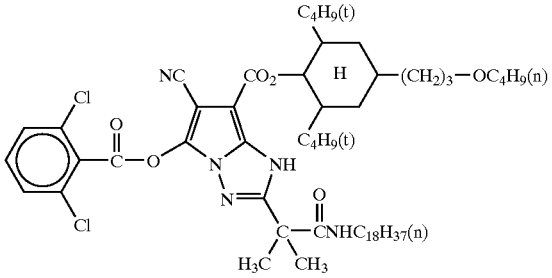
(10)
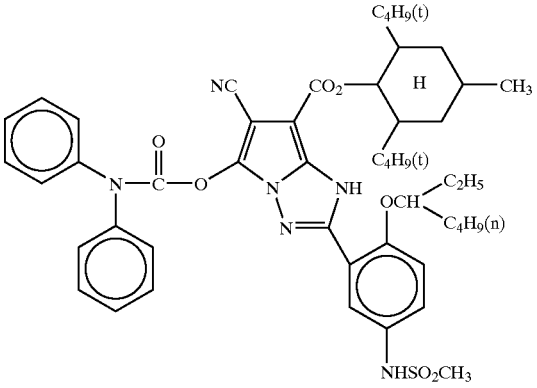
(11)
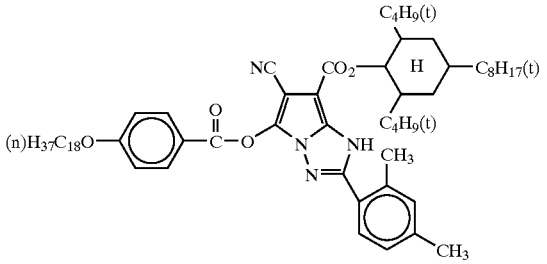
(12)
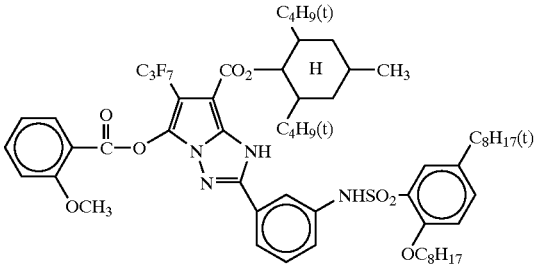
(13)
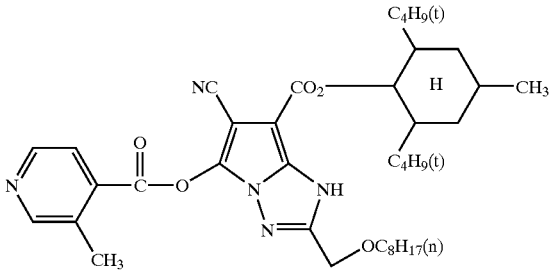

-continued
(14)
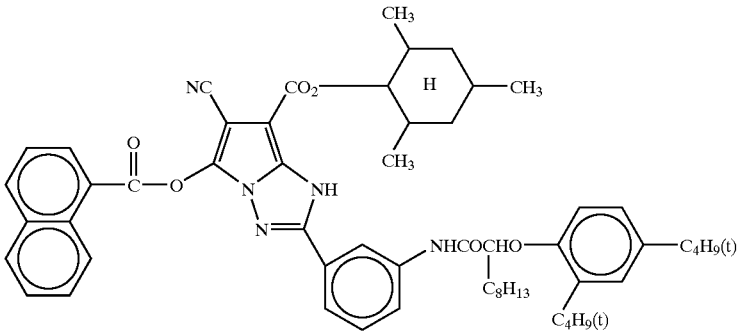
(15)
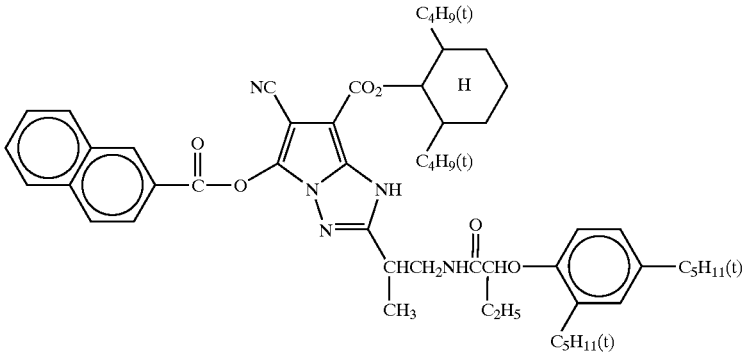
(16)
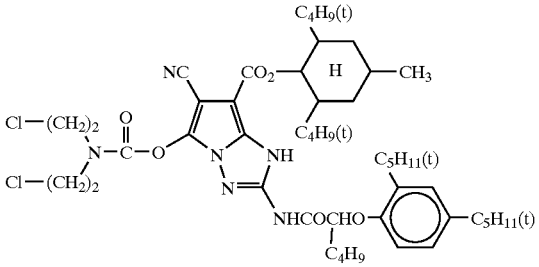
(17)
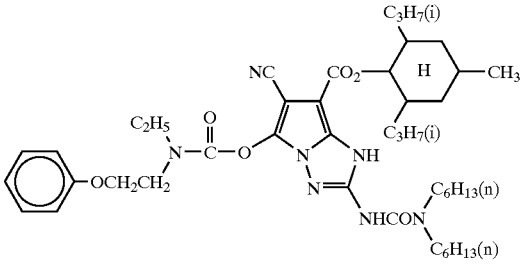
(18)
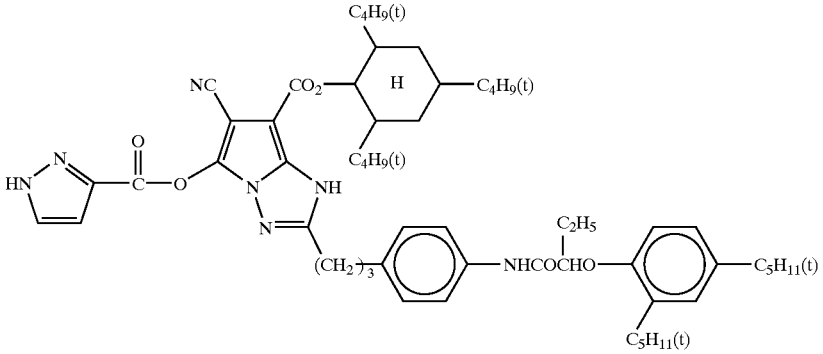

-continued
(19)
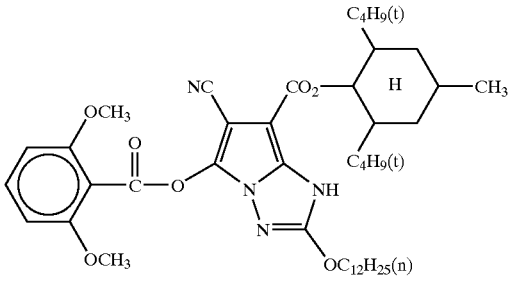
(20)
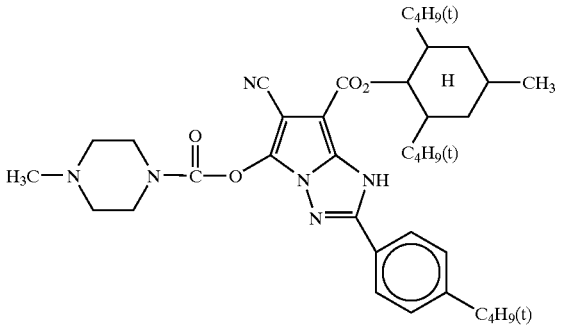
(21)
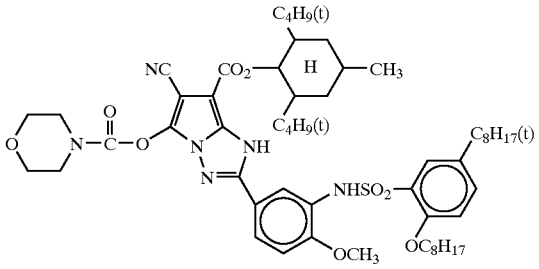
(22)
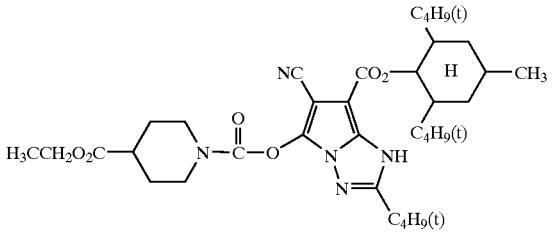
(23)
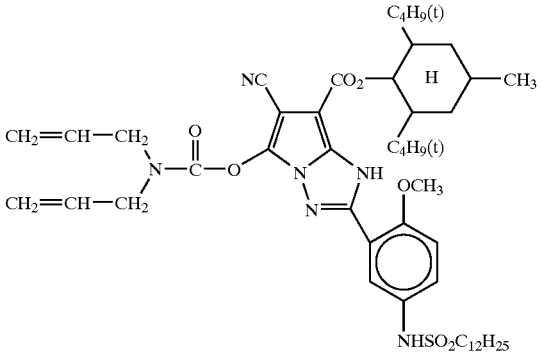
(24)
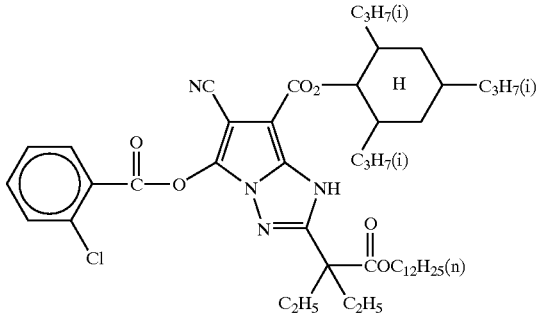
(25)
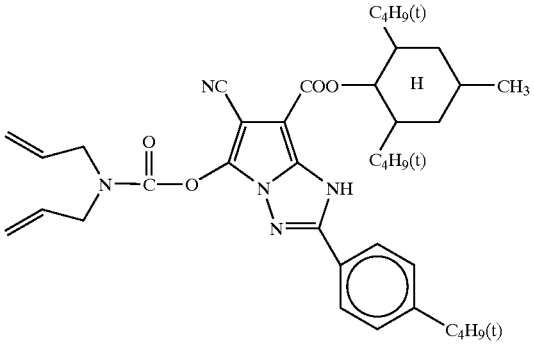
(26)
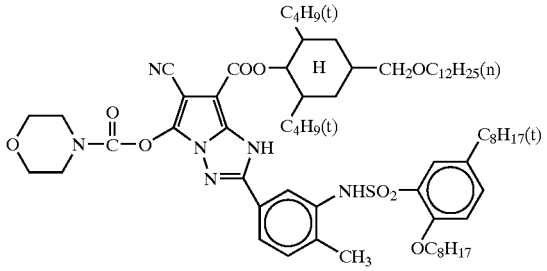

-continued
(27)
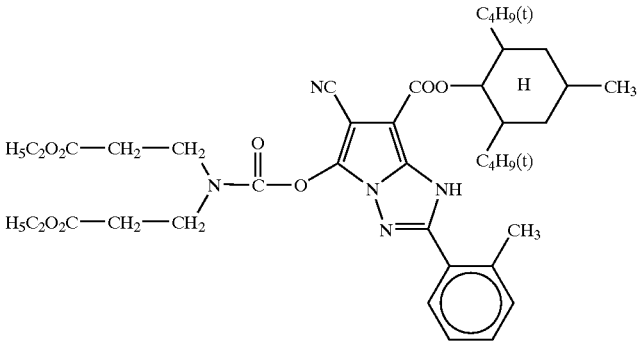
(28)
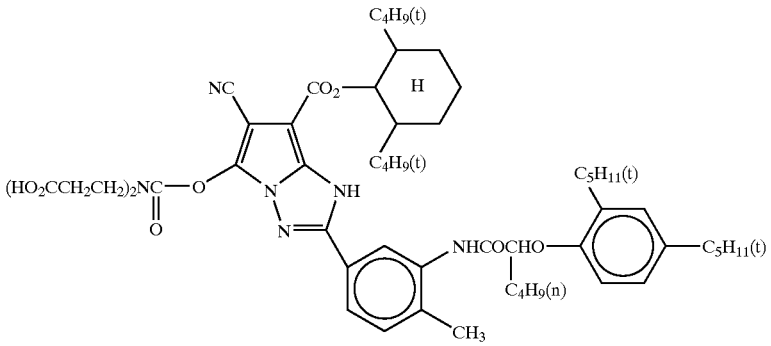
(29)
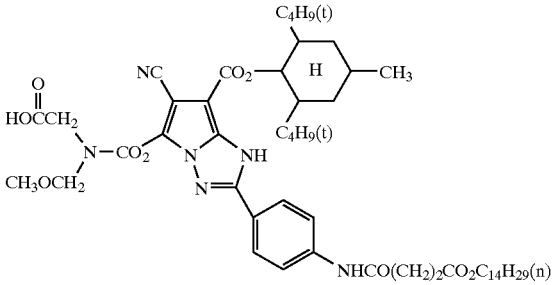
(30)
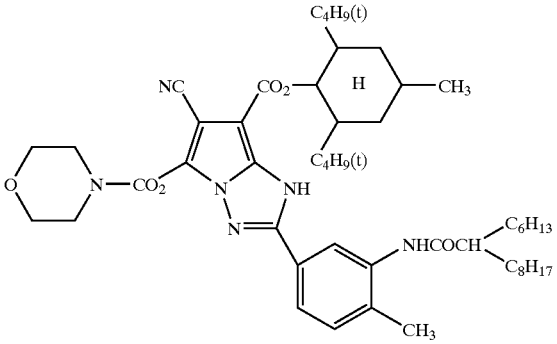
(31)
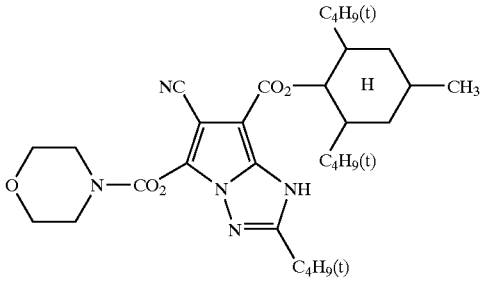
(32)
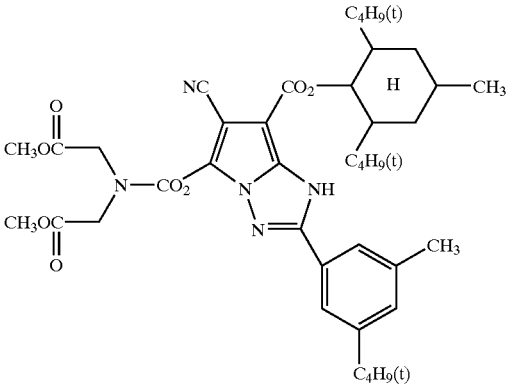

The compounds represented by formula (PTA-III) and usable in the invention can be synthesized by known methods, such as the methods disclosed in JP-A-5-255333, JP-A-5-202004, JP-A-7-48376 and JP-A-8-110623.

In addition, it is also appropriate that compounds represented by the following formula (IA) be used as cyan couplers.

Formula (IA)

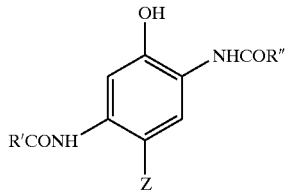

In formula (IA), R' and R" each represent a substituent, and Z represents a hydrogen atom or a radical capable of being eliminated by coupling reaction with the oxidation product of an aromatic primary amine color developing agent.

Additionally, it is appropriate that R' and R" be substituents selected for imparting a hue specified in this specification to the coupler.

The term "alkyl" used throughout this specification is intended to include unsaturated or saturated, linear or branched alkyl groups (including alkenyl and aralkyl groups) and 3-8C cycloalkyl groups (including cycloalkenyl groups) unless otherwise indicated. And the term "aryl" specifically includes condensed aryl groups also.

In formula (IA), it is appropriate that R' and R" each be selected independently from unsubstituted or substituted alkyl, aryl, amino or alkoxy groups, or 5- to 10-membered heterocyclic ring residues (the rings of which may be unsubstituted or substituted) containing as hetero atoms one or more nitrogen, oxygen or/and sulfur atoms per ring.

The amino or alkoxy group represented by R' and R" each may be substituted with a halogen atom, an aryloxy group, an alkylsulfonyl group or an arylsulfonyl group. However, it is preferable that R' and R" each are selected independently from unsubstituted or substituted alkyl or aryl groups, or 5- to 10-membered heterocyclic residues such as pyridyl, morpholino, imidazolyl and pyridazolyl groups.

As to R', the alkyl group substituted with a halogen atom or an alkyl, aryloxy, alkylsulfonyl or arylsulfonyl group (which may further be substituted) is far preferred over the others. The alkyl group represented by R" may also have the same substituents as the alkyl group suitable as R' has.

However, the group far preferred as R" is an unsubstituted aryl group or a heterocyclic ring residue substituted with a cyano group, a chlorine atom, a bromine atom, an iodine atom, an alkyl- or aryl-carbonyl group, an alkyl- or aryl-oxycarbonyl group, an acyloxy group, a carbonamido group, an alkyl- or aryl-carbonamido group, an alkyl- or aryl-oxycarbonamido group, an alkyl- or aryl-sulfonyl group, an alkyl-or aryl-sulfonyloxy group, an alkyl- or aryl-oxysulfonyl group, an alkyl- or arylsulfoxide group, an alkyl- or aryl-sulfamoyl group, an alkyl- or aryl-sulfamoylamino group, an alkyl- or aryl-sulfonamido group, an aryl group, an alkyl group, an alkoxy group, an aryloxy group, a nitro group, an alkyl- or aryl-ureido group, or an alkyl- or aryl-carbamoyl group (wherein the groups recited as substituents may further be substituted). Of those substitutents, halogen, cyano, alkoxycarbonyl, alkylsulfamoyl, alkylsulfonamido, alkylsulfonyl, carbamoyl, alkylcarbamoyl and alkylcarbonamido are preferred over the others. When R' represents an aryl group or a heterocyclic ring residue, it may be substituted similarly to the case of R".

Suitable examples of R" include 4-chlorophenyl, 3,4-dichlorophenyl, 3,4-difluorophenyl, 4-cyanophenyl, 3-chloro-4-cyanophenyl, pentafluorophenyl and 3- or 4-sulfonamidophenyl groups.

In formula (IA), Z represents a hydrogen atom or a radical capable of splitting off in coupling reaction with the oxidation product of an aromatic primary amine color developing agent. However, it is advantageous for Z to be a hydrogen atom, a chlorine atom, a fluorine atom, a substituted aryloxy group or a mercaptotetrazolyl group, especially a hydrogen atom or a chlorine atom.

The chemical equivalent of the coupler, namely whether the coupler is a two-equivalent or four-equivalent coupler, is determined by Z, and the reactivity of the coupler can be changed by choosing the kind of Z. After splitting from the couplers, these groups can have favorable effects on the coupler-coated layers or other layers in a photographic recording material by performing their functions including formation of dyes, hue adjustment of dyes formed, development acceleration or retardation, bleach acceleration or retardation, facilitation of electron transfer and color correction.

A typical class of radicals capable of splitting off by coupling includes halogen, alkoxy, aryloxy, heterocyclyloxy, sulfonyloxy, acyloxy, acyl, heterocyclyl, sulfonamido, heterocyclylthio, benzothiazolyl, phosphonyloxy, alkylthio, arylthio and arylazo. These splitting-off radicals are disclosed in U.S. Pat. Nos. 2,455,169, 3,227,551, 3,432,521, 3,467,563, 3,617,291, 3,880,661, 4,052,212 and 4,134,766; GB Patent Nos. 1,466,728, 1,531,927 and 1,533,039; and GB-A-2066755 and GB-A-2017704 (these disclosures are incorporated in this specification by citation). In that class, halogen, an alkoxy group and an aryloxy group are most suitable.

Suitable examples of a radical capable of splitting off by coupling include —Cl, —F, —Br, —SCN, —$OCH_3$, —$OC_6H_5$, —$OCH_2C(=O)NHCH_2CH_2OH$, —$OCH_2C(=O)NHCH_2CH_2OCH_3$, —$OCH_2C(=O)NHCH_2CH_2C(=O)OCH_3$, —$P(=O)(OC_2H_5)_2$, —$SCH_2CH_2COOH$,

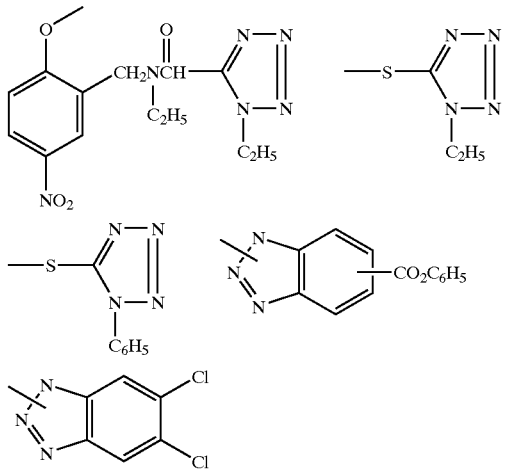

-continued
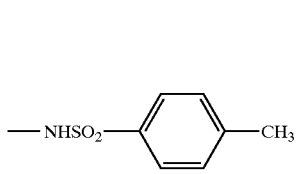
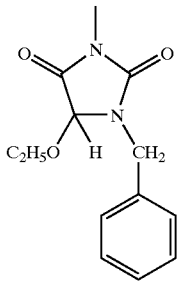
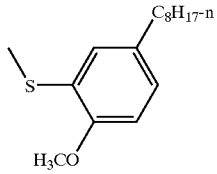
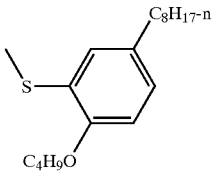
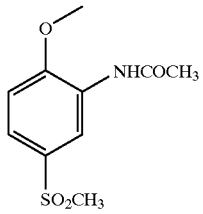
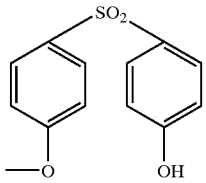
In most cases, Z represents a chlorine atom, a hydrogen atom or a p-methoxyphenoxy group.
Examples of a compound represented by formula (IA) are illustrated below, but these examples should not construed as limiting the scope of the invention.
IC-1
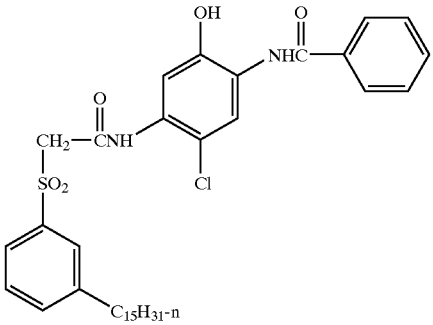
IC-2
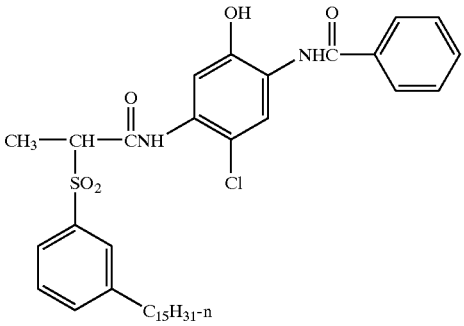
-continued
IC-3
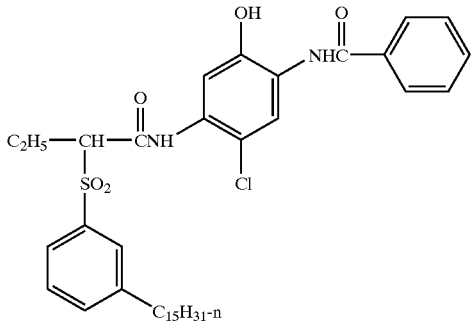
IC-4
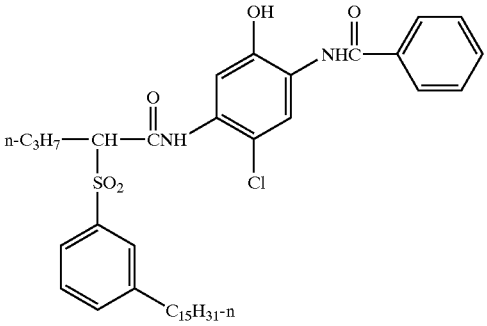
IC-5
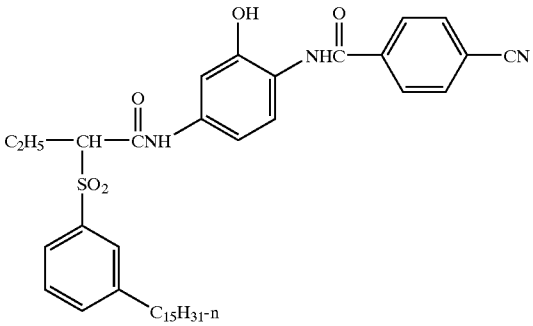
IC-6
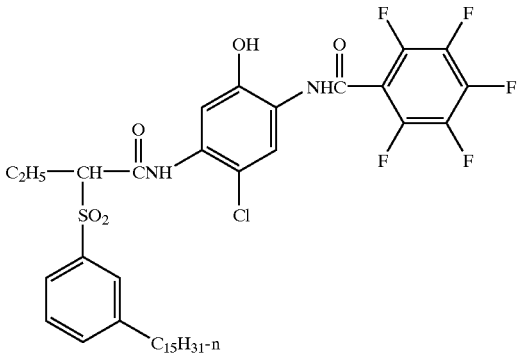

-continued
IC-7
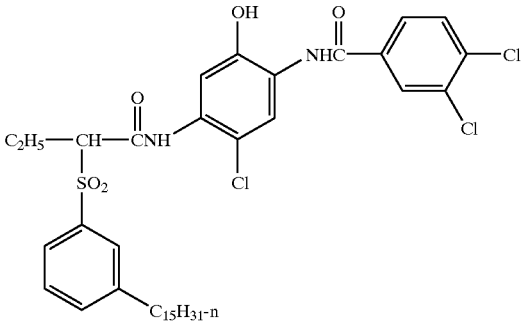
IC-8
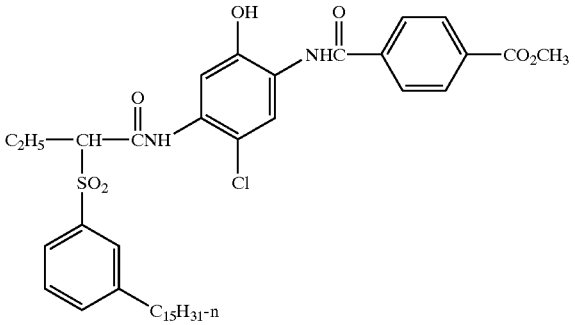
IC-9
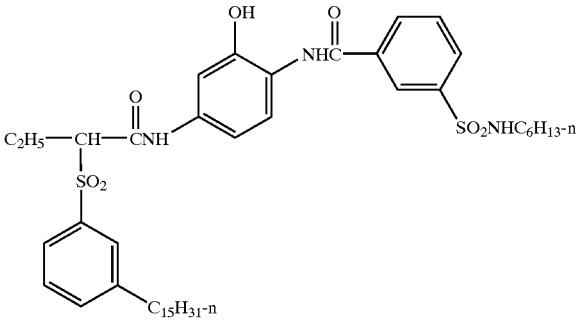
IC-10
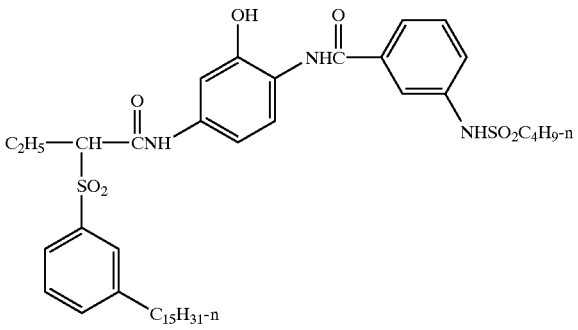
-continued
IC-11
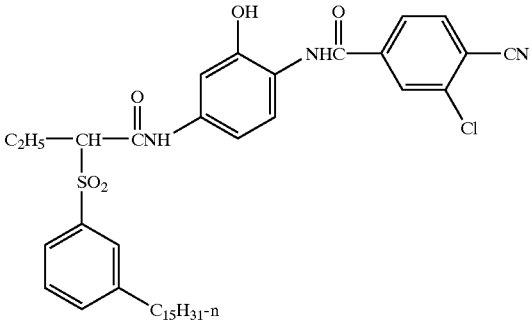
IC-12
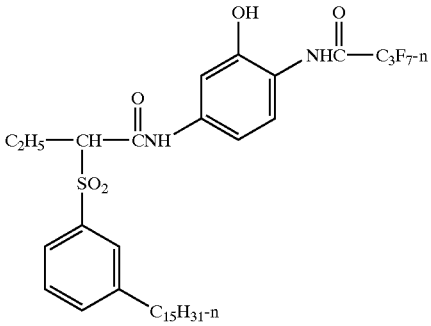
IC-13
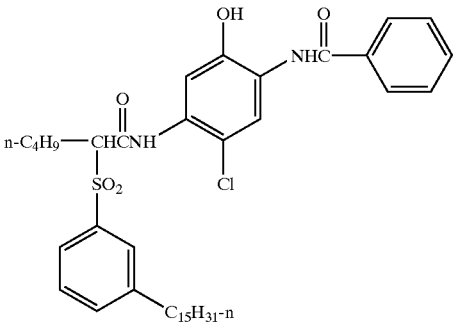
IC-14
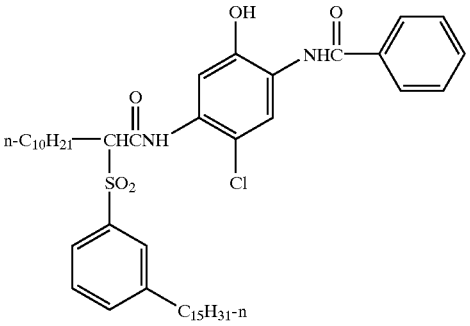

-continued
IC-15
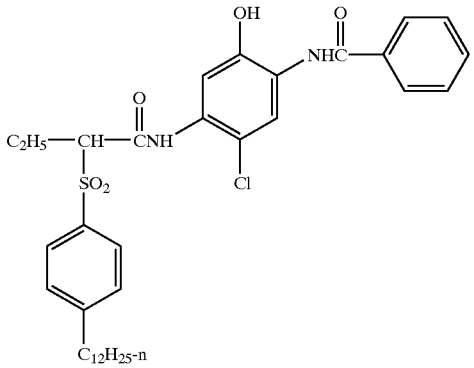
IC-16
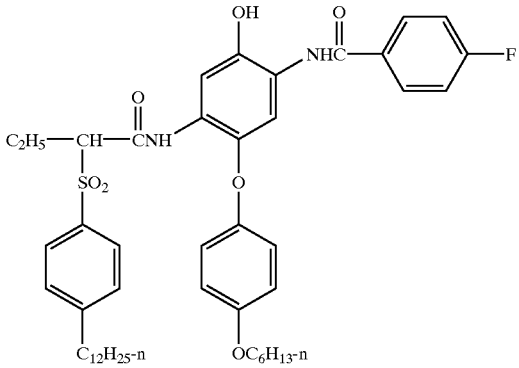
IC-17
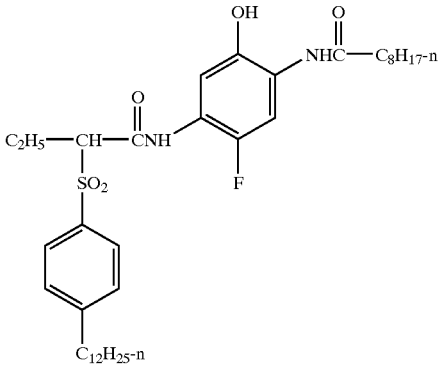
IC-18
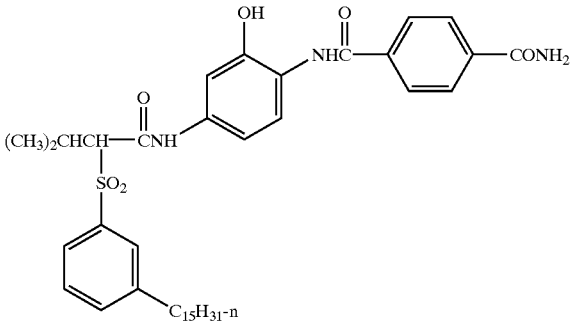
-continued
IC-19
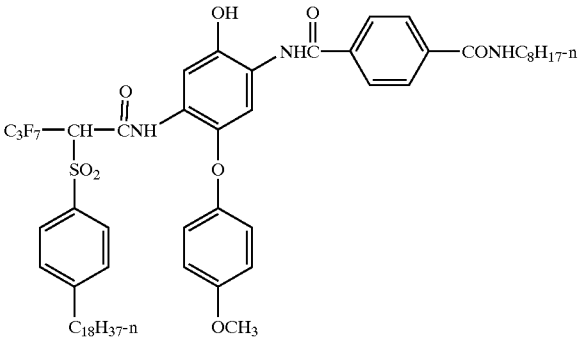
IC-20
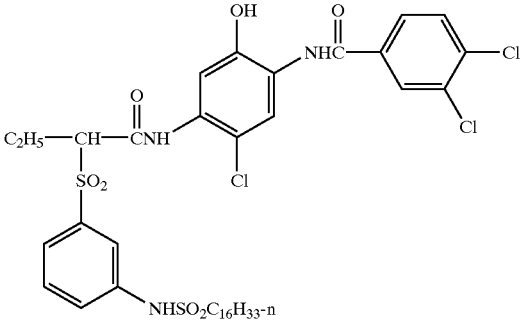
IC-21
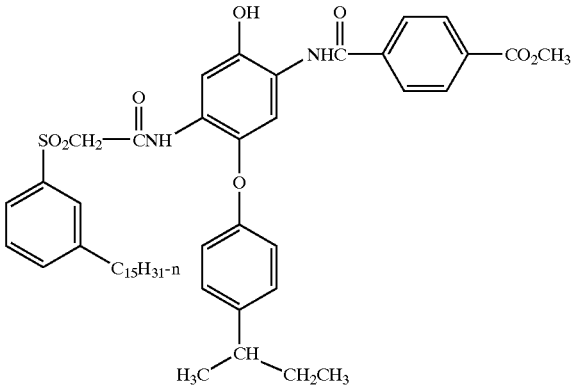
IC-22
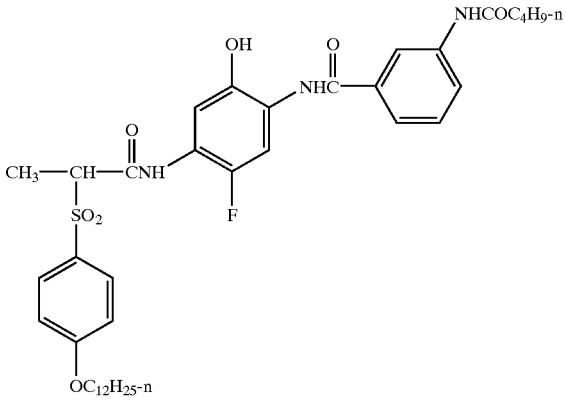

-continued

IC-23

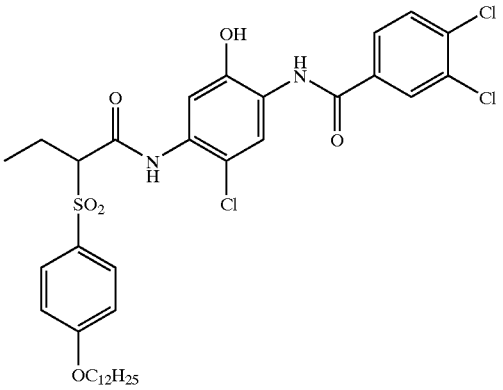

IC-24

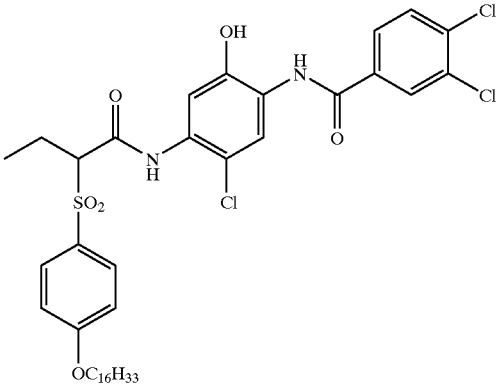

IC-25

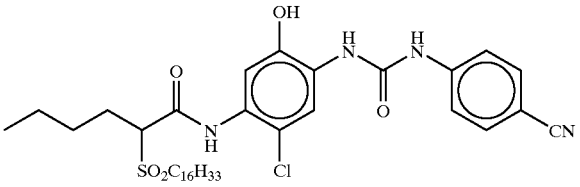

IC-26

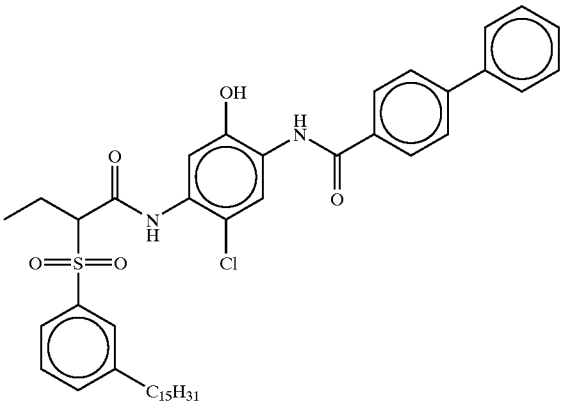

-continued

IC-27

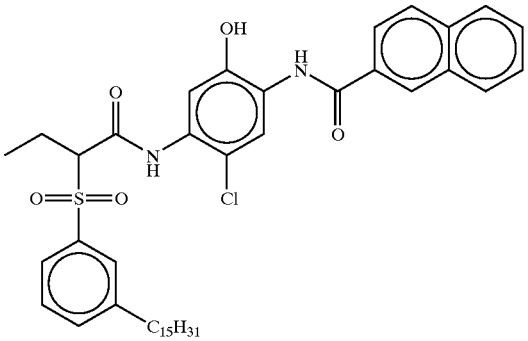

IC-28

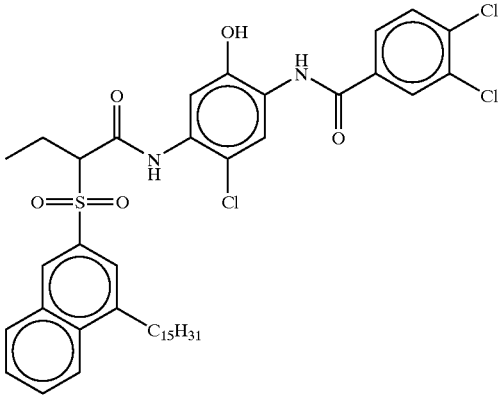

In a second embodiment of the invention, the photosensitive material contain as a cyan dye-forming coupler (hereinafter simply referred to as "cyan coupler" on occasion) at least one compound selected from the compounds represented by the foregoing formula (IA), and may further contain other cyan couplers in combination with such a compound.

Magenta dye-forming couplers (hereinafter simply referred to as "magenta coupelrs" on occasion) used in the invention include the pyrazolone magenta couplers and pyrazoloazole magenta couplers as known in the literature. Of these magenta couplers, the pyrazolotriazole couplers as disclosed in JP-A-61-65245 which have a secondary or tertiary alkyl group attached directly to the 2-, 3- or 6-position of each individual pyrazolotriazole ring, the pyrazoloazole couplers containing sulfonamido groups in their respective molecules as disclosed in JP-A-61-65246, the pyrazoloazole couplers having alkoxyphenylsulfonamido ballast groups as disclosed in JP-A-61-147254 and the pyrazoloazole couplers having alkoxy groups or aryloxy groups at their respective 6-positions as disclosed in EP-A-226849 and EP-A-294785 are used to advantage from the viewpoints of hue, image stability and color formability. Further, the pyrazoloazole couplers represented by formula (M−1) in JP-A-8-122984 are preferred in particular as magenta couplers used in the invention, and the descriptions in Paragraph Nos. 0009 to 0026 of the document cited above are applicable to the present application as they are, and incorporated into the present specification. In addition, the pyrazoloazole couplers which each have groups causing steric hindrance at their individual 3- and 6-positions as disclosed in European Patent Nos. 854384 and 884640 can also be used to advantage.

In the second embodiment of the invention, magenta dye-forming couplers (hereinafter simply referred to as "magenta couplers" on occasion) usable in the photosensitive material are the 5-pyrazolone magenta couplers and pyrazoloazole magenta couplers disclosed in the documents as cited above. It is preferable that the pyrazoloazole magenta couplers have a structure shown by the following formula (M-I) Compounds represented by formula (M-I) are thus illustrated below in detail.

Formula (M-I)

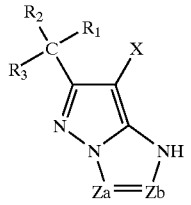

In formula (M-I), Za and Zb each represent =N— or =$CR_4$—, and $R_1$, $R_2$, $R_3$ and $R_4$ each represent a hydrogen atom or a substituent. Examples of such a substituent include a halogen atom, an aliphatic group, an aryl group, a heterocyclyl group, a cyano group, a hydroxyl group, a nitro group, a carboxyl group, a sulfo group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclyl group, an azo group, an acyloxy group, a carbamoyloxy group, a silyloxy group, an aryloxycarbonylamino group, an imido group, a heterocyclylthio group, a sulfinyl group, a phosphonyl group, an aryloxycarbonyl group, an acyl group or an azolyl group. These groups may further be substituted with the substituents as recited above as far as they can have substituents.

More specifically, $R_1$, $R_2$, $R_3$ and $R_4$ each represent a halogen atom (e.g., a chlorine or bromine atom), an aliphatic group (including a 1-32C linear or branched alkyl group, an aralkyl group, an alkenyl group, an alkynyl group, a cycloalkyl group and a cycloalkenyl group, specifically methyl, ethyl, propyl, isopropyl, tert-butyl, tridecyl, 2-methanesulfonylethyl, 3-(3-pentadecylphenoxy)propyl, 3-{4-[2-(4-(4-hydroxyphenylsulfonyl)phenoxy] dodecanamido) phenyl}propyl, 2-ethoxytridecyl, trifluoromethyl, cyclopentyl and 3-(2,4-di-tert-amylphenoxy)propyl), an aryl group (such as phenyl, 4-tert-butylphenyl, 2,4-di-tert-amylphenyl, 2,4,6-trimethylphenyl, 3-tridecanamido-2,4,6-trimethylphenyl,4-tetradecanamidophenyl or tetrafluorophenyl), a heterocyclyl group (such as 2-furyl, 2-thienyl, 2-pyrimidinyl or 2-benzothiazolyl), a cyano group, a hydroxyl group, a nitro group, a carboxyl group, a sulfo group, an amino group, an alkoxy group (such as methoxy, ethoxy, 2-methoxyethoxy, 2-dodecylethoxy or 2-methanesulfonylethoxy), an aryloxy group (such as phenoxy, 2-methylphenoxy , 4-tert-butylphenoxy, 3-nitrophenoxy, 3-tert-butoxycarbamoylphenoxy or 3-methoxycarbamoylphenoxy), an acylamino group (such as acetamido, benzamido, tetradecanamido, 2-(2,4-di-tert-amylphenoxy)butanamido, 4-(3-tert-butyl-4-hydroxyphenoxy)butanamido or 2-[4-(4-hydroxyphenylsulfonyl)phenoxy]decanamido), an alkylamino group (such as methyamino, butylamino, dodecylamino, diethylamino or methylbutylamino), an anilino group (such as phenylamino, 2-chloroanilino, 2-chloro-5-tetradecanaminoanilino, 2-chloro-5-dodecyloxycarbonylanilino, N-acetylanilino or 2-chloro-5-[2-(3-tert-butyl-4-hydroxyphenoxy)dodecanamido] anilino), a carbamoylamino group (such as N-phenylcarbamoylamino, N-methylcarbamoylamino or N,N-dibutylcarbamoylamino), a sulfamoylamino group (such as N,N-dipropylsulfamoylamino or N-methyl-N-decylsulfamoylamino), an alkylthio group (such as methylthio, octylthio, detradecylthio, 2-phenoxyethylthio, 3-phenoxypropylthio or 3-(4-tert-butylphenoxy)propylthio), an arylthio group (such as phenylthio, 2-butoxy-5-tert-octylphenylthio, 3-pentadecylphenylthjo, 2-carboxyphenylthio or 4-tetradecanamidophenylthio), an alkoxycarbonyllamino group (such as methoxycarbonylamino or tetradecyloxycarbonylamino), a sulfonamido group (such as methanesulfonamido, hexadecanesulfonamido, benzenesulfonamido, p-toluenesulfonamido, octadecansulfonamido or 2-methoxy-5-tert-butylbenzenesulfonamido), a carbamoyl group (such as N-ethylcarbamoyl, N,N-dibutylcarbamoyl, N-(2-dodecyloxyehyl)carbamoyl,N-methyl-N-dodecylcarbamoyl, N-[3-(2,4-di-tert-amylphenoxy)propyl] carbamoyl), a sulfamoyl group (such as N-ethylsulfamoyl, N,N-dipropylsulfamoyl, N-(2-dodecyloxyethyl)sulfamoyl, N-ethyl-N-dodecylsulfamoyl or N,N-diethylsulfamoyl), a sulfonyl group (such as methanesulfonyl, octanesulfonyl, benzenesulfonyl or toluenesulfonyl), an alkoxycarbonyl group (such as methoxycarbonyl, butoxycarbonyl, dodecyloxycarbonyl or octadecyloxycarbonyl), a heterocyclyloxy group (such as 1-phenyltetrazole-5-oxy or 2-tetrahydropyranyloxy), an azo group (such as phenylazo, 4-methoxyphenylazo, 4-pivaloylaminophenylazo or 2-hydroxy-4-propanoylphenylazo), an acyloxy group (such as acetoxy), a carbamoyloxy group (such as N-methylcarbamoyloxy or N-phenylcarbamoyloxy), a silyloxy group (such as trimethylsilyloxy or dibutylmethylsilyloxy), an aryloxycarbonylamino group (such as phenoxycarbonylamino), an imido group (such as N-succinimido, N-phthalimido or 3-octadecenylsuccinimido), a heterocyclylthio group (such as 2-benzothiazolylthio, 2,4-diphenoxy-1,3,5-triazole-6-thio or 2-pyridylthio), a sulfinyl group (such as dodecanesulfinyl, 3-pentadecylphenylsulfinyl or 3-phenoxypropylsulfinyl), a phosphonyl group (such as phenoxyphosphonyl, octylphosphonyl or phenylphosphonyl), an aryloxycarbonyl group (such as phenoxycarbonyl), an acyl group (such as acetyl, 3-phenylpropanoyl, benzoyl or 4-dodecyloxybenzoyl), and an azolyl group (such as imidazolyl, pyrazolyl, 3-chloropyrazole-1-yl or triazolyl).

Of these substituents, analkyl group, acycloalkyl group, an aryl group, an alkoxy group, an aryloxy group, an alkylthio group, a carbamoylamino group, an aryloxycarbonylamino group, an alkoxycarbonylamino group, an alkylacylamino group and an arylacylamino group are preferred over the others.

In formula (M-I), X represents a hydrogen atom or a radical capable of splitting off in reaction with the oxidation product of an aromatic primary amine developing agent. Examples of such a splitting-off radical include a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclylthio group, a carbamoylamino group, a 5- or 6-membered nitrogen-containing heterocyclyl group, an imido group and an arylazo group. These groups each may further be substituted with the groups accepted as the substituents of $R_1$ to $R_4$.

More specifically, the splitting-off radical represented by X is a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 4-methoxycarbonylphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamido, heptafluorobutyrylamino), an alkyl- or arylsulfonamido group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), analkyl-, aryl- or heterocyclylthio group (e.g., dodecylthio, 1-carboxydodecylthio, phenylthio, 2-butoxy-5-tert-octylphenylthio, 2-benzyloxycarbonylaminophenylthio, tetrazolylthio), a carbamoylamino group (e.g., N-methylcarbamoylamino, N-phenylcarbamoylamino), a 5- or 6-membered nitrogen-containing heterocyclyl group (e.g., 1-imidazolyl, 1-pyrazolyl, 1,2,4-triazole-1-yl, tetrazolyl, 3,5-dimethyl-1-pyrazolyl, 4-cyano-1-pyrazolyl, 4-methoxycarbonyl-1-pyrazolyl, 4-acetylamino-1-pyrazolyl, 1,2-dihydro-2-oxo-1-pyridyl), an imido group (e.g., succinimido, hydantoinyl) or an arylazo group (e.g., phenylazo, 4-methoxyphenylazo). The suitable ones among these radicals area halogen atom, an alkoxy group, an aryloxy group, an alkyl- or arylthio group and a 5- or 6-membered nitrogen-containing heterocyclyl group the nitrogen atom of which is bound to the coupling site. And those preferred as X in particular are a halogen atom, a substituted aryloxy group, a substituted arylthio group and a substituted 1-pyrazolyl group.

Of the compounds represented by formula (M-I), those represented by the following formula (M-II) or (M-III) are preferred as magenta couplers used in the invention. And especially preferable ones are compounds represented by formula (M-II).

Formula (M-II)

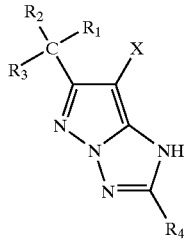

(wherein $R_1$, $R_2$, $R_3$, $R_4$ and X have the same meanings as in formula (M-I), respectively)

Formula (M-III)

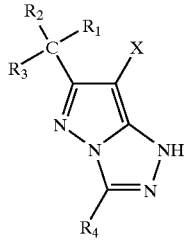

(wherein $R_1$, $R_2$, $R_3$, $R_4$ and X have the same meanings as in formula (M-I), respectively)

The following are radicals preferred in formulae (M-II) and (M-III).

Examples of a radical suitable as X include a halogen atom, an alkoxy group and an aryloxy group. Of these radicals, chlorine atom is the most suitable one. Examples of radicals suitable as $R_1$ to $R_4$ include alkyl groups, aryl groups, anilino groups and alkoxy groups. Of these groups, alkyl and aryl groups are preferred over the others. And the case where $R_1$, $R_2$ and $R_3$ are methyl groups and $R_4$ is an alkyl or aryl group (preferably having a substituent) is advantageous in particular. Further, it is optimal cases that $R_4$ is an aryl group in formula (M-II) and an alkyl group in formula (M-III). These magenta couplers are used in an amount of 0.001 to 1 mole, preferably 0.003 to 0.3 mole, per mole of light-sensitive silver halide in the same layer. The suitable molecular weight of magenta couplers useable in the invention is 600 or below.

Examples of a magenta coupler represented by formula (M-I) are illustrated below, but these examples should not be construed as limiting the scope of the invention.

(Ma-1)

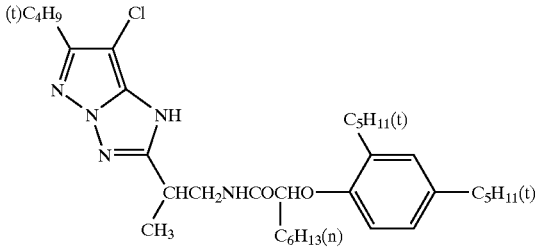

(Ma-2)

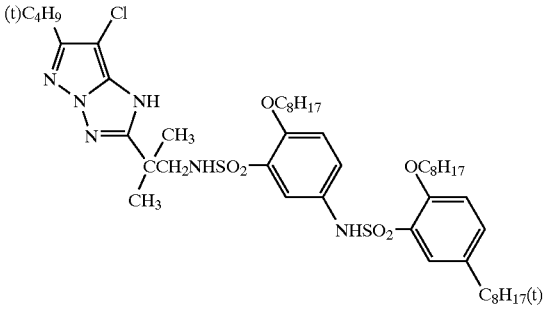

-continued
(Ma-3)
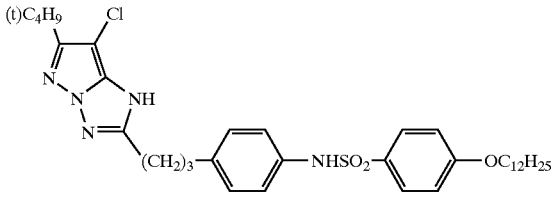
(Ma-4)
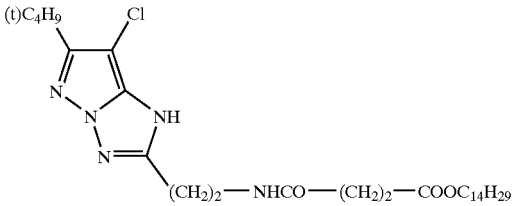
(Ma-5)
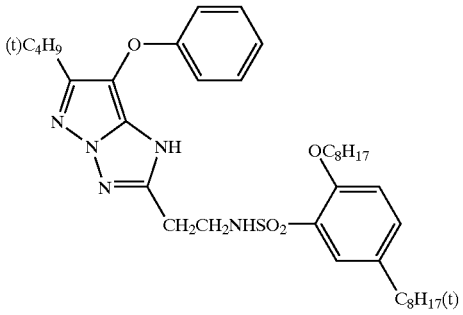
(Ma-6)
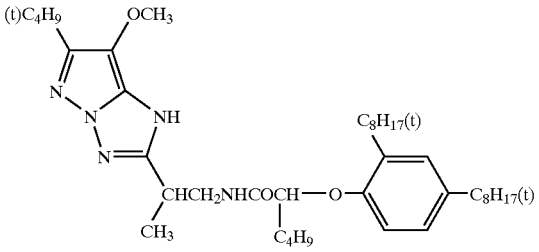
(Ma-7)
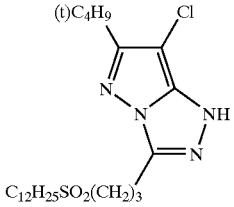
(Ma-8)
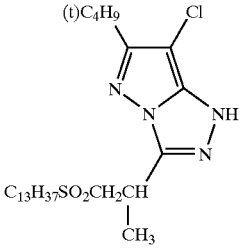
(Ma-9)
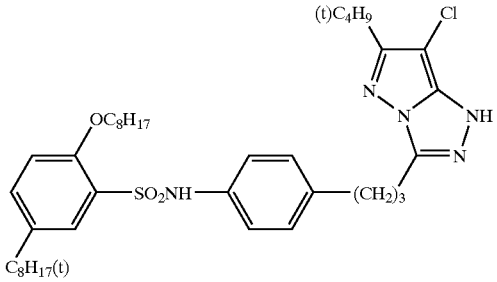
(Ma-10)
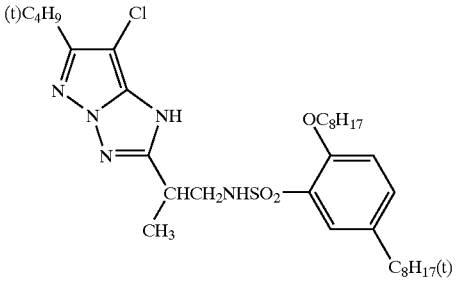
(Ma-11)
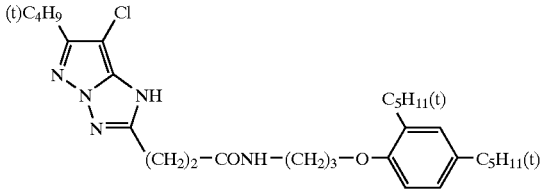
(Ma-12)
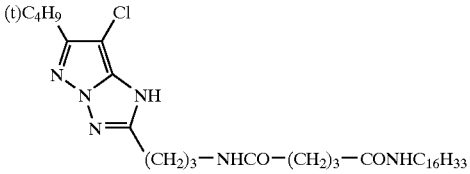
(Ma-13)
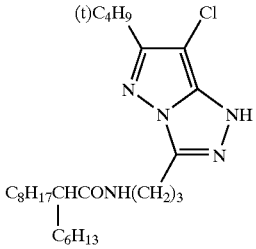
(Ma-14)
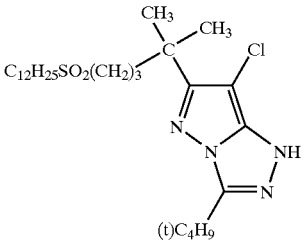

-continued
(Ma-15)
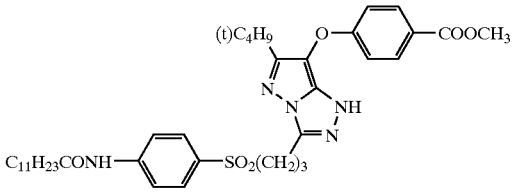
(Ma-16)
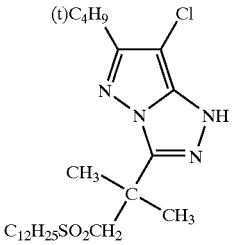
(Ma-17)
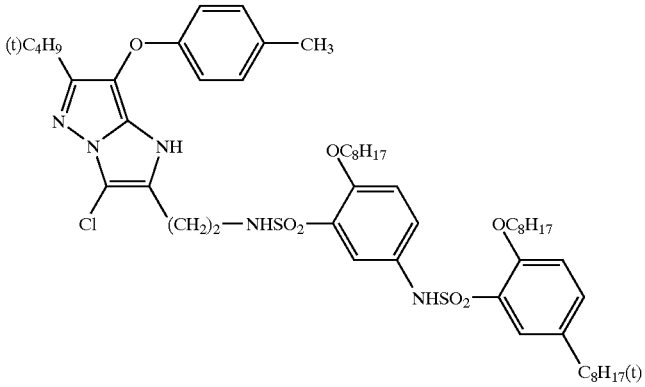
(Ma-18)
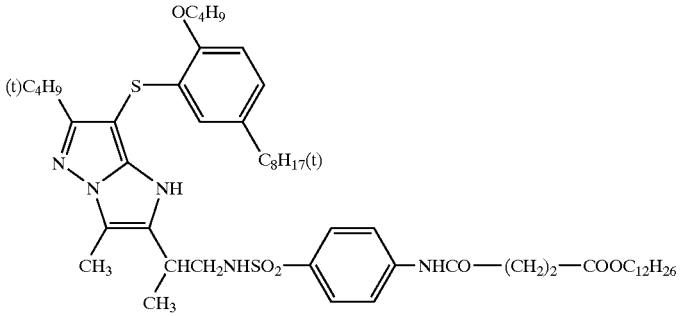
(Ma-19)
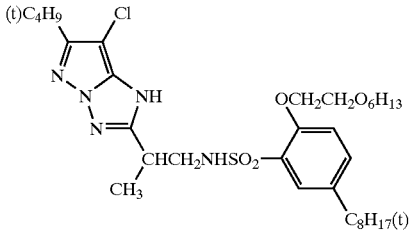
(Ma-20)
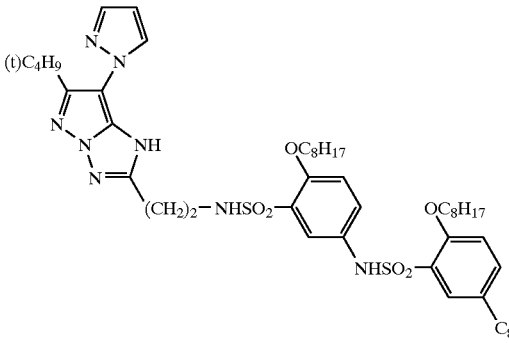

-continued
(Ma-21)
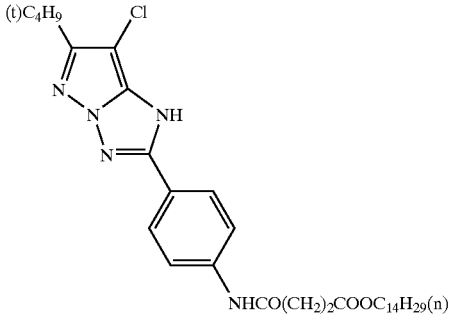
(Ma-22)
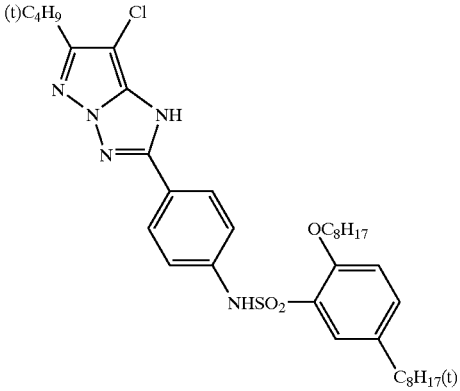
(Ma-23)
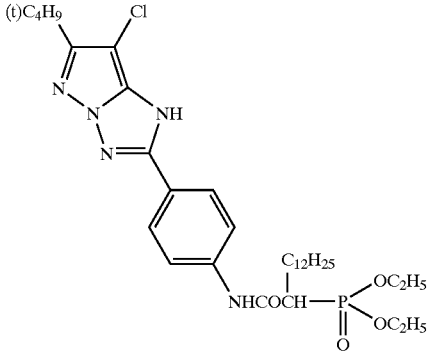
(Ma-24)
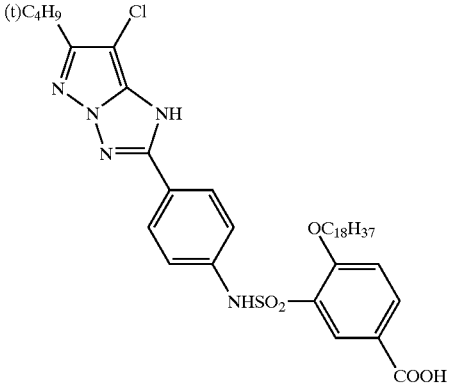
(Ma-25)
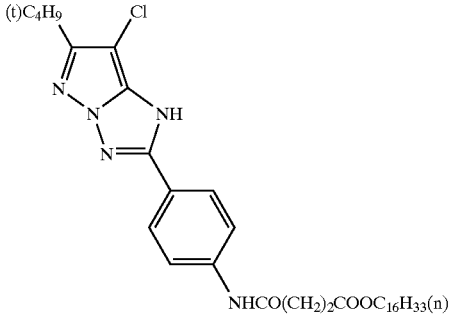
(Ma-26)
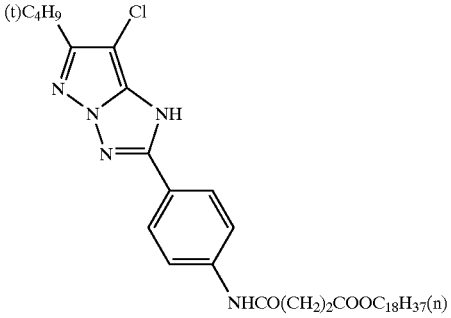
(Ma-27)
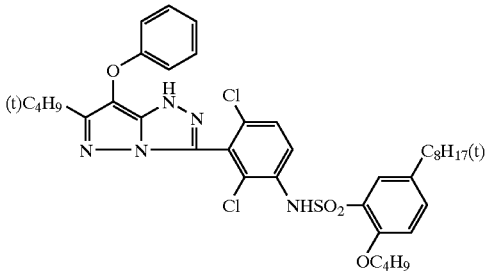
(Ma-28)
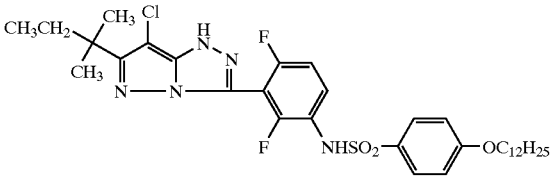

-continued
(Ma-29)
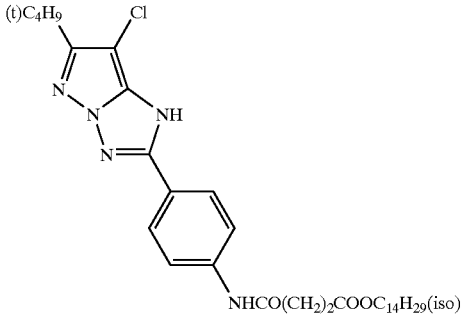
(Ma-30)
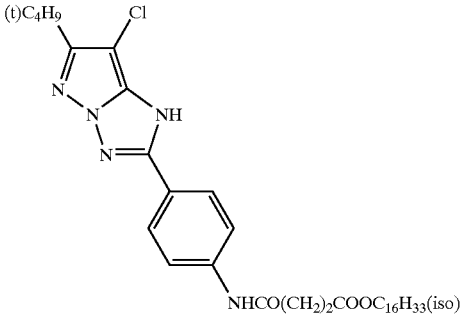
(Ma-31)
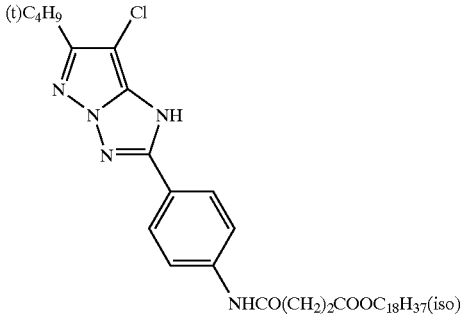
(Ma-32)
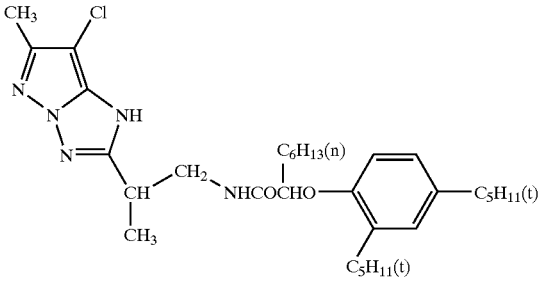
(Ma-33)
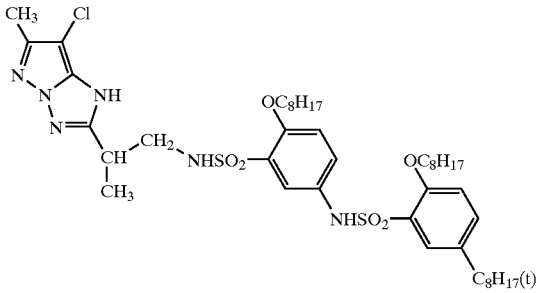
(Ma-34)
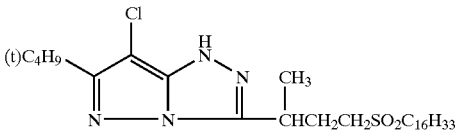
(Ma-35)
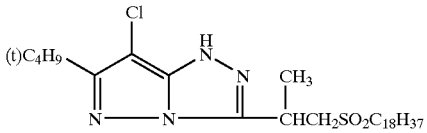
(Ma-36)
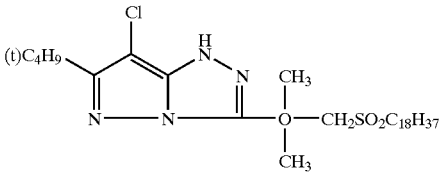
(Ma-37)
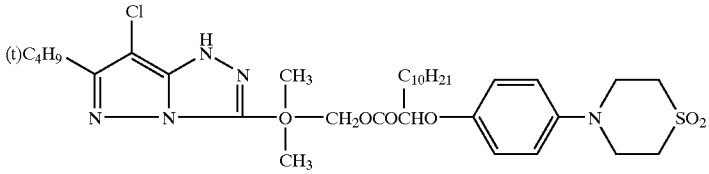
(Ma-38)
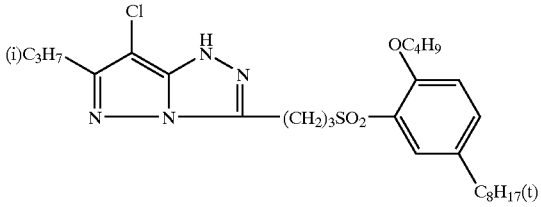
(Ma-39)
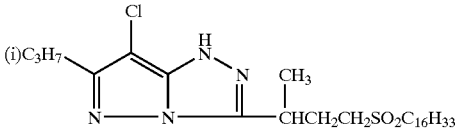

-continued (Ma-40)

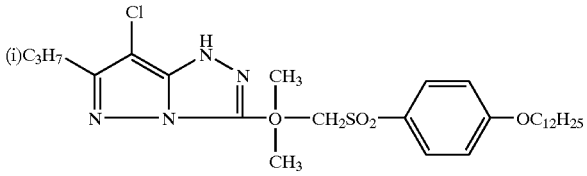

(Ma-41)

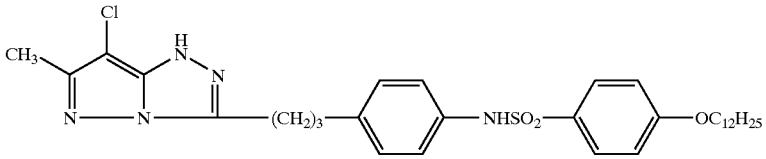

(Ma-42)

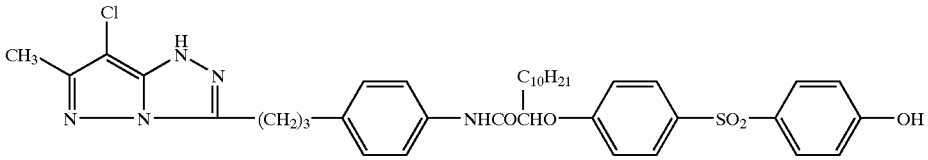

(Ma-43)

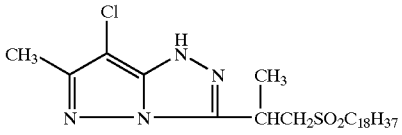

(Ma-44)

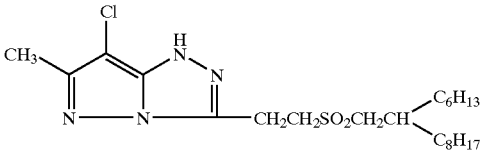

(Ma-45)

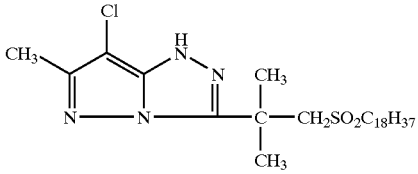

(Ma-46)

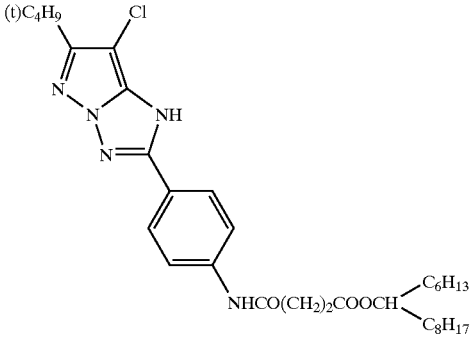

(Ma-47)

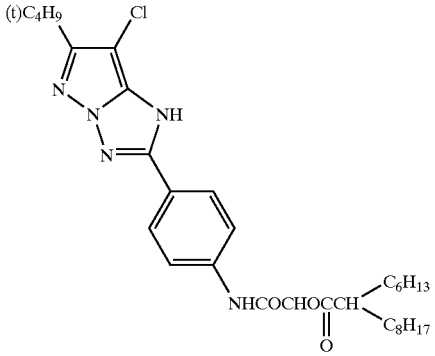

(Ma-48)

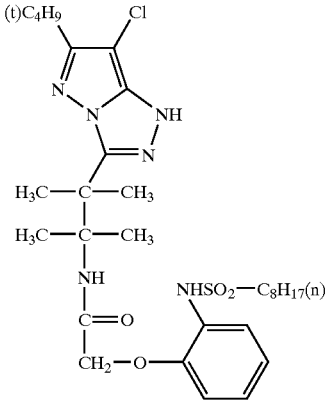

The compounds represented by formula (M-I), which is generically referred to as "pyrazoloazole magenta couplers", can form dyes reduced in undesired yellow and cyan components, compared with pyrazolone magenta couplers. Therefore, they can ensure high color purity, satisfactory storage stability in white areas and consistent formation of color images.

In photosensitive materials relating to the invention, the following compounds can further be contained as yellow dye-forming couplers (hereinafter simply referred to as "yellow couplers" on occasion) on an as needed basis. More specifically, the acylacetoamide yellow couplers containing 3- to 5-membered cyclic structures in their respective acyl groups as disclosed in EP-A1-0447969, the cyclic structure-containing malondianilide yellow couplers disclosed in EP-A1-0482552, the pyrrole-2 or 3-yl- or indole-2 or 3-ylcarbonylacetanilide couplers disclosed in EP-A1-953870, EP-A1-953871, EP-A1-953872, EP-A1-953873, EP-A1-953874 and EP-A1-954875, and the dioxane structure-containing acylacetamide yellow couplers disclosed in U.S. Pat. No. 5,118,599 are used to advantage. Of those couplers, the acylacetamide yellow couplers the acyl groups of which are 1-alkylcyclopropane-1-carbonyl groups and the malondianilide yellow couplers one of the anilides of which forms an indoline ring are preferred over the others. The yellow couplers as recited above can be used alone or as combinations of two or more thereof.

In using a coupler in the invention, it is preferable that a loadable latex polymer (as disclosed in U.S. Pat. No. 4,203,716) is impregnated with the coupler in the presence (or absent) of high boiling organic solvents known in the arts, or the coupler is dissolved together with a water-insoluble, organic solvent-soluble polymer, and further dispersed into a hydrophilic colloid solution in an emulsified state. Examples of a water-insoluble, organic solvent-soluble polymer usable therein include the homopolymers and the copolymers disclosed in U.S. Pat. No. 4,857,449, columns 7 to 15, and WO88/00723, pages 12 to 30. Of these polymers, the methacrylate polymers and the acryl amide polymers, especially the acrylamide polymers, are preferable from the viewpoint of dye image stability.

In the second embodiment of the invention, the photosensitive material contains in a red-sensitive silver halide emulsion layer at least one cyan dye-forming coupler selected from the compounds represented by formula (IA) and shows a photographic characteristic that a cyan density change ΔDc after processing is 0.02 or below. In addition, it is appropriate that the photosensitive material contain at least one magenta dye-forming coupler selected from the compounds represented by formula (M-I) (especially formula (M-II)) in a green-sensitive silver halide emulsion layer.

The term "cyan density change ΔDc" as used herein is explained below. Calibration pattern output is produced on Frontier 330, a product of Fuji Photo Film Co., Ltd., by the use of the processing machine and the processing solutions described in Example 1 of this specification. On a batch providing the Cyan X-rite data highest portion of the output, density measurement is made for 10 times within 3 minutes after photographic processing and subsequent drying. The average of density values thus measured is symbolized by Dc(Fr). This batch is stored for 3 months under the atmosphere of 30° C.–55% RH in a well-ventilated dark place, and then subjected to the same density measurement as adopted for determination of Dc(Fr) The thus obtained density value is symbolized by Dc(3m). By using these values, the cyan density change ΔDc is defined as follows:

$$\Delta Dc = Dc(3m) - Dc(Fr)$$

Then a third embodiment of the invention is describe in detail.

A silver halide emulsion used in the third embodiment of the invention contains a compound represented by formula (I).

Formula (I)

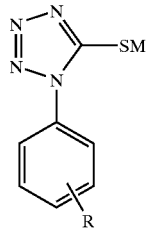

In formula (I), M represents a cation. Suitable examples of M include a hydrogen ion, an alkali metal ion (such as sodium ion or potassium ion), an ammonium ion, a tetra-substituted ammonium ion (such as tetramethylammonium ion or tetraethylammonium ion) and a silver ion.

R represents an atom having a weight of 100 or below, or a group having the total atomic weight of 100 or below. Examples of R include a hydogen atom, a fluorine atom, a chlorine atom, an alkyl group (such as methyl, ethyl or propyl group), an alkoxy group (such as methoxy or ethoxy group), a carboxyl group, a hydroxyl group, and an amino group. These groups each may be substituted so long as the total weight of atoms contained therein is not higher than 100. R is preferably a hydrogen atom, a chlorine atom and an ethoxy group, especially a hydrogen atom.

Suitable examples of a compound represented by formula (I) are recited below, but these examples should not be construed as limiting the scope of the invention.

Specifically, the suitable compounds include
1-phenyl-5-mercaptotetrazole,
1-(5-methylureidophenyl)-5-mercaptotetrazole,
1-(4-hydroxymethylphenyl)-5-mercpatotetrazole,
1-(4-sulfomethylphenyl)-5-mercaptotetrazole,
1-(4-acetylphenyl)mercaptotetrazole,
1-(3-hydroxymethylphenyl)-5-mercaptotetrazole,
1-(4-hydroxyphenyl)-5-mercpatotetrazole,
1-(4-methylsulfoaminophenyl)-5-mercaptotetrazole,
1-(2-aminophenyl)-5-mercaptotetrazole,
1-(4-dimethylaminophenyl)-5-mercaptotetrazole,
1-(4-methoxyphenyl)-5-mercaptotetrazole,
1-(4-hydroxyethylphenyl)-5-mercaptotetrazole,
1-(4-propylphenyl)-5-mercaptotetrazole,
1-(2-chlorophenyl)-5-mercaptotetrazole,
1-(2-bromophenyl)-5-mercaptotetrazole and
1-(4-carboxymethylphenyl)-5-mercaptotetrazole.
Additionally, the mercapto hydrogen atoms in the compounds recited above may be other cations defined above. Further, those compounds may be used as combinations of two or more thereof. The combined use can enhance the present effects in some cases.

Of the compounds represented by formula (I), 1-(4-methoxyphenyl)-5-mercaptotetrazole, 1-phenyl5-mercaptotetrazole and 1-(5-methylureidophenyl)-5-mercaptotetrazole are preferred over the others.

The compounds represented by formula (I) are insufficient to produce uneven image density inhibiting effect when the atomic weight of an atom represented by R or the total weight of atoms constituting a group represented by R is greater than 100 beyond the scope of the invention.

The photosensitive materials containing the compounds of formula (I) in silver halide emulsion layers are reduced in pressure sensibility and can resist both pressure sensitization and pressure desensitization. As a result, the finished images can have reduced unevenness of density even when the exposure and photographic processing for obtaining them are performed under high-speed transport in a sheet form.

Therefore, the present photographic material can achieve remarkably enhanced effects by addition of the compounds of formula (I) to constituent layers, especially emulsion layers, besides the use of silver halide grains having characteristics mentioned below.

In order to enhance keeping quality of a photosensitive material and inhibit unevenness of images from developing during the processing of a photosensitive material, it is appropriate that the compounds represented by formula (I) be added in an amount of 0.1 mg/m$^2$ to 5.0 mg/m$^2$, preferably 0.12 Mg/m$^2$ to 4.9 mg/m$^2$, in the process of producing the photosensitive material. Further, it is preferable that they are added in an amount of 10 to 2,700 mg per mole of silver halide contained in the photosensitive material. The compounds of formula (I) can be added at any time during the production of a photosensitive material (including the times of forming, physically ripening and chemically sensitizing silver halide grains, and the time of preparing coating solutions). However, it is preferable that they are added at least during chemical ripening and/or preparation of coating solutions, and it is far preferable to add them after grain formation, at the conclusion of chemical sensitization, or add them to coating solutions. Therein, they can also be divided into several portions and added to separate coating solutions.

Silver halide emulsions used in the invention contain specific silver halide grains. The grains have any particular restriction as to their crystal shape, but it is preferable that they substantially include cubic and tetrahedral crystalline grains having {100} faces (which each may have roundish apices and higher order faces), octahedral crystalline grains, or tabular grains having {100} or {111} faces as major surfaces and an aspect ratio of at least 3. The term "aspect ratio" as used herein is defined as the value obtained by dividing the diameter of a circle having the same area as the projected area of a grain by the thickness of the grain.

The silver halide grains used in the invention are required to have a chloride content of at least 90 mole %. From the viewpoint of rapid processing suitability, it is preferable that the grains have a chloride content of at least 93 mole %, especially at least 95 mole %. On the other hand, it is preferable from the viewpoint of high contrast and excellent stability of latent images that the bromide content is from 0.1 to 7 mole %, particularly from 0.5 to 5 mole %. As iodide can ensure high sensitivity and high contrast in high illumination intensity exposure, the content thereof is preferably from 0.05 to 1 mole %, far preferably from 0.05 to 0.50 mole %, particularly preferably from 0.07 to 0.40 mole %. The silver halide grains specific to the invention are preferably silver iodobromochloride grains having a halide composition within the limits mentioned above.

It is advantageous that the specific silver halide grains in the present silver halide emulsions have a silver bromide-containing phase and/or a silver iodide-containing phase. The term "silver bromide- or silver iodide-containing phase" as used herein signifies the area higher in silver bromide or silver iodide concentration than the surroundings. The change in halide composition from the surroundings to the silver bromide-containing phase or the silver iodide-containing phase may be continuous or steep. The silver bromide- or silver iodide-containing phase may form a layer of an almost uniform density width in a certain inside area of each grain, or may be a maximum point having no dimensions. The content of localized silver bromide in the silver bromide-containing phase is preferably at least 5 mole %, far preferably from 10 to 80 mole %, particularly preferably from 15 to 50 mole %. The content of localized silver iodide in the silver iodide-containing phase is preferably at least 0.3 mole %, far preferably from 0.5 to 8 mole %, particularly preferably from 1 to 5 mole %. Further, two or more of silver bromide-containing or silver iodide-containing phases as mentioned above may be present in the form of layers inside of each grain, and their respective bromide or iodide contents may be different from one another. However, each grain is required to have at least one silver bromide- or silver iodide-containing phase.

It is important that the silver bromide-containing phase or the silver iodide-containing phase of the present silver halide emulsion is present in a state of a layer rimming each emulsion grain. In a preferred mode, the silver bromide-containing phase or the silver iodide-containing phase formed in a state of a layer rimming each grain has a uniform concentration distribution in a direction orbiting around the grain. On the other hand, the silver bromide-containing phase or the silver iodide-containing phase in a state of layer rimming each grain may have a concentration distribution that a maximum point or a minimum point of the silver bromide or silver iodide concentration is present in the direction orbiting around each grain. For instance, in the case where the silver bromide-containing phase or the silver iodide-containing phase is present in the vicinity of the grain surface and forms a layer rimming each grain, the silver bromide or silver iodide concentration at the corners or edges of each grain sometimes differs from that at the major surface. Aside from the silver bromide- or silver iodide-containing phase present in a state of layer rimming each grain, another silver bromide- or silver iodide-containing phase may be present in specific areas of grain surfaces in a completely discrete state without rimming each grain.

When the present silver halide emulsion contains a silver bromide-containing phase, it is preferable that the silver bromide-containing phase is formed in a layer state so as to have the maximum of silver bromide concentration inside of each grain. When the present silver halide emulsion contains a silver iodide-containing phase, on the other hand, it is preferable that the silver iodide-containing phase is formed in a layer state so as to have the maximum of silver iodide concentration at the surface of each grain. In a sense of heightening the local concentration with a lower silver bromide content or a lower silver iodide content, it is preferable that such a silver bromide- or iodide-containing phase makes up 3 to 30%, especially 3 to 15%, of the volume of each grain on a silver content basis.

It is also preferable that the present silver halide emulsion contains both silver bromide-containing phase and silver iodide-containing phase. In this case, the silver bromide-containing phase and the silver iodide-containing phase may be present in the same location or different locations inside of each grain, but the presence of these two phases in different locations is preferable from the viewpoint of enabling easy control of grain formation. Further, the silver bromide-containing phase may contain silver iodide, and contrary thereto the silver iodide-containing phase may contain silver bromide. In general, the iodide added during the formation of grains having high silver chloride contents is more likely to exude to the grain surface than the bromide added, and the silver iodide-containing phase tends to be formed in the vicinity of the grain surface. In the case where the silver bromide-containing phase and the silver iodide-containing phase are present in different locations, therefore, it is advantageous to form the silver bromide-containing phase on a more inner side than the silver iodide-containing phase. In this case, another silver bromide-containing phase may further be formed on the outside of the silver iodide-containing phase formed in the vicinity of the grain surface.

The silver bromide content or the silver iodide content required for the present effects, including enhancement of sensitivity and contrast, to be achieved increases with the depth of the location inside each grain in which the silver bromide-containing phase or the silver iodide-containing phase is formed. Therefore, there is a fear that the silver chloride content is decreased to an extent greater than necessary to result in impairment of rapid processing suitability. In order that these functions of controlling photographic actions are put together in the vicinity of the inner surface of each grain, it is advantageous for the silver bromide-containing phase and the silver iodide-containing phase to be adjacent to each other. In this respect, it is appropriate to form the silver bromide-containing phase in any location included in the region corresponding to 50 to 100% of grain volume as measured from the inside and the silver iodide-containing phase in any location included in the region corresponding to 85 to 100% of grain volume as measured from the inside. Further, it is preferable to form the silver bromide-containing phase in any location included in the region corresponding to 70 to 95% of grain volume as measured from the inside and the silver iodide-containing phase in any location included in the region corresponding to 90 to 100% of grain volume as measured from the inside.

Introduction of bromide ion or iodide ion for incorporation of silver bromide or silver iodide into the present emulsion having a high silver chloride content may be carried out by adding a solution of bromide salt or iodide salt independently, or together with the addition of a silver salt solution and a chloride salt solution. In the latter case, the bromide salt solution or the iodide salt solution may be added independently of the chloride salt solution, or as a solution mixed with the chloride salt solution. The bromide salt or the iodide salt is added in the form of soluble salt, such as a bromide or iodide of an alkali metal or an alkaline earth metal. In another way, bromide ion or iodide ion can be introduced by being split off from the organic molecule disclosed in U.S. Pat. No. 5,389,508. In still another way of introduction, fine grains of silver bromide or silver iodide can be used as a bromide or iodide ion source.

The addition of a bromide or iodide salt solution may be carried out with a concentration at a time of grain formation, or continuously over a period of time. The position of iodide ion introduced into each emulsion grain having a high chloride content is restricted from the standpoint of making an emulsion with high sensitivity and reduced fog. When iodide ion is introduced on the more inner side of each grain, an increase in sensitivity becomes the smaller. Therefore, it is appropriate that the addition of an iodide salt solution is started from the outside of 50%, preferably 70%, particularly preferably 85%, of each grain volume. In addition, it is advantageous that the addition of an iodide salt solution is ended on the inside of 98%, particularly 96%, of each grain volume. In other words, an emulsion with higher sensitivity and lower fog can be obtained by completing the addition of an iodide salt solution on the slight inside from the grain surface.

On the other hand, it is appropriate that the addition of a bromide salt solution is started from the outside of 50%, preferably 70%, of each grain volume.

The distribution of a bromide or iodide ion concentration in the depth direction of each grain can be determined in accordance with an etching/TOF-SIMS (Time of Flight—Secondary Ion Mass Spectrometry) method by use of, e.g., TRIFT Model TOF-SIMS made by Phi Evans Inc. Descriptions of the TOF-SIMS method can be found, e.g., in a book entitled "Hyomen Bunseki Gijutsu Sensho Niji-Ion Shitsuryo Bunseki-ho" compiled by Nippon Hyomen Kagakukai, published by Maruzen Co., Ltd. in 1999. In analysis of emulsion grains by the etching/TOF-SIMS method, it can be shown that iodide ion exudes to the grain surface even when the addition of an iodide salt solution is completed on the inside of each grain. According to the etching/TOF-SIMS method, emulsions suitable for the invention have an iodide ion concentration distribution showing the maximum of iodide ion concentration at the grain surface and diminution of iodide ion concentration in a direction toward the inside of each grain, and besides, they have the maximum of bromide ion concentration on the inside of each grain. The local concentration of silver bromide can also be determined by X-ray diffractometry.

The term "sphere-equivalent diameter" as used herein is expressed in the diameter of a sphere having the same volume as each individual grain. It is preferable that the present emulsion includes emulsion grains monodisperse in grain size distribution. The suitable coefficient of variation in sphere-equivalent diameters of the total grains in the present emulsion is 20% or below, preferably 15% or below, far preferably 10% or below. The term "coefficient of variation in sphere-equivalent diameters" as used herein refers to the percentage of a standard deviation of sphere-equivalent diameters of individual grains to the average sphere-equivalent diameter. For the purpose of obtaining a wide latitude, it is advantageous that monodisperse emulsions as defined above are blended and used in the same layer or they are coated in a multilayer form.

The suitable sphere equivalent diameters of silver halide emulsion grains in the yellow coupler-containing silver halide emulsion layer are 0.07 μm or below, preferably 0.6 μm or below, particularly preferably 0.5 μm or below. The suitable sphere equivalent diameters of silver halide emulsion grains in the magenta coupler-containing silver halide emulsion layer and those of silver halide emulsion grains in the cyan coupler-containing silver halide emulsion layer are 0.5 μm or below, preferably 0.4 μm or below, particularly preferably 0.3 μm or below. The grains having a sphere-equivalent diameter of 0.6 μm are comparable to the cubic grains having an edge length of about 0.48 μm, those having a sphere-equivalent diameter of 0.5 μm are comparable to the cubic grains having an edge length of about 0.40 μm, those having a sphere-equivalent diameter of 0.40 μm are comparable to the cubic grains having an edge length of about 0.32 μm, and those having a sphere-equivalent diameter of 0.30 μm are comparable to the cubic grains having an edge length of about 0.24 μm. Besides containing the aforesaid specific silver halide grains, the silver halide emulsions defined in the invention may contain other silver halide grains. In each of the silver halide emulsions defined in the invention, however, it is required for the specific silver halide grains defined in the invention to constitute least 50%, preferably at least 80%, far preferably at least 90%, of the total projected area of the whole grains.

Metal complexes represented by the following formula (I), which can be used suitably in a fourth embodiment of the invention, are illustrated below.

$$[IrX^I_nL^I_{(6-n)}]^m \qquad \text{Formula (I)}$$

In formula (I), $X^I$ represents a halogeno ion or a pseudo halogeno ion other than a cyanato ion, $L^I$ represents any ligand different from $X^I$, n represents 3, 4 or 5, and m represents an integer of −4 to +1.

Herein, three to five $X^I$ ligands may be the same or different and, when a plurality of $L^I$ ligands are present, these ligands also may be the same or different.

The term "pseudo halogeno (halogenoid) ion" represented by $X^I$ signifies an ion having properties similar to those of halogeno ions, which includes a cyano ion ($CN^-$), a thiocyanato ion ($SCN^-$), a selenocyanato ion ($SeCN^-$), a tellurocyanato ion ($TeCN^-$), an azidothiocarbonato ion ($SCSN_3^-$), an isocyanato ion ($CNO^-$), afluminatoion ($ONC^-$) and an azido ion ($N_3^-$), but excludes a cyanato ion.

Suitable examples of $X^I$ include a fluoro ion, a chloro ion, a bromo ion, an iodo ion, a cyano ion, an isocyanato ion, a thiocyanato ion, a nitrato ion, a nitro ion or an azido ion. Of these ions, chloride and bromide ions are preferred in particular. $L^I$ has no particular restriction, but it may be an inorganic or organic compound, which may have electric charge or not. However, $L^I$ is preferably an inorganic or organic compound having no electric charge.

Of the metal complexes represented by formula (I), metal complexes represented by the following formula (IA) are preferred over the others.

$$[IrX^{IA}{}_nL^{IA}{}_{(6-n)}]^m \qquad \text{Formula (IA)}$$

In formula (IA), $X^{IA}$ represents a halogeno ion or a pseudo halogeno ion other than a cyanato ion, $L^{IA}$ represents any ligand different from $X^{IA}$, n represents 3, 4 or 5, and m represents an integer of −4 to +1.

$X^{IA}$ has the same meaning as $X^I$ in formula (I), and the scope suitable for $X^{IA}$ is the same as that for $X^I$. Suitable examples of $L^{IA}$ include aquo, ammine, phosphine and carbonyl. Of these ligands, aquo is preferred in particular.

Herein, three to five $X^{IA}$ ligands may be the same or different and, when a plurality of $L^{IA}$ ligands are present, these ligands also may be the same or different.

Of the metal complexes represented by formula (IA), metal complexes represented by the following formula (IB) are preferred over the others.

$$[IrX^{IB}{}_nL^{IB}{}_{(6-n)}]^m \qquad \text{Formula (IB)}$$

In formula (IB), $X^{IB}$ represents a halogeno ion or a pseudo halogeno ion other than a cyanato ion, $L^{IB}$ represents a ligand having a linear or cyclic hydrocarbon as its mother structure, or a ligand in which a linear or cyclic hydrocarbon is contained as a mother structure and part of the carbon or hydrogen atoms constituting the mother structure are replaced by other atoms or groups, n represents 3, 4 or 5, and m represents an integer of −4 to +1.

$X^{IB}$ has the same meaning as $X^I$ in formula (I), and the scope suitable for $X^{IB}$ is the same as that for $X^I$. LIB represents a ligand having a linear or cyclic hydrocarbon as its mother structure or a ligand in which a linear or cyclic hydrocarbon is contained as a mother structure and part of the carbon or hydrogen atoms constituting the mother structure are replaced by other atoms or groups, but a cyano ion is not included therein. And a heterocyclic compound is suitable as LIB.

Of the metal complexes represented by formula (IB), complexes containing 5-membered cyclic compounds as their ligands are preferred over the others. As 5-membered cyclic compounds contained therein, compounds containing at least one nitrogen atom and at least one sulfur atom in each individual 5-membered ring skeleton are highly suitable.

Additionally, three to five $X^{IB}$ ligands may be the same or different and, when a plurality of $L^{IB}$ ligands are present, these ligands also may be the same or different.

Of the metal complexes represented by formula (IB), metal complexes represented by the following formula (IC) are preferred over the others.

$$[IrX^{IC}{}_nL^{IC}{}_{(6-n)}]^m \qquad \text{Formula (IC)}$$

In formula (IC), $X^{IC}$ represents a halogeno ion or a pseudo halogeno ion other than a cyanato ion, $L^{IC}$ represents a 5-membered ring ligand containing at least one nitrogen atom and at least one sulfur atom in its ring skeleton, which may have any substituents on carbon atoms constituting the ring skeleton. n represents 3, 4 or 5, and m represents an integer of −4 to +1.

$X^{IC}$ has the same meaning as $X^I$ in formula (I), and the scope suitable for $X^{IC}$ is the same as that for $X^I$. Substituents which may be present on carbon atoms constituting the ring skeleton contained in $L^{IC}$ are preferably groups having smaller volume than n-propyl group, with examples including a methyl group, an ethyl group, a methoxy group, an ethoxy group, a cyano group, an isocyano group, a cyanato group, an isocyanato group, a thiocyanato group, an isothiocyanato group, a formyl group, a thioformyl group, a hydroxyl group, a mercapto group, an amino group, a hydradino group, an azido group, a nitro group, a nitroso group, a hydroxyamino group, a carboxyl group, a carbamoyl group, a fluoro radical, a chloro radical and an iodo radical.

Additionally, three to five $X^{IC}$ ligands may be the same or different and, when a plurality of LIC ligands are present, these ligands also may be the same or different.

Of the metal complexes represented by formula (IC), metal complexes represented by the following formula (ID) are preferred over the others.

$$[IrX^{ID}{}_nL^{ID}{}_{(6-n)}]^m \qquad \text{Formula (ID)}$$

In formula (ID), $X^{ID}$ represents a halogeno ion or a pseudo halogeno ion other than a cyanato ion, $L^{ID}$ represents a 5-membered ring ligand containing at least two nitrogen atom and at least one sulfur atom in its ring skeleton, which may have any substituents on carbon atoms constituting the ring skeleton. n represents 3, 4 or 5, and m represents an integer of −4 to +1.

$X^{ID}$ has the same meaning as $X^I$ in formula (I), and the scope suitable for $X^{ID}$ is the same as that for $X^I$. $L^{ID}$ is preferably a compound having a thiadiazole skeleton, and it is advantageous that the compound has a substituent or substituents, other than hydrogen, attached to either or both of the carbon atoms in the ring skeleton. Suitable examples of such substituent(s) include halogen (fluorine, chlorine, bromine, iodine), a methoxy group, an ethoxy group, a carboxyl group, a methoxycarbonyl group, an acyl group, an acetyl group, a chloroformyl group, a mercapto group, a methylthio group, a thioformyl group, a dithiocarboxy group, a sulfino group, a sulfo group, a sulfamoyl group, a methylamino group, a cyano group, an isocyano group, a cyanato group, an isocyanato group, a thiocyanato group, an isocyanato group, a hydroxyamino group, a hydroxyimino group, a carbamoyl group, a nitroso group, a nitro group, a hydrazino group, a hydrazono group and an azido group, and preferably include halogen (fluorine, chlorine, bromine, iodine), a chloroformyl group, a sulfino group, a sulfo group, a sulfamoyl group, an isocyano group, a cyanato group, an isocyanato group, a thiocyanato group, a isocyanato group, a hydroxyimino group, a nitroso group, a nitro group and an azido group are preferred over the others. Of these substituents, chlorine, bromine, a chloroformyl group, an isocyano group, a cyanato group, an isocyanato group and a thiocyanato group are preferred in particular. n is preferably 4 or 5, and m is preferably −2 or −1.

Additionally, three to five $X^{ID}$ ligands may be the same or different and, when a plurality of $L^{ID}$ ligands are present, these ligands also may be the same or different.

Suitable examples of a metal complex represented by formula (I) are listed below, but these examples should not be construed as limiting the scope of the invention: $[IrCl_5(H_2O)]^{2-}$, $[IrCl_4(H_2O)]^{-}$, $[IrCl_5(H_2O)]^{-}$, $[IrCl_4(H_2O)_2]^{0}$, $[IrCl_5(OH)]^{3-}$, $[(IrCl_4(OH)_2]^{2-}$, $[IrCl_5(OH)]^{2-}$, $[IrCl_4(OH)_2]^{2-}$, $[IrCl_5(O)]^{4-}$, $[IrCl_4(O)_2]^{5-}$, $[IrCl_5(O)]^{3-}$, $[IrCl_4(O)_2]^{4-}$, $[IrBr_5(H_2O)]^{2-}$, $[IrBr_4(H_2O)_2]^{-}$, $[IrBr_5(H_2O)]^{-}$, $[IrBr_4(H_2O)_2]^{0}$, $[IrBr_5(OH)]^{3-}$, $[IrBr_4(OH)_2]^{2-}$, $[IrBr_5(OH)]^{2-}$, $[IrBr_4(OH)_2]^{2-}$, $[IrBr_5(O)]^{4-}$, $[IrBr_4(O)_2]^{5-}$, $[IrBr_5(O)]^{3-}$, $[IrBr_4(O)_2]^{4-}$, $[IrCl_5(OCN)]^{3-}$, $[IrBr_2(OCN)]^{3-}$, $[IrCl_5(\text{thiazole})]^{2-}$, $[IrCl_4(\text{thiazole})_2]^{2-}$, $[IrCl_3(\text{thiazole})_3]^{0}$, $[IrBr_5(\text{thiazole})]^{2-}$, $[IrBr_4(\text{thiazole})_2]^{-}$, $[IrBr_3(\text{thiazole})_3]^{0}$, $[IrCl_5(5\text{-methylthiazole})]^{2-}$, $[IrCl_4(5\text{-methylthiazole})_2]^{-}$, $[IrBr_5(5\text{-methylthiazole})]^{2-}$, $[IrBr_4(5\text{-methylthiazole})_2]^{-}$, $[IrCl_5(5\text{-chlorothiadiazole})]^{2-}$, $[IrCl_4(5\text{-chlorothiadiazole})_2]^{-}$, $[IrBr_5(5\text{-chlorothiadiazole})]^{2-}$, $[IrBr_4(5\text{-chlorothiadiazole})_2]^{-}$, $[IrCl_5(2\text{-chloro-5-fluorothiadiazole})]^{2-}$, $[IrCl_4(2\text{-chloro-5-fluorothiadiazole})_2]^{-}$ $[IrBr_5(2\text{-chloro-5-fluorothiadiazole})]^{2-}$, $[IrBr_4(2\text{-chloro-5-fluorothiadiazole})_2]^{-}$, $[IrCl_5(2\text{-bromo-5-chlorothiadiazole})]^{2-}$, $[IrCl_4(2\text{-bromo-5-chlorothiadiazole})_2]^{-}$, $[IrBr_5(2\text{-bromo-5-chlorothiadiazole})]^{2-}$, $[IrBr_4(2\text{-bromo-5-chlorothiadiazole})_2]^{-}$.

Of these complexes, $[IrCl_5(5\text{-methylthiazole})]^{2-}$ and $[IrCl_5(2\text{-chloro-5-fluorothiadiazole})]^{2-}$ are preferred in particular.

Other metal complexes used suitably in the invention, which are represented by the following formula (II), are illustrated.

$$[MX^{II}_{n}L^{II}_{(6-n)}]_{M} \qquad \text{Formula (II)}$$

In formula (II), M represents Cr, Mo, Re, Fe, Ru, Os, Co, Rh, Pd or Pt, $X^{II}$ represents a halogeno ion, $L^{II}$ represents any ligand different from $X^{II}$, n represents 3, 4, 5 or 6, and m represents an integer of −4 to +1.

Specifically, $X^{II}$ is a fluoro ion, a chloro ion, a bromo ion, or an iodo ion. Of these ions, chloro and bromo ions are preferred over the others.

$L^{II}$ may be an inorganic or organic compound, and this compound may have electric charge or not. However, $L^{II}$ is preferably an inorganic compound having no electric charge. Suitable examples of $L^{II}$ include $H_2O$, NO and NS.

Additionally, three to six $X^{II}$ ligands may be the same or different and, when a plurality of $L^{II}$ ligands are present, these ligands also may be the same or different.

Of the metal complexes represented by formula (II), metal complexes represented by the following formula (IIA) are preferred over the others.

Formula (IIA)

$$[M^{IIA}X^{IIA}_{n}L^{IIA}_{(6-n)}]^{m} \qquad \text{Formula (IIA)}$$

In formula (IIA), $M^{IIA}$ represents Re, Ru, Os or Rh, $X_{IIA}$ represents a halogeno ion, $L^{IIA}$ is NO or NS when $M^{IIA}$ is Re, Ru or Os, while it is $H_2O$, OH or O when $M^{IIA}$ is Rh. n represents 3, 4, 5 or 6, and m represents an integer of −4 to +1.

$X^{IIA}$ has the same meaning as $X^{II}$ in formula (II), and the scope suitable for $X^{IIA}$ is the same as that for $X^{II}$.

Herein, three to six $X^{IIA}$ ligands may be the same or different and, when a plurality of $L^{IIA}$ ligands are present, these ligands also may be the same or different.

Suitable examples of a metal complex represented by formula (II) are listed below, but these examples should not be construed as limiting the scope of the invention: $[ReCl_6]^{2-}$, $[ReCl_5(NO)]^{2-}$, $[RuCl_6]^{2-}$, $[RuCl_6]^{3-}$, $[RuCl_5(NO)]^{2-}$, $[RuCl_5(NS)]^{2-}$, $[RuBr_5(NS)]^{2-}$, $[OsCl_6]^{4-}$, $[OsCl_5(NO)]^{2-}$, $[OsBr_5(NS)]^{2-}$, $[RhCl_6]^{3-}$, $[RhCl_5(H_2O)]^{2-}$, $[RhCl_4(H_2O)_2]^{-}$, $[RhBr_6]^{3-}$, $[RhBr_5(H_2O)]^{2-}$, $[RhBr_4(H_2O)_2]^{-}$, $[PdCl_6]^{2-}$, $[PtCl_6]^{2-}$.

Of these complexes, $[OsCl_5(NO)]^{2-}$ and $[RhBr_6]^{3-}$ are preferred in particular.

All the metal complexes recited above are anions. When salts are formed by combining these anions with cations, these counter cations are preferably positive ions having high solubility in water. Suitable examples of such counter cations include alkali metal ions such as sodium, potassium, rubidium, cesium and lithium ions, an ammonium ion and alkylammonium ions. These metal complexes can be used in a state of being dissolved in water or a mixture of water and a water-miscible organic solvent (e.g., alcohol, ether, glycol, ketone, ester, amide). It is appropriate that the metal complexes represented by formula (I) be added during the grain formation in an amount of $1\times10^{-10}$ to $1\times10^{-3}$ mole, particularly preferably $1\times10^{-8}$ to $1\times10^{-5}$ mole, per mole of silver. And it is appropriate that the metal complexes represented by formula (II) be added during the grain formation in an amount of $1\times10^{-9}$ to $1\times10^{-6}$ mole, particularly preferably $1\times10^{-9}$ to $1\times10^{-7}$ mole, per mole of silver.

In the invention, it is preferable that the metal complexes as recited above are incorporated into silver halide grains by being added directly to a reaction solution during the formation of silver halide grains or by being added in advance to an aqueous halide solution for forming silver halide grains or another solution, and then added to a reaction solution for grain formation. And it is also preferable to incorporate the metal complexes into silver halide grains by carrying out physical ripening with fine grains into which the metal complexes are incorporated in advance. Further, the metal complexes can be incorporated into silver halide grains by the combined use of the methods mentioned above.

Although the metal complexes can be incorporated into silver halide grains so that they are distributed uniformly inside the grains, it is advantageous to make the metal complexes be present at the grain surface alone, or to make the metal complexes be present only on the inside of the grains and add a metal complex-free layer to the grain surface, as disclosed in JP-A-4-208936, JP-A-2-125245 and JP-A-3-188437. On the other hand, as disclosed in U.S. Pat. Nos. 5,252,451 and 5,256,530, it is also preferable that the grain surface is reformed by physical ripening with fine grains into which metal complexes as recited above are incorporated. Further, these methods may be used in combination, and two or more of metal complexes of different kinds may be incorporated in each individual grain.

Compounds usable in a fourth embodiment of the invention, which are represented by the formula (III), are illustrated in detail.

In formula (III), $R^1$ represents an alkyl group, an alkenyl group or an aryl group, and X represents a hydrogen atom, an alkali metal atom, an ammonium group or a precursor. The alkali metal atom as X includes a sodium atom and a potassium atom, and the ammonium group as X include a tetramethylammonium group and trimethylbenzylammonium group. The precursor signifies a group capable of converting to H or an alkali metal under an alkaline condition, with examples including an acetyl group, a cyanoethyl group and a methanesulfonylethyl group.

The alkyl group and the alkenyl group of $R^1$ in formula (III) include unsubstituted and substituted ones, and further alicyclic groups. Examples of a substituent of the substituted alkyl group include a halogen atom, a nitro group, a cyano group, a hydroxyl group, an alkoxy group, an aryl group, an acylamino group, an alkoxycarbonylamino group, an ureido group, an amino group, a heterocyclic group, an acyl group, a sulfamoyl group, a sulfonamido group, a thioureido group, a carbamoyl group, an alkylthio group, an arylthio group, aheterocyclylthio group, a carboxylic acid group or a salt thereof, and a sulfonic acid group or a salt thereof. Each of the ureido, thioureido, sulfamoyl, carbamoyl and amino groups includes unsubstituted, N-alkyl-substitutedand N-aryl-substituted ones. Examples of a substituent of the substituted alkenyl group include the same substituents as recited above for the substituted alkyl group.

Examples of an aryl group represented by $R^1$ in formula (III) include unsubstituted and substituted phenyl groups. Examples of a substituent of the substituted phenyl group include the same substituents as recited above for the substituted alkyl or alkenyl group.

Examples of a compound represented by formula (III) include the same compounds as disclosed in JP-A-2-123350, pages 10–17. Of these compounds, the compounds illustrated below are preferred in the invention. However, these examples should not be construed as limiting the scope of the invention.

(I-1)

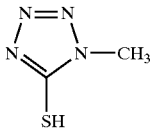

(I-2)

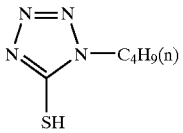

(I-3)

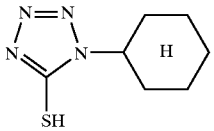

(I-4)

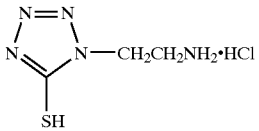

(I-5)

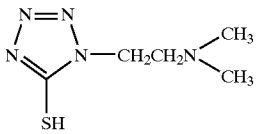

(I-6)

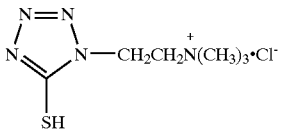

(I-7)

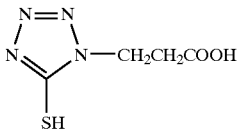

-continued (I-8)

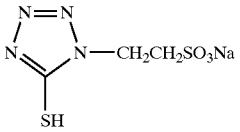

(I-9)

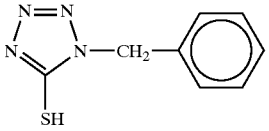

(I-10)

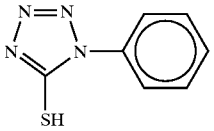

(I-11)

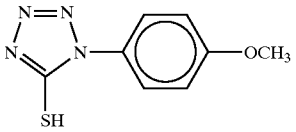

(I-12)

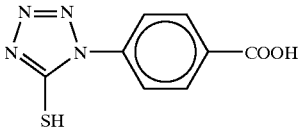

(I-13)

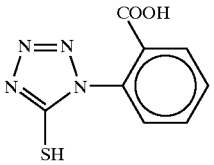

(I-14)

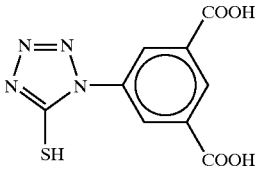

(I-15)

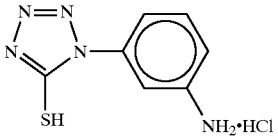

(I-16)

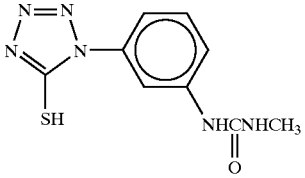

(I-17)

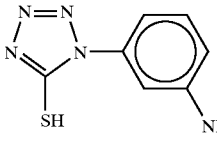

-continued (I-18)

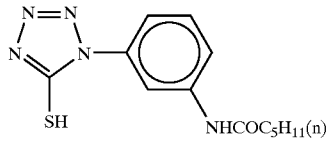

(I-19)

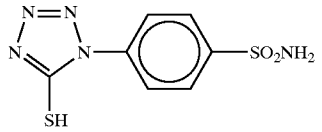

(I-20)

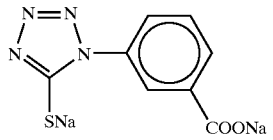

(I-21)

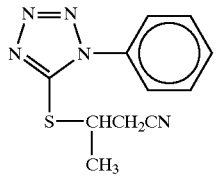

(I-22)

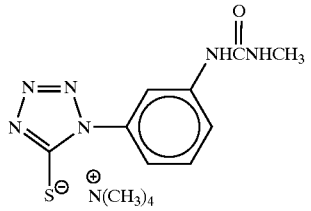

The compounds represented by formula (III) as illustrated above can be incorporated in at least one of light-sensitive or light-insensitive emulsion layers constituting the present silver halide photographic material. However, it is preferable to add them to the light-sensitive emulsion layers. As to the addition timing of these compounds, it is appropriate that they be added to silver halide emulsions after the physical ripening is finished and before the chemical ripening is completed, or to compositions for coating silver halide emulsions, but the former case is preferable to the latter. Further, it is advantageous to add them in a state that they are dissolved in water or an organic solvent (e.g., alcohol including methanol). The suitable total amount of these compounds added is from $1.0\times10^{-6}$ to $5.0\times10^{-2}$ mole, preferably $1.0\times10^{-5}$ to $1.0\times10^{-3}$ mole, per mole of silver halide.

To silver halide emulsions used in the invention, not only the compounds of formula (III) but also various compounds or precursors thereof can be added for the purpose of preventing photographic materials from fogging in the process of production, storage or photographic processing, or stabilizing photographic properties. Suitable examples of such compounds include those disclosed in JP-A-62-215272, pages 39-72. The emulsions used in the invention are the so-called surface latent-image type emulsions, or emulsions of the type which form latent images predominantly at the grain surfaces.

Besides containing iridium complexes represented by formula (I), the specific silver halide grains in the present silver halide emulsions can contain other iridium complexes containing Cl, Br or I as all of their respective six ligands. In such six-coordinate complexes, on the other hand, the six ligands may be a mixture of halogeno ions of different kinds. In order to achieve high gradation under high illumination intensity exposure, it is advantageous in particular to incorporate these iridium complexes containing Cl, Br or/and I as ligands into the silver bromide-containing phase of the specific silver halide grains.

Examples of a six-coordinate iridium complex all the ligands of which are constituted of Cl, Br or/and I include $[IrCl_6]^{2-}$, $[IrCl_6]^{3-}$, $[IrBr_6]^{2-}$, $[IrBr_6]^{3-}$ and $[IrI_6)^{3-}$, but such a kind of iridium complex usable in the invention should not be construed as being limited to these examples.

In addition to the metal complexes recited above, the interior or/and the surface of silver halide grains used in the invention can be doped with other metal ions. The metal ions used suitably for the doping are transition metal ions, especially iron, ruthenium, osmium, lead, cadmium and zinc ions. And it is more suitable to use these metal ions in a state of being associated with ligands and forming 6-coordinate octahedral complexes. In the case where inorganic compounds are used as those ligands, it is appropriate to use as the ligands cyano ions, halogeno ions, thiocyano ions, hydroxo ions, peroxo ions, azido ions, nitro ions, aquo, ammine, nitrosyl ions, or thionitrosyl ions. It is suitable to coordinate these ligands with any of metal ions including iron, ruthenium, osmium, lead, cadmium and zinc ions, and to contain two or more different kinds of ligands in one complex molecule. Further, it is possible to use organic compounds as ligands in the metal complexes as recited above. Organic compounds suitable as ligands include linear compounds containing at most 5 carbon atoms in each individual main chain and 5- or 6-membered heterocyclic compounds. Of these compounds, compounds containing in each individual molecule a nitrogen, phosphorus, oxygen or sulfur atom as the atom for coordination to metal are preferred in particular, with examples including furan, thiophene, oxazole, isoxazole, thiazole, isothiazole, imidazole, pyrazole, triazole, furazane, pyran, pyridine, pyridazine, pyrimidine and pyrazine. Further, compounds having basic skeletons of those compounds and substituents attached thereto are also usable.

The suitable combinations of metal ions and ligands are combinations of iron or ruthenium ions and cyano ions. In the invention, the combined use of the metal complexes as recited hereinbefore and these compounds are preferred. In these compounds, it is appropriate that cyano ions hold a majority in the number of the ligands coordinated with iron or ruthenium as the central metal and the remainder of the coordination sites be occupied by thiocyano, ammine, aquo, nitrosyl, dimethylsulfoxide, pyridine, pyrazine or 4,4'-bipyridine ligands. And it is especially appropriate that all the six coordination sites of the central metal be occupied by cyano ions and hexacyanoiron or hexacyanoruthenium complexes be formed. These complexes having cyano ions as ligands are added during the grain formation in an amount of preferably $1\times10^{-8}$ to $1\times10^{-2}$ mole, particularly preferably $1\times10^{-6}$ to $5\times10^{-4}$ mole, per mole of silver.

Silver halide emulsions used suitably in the invention are emulsions having undergone gold sensitization known in the arts. This is because the gold sensitization enables the emulsions to be increased in sensitivity and reduced in photographic property variations resulting from scanning laser-beam exposure. For effecting gold sensitization, various inorganic gold compounds, gold(I) complexes having inorganic ligands and gold(I) compounds having organic ligands can be used. Examples of an inorganic gold compound usable there for include chloroauric acid or salts thereof, and examples of a usable gold(I) complex having inorganic ligands include dithiocyanatogold(I) compounds, such as potassium dithiocyanatoaurate(I), and dithiosulfatogold(I) compounds, such as trisodium dithosulfatoaurate(I).

Examples of a usable gold(I) complex having organic ligands (organic compounds) include the bis(meso-ionic heterocylic compound)gold(I) compounds, such as bis(1,4,5-trimethyl-1,2,4-triazolium-3-thiorato)aurate(I) tetrafluoroborate, disclosed in JP-A-4-267249, the organic mercpato-gold(I) complexes, such as potassium bis(1-[3-(2-sulfonatobenzamido)phenyl]-5-mercaptotetrazole potassium) aurate(I) pentahydrate, disclosed in JP-A-11-218870, and the nitrogen compound anion-coordinate gold (I) compounds, such as sodium bis(1-methylhydantoinato) aurate(I) tetrahydrate, as disclosed in JP-A-4-268550. These gold(I) compounds having organic ligands may be isolated in advance of their use after synthesis, or may be added to emulsions without isolation as they are produced by mixing organic ligands and gold compounds (e.g., chloroauric acid and salts thereof). Further, it is also possible to prepare gold(I) compounds having organic ligands in emulsions by adding thereto organic ligands and gold compounds (e.g., chloroauric acid and salts thereof) independently. In addition, the gold(I) mercaptides disclosed in U.S. Pat. No. 3,503,749, the gold compounds disclosed in JP-A-8-69074, JP-A-8-69075 and JP-A-9-269554, and the gold compounds disclosed in U.S. Pat. Nos. 5,620,841, 5,912,112, 5,628,841, 5,939,245 and 5,912,111 can also be used.

The addition amounts of such compounds, though can be widely varied according to the circumstances, are within the range of $5\times10^{-7}$ to $5\times10^{-3}$ mole, preferably $5\times10^{-6}$ to $5\times10^{-4}$ mole, per mole of silver halide.

In addition, colloidal gold sulfide can also be used, and the preparation methods thereof are disclosed in *Research Disclosure,* 37154; *Solid State Ionics*, vol. 79, pp. 60–66 (1995); and *Compt. Rend. Hebt. Seances Acad. Sci. Sect. B*, vol. 263, p. 1328 (1966). For preparing colloidal gold sulfide, the method disclosed in the above-cited *Research Disclosure* uses thiocyanato ion, but thioether compounds, such as methionine and thiodiethanol, can be used instead. Although colloidal gold sulfide various in size can be used, it is advantageous to use colloidal gold sulfide having an average particle size of 50 nm or below, preferably 10 nm or below, far preferably 3 nm or below. The sizes of colloid particles can be determined from TEM photographs. The composition of colloidal gold sulfide is, though may be $Au_2S_1$ or a composition containing an excess of sulfur within the range up to $Au_2S_2$, preferably a composition having an excess of sulfur, far preferably within the range of $Au_2S_{1.1}$ to $Au_2S_{1.8}$.

The composition of colloidal gold sulfide can be analyzed in a way that gold sulfide particles are taken out and the gold content and the sulfur content therein are determined independently by utilizing ICP or iodometry. Herein, gold ions and sulfur ions (including hydrogen sulfide and salts thereof) dissolved in the liquid phase are present in a gold sulfide colloid and affect the composition analysis of colloidal gold sulfide particles, so that the analysis is performed after isolation of gold sulfide particles by ultrafiltration.

The addition amount of gold sulfide colloid, though can be widely varied according to the circumstances, is within the range of $5\times10^{-7}$ to $5\times10^{-3}$ mole, preferably $5\times10^{-6}$ to $5\times10^{-4}$ mole, based on gold per mole of silver halide.

Chalcogen sensitization in combination with gold sensitization can be effected using one and the same compound, or a compound capable of releasing $AuCh^-$. Herein, Au represents Au(I), and $Ch^-$ represents a sulfur atom, a selenium atom or a tellurium atom. Examples of a compound capable of releasing $AuCh^-$ include gold compounds represented by AuCh-L, wherein L represents a group combining with AuCh and forming a molecule. In addition to Ch-L, one or more of a ligand may form a coordinate bond with Au. Further, the compounds represented by AuCh-L have a property that, when undergo reaction in a solvent in the presence of silver ion, they are apt to produce AgAuS in the case where Ch represents S, AgAuSe in the case where Ch represents Se and AgAuTe in the case where Ch represents Te. Examples of such compounds include not only a compound containing an acyl group as L but also compounds represented by formula (AuCh1), compounds represented by formula (AuCh2) and compounds represented by formula (AuCh3).

R1-X-M-ChAu Formula (AuCh1)

Herein, Au represents Au(I), Ch represents a sulfur atom, a selenium atom or a tellurium atom, M represents a substituted or unsubstituted methylene group, and X represents a oxygen atom, a sulfur atom, a selenium atom or $NR_2$, $R^1$ represents a group combining with X and constituting a molecule (e.g., an organic group such as an alkyl group, an aryl group or a heterocyclic group), and $R^2$ represents a hydrogen atom or a substituent (e.g., an organic group such as an alkyl group, an aryl group or a heterocyclic group). In addition, $R^1$ and M combine with each other and form a ring.

In the compounds represented by formula (AuCh1), Ch is preferably a sulfur atom or a selenium atom, X is preferably an oxygen atom or a sulfur atom, and $R^1$ is preferably an alkyl group or an aryl group. Examples of such compounds include an Au(I) salt of thiosugar (e.g., gold thioglucose such as α-form gold salt of thioglucose, gold peracetylglucose, gold thiomannose, gold thiogalactose, gold thioarabinose), an Au(I) salt of selenosugar (e.g., gold peracetylselenoglucose, gold peracetylselenomannose), and an Au(I) salt of tellurosugar. The terms "thiosugar, selenosugar and tellurosugar" as used herein refer to the sugar compounds having SH, SeH and TeH groups, respectively, in place of the OH group at their individual anomer position.

$W_1W_2C{=}CR_3ChAu$ Formula (AuCh2)

Herein, Au represents Au(I), Ch represents a sulfur atom, a selenium atom or a tellurium atom, $R_3$ and $W_2$ each represent a substituent (e.g., a hydrogen atom, a halogen atom, an organic group such as an alkyl, aryl or heterocyclic group), and $W_1$ represents an electron-attracting group whose Hammett's substituent constant value σp is positive. $R_3$ and $W_1$ or $W_2$, or W1 and W2 may combine with each other and form a ring.

In the compounds represented by formula (AuCh2), Ch is preferably a sulfur atom or a selenium atom, $R_3$ is preferably a hydrogen atom or an alkyl group, and each of $W_1$ and $W_2$ is preferably an electron-attracting group having a Hammett's substituent constant value σp of at least 0.2. Examples of such compounds include $(NC)_2C{=}CHSAu$, $(CH_3OCO)_2C{=}CHSAu$ and $CH_3CO(CH3OCO)C{=}CHSAu$.

$W_2$-E-ChAu Formula (AuCh3)

Herein, Au represents Au (I), Ch represents a sulfur atom, a selenium atom or a tellurium atom, E represents a substituted or unsubstituted ethylene group, and $W_3$ represents an electron-attracting group whose Hammett's substituent constant value op is positive.

In the compounds represented by formula (AuCh3), Ch is preferably a sulfur atom or a selenium atom, E is preferably an ethylene group having an electron-attracting group whose Hammett's substituent constant value σp is positive, and $W_3$ is preferably an electron-attracting group having a Hammett's substituent constant value σp of at least 0.2. Examples of such compounds include $AuSCH(CO_2C_2H_5)CH_2CO_2C_2H_5$ and $AuSCH_2CH_2CN$. The addition amounts of the gold compounds recited above, though can be widely varied according to the circumstances, are within the range of $5\times10^{-7}$ to $5\times10^{-3}$ mole, preferably $5\times10^{-6}$ to $5\times10^{-4}$ mole, per mole of silver halide.

In the invention, the gold sensitization methods as mentioned above may be further combined with other sensitization methods, such as a sulfur sensitization method, a selenium sensitization method, a tellurium sensitization method, a reduction sensitization method and sensitization methods utilizing precious metals other than gold. Of these combinations, the combination of gold sensitization with sulfur sensitization and the combination of gold sensitization with selenium sensitization are preferred in particular.

For the purpose of preventing photographic materials from fogging in the process of production, storage or photographic processing, or stabilizing photographic properties, various compounds or precursors thereof can be added to the present silver halide emulsions. Suitable examples of such compounds include those disclosed in JP-A-62-215272, pages 39-72. In addition, the 5-arylamino-1,2,3,4-thiatrizole compounds (which each contain at least one electron-attracting group in their individual aryl residue) can also be used to advantage.

Further, the hydroxamic acid derivatives disclosed in JP-A-11-109576, the cyclic ketones disclosed in JP-A-11-109576, which each have at the position adjacent to the carbonyl group a double bond both ends of which are substituted with amino groups, hydroxyl groups or an amino group and a hydroxyl group respectively (the compounds represented by formula (S1) in the document cited, especially those illustrated in paragraphs [0036] to [0071], can be incorporated into this specification), the sulfo-substituted catechol and hydroquinone compounds disclosed in JP-A-11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzzenesulfonicacid, salts of these acids), the hydroxylamines represented by formula (A) in U.S. Pat. No. 5,556,741 (the descriptions therein, from column 4, line 56, to column 11, line 22, are suitably applicable to the invention also and incorporated into this specification), and the water-soluble reducers represented by formulae (I) to (III) disclosed in JP-A-11-102045 can also be used suitably in the invention.

In the present silver halide emulsions, spectral sensitizing dyes showing sensitivity to light in the desired wavelength range are incorporated for the purpose of imparting the so-called spectral sensitivities. Examples of spectral sensitizing dyes used for spectral sensitization in the blue, green and red regions respectively include those described in F. M. Harmer, *Heterocyclic Compounds—Cyanine Dyes and Related Compounds*, John Wiley & Sons, New York, London (1964). More specifically, the compounds and the methods for spectral sensitization as disclosed in the above-cited JP-A-62-215272, from page 22, right upper column, to page 38, can be used to advantage. Further, the spectral sensitizing dyes disclosed in JP-A-3-123340 are preferred in particular as red-sensitive spectral sensitizing dyes for silver halide grains having high silver halide contents from the viewpoints of stability, adsorption strength and dependence of exposure on temperature.

The suitable addition amounts of those sensitizing dyes, though can be widely varied according to the circumstances, are within the range of $0.5\times10^{-6}$ to $10\times10^{-2}$ mole, preferably $1\times10^{-6}$ to $5.0\times10^{-3}$ mole, per mole of silver halide.

The present photosensitive materials are illustrated below in detail.

The suitable total silver coverage of the photographic layers constituting each of the present photosensitive materials is 0.46 g/m$^2$ or below, preferably from 0.25 g/m$^2$ to 0.46 g/m$^2$, far preferably from 0.25 g/m$^2$ to 0.45 g/m$^2$, particularly preferably from 0.25 g/m$^2$ to 0.40 g/m$^2$.

In photosensitive materials, gelatin is used as hydrophilic binder, but hydrophilic colloids of gelatin derivatives, graft polymers prepared from gelatin and other polymers, proteins other than gelatin, sugar derivatives, cellulose derivatives and synthetic hydrophilic homo- or copolymers can be used together with gelatin, if needed. The gelatin used in silver halide color photographic materials relating to the invention may be any of lime-processed gelatin and acid-processed gelatin, and may be prepared from any of raw materials including cattle bone, cattle hide and pig skin. However, lime-processed gelatin using cattle bone or pig skin as a raw material is preferred in the invention.

The suitable total gelatin coverage of the photographic layers constituting each of the present photosensitive materials, or the total amount of gelatin contained in light-sensitive silver halide emulsion layers and light-insensitive hydrophilic colloid layers up to the outermost hydrophilic colloid layer present on the side of silver halide emulsion layers, is from 4.0 g/m$^2$ to 7.0 g/m$^2$, preferably from 4.5 g m$^2$ to 6.5 g/m$^2$, particularly preferably from 5.0 g/m$^2$ to 6.0 g/m$^2$. When the total amount of hydrophilic binder is increased beyond the range mentioned above, the present effects tend to be lessened because the rapidity of color development-processing is impaired, blix discoloration becomes worse and the rapid processing suitability in a rinsing process (washing and/or stabilizing process) is lowered. On the other hand, when the total amount of hydrophilic binder is below the lower limit mentioned above, the detrimental effects resulting from insufficient film strength, such as pressure fog streaks, tend to be produced.

For the purposes of preventing irradiation and halation and improving safelight safety, it is preferable to add the dyes capable of being decolored by processing as disclosed in EP-A2-0337490, pages 27–76 (preferably oxonol dyes and cyanine dyes) to hydrophilic colloid layers provided in each of the photosensitive materials relating to the invention. Further, the dyes disclosed in European Patent No. 0819977 can also be used suitably in the invention. These dyes include water-soluble dyes having adverse effects on color separation and safelight safety when the usage thereof is increased. As dyes usable without attended by deterioration in color separation, the water-soluble dyes disclosed in JP-A-5-127324, JP-A-5-127325 and JP-A-5-216185 are preferred.

In place of or combination with such water-soluble dyes, colored layers capable of being decolored by processing can be used in each of the photosensitive materials. These colored layers capable of being decolored by processing may be arranged in direct contact with emulsion layers, or on emulsion layers via interlayers containing gelatin and an agent for inhibiting color mixing by processing, such as hydroquinone. Each colored layer is preferably arranged as a lower layer (on support side) of an emulsion layer capable of forming a primary color of the same kind as the colored layer. Herein, it is possible to arrange all the colored layers corresponding to primary colors, respectively, or a part arbitrarily chosen from them. Further, it is also possible to arrange a layer colored so as to correspond to two or more of primary color ranges. The suitable optical reflection density of each colored layer is from 0.2 to 3.0, preferably from 0.5 to 2.5, particularly preferably from 0.8 to 2.0, as measured at the wavelength providing the highest optical density in the wavelength range of exposure light (which is included in the visible region of 400 nm to 700 nm in the case of exposure with a general printer, or corresponds to the wavelength of a scanning exposure light source in the case of scanning exposure).

For formation of colored layers, known methods can be applied. For instance, the method of incorporating dyes in a state of fine solid particle dispersion into hydrophilic colloid layers as in the cases of the dyes disclosed in JP-A-2-282244, page 3, right upper column, to page 8, and the dyes disclosed in JP-A-3-7931, page 3, right upper column, to page 11, left lower column, the method of binding anionic dyes to cationic polymers in the presence of mordants, the method of fixing dyes in a layer by adsorption to fine grains of silver halide and the method of using colloidal silver as disclosed in JP-A-1-239544 are applicable. As examples of a method of dispersing a fine powder of dye in a state of solid, the methods for incorporating a finely pulverized dye which is substantially water-insoluble under a condition that the pH is 6 or below but becomes water-soluble in a substantial sense under a condition that the pH is 8 or above are disclosed in JP-A-2-308244, pages 4–13. And examples of a method of binding an anionic dye to a cationic polymer in the presence of a mordant are disclosed in JP-A-2-84637, pages 18–26. The preparation methods of colloidal silver as a light absorbing agent are disclosed in U.S. Pat. Nos. 2,688,601 and 3,459,563. Of these methods, the methods of incorporating finely pulverized dyes and the method of using colloidal silver are preferred over the others.

It is preferable that the present photosensitive materials each have at least one yellow color-developing silver halide emulsion layer, at least one magenta color-developing silver halide emulsion layer and at least one cyan color-developing silver halide emulsion layer. The arranging order of these silver halide emulsion layers is generally the yellow color-developing silver halide emulsion layer, the magenta color-developing silver halide emulsion layer and the cyan color-developing silver halide emulsion layer, based on order of increasing distance from a support.

However, other layer structures different from the foregoing one may be adopted.

In a photosensitive material relating to the invention, it is preferable that silver halide emulsions in the blue-sensitive silver halide emulsion layer are high in sensitivity, compared with the green-sensitive and red-sensitive silver halide emulsions, from the viewpoint of spectral characteristics of a negative yellow mask and a halogen lamp as exposure light source. Therefore, it is preferable that the blue-sensitive emulsion layer has a great length of grain edge, compared with the other emulsion layers. In addition, the molar absorption constants of the colored dyes formed from generally known yellow couplers are low compared with those of the colored dyes formed from magenta coupler and cyan couplers, so that there is a tendency to increase the coverage of blue-sensitive emulsions as the yellow coupler coverage is increased. Such being the case, considering the resistance to pressure from the photosensitive material surface, such as scratching pressure, the yellow color-developing blue-sensitive silver halide emulsion layer has a disadvantage in comparison with the other layers, so it is appropriate that the blue-sensitive emulsion layer be arranged in a position nearer the support.

In another photosensitive material relating to the invention, the yellow coupler-containing silver halide emulsion layer may be arranged in any position on a support. In the case of containing tabular silver halide grains in a yellow coupler-containing silver halide emulsion layer, the yellow coupler-containing silver halide emulsion layer is preferably arranged in a position more distant from the support than at least one among magenta coupler-containing silver halide emulsion layers and cyan coupler-containing silver halide emulsion layers. Further, from the viewpoints of color development acceleration, desilvering acceleration and reduction in color contamination by sensitizing dyes, it is advantageous to arrange the yellow coupler-containing blue-sensitive silver halide emulsion layer in the position more remote from the support than any other silver halide emulsion layers. Furthermore, it is appropriate from the viewpoint of reduction in blix discoloration that the cyan coupler-containing layer be arranged in the midsection between the layers containing different color couplers; while it is appropriate from the viewpoint of reduction in light discoloration that the cyan coupler-containing layer be arranged as the lowest layer. Moreover, each of yellow, magenta and cyan color-forming layers may have two or three constituent layers.

The silver halide emulsions, other ingredients (including additives), the photographic constituent layers (including the arranging order thereof), the processing methods and the processing additives as disclosed in JP-A-62-215272, JP-A-2-33144 and EP-A2-0355660, especially in EP-A2-0355660, can be applied suitably to the present photosensitive materials and processing thereof. In addition, the silver halide color photographic materials and the methods of processing them as disclosed in JP-A-5-34889, JP-A-4-359249, JP-A-4-313753, JP-A-4-270244, JP-A-5-66527, JP-A-4-34548, JP-A-4-145433, JP-A-2-854, JP-A-1-158431, JP-A-2-90145, JP-A-3-194539, JP-A-2-93641 and EP-A2-0520457 are also suitable.

As to the reflective supports, silver halide emulsions, foreign metal ion species for doping silver halide grains, storage stabilizers or antifoggants of silver halide emulsions, chemical sensitization methods (including sensitizers used therein), spectral sensitization methods (including spectral sensitizers used therein), cyan, magenta and yellow couplers and methods of dispersing them in an emulsified state, dye image keeping quality improvers (including stain inhibitors and discoloration inhibitors), dyes (colored layers), gelatin species, layer structures of photosensitive materials and pH values of coatings in photosensitive materials, the descriptions in their respective locations of the documents shown in the following Table 1 can highly advantageously be applied to the invention.

TABLE 1

| Constituents | JP-A-7-104448 | JP-A-7-77775 | JP-A-7-301895 |
|---|---|---|---|
| Reflective supports | column 7, line 12, to column 12, line 19 | column 35, line 43, to column 44, line 1 | column 5, line 40, to column 9, line 26 |
| Silver halide emulsions | column 79, line 29, to column 74, line 18 | column 44, line 36, to column 46, line 29 | column 77, line 48, to column 80, line 28 |
| Foreign metal | column 74, lines | column 46, line | column 80, line |

TABLE 1-continued

| Constituents | JP-A-7-104448 | JP-A-7-77775 | JP-A-7-301895 |
|---|---|---|---|
| ion species | 19–44 | 30, to column 47, line 5 | 29, to column 81, line 6 |
| Storage stabilizers or Antifoggants | column 75, lines 9–18 | column 47, lines 20–29 | column 18, line 11, to column 31, line 37 (especially mercaptohetero-cyclic compounds) |
| Chemical sensitization method (chemical sensitizers) | column 75, line 45 to column 75, line 6 | column 47, lines 7–17 | column 81, lines 9–17 |
| Spectral sensitization (spectral sensitizers) | column 75, line 19, to column 76 line 45 | column 47, line 30, to column 49, line 6 | column 81, line 21, to column 82, line 49 |
| Cyan couplers | column 12, line 20, to column 39, line 49 | column 62, line 50, to column 63, line 16 | column 88, line 49, to column 89, line 16 |
| Yellow couplers | column 87, line 40, to column 86, line 3 | column 63, lines 17–30 | column 89, lines 17–30 |
| Magenta couplers | column 88, lines 4–18 | column 63, line 3, to column 64, line 11 | column 31, line 34, to column 77, line 44, and column 88, lines 32–46 |
| Emulsified dispersion methods for couplers | column 71, line 3, to column 72, line 11 | column 67, lines 36–49 | column 87, lines 36–48 |
| Dye image keeping quality improvers (stain inhibitors) | column 39, line 50, to column 70, line 9 | column 61, line 50, to column 62, line 40 | column 87, line 49, to column 88, line 48 |
| Discoloration inhibitors line 2 | column 70, line 10, to column 71, | — | — |
| Dyes (coloring agents) | column 77, line 42, to column 78, line 41 | column 7, line 14, to column 19, line 42, and column 50, line 3, to column 51, line 14 | column 9, line 27, to column 18, line 10 |
| Gelatin species | column 78, lines 42–48 | column 51, lines 15–20 | column 83, lines 13–19 |
| Layer structures of sensitive materials | column 39, lines 11–26 | column 44, lines 2–35 | column 31, line 38, to column 32, to line 33 |
| Film pH of sensitive materials | column 72, lines 12–28 | — | — |
| Scanning exposure | column 76, line 6, to column 77 line 41 | column 49, line 7, to column 50, line 2 | column 82, line 49, to column 83, line 12 |
| Preservatives in developers | column 88, line 19, to column 89, line 22 | — | — |

Dye-forming couplers (simply referred to as "couplers", too), photographically useful substances and others are added together to a high boiling organic solvent, and dispersed in an emulsified state. The dispersion prepared is incorporated into a photosensitive material. More specifically, the dispersion is prepared in a manner that the high boiling organic solvent solution is emulsified and dispersed in the form of fine particles into a hydrophilic colloid, preferably an aqueous gelatin solution, by use of a surfactant as a dispersing agent and a known apparatus such as an ultrasonic dispersing device, a colloid mill, a homogenizer, Manton Gaulin or a high-speed dissolver.

The high boiling organic solvent used therein has no particular restriction, but any of generally used ones may be used. Examples of a usable high boiling organic solvent include those disclosed in U.S. Pat. No. 2,322,027 and JP-A-7-152129.

Further, auxiliary solvents can be used in combination with highboiling organic solvents. Examples of such auxiliary solvents include acetates of lower alcohol, such as ethyl acetate and butyl acetate, ethyl propionate, secondary butyl acetate, methyl ethyl ketone, methyl isobutyl ketone, s-ethoxyethyl acetate, methyl cellosolve acetate, methylcarbitol acetate and cyclohexanone.

Further, organic solvents miscible completely with water, such as methyl alcohol, ethyl alcohol, acetone, tetrahydrofuran and dimethylformamide, can be used as a part of auxiliary solvent in combination with a high boiling organic solvent, if needed. Those organic solvents can be used alone, or two or more thereof.

Part or all of the auxiliary solvents used can be eliminated from the emulsified dispersion by reduced-pressure distillation, noodle washing or ultrafiltration on an as needed basis from the viewpoints of improving aging stability of the emulsified dispersion during the storage, and suppressing changes of photographic properties and improving aging stability in a state of the final composition prepared for coating by mixing the emulsified dispersion with an emulsion.

The suitable average particle size of lipophilic fine particles in the dispersion thus prepared is from 0.04 to 0.50 $\mu$m, preferably from 0.05 to 0.30 $\mu$m, particularly preferably from 0.08 to 0.20 $\mu$m. The average particle size can be determined using a Coulter Submicron Particles Analyzer Model N4 (made by Coulter Electronics).

In the oil-in-water dispersion method using a high boiling organic solvent, the cyan couplers used may be dissolved in any amount of high boiling organic solvent, but the suitable weight ratio of the high boiling organic solvent to the total cyan couplers used is from 0.1 to 10.0, preferably from 0.3 to 7.0, particularly preferably from 0.5 to 5.0. On the other hand, it is also possible to prepare a dispersion of cyan couplers without using any high boiling organic solvent.

For the purpose of controlling a tinge of white background, tingeing pigments may be co-emulsified in making emulsions used in the invention, or may be made into an emulsion by being added to a high boiling organic solvent in which photographically useful compounds used in the invention, such as couplers, are dissolved and emulsified together with these compounds.

As to couplers usable in the present photosensitive materials, it is preferable that loadable latex polymers (as disclosed in U.S. Pat. No. 4,203,716) impregnated with the couplers in the presence (or absence) of a high boiling organic solvent as mentioned above, or the couplers dissolved in a high boiling organic solvent together with a polymer insoluble in water but soluble in an organic solvent are dispersed into hydrophilic colloidal solutions in emulsified conditions. Water-insoluble and organic solvent-soluble polymers which can be preferably used therein include the homo- or copolymers disclosed in U.S. Pat. No. 4,857,449, columns 7–15, and WO 88/00723, pages 12–30. In particular, methacrylate or acrylamide polymers, especially acrylamide polymers, are favored over the others with respect to color image stabilization.

In the photosensitive materials, known color mixing inhibitors can be used. Of known ones, the compounds as disclosed in the documents cited below are preferable in particular.

Specifically, the high molecular weight redox compounds disclosed in JP-A-5-333501, the phenidone and hydrazine compounds disclosed in WO98/33760 and U.S. Pat. No. 4,923,787, and the white couplers disclosed in JP-A-10-282615 and DE-A1-19629142 can be used. In the case of raising the pH of a developer and expediting the development, the redox compounds disclosed in DE-A1-19618786, EP-A1-839623, EP-A1-842975, DE-A1-19806846 and FR-A1-2760460 can also be used to advantage.

In the photosensitive materials, the compounds having triazine skeletons high in molar absorption constant are preferably used as ultraviolet absorbents. For instance, the compounds disclosed in the following documents can be used. These compounds are added suitably to light-sensitive or/and light-insensitive layers. Examples of a usable ultraviolet absorbent include the compounds disclosed in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, DE-A-1973979, EP-A-711804 and JP-T-8-501291 (the term "JP-T" as used herein means a published Japanese translation of a PCT patent application).

As binder or protective colloid for the photosensitive materials, gelatin is used to advantage, but other hydrophilic colloids can also be used independently or in combination with gelatin. In gelatin used suitably, it is appropriate that the content of impurity heavy metals, such as iron, copper, zinc and manganese, be at most 5 ppm, preferably at most 3 ppm. In addition, the calcium content in the present photosensitive materials each is 20 $Mg/M^2$ or below, preferably 10 $mg/m^2$ or below, particularly preferably 5 $mg/m^2$.

For the purpose of preventing the deterioration of images from occurring through propagation of various kinds of molds and bacteria in hydrophilic colloid layers, it is preferable that the bacteria- and mold-proof agents disclosed in JP-A-63-271247 are added to the present photosensitive materials each. Further, the suitable film pH of the present photosensitive materials each is from 4.0 to 7.0, preferably from 4.0 to 6.5.

From the standpoint of not only improving coating consistency but also preventing electrification and controlling the amount of electrostatic charge, surfactants may be added to the present photo sensitive materials each. Such surfactants include anionic surfactants, cationic surfactants, betaine-type surfactants and nonionic surfactants. For example, the surfactants disclosed in JP-A-5-333492 are usable. In the invention, fluorine-containing surfactants are preferred in particular. The fluorine-containing surfactants may be used alone or in combination with known other surfactants, but they are preferably used in combination with known other surfactants. The amount of these surfactants added to the photosensitive materials each is generally from $1\times10^{-5}$ to 1 $g/m^2$, preferably from $1\times10^{-4}$ to $1\times10^{-1}$ $g/m^2$, far preferably from $1\times10^{-3}$ to $1\times10^{-2}/m^2$.

The present photosensitive materials can be used as color negative films, color positive films, color reversal films, color reversal photographic paper or color photographic paper. Of these uses, it is preferred to use them as color photographic paper.

Photographic supports usable for the present photosensitive materials include both transmission and reflection supports. Suitable examples of a transmission support include transparent films, such as cellulose triacetate film and polyethylene terephthalate film, and a polyester film prepared from 2,6-naphthalenedicarboxylic acid (NDCA) and ethylene glycol (EG) or from NDCA, terephthalic acid and GE, and what is more, provided with an information recording layer, such as a magnetic layer. On the other hand, the suitable reflection support is a laminate which is formed of a plurality of polyethylene layers or/and polyester layers (water-proof layers) and contains a white pigment like titanium dioxide in at least one of these water-proof resin layers.

Further, it is appropriate that one or more of the water-proof resin layers contain a brightening agent. In addition, a brightening agent may be dispersed into hydrophilic colloid layers of the photosensitive layer. Examples of a brightening agent used suitably include benzoxazole compounds, coumarin compounds and pyrazoline compounds. Of these compounds, benzoxazolylnaphthalene compounds and benzoxazolylstilbene compounds are preferred by far as brightening agent. Specific examples of a brightening agent contained in water-proof resin layers include 4,4'-bis(benzoxazolyl)stilbene, 4,4'-bis(5-methylbenzoxazolyl)stilbene and a mixture thereof. The amount of brightening agents used in the present photosensitive materials each is not particularly limited, but it is preferably from 1 to 100 $mg/m^2$. When the brightening agents are mixed with water-proof resin, the suitable mixing proportion of the brightening agents to the water-proof resin is from 0.0005 to 3% by weight, preferably 0.001 to 0.5% by weight.

As other reflection supports, those formed by coating white pigment-containing hydrophilic colloid layers on the transmission or reflection supports as recited above can also be used. Still another reflection support may be a support having a metal surface of specular reflection or diffuse reflection of second kind.

An example of a reflection support preferred by far is a paper substrate having on the silver halide emulsion-coated side a polyolefin layer containing minute pores. The polyolefin layer may have a plurality of constituent layers. In this case, it is preferable that the minute pores are not contained in the polyolefin (e.g., polypropylene or polyethylene) layer adjacent to a gelatin layer on the silver halide emulsion-coated side but they are contained in the polyolefin (e.g., polyropylene or polyethylene) layer(s) formed on the side near the paper substrate. The suitable density of such a multiple or single polyolefin layer situated between the paper substrate and a photographic constituent layer is from 0.40 to 1.0 g/ml, preferably from 0.50 to 0.7 g/ml, and the suitable thickness thereof is from 10 to 100 $\mu$m, preferably from 15 to 70 $\mu$m. In addition, it is appropriate that the thickness ratio between the polyolefin layer and the paper substrate be from 0.05 to 0.2, preferably 0.1 to 0.15.

Further, it is preferable that a polyolefin layer is provided also on the back (the side opposite to photographic constituent layers) of the paper substrate. In this case, the polyolefin layer provided on the back is preferably a matte-finished polyethylene or polypropylene layer, especially a matte-finished polypropylene layer. The suitable thickness of the polyolefin layer on the back is from 5 to 50 $\mu$m, preferably from 10 to 30 $\mu$m, and the suitable density thereof is from 0.7 to 1.1 g/ml. Examples of a preferred constitution of the polyolefin layers provided on a paper substrate include those disclosed in JP-A-10-333277, JP-A-10-333278, JP-A-11-52513, JP-A-11-65024, and European Patent Nos. 0880065 and 0880066.

In the present image formation method, images are formed in processes that a silver halide photographic material according to the invention is cut into sheets and subjected to imagewise exposure, and further subjected to photographic processing as the exposed sheets are transported by means of pairs of transport rollers. The photographic material may undergo the exposure process before or after the cutting process, or it may be cut while undergoing the exposure process.

Besides being used in print systems using general negative printers, the present silver halide color photographic materials are applied suitably to scanning exposure systems using cathode-ray tubes (CRT) or laser beams. In the latter systems, the imagewise exposure is performed on the basis of image information in a digital scanning exposure mode utilizing monochromatic high-intensity light from gas laser, light-emitting diode, semiconductor laser, or a second harmonic generation source (SHG) in which semiconductor laser or solid laser using semiconductor laser as an optically pumping source is combined with a nonlinear optical crystal. From the standpoint of rendering the system compact and inexpensive, it is advantageous to use semiconductor laser, or a second harmonic generation source (SHG) in which semiconductor laser or solid laser using semiconductor laser as an optically pumping source is combined with a nonlinear optical crystal. In order to design compact, low-priced, long-life, highly stable apparatus, the use of semiconductor laser is preferred in particular, and it is advisable to use semiconductor laser as at least one of exposure light sources.

When such scanning exposure light sources are used, the wavelengths at which a photosensitive material shows maximum spectral sensitization can be set arbitrarily, depending on the wavelengths of scanning exposure light sources used. In the case of an SHG light source obtained by combining semiconductor laser or solid laser using semiconductor laser as optically pumping source with a nonlinear optical crystal, the lasing wavelength can be reduced to half, and blue light and green light can be obtained. Therefore, it is possible to impart the spectral sensitivity maxima to a photosensitive material in the general three wavelength regions, blue, green and red regions. Defining the exposure time per pixel in the scanning exposure as the time required for exposing the area of one pixel size in the case of a pixel density of 400 dpi, the suitable scanning exposure time is $10^{-3}$ second or below, preferably $10^{-4}$ second or below, far preferably $10^{-6}$ second or below. The invention is more apt to achieve its effects under a condition that reciprocity law failure occurs under high illumination intensity exposure and silver development is hard to be caused in shadow areas. However, similar effects are achieved also in the case of low illumination intensity exposure.

Examples of a semiconductor laser light source used suitably in the invention include the blue semiconductor laser devices with wavelengths of 430 to 450 nm (reported by NICHIA CORPORATION in Dai 48-kai Oyou Butsurigaku Kankei Rengou Kouenkai (which may be literally translated "The 48th Applied Physics Related Association Symposium) held in March, 2001), blue laser of about 470 nm taken out by subjecting semiconductor laser (oscillation wavelength: about 940 nm) to wavelength conversion by use of SHG crystal of $LiNbO_3$ having a waveguide-form reverse domain structure, green laser of about 530 nm taken out by subjecting semiconductor laser (oscillation wavelength: about 1060 nm) to wavelength conversion by use of SHG crystal of $LiNbO_3$ having a waveguide-form reverse domain structure, red semiconductor laser with a wavelength of about 685 nm (Hitachi Type No. HL6738MG), and red semiconductor laser with a wavelength of about 650 nm (Hitachi Type No. HL6501MG).

In the invention, it is particularly preferred to perform imagewise exposure by use of coherent beams of blue laser having oscillation wavelengths of 430 to 460 nm.

Each of light-sensitive layers (emulsion layers) of a silver halide photosensitive material may be subjected to imagewise exposure for two or more times, preferably at least three times. Herein, the suitable exposure time for each exposure is from $10^{-4}$ to $10^{-8}$ second. When the exposure time is set in the range of $10^{-5}$ to $10^{-8}$ second, it is appropriate that exposure be repeated at least 8 times. Any of gas laser, solid laser (LD), LED (inorganic or organic) and a Xe light source reduced in spot diameter may be used as exposure light source, but solid layer and LED are preferred in particular. The light source used is required to have a spectrum corresponding to wavelengths at which each dye-forming layer has its color sensitivity. For satisfying this requirement, an appropriate color filter (of dye-containing or dye-evaporated type) may be used, or LE or LED having an appropriate oscillation wavelength may be chosen. Further, these may be used in combination. The spot diameter of a light source used has no particular limitation, but it is preferably from 5 to 250 $\mu$m, preferably from 10 to 100 $\mu$m, in terms of half light-intensity width. The spot may have any of circular, elliptic and rectangular shapes. The light quantity distribution in the interior of one spot may be a Gaussian distribution, or a trapezoid-shape distribution relatively uniform in intensity. The light source may be a single source, or an array with two or more of light sources.

The imagewise exposure is performed suitably by scanning exposure, wherein either light source or photosensitive material, or both may be made to travel.

Herein, the exposure time for one scanning is defined as follows:

Exposure time=spot diameter/travel speed of light source (or travel speed of photosensitive material)

The term "spot diameter" as used herein refers to the diameter of a spot (half-width, unit: $\mu$m) in a travel direction the light source used for scanning exposure takes at the time of exposure. In addition, the term "travel speed of light source" as used herein refers to the speed (unit: $\mu$m/sec) at which the light source used for scanning exposure travels per unit time. In general, it is unnecessary for a spot diameter to be the same as a pixel diameter, but the spot diameter may be larger or smaller than the pixel diameter. The term "the number of times the exposure is repeated" as used in the invention refers to the number of times one point (pixel) on the photosensitive material is irradiated with light to which the layers having the same color sensitivity are sensitive. Herein, any exposure can be counted among the number of times irradiation is carried out so far as the light used for the exposure has an intensity higher than one-fifth of the highest exposure intensity in the case of repeating irradiation two or more times. In other words, the exposure having an intensity lower than one-fifth of the highest exposure intensity, back-light and overlap between spots are not counted among the number of times irradiation is carried out.

Additionally, the exposure system usable in the invention is not limited to the scanning exposure mode using light sources mentioned above, but the exposure mode used in a print system using a general negative printer and the scanning exposure mode using a cathode ray tube (CRT) may be adopted. CRT exposure apparatus is simple, compact and low in cost, compared with devices using laser. Further, color and optical axis adjustments to the apparatus can be made with ease. In the cathode ray tubes used for image exposure, various luminophors capable of emitting light in spectral regions as required can be used. For instance, any one of red luminophor, green luminophor and blue luminophor, or a mixture of two or more of these luminophors may be used.

When the photosensitive material has two or more light-sensitive layers differing in spectral sensitivity distribution and the cathode ray tube contains phosphors showing luminescence in a plurality of spectral regions, one-time exposure to a plurality of colors, or simultaneous input of image signals in a plurality of colors into a cathode ray tube, may be carried out and thereby light emission from the tube surface may be achieved. On the other hand, it is possible to adopt a method that image signals having their individual colors are input sequentially and cause light emissions of their respective colors in succession, and exposure to emitted light via a film for cutting light of other colors (sequential mask exposure) is carried out. In general, the sequential mask exposure is preferred because a high-resolution cathode-ray tube can be used and enables enhancement of image quality.

When the so-called latent-image time from the end of exposure to the start of color development is reduced to a short time below 9 seconds, the invention can readily deliver its effects. In the case of the latent-image time shorter than 6 seconds, greater effects can be obtained. In a system where an exposure device and a processor are isolated and independent of each other, the latent-image time becomes longer and makes it difficult for the present effects to be produced. On the other hand, the present effects are easily produced in the system reduced in total print time by the use of a printer in which an exposure device and a processor are united into one apparatus.

Then, steps for color-development processing are explained below.

Color development-processing applicable to the present photosensitive materials and image formation method includes a color development step, a desilvering step, a wash step or a step of using a stabilizing bath, and a drying step. Between two successive steps, an auxiliary step, such as a rinse step, an intermediate wash step or a neutralization step, may be inserted. The desilvering step is performed by one-step process using a bleach-fix bath. In addition, the wash step may be carried out using a stabilizing bath as an alternative to a washing bath, and besides, an image stabilization step using a bath for stabilizing images may be inserted between the wash or stabilization step and the drying step.

Herein, it is appropriate that the color development time (the time required for performing a color development step) be 45 seconds or below, preferably 30 seconds or below, far preferably 28 seconds or below, particularly preferably from 6 to 25 seconds, optimally from 6 to 20 seconds. And the suitable blix time (or the time required for performing the bleach-fix step) is from 1 to 45 seconds, preferably up to 28 seconds, far preferably from 6 to 25 seconds. The present silver halide photographic materials enable high-speed processing in not only a color development step but also a blix step. In addition, the suitable rinse (wash or stabilization) time (or the time required for performing a rinse step) is 90 seconds or below, preferably 30 seconds or below, far preferably from 6 to 30 seconds.

Additionally, the term "color development time" as used herein refers to the time between starting to dip a photosensitive material in a color developer and bringing the photosensitive material to a blix bath used in the next step. In the case of processing with an automatic developing machine, for instance, the color development time is the sum total of the time spent in dipping a photosensitive material in a color developer (the so-called in-solution time) and the time spent in transporting the photosensitive material in midair to a blix bath used in the next step after removing the photosensitive material from the color developer (the so-called in-mid air time). Similarly to the above, the term "blix time" as used in the invention refers to the time between starting to dip a photosensitive material in a blix bath and bringing the photosensitive material to a washing or stabilizing bath used in the next step. And the term "rinse (wash or stabilization) time" as used in the invention refers to the time between placing a photosensitive material in a rinsing bath (wash or stabilizing bath) and taking the photosensitive material out of the bath for moving to a drying step (the so-called in-solution time).

The temperatures of processing solutions used in color-development, blix and rinse steps range generally from 30 to 40° C.; while those in the rapid processing are preferably within the range of 38 to 60° C., far preferably within the range of 40 to 50° C.

The volume of a rinsing solution (washing water) can be chosen from a wide range depending on the characteristics of the photosensitive material to be processed (e.g., on what kinds of couplers are incorporated therein), the end-use purposes of the photosensitive material to be processed, the temperature of the rinsing solution (or the washing water), the number of rinse tanks (wash tanks) (the number of stages) and other various conditions. Of these conditions, the relation between the number of rinse tanks (wash tanks) and the volume of water in the multistage counter current process can be determined according to the methods described in Journal of the Society of Motion Picture and Television Engineers, volume 64, pages 248 to 253 (May 1955).

In general, the suitable number of stages in the multistage counter current process is from 3 to 15, especially from 3 to 10.

According to the multistage counter current process, the volume of the rinsing solution can be sharply reduced. However, the process has a disadvantage in that bacteria having propagated themselves in the tanks because of an increase in the staying time of the rinsing solution in the tanks produce a suspending matter, and the suspending matter produced adheres to photosensitive materials processed therein. As a measure for solving this problem, the use of rinsing solutions containing bacteria- and mold-proof agents as mentioned below is suitable.

The silver halide color photographic materials having underwent photographic processing are subjected to after-treatment in a drying step. In the drying step, it is possible to absorb water adhering to the photographic material surface by use of a squeegee roller or cloth just after the conclusion of photographic processing (rinsing step) from the standpoint of reducing the amount of water brought into image-formed layers of the photographic material processed, and expedite the process of drying. As a matter of course, it is also possible to expedite the drying process by raising the drying temperature, or changing the shape of a blowing nozzle to strengthen the power of drying air. Further, as disclosed in JP-A-3-157650, the drying process can be speeded up by adjustment of a blowing angle that the drying air makes with the photosensitive material or by a scheme to remove discharged air.

Constituents of processing compositions used in the processing steps mentioned above, and processing solutions prepared there from are explained below. As to the constituents, no distinction is made between processing compositions (processing agents) and processing solutions prepared therefrom, exclusive of special cases, but they are described collectively. And the constituent concentration is expressed in principle as the concentration of the constituent in the processing solution prepared.

Additionally, in using the processing compositions, mother solutions (tank solutions) or replenishers are prepared by mixing them with a solvent, such as water, at a prescribed ratio. In this specification, tank solutions and their respective replenishers are both expressed as available solutions.

The color development-processing composition and the color developer each contain a color developing agent.

Suitable examples of a color developing agent include known aromatic primary amine color developing agent, especially p-phenylenediamine derivatives. Representatives of these derivatives are described below. However, The invention should not be construed as being limited to these compounds.

1) N,N-dimethyl-p-phenylenediamine
2) 4-amino-3-methyl-N,N-diethylamiline
3) 4-amino-N-(β-hydroxyethyl)-N-methylaniline
4) 4-amino-N-ethyl-N-(β-hydroxyethyl)aniline
5) 4-amino-3-methyl-N-ethyl-N-(β-hydroxyethyl)aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-3-methyl-N-ethyl-N-(β-methanesulfonamidoethyl)aniline
9) 4-amino-N,N-diethyl-3-(β-hydroxyethyl)aniline
10) 4-amino-3-methyl-N-ethyl-N-(β-methoxyethyl)aniline
11) 4-amino-3-methyl-N-(β-ethoxyethyl)-N-ethylaniline
12) 4-amino-3-methyl-N-(3-carbamoylpropyl)-N-(n-propyl)-aniline
13) 4-amino-N-(4-carbamoylbutyl)-N-(n-propyl)-3-methylaniline
14) N-(4-amino-3-methylphenyl)-3-hydroxypyrrolidine
15) N-(4-amino-3-methylphenyl)-3-(hydroxymethyl) pyrroli-dine
16) N-(4-amino-3-methylphenyl)-3-pyrrolidinecarboxamide Of these p-phenylenediamine derivatives, the compounds 5), 6), 7), 8) and 12), especially 5) and 8), are preferred over the others. These p-phenylenediamine derivatives may form salts in a state of solid matter. Examples of such salts include sulfates, hydrochlorides, sulfites, naphthalene disulfonates and p-toluenesulfonates.

As to the suitable content of such an aromatic primary amine developing agent among the processing chemicals in a developer, the color developing agent is added so as to have a concentration of from 2 to 200 millimoles, preferably from 6 to 100 millimoles, far preferably from 10 to 40 millimoles, per L of available solution.

Depending on the kinds of photosensitive materials to be processed, the color developing kit may contain a small amount of sulfite ion, or may not contain sulfite ion in a substantial sense. In the invention, however, it is preferable to contain a small amount of sulfite in the color developing kit used.

Further, the color developing kit used in the invention may contain a small amount of hydroxylamine, also. The hydroxylamine (generally used in the form of hydrochloride or sulfate, but herein expressed in the salt part-omitted form) functions as a preservative similarly to sulfite ion, but has an influence upon photographic characteristics because of its own activity in silver development. Therefore, the addition amount of hydroxylamine is required to be small.

In addition to hydroxylamine and sulfite ion as preservatives, the color developing kit may contain organic preservatives also. Examples of organic preservatives usable in the invention include the compounds disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

To a color developing kit for, e.g., color paper, chloride ion may be added, if needed. In general, many of color developers (especially for color print materials) contain $3.5\times10^{-2}$ to $1.5\times10^{-1}$ mole/L of chloride ion. However, chloride ions are generally released into developers from photosensitive materials as a by-product of development, so that it is not required in many cases to add chloride ion to a developer for replenishment use. Additionally, the developers used for picture-taking photosensitive materials may contain no chloride ion.

On the other hand, the suitable bromide ion concentration in a color developer is from about $1\times10^{-3}$ to about $5\times10^{-3}$ mole/L in the case of processing picture-taking materials, while it is at most $1.0\times10^{-3}$ mole/L in the case of processing print materials. In many cases, however, color developers do not require the addition of bromide ion, similarly to the addition of chloride ion.

In the invention, it is preferable that the developer and the replenisher are both adjusted to pH 9.0 to 13.5. Therefore, alkali agents, pH buffers and, if needed, acid agents can be added to the developer and the replenisher so as to keep their pH values within the foregoing range.

For keeping the pH within the foregoing range at the time the processing solutions are prepared, it is appropriate to use various buffers. Examples of buffers usable therein include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. Of these buffers, carbonates, phosphates, tetraborates and hyroxybenzoates are used to particular advantage because they have excellent buffer capacity in a high pH range of 9.0 or above, exert no adverse effect (fogging) on photographic properties even when added to color developers, and are inexpensive.

Examples of these buffers include sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffers usable in the invention should not be construed as being limited to these compounds.

The amounts of buffers added to the composition are determined so that the buffers have a content of 0.01 to 2 mole, preferably 0.1 to 0.5 mole, per L of each of developer and replenisher prepared from processing chemicals.

As another component of the color developer, various kinds of chelating agents can be added to a color developing kit as a suspending agent for calcium and magnesium ions or an agent for improving the stability of the color developer. Examples thereof include nitrilotriacetic acid, diethylenetriamine-pentaacetic acid, ethylenediaminetetraacetic acid, N,N,N-trimethylenephosphonic acid, ethylenediamine-N,N,N',N'-tetramethylenesulfonic acid, transcyclohexanediaminetetra-acetic acid, 1,2-diaminopropanetetraacetic acid, glycol-ether-diaminetetraacetic acid, ethylenediamine-o-hydroxyphenylacetic acid, ethylenediaminedisuccinic acid (SS body), N-(2-carboxylatoethyl)-L-aspartic acid, β-alaninediacetic acid, 2-phosphonobutane-1,2,4-tricarboxylic acid, 1-hyroxyethylidene-1,1-diphosphonic acid, N,N'-bis (2-hydroxybenzyl) ethylenediamine-N,N7-diacetic acid, and 1,2-dihydroxybenzene-4,6-disulfonic acid.

The chelating agents recited above may be used as a combination of two or more thereof, if needed.

These chelating agents are added in an amount sufficient to block metal ions in the color developer. For example, the addition thereof in an amount of from about 0.1 g to about 10 g per liter of the color developer will suffice for such a purpose.

To a color developing kit relating to the invention, any development accelerator can be added, if needed. Specifically, the thioether compounds disclosed in JP-A-37-16088, JP-A-37-5987, JP-A-38-7826, JP-A-44-12380, JP-A-45-9019 and U.S. Pat. No. 3,813,247, the polyalkylene oxides disclosed in JP-A-37-16088, JP-A-42-25201, U.S. Pat. No. 3,128,183, JP-A-41-11431, JP-A-42-23883 and U.S. Pat. No. 3,532,501, 1-phenyl-3-pyrazolidones and imidazoles can be added as development accelerators, if needed. The amounts of those development accelerators added to the composition are determined so that the accelerators have a content of 0.001 to 0.2 mole, preferably 0.01 to 0.05 mole, per L of each of developer and replenisher prepared from processing chemicals.

In addition to the halide ions mentioned above, any antifoggant can be added to a color developing kit relating to the invention, if needed. As to the organic antifoggants usable therein, nitrogen-containing heterocyclic compounds, such as benzotriazole, 6-nitrobenzimidazole, 5-nitroisoindazole, 5-methylbenzotriazole, 5-nitrobenzotriazole, 5-chlorobenzo-triazole, 2-thiazolylbenzimidazole, 2-thiazolylmethylbenzimidazole, indazozle, hydroxyazaindolidine and adenine, are typical examples.

Further, various kinds of surfactants, such as alkylsulfonicacids, arylsulfonicacids, aliphaticcarboxylic acids and aromatic carboxylic acids, may be added to the color developing kit, if desired. The amounts of those surfactants added to the composition are determined so that the surfactants have a content of 0.0001 to 0.2 mole, preferably 0.001 to 0.05 mole, per L of each of developer and replenisher prepared from processing chemicals.

In the invention, a brightening agent can be used, if needed. As the brightening agent, bis(triazinylamino)-stilbenesulfonic acid compounds including known or commercially available diaminostilbene brightening agents are used to advantage. As known bis(triazinyl-amino) stilblenesulfonic acid compounds, the compounds disclosed in JP-A-6-329936, JP-A-7-140625 and JP-A-10-140849 are preferable. The commercially available compounds are described, e.g., in *Senshoku Nohto* (which may be translated "Dyeing Notes"), 9th ed., pp. 165–168, Shikisen-sha. Of the compounds described therein, Blankophor BSU liq. and Hakkol BRK are preferred over the others/ In addition to aminopolycarboxylic acid-Fe(III) complex salts, other bleaching agents known in the arts can also be used in the invention. Examples of bleaching agents usable in combination with the Fe(III) complex salts include Fe(III) complex salts of organic acids, such as citric acid, tartaric acid and malic acid, persulfates and hydrogen peroxide.

The suitable aminopolycarboxylic acid-Fe(III) complex salts are Fe(III) complex salts of aminopolycarboxylic acids recited below. Specifically, these acids are biodegradable acids, with examples including not only ethylenediaminedisuccinic acid (SS body), N-(2-carboxylatoethyl)-L-aspartic acid, β-alaninediacetic acid and methyliminodiacetic acid, but also ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid and glycol-ether-diaminetetraacetic acid. Of these acids, ethylenediaminedisuccinic acid (SS body), N-(2-carboxylatoethyl)-L-aspartic acid, β-alaninediacetic acid, ethylenediaminetetraacetic acid, 1,3-diaminopropanetetraacetic acid and methyliminodiacetic acid are preferred over the others because the Fe (III) complex salts thereof can have good effects on photographic properties. The Fe(III) complex salts of these acids may be used in the form of a complex salt itself, or may be formed in a processing bath by using ferric salts, such as ferric sulfate, ferric chloride, ferric nitrate, ammonium ferric sulfate, ferric phosphate, and chelating agents such as aminopolycarboxylic acids. Moreover, such chelating agents may be used in excess of the need for formation of the Fe(III) complex salts. The content of a bleaching agent in the bleaching agent part is determined so that the bleaching agent concentration in a processing solution prepared from a processing composition is in the range of 0.01 to 1.0 mole/L, preferably 0.03 to 0.80 mole/L, far preferably 0.05 to 0.70 mole/L, particularly preferably 0.07 to 0.50 mole/L.

In the bleaching agent part, it is preferable to contain various known organic acids (e.g., acetic acid, lactic acid, glycolic acid, succinic acid, maleic acid, malonic acid, citric acid, sulfosuccinic acid, tartaric acid, glutaric acid), organic bases (e.g., imidazole, dimethylimidazole), or the compounds represented by formula (A-a) in JP-A-9-211819 including 2-picolinic acid, and the compounds represented by formula (B-b) in the same document as cited above. The addition amount of these compounds is determined so that their concentration in the processing solution prepared is in the range of 0.005 to 3.0 moles/L, preferably 0.05 to 1.5 moles/L.

The fixing agent part which constitutes the processing composition for a blix bath in combination with the bleaching agent part contains as a fixing agent one compound or a mixture of two or more compounds selected from among known fixing chemicals, specifically water-soluble silver halide solvents including thiosulfates such as sodiumthiosulfate and ammonium thiosulfate, thiocyanates such as sodium thiocyanate and ammonium thiocyanate, thioether compounds such as ethylenebisthioglycolic acid and 3,6-dithia-1,8-octanediol, and thioureas. In addition, a special bleach-fix bath containing a combination of the fixing agent disclosed in JP-A-55-155354 and a large quantity of halide, such as potassium iodide, can be used. In the invention, the use of thiosulfates, especially ammonium thiosulfate, is preferred. The content of the fixing agent in the fixing agent part is preferably designed so that the blix bath prepared has a fixing agent concentration ranging from 0.1 to 3 moles/L, particularly from 0.2 to 2.0 mole/L.

It is preferable that the fixing agent part contains, as preservatives, sulfite ion-releasing compounds such as sulfites, bisulfitesandmetabisulfites, or arylsulfinic acids such as p-toluenesulfinic acid and m-carboxybenzenesulfinic acid. These compounds are added in a concentration (as a concentration in the processing solution prepared) ranging from about 0.02 to about 1.0 mole/L, based on the sulfite ion or the sulfinic acid ion.

A blix bath prepared by mixing the bleaching agent part and the fixing agent part and, if needed, adding a little water to the mixture is described below. In addition, chemicals which are added to either of the bleaching agent part and the fixing agent part and constitute a blix bath are also explained below.

The suitable pH the processing composition for a blix bath shows at the time when the composition is dissolved is in the range of 3 to 8, particularly preferably 4 to 8. When the pH is lower than the foregoing range, the desilvering characterisics are improved but the deterioration of the bath and conversion of cyan dyes into their corresponding leuco dyes is accelerated. When the pH is higher than the foregoing range, on the other hand, the desilvering is retarded and stains tend to develop.

For pH adjustment, an alkali agent, such as potassium hydroxide, sodium hydroxide, lithium hydroxide, lithium carbonate, sodium carbonate or potassium carbonate, and acidic or basic buffering agents can be added to the fixing agent part, if needed.

The replenisher volume for the blix bath can be greatly reduced by making up a processing composition for the blix bath in accordance with the invention. The suitable replenisher volume is from 20 to 50 ml, preferably from 25 to 45 ml, particularly preferably from 25 to 40 ml, per $m^2$ of a photosensitive material. The replenisher volume for the blix bath is preferably divided between the bleaching agent part and the fixing agent part. In this case, the volume of replenishers for the blix bath means the total of the replenisher volume for the bleaching agent part and that for the fixing agent part. The replenisher volume for the rinse bath (wash water and/or a stabilizing bath) as a whole is preferably in the range of 50 to 200 ml.

After conclusion of fixation or bleach-fix processing, a stabilizing bath as an alternative to wash water and a stabilizing bath for image stabilization are used in many cases. These baths are low in concentration and effectiveness of processing chemicals, but processing chemicals can be produced therein, if needed. To processing chemicals for a stabilizing bath, the method of reducing calcium and magnesium concentrations as disclosed in JP-A-62-288838 can be very effectively applied. Further, bactericides such as isothiazolone compounds and thiabendazole compounds disclosed in JP-A-57-8542, chlorine-containing germicides such as sodium salt of chlorinated isocyanuric acid disclosed in JP-A-61-120145, the benzotriazoles disclosed in JP-A-61-267761, copper ion, and other germicides described in Hiroshi Horiguchi, *Bohkin Bohbai no Kagaku* (which means "Antibacterial and Moldproof Chemistry"), Sankyo Shuppan (1986), *Biseibutsu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982, and *Bohkin-Bohbaizai Jiten* (which means "Thesaurus of Antibacteria and Antimolds"), compiled by Nippon Bohkin Bohbai Gakkai in 1986.

The present photographic processing methods using concentrated processing compositions are explained above, so the descriptions of apparatus for performing such photographic processing are given below.

The photographic processing methods relating to the invention are carried out using an automatic developing machine. The automatic developing machine used suitably in the invention is described below.

The suitable linear transport speed of the automatic developing machine used in the invention is 100 mm/sec or below, preferably from 27.8 mm/sec to 80 mm/sec, particularly preferably from 27.8 mm/sec to 50 mm/sec.

For transport in the automatic developing machine for color paper use, the system in which color paper is cut into sheets of a final size and then subjected to photographic processing (sheet type transport system) and the system in which color paper in the form of a long length of roll film is subjected to photographic processing and then cut into sheets of a final size (motion picture film type transport system) can be adopted. In the motion picture film type transport system, the photosensitive material has a waste space having a width of about 2 mm between frames. So the sheet type transport system is preferred in the invention.

When the present processing solutions are placed in processing tanks and replenisher tanks, it is advantageous to minimize the solutions' contact areas with air. For instance, the opening rate defined by the value obtained by dividing an opening area ($cm^2$) by a volume ($cm^3$) of the processing solution placed in the tank is preferably 0.01 ($cm^{-1}$) or below, far preferably 0.005 or below, particularly preferably 0.001 or below.

For reducing the area of contact with air, it is appropriate that the processing tanks and the replenishing tanks be equipped with solid or liquid substances floating on the processing solution surface and avoiding contact with air.

Specifically, the method of floating a plastic float on the processing solution surface or the method of covering the processing solution surface with a liquid causing neither mixing nor chemical reaction with the processing solution is preferred. Suitable examples of such a liquid include liquid paraffin and liquid saturated hydrocarbons.

For performing rapid processing in the invention, it is more advantageous that the in-midair time, or the crossover time, spent in transporting photosensitive material from one processing solution to another processing solution is reduced to the greater extent. Specifically, the suitable crossover time is 10 seconds or below, preferably 7 seconds or below, far preferably 5 seconds or below.

Further, it is preferable to adopt a crossover rack structure provided with mixing prevention plates in order to shorten the crossover time and inhibit mixing of processing solutions.

As a method of eliminating the crossover time, it is preferred in particular to adopt the blade-utilized in-solution transport structure disclosed in JP-A-2002-55422. According to this method, a blade is provided between processing tanks so as to prevent leakage of processing solutions and enable passage of a photosensitive material, and thereby the crossover time can be reduced to zero.

It is particularly advantageous that the liquid circulation structure disclosed in Japanese Patent Application No. 2001-147814, wherein the liquid is made to flow downwardly, is attached to the blade-utilized in-solution transport structure, and the circulation system therein is provided with a pleated filter made of a porous material.

To each of the processing solutions relating to the invention, it is preferable to supply water in an amount corresponding to an evaporated portion of the processing solution, namely to carry out the so-called evaporation correction. This correction is effective particularly for a color developer and a bleach-fix bath.

Although the invention has no particular restriction as to the method of replenishing each processing solution with water, it is advantageous for the invention to adopt the methods disclosed in JP-A-1-254959 and JP-A-1-254960, specifically the method in which a water monitoring tank is installed separately from a bleach-fix bath, the volume of evaporated water in the water monitoring tank is determined and therefrom the volume of evaporated water in the bleach-fix bath is calculated, and the bleach-fix bath is replenished with water in the amount proportional to the thus calculated volume of evaporated water, and the evaporation correction method using a liquid level sensor or an overflow sensor. In the most suitable evaporation correction methods, the volume of water corresponding to the volume of water lost by evaporation is estimated, and water is added in the estimated volume. More specifically, water is added in an amount calculated by use of coefficients determined in advance on a basis of information on the operation time, the stop time and the temperature adjustment time of an automatic developing machine, as disclosed in *Journal of technical disclosure,* 94-49925, page 1, right column, line 26, to page 3, left column, line 28, published by Nippon Hatsumei Kyoukai.

Further, it is required to devise a reduction in volume of evaporation water, e.g., through reduction in opening area and control of the amount of ventilation. As in the case of the suitable opening rate for the color developer already described, it is advantageous to reduce opening rates of other processing solutions.

As a measure to reduce the volume of evaporation water, it is preferred in particular to keep the humidity of the space above a processing tank at 80% RH or higher as disclosed in JP-A-6-110171. And it is especially advantageous that the automatic developing machine used in the invention is equipped with the evaporation preventing rack and the automatic roller-cleaning mechanism illustrated in FIG. 1 and FIG. 2 of the document cited above. For preventing condensation from occurring during temperature adjustment, a ventilation fan is generally attached to a processing tank. The suitable amount of ventilation is from 0.1 $m^3$ to 1 $m^3$ per minute, particularly preferably from 0.2 $m^3$ to 0.4 $m^3$.

The drying condition of the photosensitive material has an influence on evaporation of processing solutions, too. For drying, it is appropriate to use a ceramic warm-air heater. The suitable quantity of air supplied by the heater is from 4 $m^3$ to 20 $m^3$ per minute, particularly from 6 $m^3$ to 10 $m^3$ per minute.

The thermostat attached suitably to the ceramic warm-air heater for prevention of overheating is a heat transfer-operated thermostat, and it is appropriate that this thermostat be situated on the windward or the downwind side along a radiating fin and a heat transfer section. The drying temperature is preferably determined depending on the water content in a photosensitive material to be processed. Specifically, the optimum drying temperature is from 45 to 55° C. in the cases of APS format and 35 mm-width films, and from 55 to 65° C. in the case of Blownie film. The suitable drying time is from 5 seconds to 2 minutes, particularly from 5 seconds to 60 seconds.

In accordance with the photographic processing mentioned above, image output is produced on silver halide photographic materials.

Other preferred forms the present image formation method can take are explained below.

The present image formation method, though performed appropriately using the aforementioned exposure and development systems, may be carried out in combination with the exposure and development systems disclosed in the following documents. Examples of other systems usable in the present image formation method include the automatic print and development system disclosed in JP-A-10-333253, the photosensitive material transporting apparatus disclosed in JP-A-2000-10206, the recording system image including the image reader disclosed in JP-A-11-215312, the image exposure system included in the color image recording system disclosed in JP-A-11-88619 and JP-A-10-202950, the remote diagnosis-incorporated digital photo print system disclosed in JP-A-10-210206, and the photo print system including the image recording apparatus disclosed in U.S. Pat. No. 6,297,873 B1.

The scanning exposure systems are described in detail in the documents cited in Table 1 shown hereinbefore.

In performing imagewise exposure, the band stop filter disclosed in U.S. Pat. No. 4,880,726 is used to advantage. The use of this filter enables removal of the interlayer color mixing and a marked improvement of color reproducibility.

Further, as disclosed in EP-Al-0789270 and EP-Al-0789480, pre-exposure via a yellow micro-dot pattern may be carried out before image information is provided, thereby performing the control of duplication.

To the development processing, on the other hand, the processing materials and methods disclosed in JP-A-2-207250, page 26, right lower column, line 1, to page 34, right upper column, line 9, and JP-A-4-97355, page 5, left upper column, line 17, to page 18, right lower column, line 20, can be applied adequately. As the preservatives used in those developers, the compounds disclosed in the documents cited in Table 1 are used appropriately.

In a typical case, Mini Labo PP360 made by Fuji Photo Film Co., Ltd. is used for color development processing, CP48S is used as a processing chemical, photosensitive materials are subjected to imagewise exposure via negative films of average density, and photographic processing is carried out with processing solutions obtained in the continuous processing carried out until the volume of a replenisher for color development reaches twice the volume of a color deveveloping tank used.

As the processing chemical, CP47L mad e by Fuji Photo Film C o., Ltd. may be used in place of CP48S.

EXAMPLE 1

Preparation of Photosensitive Material Samples:

Sample No. 100

(Making of Blue-Sensitive Emulsion A)

In a reaction vessel, 1.06 liter of deionized distilled water containing 5.7 weight % of demineralized gelatin was placed, and thereto were added 46.3 ml of a 10% NaCl solution, then 46.4 ml of 1N $H_2SO_4$ and further 0.012 g of Compound (X). Then the temperature of the solution in the reaction vessel was adjusted to 60° C. Immediately thereafter, 0.1 mole of silver nitrate and 0.1 mole of NaCl were added to the solution over a period of 10 minutes while stirring the solution at a high speed. Then, 1.5 moles of silver nitrate and a NaCl solution were further added over a period of 60 minutes in accordance with a flow rate acceleration method wherein the final addition speed reached four times the initial addition speed. Furthermore, 0.2 mole % of silver halide and a NaCl solution were added at a constant speed over a period of 6 minutes. In the NaCl solution added herein, $K_3IrCl_5(H_2O)$ was contained in an amount of $5\times10^{-7}$ mole per total amount of silver. Thus, the grains formed were doped with the aquo iridium complex salt.

Further, 0.2 mole of silver halide, 0.18 mole of NaCl and 0.02 mole of KBr solutions were added over a 6-minute period. Herein, $K_4Ru(CN)$ 6 and $K_4Fe(CN)_6$ were each dissolved in the halogen solutions in an amount corresponding to $0.5\times10^{-5}$ mole per total amount of silver, and added to silver halide grains.

In addition, during the grain growth in the final stage, an aqueous KI solution in an amount corresponding to 0.001 mole per total amount of silver was added to the reaction vessel over a period of 1 minute. As to the timing of the addition, the addition was started at a time when 93% of the whole grain formation process finished.

Thereafter, Compound (Y) as a settling agent was added at 40° C., and the resulting emulsion was adjusted so as to have its pH in the vicinity of 3.5, desalted, and washed.

Compount (X)

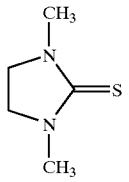

Compound (Y)

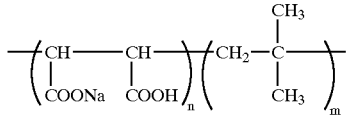

n, m = integer

To the desalted and washed emulsion, demineralized gelatin, an NaCl solution and an aqueous NaOH solution were added, and the resulting admixture was warmed up to 50° C., and adjusted to pAg 7.6 and pH 5.6.

Thus, a gelatin containing silver halide cubic grains was obtained. The composition of these grains was made up of 98.9 mole % of silver chloride, 1 mole % of silver bromide and 0.1 mole % of silver iodide, and the average edge length of these grains was 0.70 $\mu$m and the variation coefficient with respect to the edge length was 8%.

The emulsion grains were kept at 60° C., and thereto Spectral Sensitizing Dyes 1 and 2 were added in amounts of $2.5\times10^{-4}$ mole/mole Ag and $2.0\times10^{-4}$ mole/mole Ag, respectively. Further, the resulting emulsion grains were admixed with successive $1\times10^{-5}$ mole/mole Ag of thiosulfonic acid Compound 1 and a fine grain emulsion having an average grain size of 0.05 $\mu$m, containing 90 mole % of silver bromide and 10 mole % of silver chloride and being doped with iridium hexachloride, and then ripened for 10 minutes. Furthermore, the emulsion grains were admixed with a fine grain emulsion having an average grain size of 0.05 $\mu$m and containing 40 mole % silver bromide and 60 mole % silver chloride and ripened for 10 minutes. The fine grains added were dissolved, and the silver bromide content in the host cubic grains was increased to 1.3 moles. Additionally, the amount of iridium hexachloride with which the host cubic grains were doped was $1\times10^{-7}$ mole/mole Ag.

Successively, $1\times10^{-5}$ mole/mole Ag of sodium thiosulfate and $2\times10^{-5}$ mole/mole Ag of Gold Sensitizer 1 were added. Immediately thereafter, the temperature was raised to 60° C. and the ripening was continued for additional 40 minutes, and then the temperature was lowered to 50° C. Just after lowering the temperature, Mercapto Compounds 1 and 2 were each added so as to have a content of $6\times10^{-4}$ mole per mole Ag. After 10 minutes' ripening, an aqueous KBr solution was added in an amount of 0.008 mole per silver and ripening was continued for additional 10 minutes. Then, the emulsion thus ripened was cooled, and stored.

Thus, a high-speed Emulsion A-1 was prepared.

Under the same conditions as the above except the temperature during the grain formation, cubic emulsion grains having an average edge length of 0.55 $\mu$m and a variation coefficient of 9% with respect to the edge length were formed. The temperature during the grain formation was 55° C.

The grains thus formed were subjected to spectral sensitization and chemical sensitization under the same conditions as mentioned above, except that the corrections for specific surface area (edge length ratio=0.7/0.55=1.27) were made respectively on the amounts of the sensitizers used. In this manner, a low-speed Emulsion A-2 was prepared.

Spectral Sensitizing Dye 1

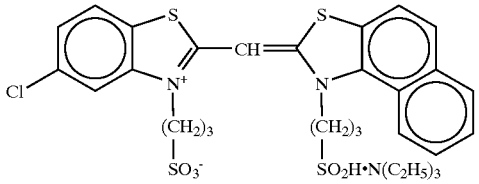

Spectral Sensitizing Dye 2

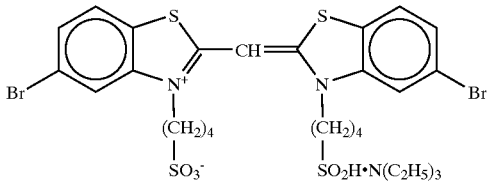

Thiosulfonic Acid Compound 1

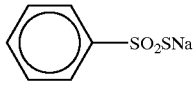

Mercapto Compound 1

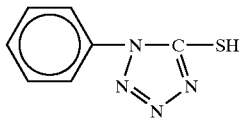

Mercapto Compound 2

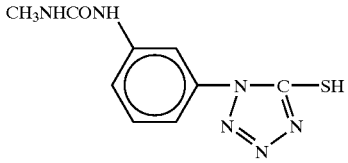

Gold Sensitizer 1

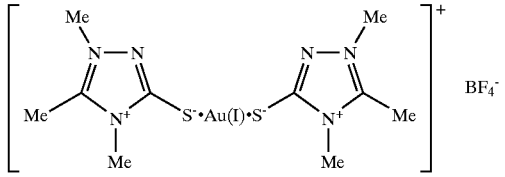

(Making of Green-Sensitive Emulsion C)

A high-speed, green-sensitive Emulsion C-1 and a low-speed, green-sensitive Emulsion C-2 were prepared in the same manner under the same conditions as Emulsion A-1 and Emulsion A-2 respectively, except that the grain formation was performed at a low temperature, compared with the case of Emulsion A-1, and the sensitizing dyes were replaced by those illustrated below.

Sensitizing Dye D

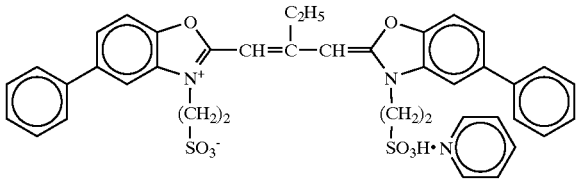

-continued

Sensitizing Dye E

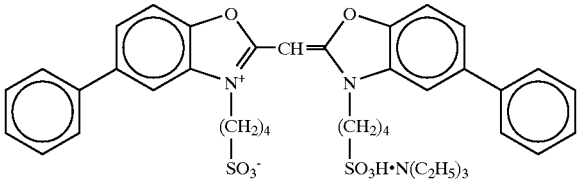

As to the grain sizes, the average edge length of the high-speed emulsion was 0.40 μm and that of the low-speed emulsion was 0.30 μm. The variation coefficients with respect to the edge length were both 8%.

Additionally, the amounts of sensitizing Dye D added to the large-sized emulsion and the small-sized emulsion were $3.0\times10^{-4}$ mole/mole Ag and $3.6\times10^{-4}$ mole/mole Ag, respectively. And the amounts of sensitizing Dye E added to the large-sized emulsion and the small-sized emulsion were $4.0\times10^{-5}$ mole/mole Ag and $7.0\times10^{-5}$ mole/mole Ag, respectively.

(Making of Red-Sensitive Emulsion E)

A high-speed, red-sensitive Emulsion E-1 and a low-speed, red-sensitive Emulsion E-2 were prepared in the same manner under the same conditions as Emulsion A-1 and Emulsion A-2 respectively, except that the grain formation was performed at a low temperature, compared with the case of Emulsion A-1, and the sensitizing dyes were replaced by those illustrated below.

Sensitizing Dye G

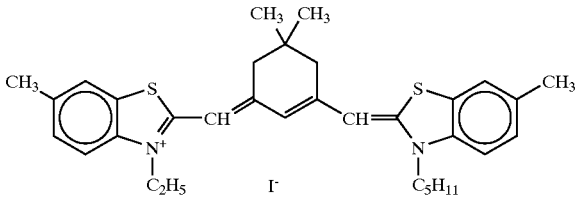

Sensitizing Dye H

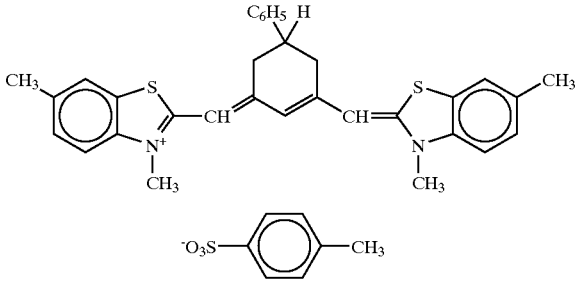

As to the grain sizes, the average edge length of the high-speed emulsion was 0.38 im and that of the low-speed emulsion was 0.32 μm. And the variation coefficient with respect to the edge length was 9% in the case of the high-speed emulsion, and it was 10% in the case of the low-speed emulsion.

Additionally, the amounts of sensitizing Dyes G and H added to the large-sized emulsion were each $8.0\times10^{-5}$ mole/mole Ag, and the amounts of spectral sensitizing Dyes G and H added to the small-sized emulsion were each $10.7\times10^{-5}$ mole/mole Ag.

Further, Compound I illustrated below was added to the red-sensitive emulsion in an amount of 3.0×10−3 mole per mole of silver halide.

(Compound I)

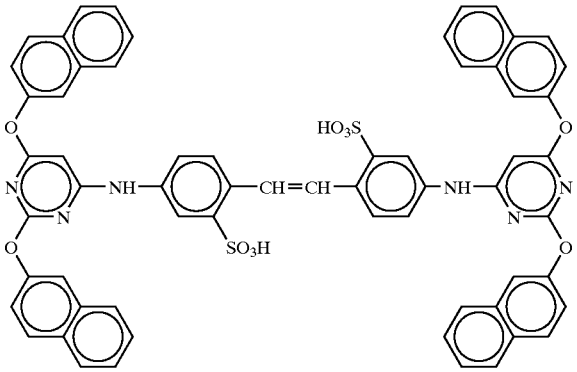

Preparation of Coating Solution for First Layer:

A yellow coupler (ExY-1) in the amount of 57 g, 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in a mixture of 21 g of a solvent (Solv-1) and 80 ml of ethyl acetate, and then dispersed in an emulsified condition into 220 g of a 23.5 weight % aqueous gelatin solution containing 4 g of sodium dodecylbenzenesulfonate by use of a high speed agitation emulsification apparatus (dissolver), and further thereto 900 g of water was added. Thus, emulsified Dispersion A was prepared.

The emulsified Dispersion A thus prepared was mixed homogeneously with the Emulsions A-1 and A-2, and thereto were added other ingredients described below so as to obtain the coating solution for the first layer having the following composition. The emulsion coverage is shown on a silver basis.

Coating solutions for the second to seventh layers were prepared respectively in the same manner as that for the first layer. In each layer, sodium 1-oxy-3,5-dichloro-s-triazine (H-1), Hardener (H-2) and Hardener (H-3) were used as gelatin hardener. In addition, Ab-1, Ab-2, Ab-3 and Ab-4 were added to all layers so that their total coverage values were 15.0 mg/m$^2$, 60.0 mg/m$^2$, 5.0 mg/m$^2$ and 10.0 mg/m$^2$, respectively.

(H-1) Hardener

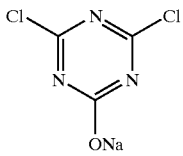

(used in a proportion of 1.4% by weight to gelatin)

(H-2) Hardener

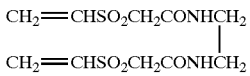

(H-3) Hardener

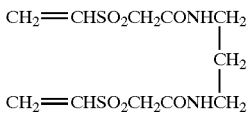

(Ab-1) Antiseptic

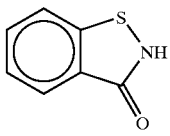

-continued (Ab-2) Antiseptic

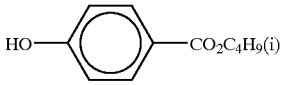

(Ab-3) Antiseptic

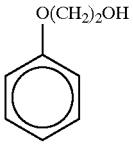

(Ab-4) Antiseptic

1:1:1:1 (by mole) Mixture of a, b, c and d

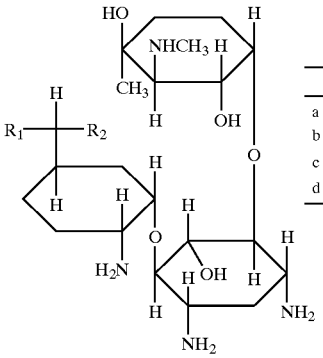

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Further, 1-(3-methylureidophenyl)-5-mercaptotetrazole was added to the second layer, the fourth layer, the sixth layer and the seventh layer so as to have coverage values of 0.2 mg/m$^2$, 0.2 mg/m$^2$, 0.6 mg/m$^2$ and 0.1 mg/m$^2$, respectively.

Furthermore, 4-hydroxy-6-methyl-1, 3, 3a, 7-tetraazaindene was added to the blue-sensitive emulsion layer and the green-sensitive emulsion layer in amounts of $1\times10^{-4}$ mole and $2\times10^{-4}$ mole, respectively, per mole of silver halide.

Moreover, methacrylicacid-butylacrylate (1:1 by weight) copolymer latex (average molecular weight: 200,000 to 400,000) was added to the red-sensitive emulsion layer so as to have coverage of 0.05 g/m$^2$.

In addition, disodiumcatechol-3,5-disulfonate was added to the second layer, the fourth layer and the sixth layer so as to have coverage values of 6 mg/m$^2$, 6 mg/m$^2$ and 18 mg/m$^2$, respectively.

For preventing irradiation, the following dyes were added (each figure in parentheses designates the coverage).

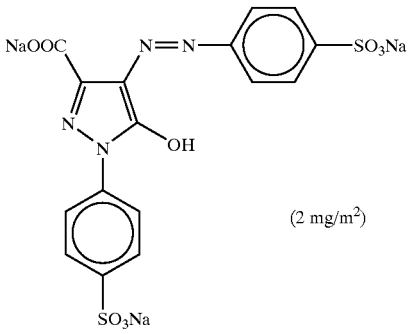

(2 mg/m$^2$)

-continued

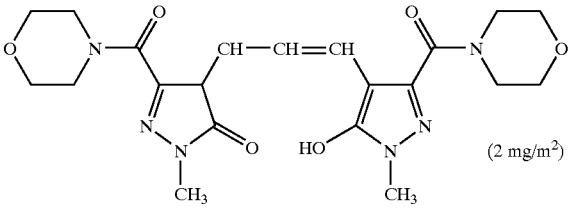

(2 mg/m$^2$)

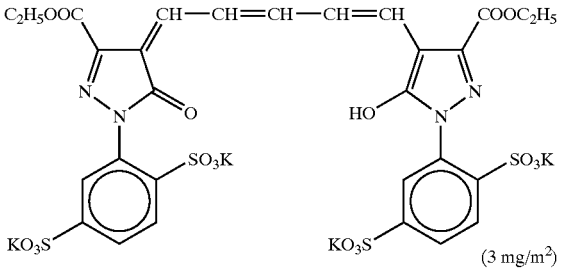

(3 mg/m$^2$)

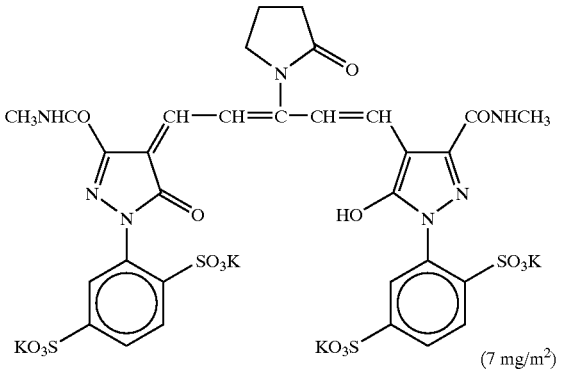

(7 mg/m$^2$)

(Layer Structure)

The composition of each constituent layer is described below. Each figure on the right side designates the coverage (g/m$^2$) of the ingredient corresponding thereto. As to the silver halide emulsion, the figure represents the coverage based on silver.

Support:

Polyethylene resin-laminated paper which contained white pigments ($TiO_2$: content 16 weight %, ZnO: content 4 weight %), a brightening agent (4,4'-bis(5-methylbenzoxazolyl)-stilbene: content 0.03 weight %) and a bluish dye (ultramarin: content 0.33 weight %) in the polyethylene resin on the side of the first layer, and has the polyethylene resin coverage of 29.2 g/m2.

First Layer (Blue-Sensitive Emulsion Layer):

| | |
|---|---|
| Silver chlorobromoiodide Emulsion A (containing gold-sulfur sensitized cubic grains and being a 3:7 (by mole on a silver basis) mixture of large-sized Emulsion A-1 and small-sized Emulsion A-2) | 0.24 |
| Gelatin | 1.25 |
| Yellow coupler (ExY-1) | 0.56 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |

Second Layer (Color Mixing Inhibiting Layer):

| | |
|---|---|
| Gelatin | 1.15 |
| Color mixing inhibitor (Cpd-4) | 0.10 |
| Color image stabilizer (Cpd-5) | 0.018 |
| Color image stabilizer (Cpd-6) | 0.13 |
| Color image stabilizer (Cpd-7) | 0.07 |
| Solvent (Solv-1) | 0.04 |
| Solvent (Solv-2) | 0.12 |
| Solvent (Solv-5) | 0.11 |

Third Layer (Green-Sensitive Emulsion Layer):

| | |
|---|---|
| Silver chlorobromoiodide Emulsion C (containing gold-sulfur sensitized cubic grains and being a 1:3 (by mole on a silver basis) mixture of large-sized Emulsion C-1 and small-sized Emulsion C-2) | 0.14 |
| Gelatin | 0.46 |
| Magenta coupler (ExM) | 0.15 |
| Ultraviolet absorbent (UV-A) | 0.14 |
| Color image stabilizer (Cpd-2) | 0.003 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.01 |
| Color image stabilizer (Cpd-10) | 0.01 |
| Color image stabilizer (Cpd-11) | 0.0001 |
| Solvent (Solv-3) | 0.09 |
| Solvent (Solv-4) | 0.18 |
| Solvent (Solv-5) | 0.27 |

Fourth Layer (Color Mixing Inhibiting Layer):

| | |
|---|---|
| Gelatin | 0.68 |
| Color mixing inhibitor (Cpd-4) | 0.06 |
| Color image stabilizer (Cpd-5) | 0.011 |
| Color image stabilizer (Cpd-6) | 0.08 |
| Color image stabilizer (Cpd-7) | 0.04 |
| Solvent (Solv-1) | 0.02 |
| Solvent (Solv-2) | 0.07 |
| Solvent (Solv-5) | 0.065 |

Fifth Layer (Red-Sensitive Emulsion Layer):

| | |
|---|---|
| Silver chlorobromoiodide Emulsion E (containing gold-sulfur sensitized cubic grains and being a 5:5 (by mole on a silver basis) mixture of large-sized Emulsion E-1 and small-sized Emulsion E-2) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color image stabilizer (Cpd-1) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.01 |
| Color image stabilizer (Cpd-17) | 0.01 |
| Color image stabilizer (Cpd-18) | 0.07 |
| Color image stabilizer (Cpd-20) | 0.01 |

-continued

| | |
|---|---|
| Ultraviolet absorbent (UV-7) | 0.01 |
| Solvent (Solv-5) | 0.15 |

Sixth Layer (Ultraviolet Absorbing Layer):

| | |
|---|---|
| Gelatin | 0.46 |
| Ultraviolet absorbent (UV-B) | 0.35 |
| Compound (S1-4) | 0.0015 |
| Solvent (Solv-7) | 0.18 |

Seventh Layer (Protective Layer):

| | |
|---|---|
| Gelatin | 1.00 |
| Acryl-modified polyvinyl alcohol (modification degree: 17%) | 0.4 |
| Liquid paraffin | 0.02 |
| Surfactant (Cpd-13) | 0.02 |

The structural formulae of the compounds used herein are illustrated below:

(ExY-1) Yellow coupler

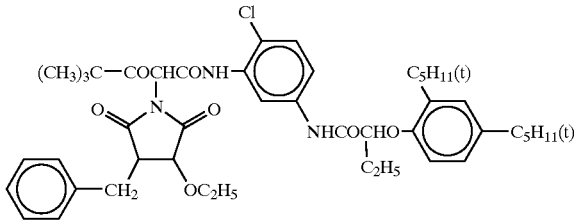

(ExM) Magenta coupler

40:40:20 (by mole) Mixture of (1), (2), and (3):

(1)

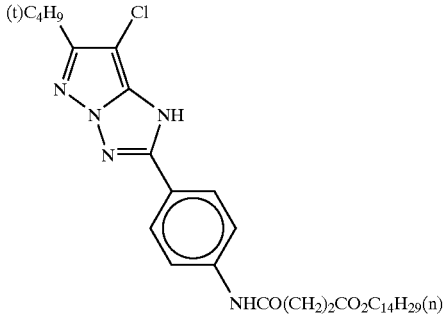

-continued
(2)
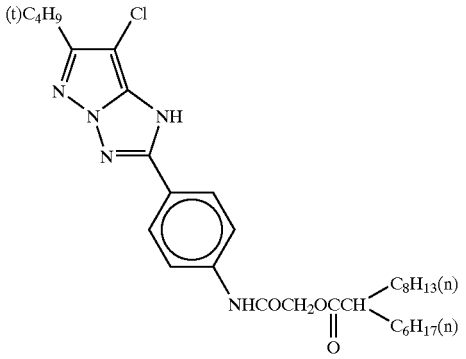
(3)
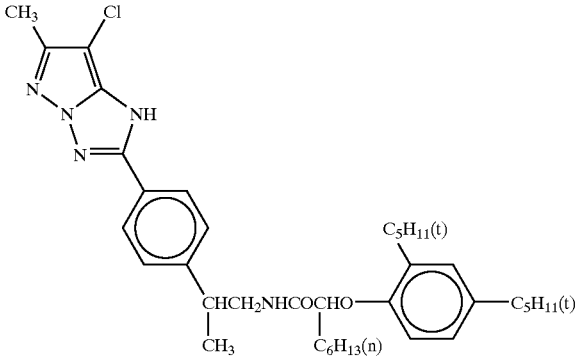
(ExC-1) Cyan coupler
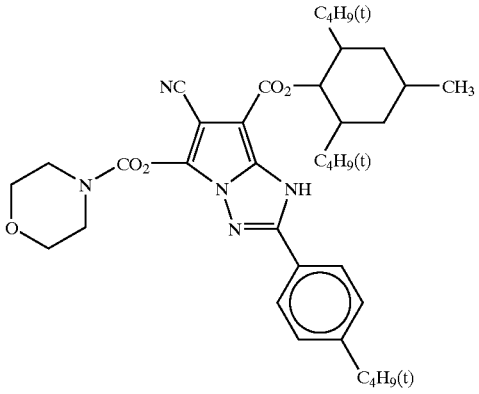
(ExC-2) Cyan coupler
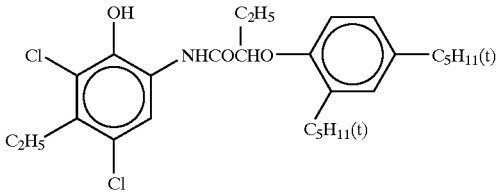
(ExC-3) Cyan coupler
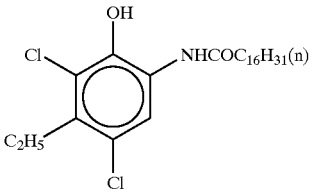
(ExC-4) Cyan coupler
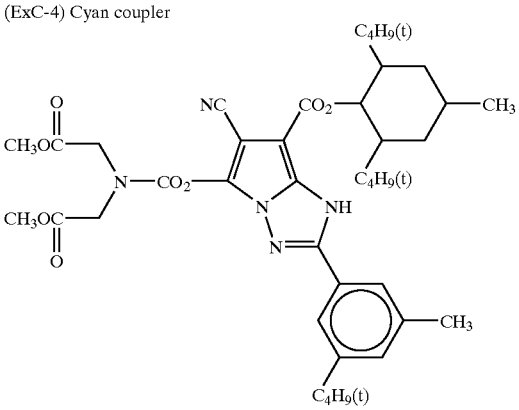
(ExC-5) Cyan coupler
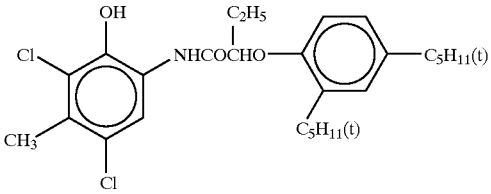
(Cpd-1) Color image stabilizer
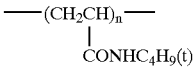
(Cpd-2) Color image stabilizer
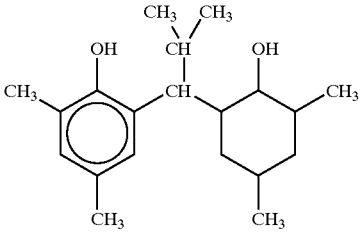

(Cpd-3) Color image stabilizer
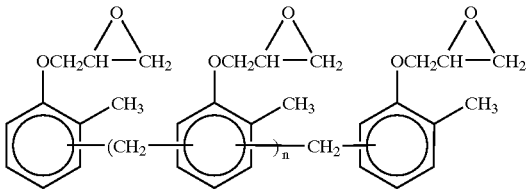
n = 7–8 (on average)
(Cpd-4) Color mixing inhibitor
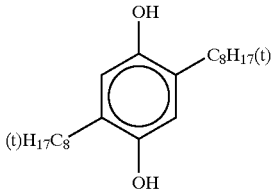
(Cpd-5) Color image stabilizer
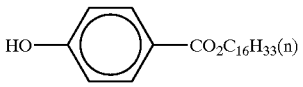
(Cpd-6) Color image stabilizer
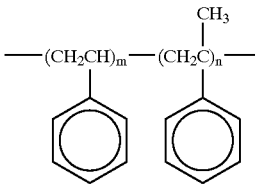
number average molecular weight: 600
m/n = 10/90
(Cpd-7) Color image stabilizer
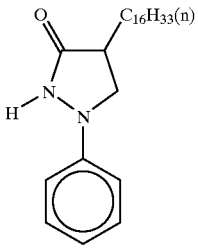
(Cpd-8) Color image stabilizer
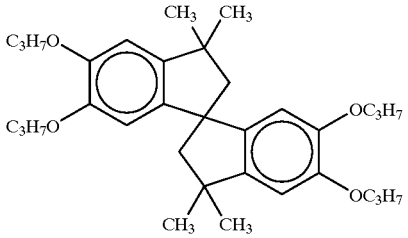
(Cpd-9) Color image stabilizer
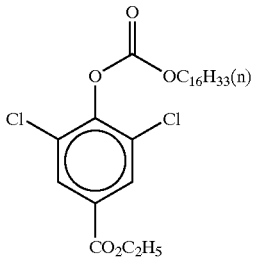
(Cpd-10) Color image stabilizer
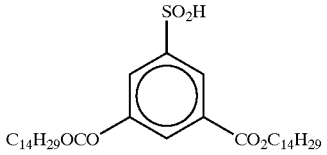
(Cpd-11)
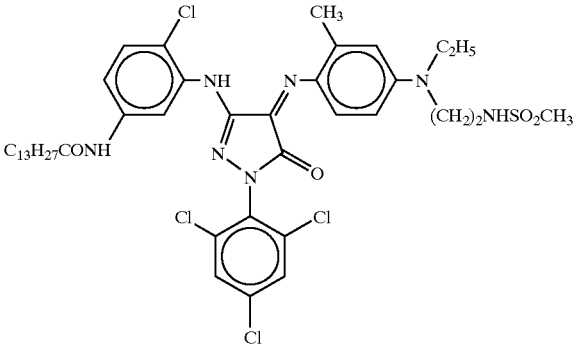
(Cpd-12)
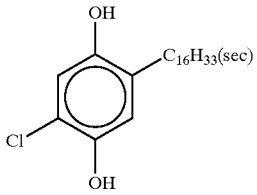

(Cmp-13)
7:3 (by mole) mixture of
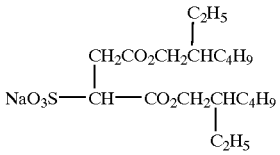
and
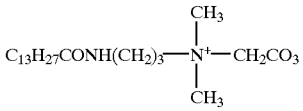
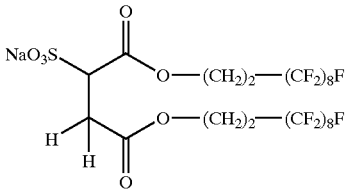
(Cpd-14)
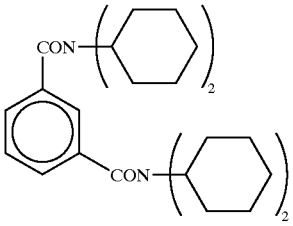
(Cpd-15)
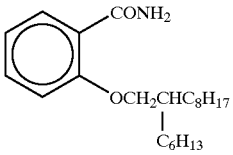
(Cpd-16)
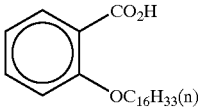
(Cpd-17)
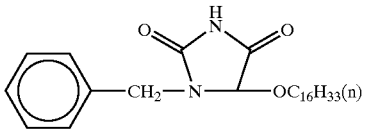
(Cpd-18)
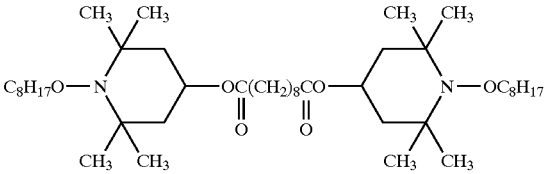
(Cpd-19) Color mixing inhibitor
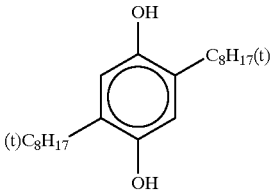
(Cpd-20)
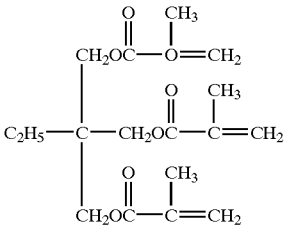
(Solv-1)
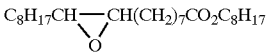
(Solv-2)
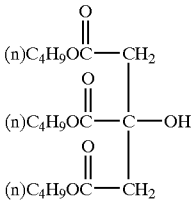
(Solv-3)
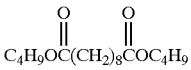
(Solv-4)
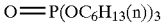

(Solv-5)
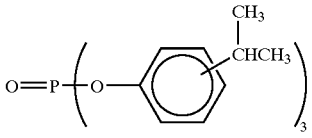
(Solv-7)
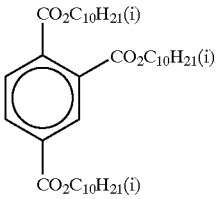
(Solv-8)
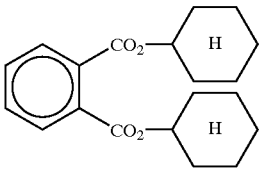
(Solv-9)
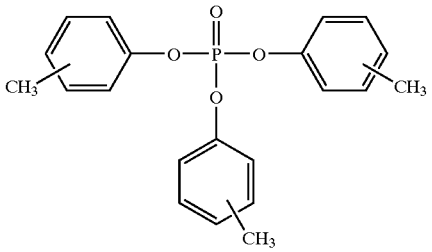
(S1-4)
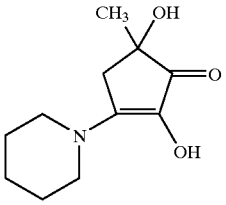
(UV-1) Ultraviolet absorbent
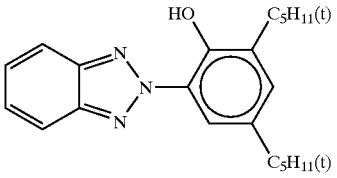
(UV-2) Ultraviolet absorbent
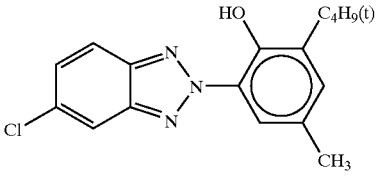
(UV-3) Ultraviolet absorbent
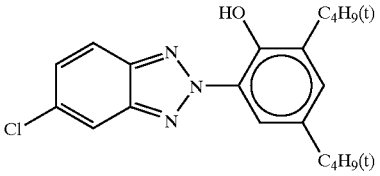
(UV-5) Ultraviolet absorbent
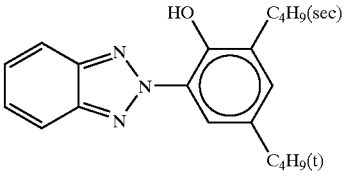
(UV-6) Ultraviolet absorbent
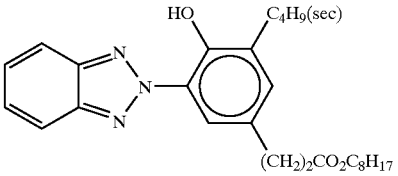
(UV-7) Ultraviolet absorbent
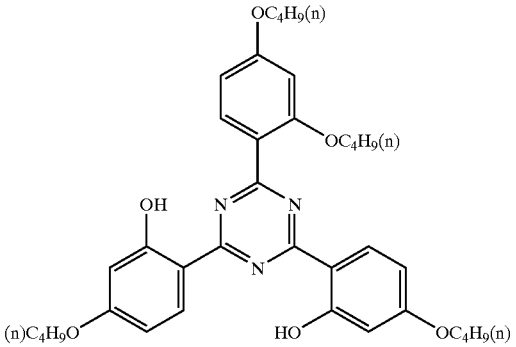
UV-A: 7:2:2 (by weight) mixture of UV-1, UV-2 and UV-3
UV-B: 13:3:3:5:3 (by weight) mixture of UV-1, UV-2, UV-3, UV-5 and UV-6
UV-C: 9:1 (by weight) mixture of UV-1 and UV-3

Sample Nos. 101 to 117 were prepared in the same manner as Sample No. 100, except that the layers' compositions were changed as shown below.

Sample No. 101

Sample No. 101 was prepared in the same manner as Sample No. 100, except that every constituent layer had the gelatin coverage reduced by 5%.

Sample No. 102

Sample No. 102 was prepared in the same manner as Sample No. 101, except that the composition of the third layer was changed to the composition (green-sensitive emulsion layer (2)) described below.

Third Layer (Green-Sensitive Emulsion Layer (2)):

| | |
|---|---|
| Silver chlorobromoiodide Emulsion C (containing gold-sulfur sensitized cubic grains and being a 1:3 (by mole on a silver basis) mixture of large-sized Emulsion C-1 and small-sized Emulsion C-2) | 0.12 |
| Gelatin | 0.46 |
| Magenta coupler (ExM) | 0.20 |
| Ultraviolet absorbent (UV-A) | 0.14 |
| Color image stabilizer (Cpd-2) | 0.003 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.01 |
| Color image stabilizer (Cpd-10) | 0.01 |
| Color image stabilizer (Cpd-11) | 0.0001 |
| Solvent (Solv-3) | 0.09 |
| Solvent (Solv-4) | 0.18 |
| Solvent (Solv-5) | 0.20 |

Sample No. 103

Sample No. 103 was prepared in the same manner as Sample No. 101, except that the composition of the third layer was changed to the composition (green-sensitive emulsion layer (3)) described below.

Third Layer (Green-Sensitive Emulsion Layer (2)):

| | |
|---|---|
| Silver chlorobromoiodide Emulsion C (containing gold-sulfur sensitized cubic grains and being a 1:3 (by mole on a silver basis) mixture of large-sized Emulsion C-1 and small-sized Emulsion C-2) | 0.10 |
| Gelatin | 0.44 |
| Magenta coupler (ExM) | 0.15 |
| Oleyl alcohol | 0.07 |
| Solvent (diundecyl phosphate) | 0.11 |
| Color image stabilizer (ST-21) | 0.04 |
| Color image stabilizer (ST-22) | 0.28 |
| Dye-2 | 0.007 |
| Surfactant (SF-1) | 0.023 |
| Sodium phenylmercaptotetrazole | 0.0007 |

Sample No. 104

Sample No. 104 was prepared in the same manner as Sample No. 101, except that the composition of the third layer was changed to the composition (green-sensitive emulsion layer (4)) described below.

Third Layer (Green-Sensitive Emulsion Layer (4)):

| | |
|---|---|
| Silver chlorobromoiodide Emulsion C (containing gold-sulfur sensitized cubic grains and being a 1:3 (by mole on a silver basis) mixture of large-sized Emulsion C-1 and small-sized Emulsion C-2) | 0.13 |
| Gelatin | 0.90 |
| Magenta coupler (ExM-1) | 0.27 |
| Solvent (dibutyl phosphate) | 0.08 |
| Solvent (diundecyl phosphate) | 0.11 |
| Color image stabilizer (ST-8) | 0.02 |
| Color image stabilizer (ST-21) | 0.17 |
| Color image stabilizer (ST-22) | 0.53 |
| Dye-2 | 0.007 |
| Surfactant (SF-1) | 0.023 |
| Sodium phenylmercaptotetrazole | 0.0007 |

Sample No. 105

Sample No. 105 was prepared in the same manner as Sample No. 101, except that the composition of the third layer was changed to the composition (green-sensitive emulsion layer (5)) described below.

Third Layer (Green-Sensitive Emulsion Layer (2)):

| | |
|---|---|
| Silver chlorobromoiodide Emulsion C (containing gold-sulfur sensitized cubic grains and being a 1:3 (by mole on a silver basis) mixture of large-sized Emulsion C-1 and small-sized Emulsion C-2) | 0.10 |
| Gelatin | 0.90 |
| Magenta coupler (ExM-2) | 0.21 |
| Oleyl alcohol | 0.22 |
| Solvent (diundecyl phosphate) | 0.11 |
| Color image stabilizer (ST-21) | 0.04 |
| Color image stabilizer (ST-22) | 0.28 |
| Dye-2 | 0.007 |
| Surfactant (SF-1) | 0.023 |
| Sodium phenylmercaptotetrazole | 0.0007 |

(ExM-1)

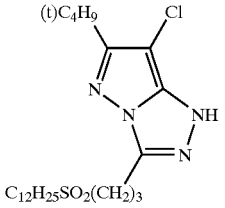

(ExM-2)

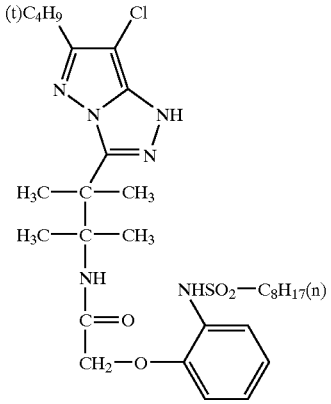

Sample No. 106

Sample No. 106 was prepared in the same manner as Sample No. 101, except that the composition of the fifth layer was changed to the composition (red-sensitive emulsion layer (6)) described below.

Fifth Layer (Red-Sensitive Emulsion Layer (6)):

| | |
|---|---|
| Silver chlorobromoiodide Emulsion E (containing gold-sulfur sensitized cubic grains and being a 5:5 (by mole on a silver basis) mixture of large-sized Emulsion E-1 and small-sized Emulsion E-2) | 0.16 |
| Gelatin | 1.05 |
| Cyan coupler (IC-23) | 0.28 |
| Ultraviolet absorbent (UV-1) | 0.36 |
| Dibutyl sebacate | 0.44 |
| Solvent (tris(2-ethylhexyl) phosphate) | 0.15 |
| Dye-3 | 0.02 |
| Sodium phenylmercaptotetrazole | 0.0005 |
| Surfactant (SF-1) | 0.05 |

Sample No. 107

Sample No. 107 was prepared in the same manner as Sample No. 106, except that the third layer was changed to the green-sensitive emulsion layer (5) mentioned above.

Sample No. 108

Sample No. 108 was prepared in the same manner as Sample No. 101, except that the composition of the fifth layer was changed to the composition (red-sensitive emulsion layer (8)) described below.

Fifth Layer (Red-Sensitive Emulsion Layer (8)):

| | |
|---|---|
| Silver chlorobromoiodide Emulsion E (containing gold-sulfur sensitized cubic grains and being a 5:5 (by mole on a silver basis) mixture of large-sized Emulsion E-1 and small-sized Emulsion E-2) | 0.22 |
| Gelatin | 1.05 |
| Cyan coupler (IC-23) | 0.23 |
| Ultraviolet absorbent (UV-1) | 0.36 |
| Dibutyl sebacate | 0.44 |
| Solvent (tris(2-ethylhexyl) phosphate) | 0.15 |
| Dye-3 | 0.02 |
| Sodium phenylmercaptotetrazole | 0.0005 |
| Surfactant (SF-1) | 0.05 |

Sample No. 109

Sample No. 109 was prepared in the same manner as Sample No. 101, except that the third layer was changed to the green-sensitive emulsion layer (5) and the fifth layer was changed to the red-sensitive emulsion layer (8).

Sample No. 110

Sample No. 110 was prepared in the same manner as Sample No. 101, except that the third layer was changed to the green-sensitive emulsion layer (3) and the fifth layer was changed to the red-sensitive emulsion layer (8).

Sample No. 111

Sample No. 111 was prepared in the same manner as Sample No. 101, except that the composition of the fifth layer was changed to the composition (red-sensitive emulsion layer (11)) described below.

Fifth Layer (Red-Sensitive Emulsion Layer (11)):

| | |
|---|---|
| Silver chlorobromoiodide Emulsion E (containing gold-sulfur sensitized cubic grains and being a 5:5 (by mole on a silver basis) mixture of large-sized Emulsion E-1 and small-sized Emulsion E-2) | 0.16 |
| Gelatin | 1.05 |
| Cyan coupler (ExC-1) | 0.023 |
| Cyan coupler (ExC-2) | 0.05 |
| Cyan coupler (ExC-3) | 0.17 |
| Ultraviolet absorbent (UV-A) | 0.055 |
| Color image stabilizer (Cpd-1) | 0.22 |
| Color image stabilizer (Cpd-7) | 0.003 |
| Color image stabilizer (Cpd-9) | 0.01 |
| Color image stabilizer (Cpd-12) | 0.01 |
| Solvent (Solv-8) | 0.05 |

Sample No. 112

Sample No. 112 was prepared in the same manner as Sample No. 101, except that the composition of the fifth layer was changed to the composition (red-sensitive emulsion layer (12)) described below.

Fifth Layer (Red-Sensitive Emulsion Layer (12)):

| | |
|---|---|
| Silver chlorobromoiodide Emulsion E (containing gold-sulfur sensitized cubic grains and being a 5:5 (by mole on a silver basis) mixture of large-sized Emulsion E-1 and small-sized Emulsion E-2) | 0.20 |
| Gelatin | 1.05 |
| Cyan coupler (ExC-1) | 0.020 |
| Cyan coupler (ExC-2) | 0.045 |
| Cyan coupler (ExC-3) | 0.15 |
| Ultraviolet absorbent (UV-A) | 0.055 |
| Color image stabilizer (Cpd-1) | 0.22 |
| Color image stabilizer (Cpd-7) | 0.003 |
| Color image stabilizer (Cpd-9) | 0.01 |
| Color image stabilizer (Cpd-12) | 0.01 |
| Solvent (Solv-8) | 0.05 |

Sample No. 113

Sample No. 113 was prepared in the same manner as Sample No. 101, except that the composition of the first layer was changed to the composition (blue-sensitive emulsion layer (13)) described below.

First Layer (Blue-Sensitive Emulsion Layer (13)):

| | |
|---|---|
| Silver chloride Emulsion B (containing gold-sulfur sensitized cubic grains and being a 3:7 (by mole on a silver basis) mixture of large-sized Emulsion B-L and small-sized Emulsion B-S) | 0.21 |
| Gelatin | 1.10 |
| Yellow coupler (ExY-1) | 0.72 |
| Color image stabilizer (Cpd-2) | 0.03 |
| Color image stabilizer (Cpd-8) | 0.04 |
| Color image stabilizer (Cpd-20) | 0.10 |
| Solvent (Solv-1) | 0.21 |

Sample No. 114

Sample No. 114 was prepared in the same manner as Sample No. 101, except that the composition of the first layer was changed to the composition (blue-sensitive emulsion layer (14)) described below.

First Layer (Blue-Sensitive Emulsion Layer (14)):

| | |
|---|---|
| Silver chlorobromoiodide Emulsion A (containing gold-sulfur sensitized cubic grains and being a 3:7 (by mole on a silver basis) mixture of large-sized Emulsion A-1 and small-sized Emulsion A-2) | 0.16 |
| Gelatin | 1.25 |
| Yellow coupler (ExY-2) | 0.41 |
| Color image stabilizer (Cpd-2) | 0.07 |
| Color image stabilizer (Cpd-8) | 0.07 |
| Color image stabilizer (Cpd-20) | 0.05 |
| Solvent (Solv-9) | 0.40 |

Sample No. 115

Sample No. 115 was prepared in the same manner as Sample No. 114, except that the fifth layer was changed to the red-sensitive emulsion layer (6).

Sample No. 116

Sample No. 116 was prepared in the same manner as Sample No. 102, except that the first layer was changed to the blue-sensitive emulsion layer (14).

Sample No. 117

Sample No. 117 was prepared in the same manner as Sample No. 111, except that the composition of the third layer was changed to the composition (green-sensitive emulsion layer (17)) described below.

Third Layer (Green-Sensitive Emulsion Layer (17)):

| | |
|---|---|
| Silver chlorobromoiodide Emulsion C (containing gold-sulfur sensitized cubic grains and being a 1:3 (by mole on a silver basis) mixture of large-sized Emulsion C-1 and small-sized Emulsion C-2) | 0.18 |
| Gelatin | 0.46 |
| Magenta coupler (ExM) | 0.18 |
| Ultraviolet absorbent (UV-A) | 0.14 |
| Color image stabilizer (Cpd-2) | 0.003 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.01 |
| Color image stabilizer (Cpd-10) | 0.01 |
| Color image stabilizer (Cpd-11) | 0.0001 |
| Solvent (Solv-3) | 0.09 |
| Solvent (Solv-4) | 0.18 |
| Solvent (Solv-5) | 0.20 |

(ExY-1)

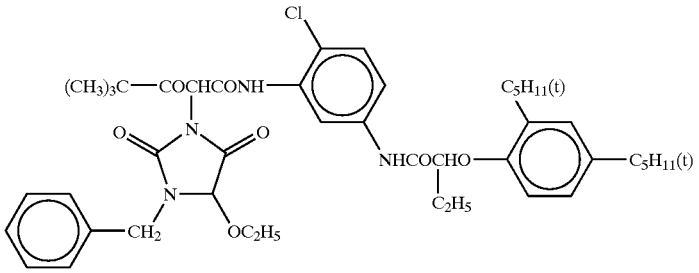

(ExY-2)

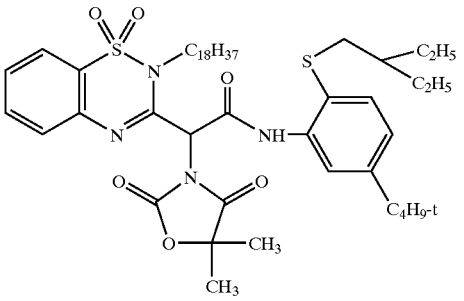

-continued
(SF-1)
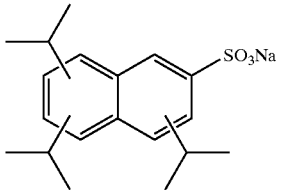
(ST-8)
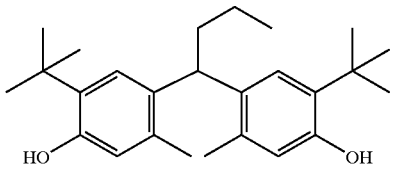
(ST-21)
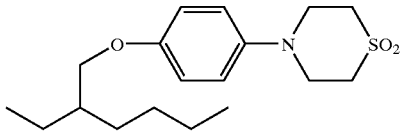
Dye-2
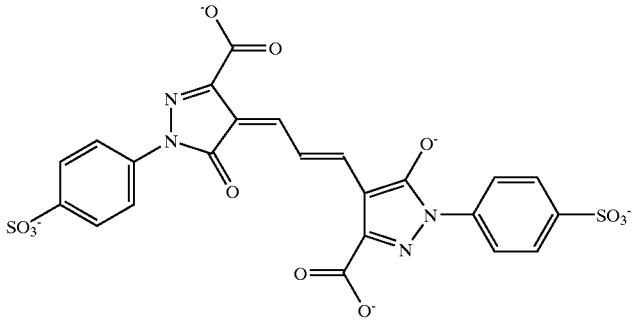
Dye-3
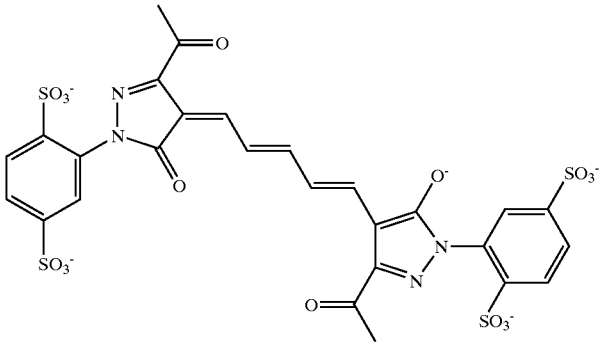

With respect to each sample, silver coverage and silver/coupler ratio (by mol/mol) of each color-sensitive layer, and the total gelatin coverage are set forth in Table 2.

TABLE 2

| Sample No. | Silver coverage (mmol/m$^2$) Blue-sensitive emulsion layer | Green-sensitive emulsion layer | Red-sensitive emulsion layer | All told | Silver/Coupler ratio (mol/mol) Blue-sensitive emulsion layer | Green-sensitive emulsion layer | Red-sensitive emulsion layer | Total gelatin coverage (g/m$^2$) |
|---|---|---|---|---|---|---|---|---|
| 100 | 2.12 | 1.30 | 0.93 | 4.35 | 3.05 | 5.04 | 4.08 | 6.11 |
| 101 | 2.12 | 1.30 | 0.93 | 4.35 | 3.05 | 5.04 | 4.08 | 5.80 |
| 102 | 2.12 | 1.10 | 0.93 | 4.15 | 3.05 | 3.24 | 4.08 | 5.80 |
| 103 | 2.12 | 0.93 | 0.93 | 3.98 | 3.05 | 3.60 | 4.08 | 5.80 |
| 104 | 2.12 | 1.20 | 0.93 | 4.25 | 3.05 | 2.10 | 4.08 | 6.26 |
| 105 | 2.12 | 0.93 | 0.93 | 3.98 | 3.05 | 2.75 | 4.08 | 6.26 |
| 106 | 2.12 | 1.30 | 1.48 | 4.90 | 3.05 | 5.04 | 3.83 | 5.80 |
| 107 | 2.12 | 0.93 | 1.48 | 4.53 | 3.05 | 2.75 | 3.83 | 6.26 |
| 108 | 2.12 | 1.30 | 2.04 | 5.46 | 3.05 | 5.04 | 6.41 | 5.80 |
| 109 | 2.12 | 0.93 | 2.04 | 5.09 | 3.05 | 2.75 | 6.41 | 6.26 |
| 110 | 2.12 | 0.93 | 2.04 | 5.09 | 3.05 | 3.60 | 6.41 | 5.80 |
| 111 | 2.12 | 1.10 | 1.48 | 4.90 | 3.05 | 5.04 | 2.87 | 5.80 |
| 112 | 2.12 | 1.30 | 1.85 | 5.27 | 3.05 | 5.04 | 4.00 | 5.80 |
| 113 | 1.90 | 1.30 | 0.93 | 4.13 | 3.19 | 3.24 | 4.08 | 5.80 |
| 114 | 1.48 | 1.30 | 0.93 | 3.71 | 3.19 | 3.24 | 4.08 | 5.80 |
| 115 | 1.48 | 1.30 | 1.48 | 4.26 | 3.19 | 3.24 | 3.83 | 5.80 |
| 116 | 1.48 | 1.10 | 0.98 | 4.06 | 3.19 | 3.24 | 4.08 | 5.80 |
| 117 | 2.12 | 1.67 | 1.48 | 5.27 | 3.05 | 5.40 | 2.87 | 5.80 |

Measurement of Coupler Utilization Rate

Each photosensitive material was prepared by coating on the support the coating solutions for photographic constituent layers, stored for 10 days under the condition of 25° C.–55% RH, and then cut into sheets. Each sheet underwent the following examination as it was transported, and thereby its coupler utilization rate was determined.

Standard gray output calibration was performed on each photographic printing paper sample by use of a photographic processing system including Frontier 370 and CP-48S Chemical made by Fuji Photo Film co., Ltd. To the portion of the gray step densities thus obtained the Status-A density was 2.0±0.05, a dimethylformamide-water (85/15 by volume) mixture was added in an amount of 3 ml per cm$^2$, and thereby dyes were extracted. The colors of the dyes extracted were examined by quantitative analysis using high-speed liquid chromatography, and thereby the dye contents (mole/m$^2$) My, Mm and Mc were determined. In the same manner as the above, couplers were extracted from the photographic printing paper sample before photographic processing. Thereby, the coupler coverage values (mole/m$^2$) My, Mm and Nc were determined. The coupler utilization rates of each sample (Qy, Qm and Qc, which stand for utilization rates of yellow coupler, magenta coupler and cyan coupler, respectively) were calculated from Qy=My/Ny, Qm=Mm/Nm and Qc=Mc/Nc, respectively. The values calculated for each of the present samples are shown in Table 3.

TABLE 3

| Sample No. | Coupler Utilization rate Qy | Qm | Qc | Evaluation of unevenness in images 0.5R | 1R | 2R |
|---|---|---|---|---|---|---|
| 100 | 0.72 | 0.74 | 0.77 | excellent | excellent | excellent |
| 101 | 0.72 | 0.74 | 0.77 | excellent | excellent | excellent |

TABLE 3-continued

| Sample No. | Coupler Utilization rate Qy | Qm | Qc | Evaluation of unevenness in images 0.5R | 1R | 2R |
|---|---|---|---|---|---|---|
| 102 | 0.72 | 0.72 | 0.76 | excellent | excellent | excellent |
| 103 | 0.71 | 0.73 | 0.75 | excellent | excellent | excellent |
| 104 | 0.73 | 0.56 | 0.76 | good | good | good |
| 105 | 0.72 | 0.53 | 0.75 | excellent | good | good |
| 106 | 0.72 | 0.74 | 0.81 | excellent | excellent | excellent |
| 107 | 0.70 | 0.53 | 0.80 | good | good | fair |
| 108 | 0.73 | 0.73 | 0.84 | excellent | excellent | good |
| 109 | 0.72 | 0.52 | 0.85 | good | good | fair |
| 110 | 0.72 | 0.73 | 0.83 | excellent | good | good |
| 111 | 0.71 | 0.71 | 0.71 | good | good | good |
| 112 | 0.74 | 0.73 | 0.72 | excellent | good | fair |
| 113 | 0.71 | 0.73 | 0.77 | excellent | good | good |
| 114 | 0.77 | 0.73 | 0.78 | excellent | excellent | excellent |
| 115 | 0.76 | 0.73 | 0.81 | excellent | excellent | good |
| 116 | 0.76 | 0.72 | 0.76 | excellent | excellent | good |
| 117 | 0.80 | 0.79 | 0.71 | good | good | fair |

Each sample was subjected to running processing in accordance with the following photographic processing method.

Photographic Processing

Continuous processing was performed using the following processing compositions and a minilabo printer processor, Frontier 330, made by Fuji Photo Film Co., Ltd. in the following processing process until the replenisher volume reached three times the liquid volume in the color developing tank. Additionally, the transport speed of Frontier 330 was increased to 27.9 mm/sec, and the processing racks in the color development and bleach-fix processing tanks were modified. Further, the rinse processing tank and the processing rack were adapted for the blade transport system disclosed in JP-A-2002-55422, the direction of liquid circulation was changed to the downward direction (following the form described in Japanese Patent Application No. 2001-147814), and a circulation filter with pleats was installed at the tank bottom.

Processing Conditions

| Processing Step | Temperature | Time | Replenishment rate |
|---|---|---|---|
| Color development | 45.0° C. | 25 sec | 45 ml/m$^2$ |
| Bleach-fix | 40.0° C. | 25 sec | Replenisher A 17.5 ml/m$^2$ Replenisher B 17.5 ml/m$^2$ |
| Rinse (1) | 40.0° C. | 7 sec | — |
| Rinse (2) | 40.0° C. | 4 sec | — |
| Rinse (3) | 40.0° C. | 4 sec | — |
| Rinse (4) | 40.0° C. | 7 sec | 175 ml/m$^2$ |
| Drying | 80.0° C. | 20 sec | |

Color Developer

| | Tank Solution | Replenisher |
|---|---|---|
| Cation-exchanged water | 800 ml | 800 ml |
| Dimethylpolysiloxane surfactant (Silicone KF351A, produced by Shin-Etsu Chemical Co., Ltd.) | 0.05 g | 0.05 g |
| Potassium hydroxide | 4.0 g | 9.0 g |
| Sodium hydroxide | 2.0 g | 6.0 g |
| Ethylenediaminetetraacetic acid | 4.0 g | 4.0 g |
| Tylon | 0.5 g | 0.5 g |
| Potassium chloride | 19.0 g | — |
| Sodium bromide | 0.036 g | — |
| P-1 (illustrated below) | 1.5 g | 2.9 g |
| S-1 (illustrated below) | 3.5 g | 9.0 g |
| Sodium p-toluenesulfonate | 15.0 g | 15.0 g |
| Sodium sulfite | 0.2 g | 0.2 g |

-continued

| | Tank Solution | Replenisher |
|---|---|---|
| m-Carboxybenzenesulfinic acid | 2.0 g | 3.6 g |
| Disodium N,N-bis(sulfonatoethyl)-hydroxylamine | 5.0 g | 10.8 g |
| N-Ethyl-N-(β-methanesulfonamido-ethyl)-3-methyl-4-aminoaniline 3/2 sulfate monohydrate | 6.7 g | 17.3 g |
| Potassium carbonate | 26.3 g | 26.3 g |
| Water to make | 1,000 ml | 1,000 ml |
| pH (at 25° C., adjusted with potassium hydroxide and sulfuric acid) | 10.12 | 10.26 |

Bleach-Fix Bath

| | Tank solution | Replenisher A | Replenisher B |
|---|---|---|---|
| Water | 650 ml | 300 ml | 300 ml |
| Ammonium thiosulfate (750 g/l) | 97.0 ml | — | 376.0 ml |
| Ammonium bisulfite soln. (65%) | 13.0 g | — | 185.5 ml |
| Ammonium sulfite | 21.0 g | — | — |
| Ammonium ethylenediamine-tetraacetatoferrate (III) | 37.0 g | 184.0 g | — |
| Ethylenediaminetetraacetic acid | 1.6 g | 0.4 g | 10.0 g |
| m-Carboxybenzenesulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Aqueous ammonia (27%) | 3.4 g | — | 36.0 g |
| Water to make | 1,000 ml | 1,000 ml | 1,000 ml |
| pH (at 25° C., adjusted with aqueous ammonia and nitric acid) | 5.9 | 2.5 | 5.75 |

Rinsing Bath (Tank solution=Replenisher)

| | |
|---|---|
| Sodium chloroisocyanurate | 0.02 g |
| Deionized water (conductivity: 5 μs/cm or below) | 1,000 ml |

P-1

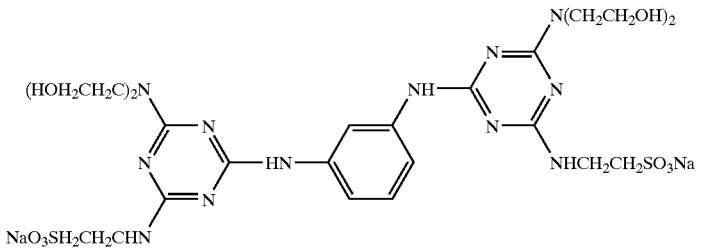

S-1

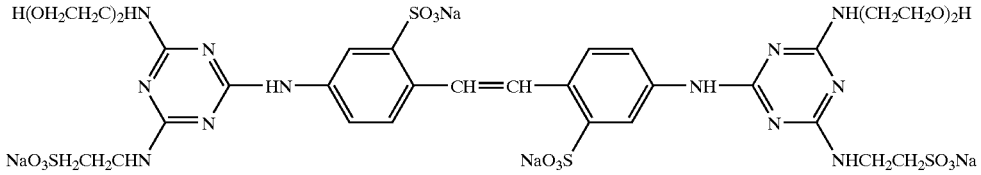

(Results)

Evaluation Method

Evaluation of image unevenness resulting from the photographic processing mentioned above was performed on each of the samples processed under the following conditions. Specifically, 20 sheets of each sample for evaluation, which had underwent gray exposure so as to impart a uniform gray density of 0.7 to 0.8 to images, were processed at the time of each of 0.5 round, 1.0 round and 2.0 round in the course of running processing (the term "one round" used herein means the time when the volume of replenisher used for color development reached the same as the tank volume in the process of performing continuous processing. The gray images obtained at every round were evaluated by visual observation in accordance with the criterion described below:

Excellent: The gray images are uniform on the whole and almost free of unevenness, or the proportion of sample sheets having perceivable image unevenness is lower than 10%

Good: The proportion of sample sheets having perceivable unevenness in the images is of the order of 10%, but the unevenness is not on the level affecting the quality of finished print Fair: Image unevenness is found among about 10% of the sample sheets processed. (acceptable level)

Bad: Image unevenness is found among higher than 10% of the sample sheets processed.

Evaluation Results

The results obtained are already shown in Table 3. As can be seen from Table 3, all the samples according to the invention, Sample Nos. 100 to 117, developed no appreciable image unevenness but provided prints of consistent quality in the continuous processing using the present high-speed transport processing system. Of these samples, Sample Nos. 100, 101, 102, 106 and 114 were each inhibited effectively from developing image unevenness throughout the continuous processing and achieved especially excellent results. And Sample Nos. 105, 108, 110, 115 and 116 attained results equivalent to those of the most excellent sample group in the initial stage of the continuous processing, and they were somewhat inferior to the foregoing sample group in suffering a little increase in image unevenness during the continuous processing but still had excellent results. On the other hand, Samples 104, 107, 109, 111, 112 and 117 were usable, but less effective than the foregoing two groups.

These results, as can be seen from Table 3, indicate that the samples having their individual coupler utilization rates Qy, Qm and Qc in the range defined by the invention and being comparatively even in these values enabled effective prevention of image unevenness. The method of controlling coupler utilization rates so as to fall within the desirable range is not restrictive, but it can be concluded that, in the most excellent sample group of this Example, all the designing factors of each sample, including silver coverage, silver/coupler ratios, total gelatin coverage and selection from specific cyan couplers (couplers represented by formulae (PTA-I), (PTA-II) and (IA)), were set within the ranges preferred respectively in the invention and, as the result, all the coupler utilization rates fell within the ranges specified by the invention. Further, it can also be found that, in the cases where the samples had some factors outside the ranges preferred in the invention, there was a tendency that the image unevenness prevention effect was decreased with increase in number of factors outside the present ranges and extent of depature from the present ranges.

Further, the other photographic processing according to the following process was performed using Samples Nos. 100 to 117. The sample sheets processed at the time of 0.5 round and those processed at the time of 1.0 round were evaluated by the same method as mentioned above.

Photographic Processing

| Processing Step | Temperature | Time | Replenishment rate |
|---|---|---|---|
| Color development | 45.0° C. | 25 sec | 45 ml/m$^2$ |
| Bleach-fix | 40.0° C. | 16 sec | Replenisher A 17.5 ml/m$^2$ Replenisher B 17.5 ml/m$^2$ |
| Rinse (1) | 40.0° C. | 5 sec | — |
| Rinse (2) | 40.0° C. | 3 sec | — |
| Rinse (3) | 40.0° C. | 3 sec | — |
| Rinse (4) | 40.0° C. | 5 sec | 175 ml/m$^2$ |
| Drying | 80.0° C. | 16 sec | |

Examination Result

Although this processing was increased in rapidity, compared with the former high-temperature rapid processing, it was found that all the sample sheets processed throughout one-round period of continuous processing were free of image unevenness or on an acceptable level with respect to image unevenness, and besides, they did not suffer poor color formation and provided color print of excellent image quality.

The present color photographic material characterized by having coupler utilization rates in the ranges $1>Qy>0.7$, $1>Qm\geqq0.5$ and $1>Qc>0.7$, and the present image formation method including cutting the present color photographic material into sheets, transporting these sheets at a speed of from 27.8 mm/sec to 100 mm/sec and subjecting them to imagewise exposure and then to photographic processing having a color developing step, a bleach-fix step and a rinsing step can provide color prints of excellent image quality without undergoing adverse effects, such as uneven development, poor color formation and deterioration of image quality, even in the case of sheet-form transport, high illumination intensity scanning irradiation with laser beams and rapid processing.

EXAMPLE 2

1. Preparation of Photosensitive Material Samples (Making of Blue-sensitive Emulsion A)

In a reaction vessel, 1.06 liter of deionized distilled water containing 5.7 weight % of demineralized gelatin was placed, and thereto were added 46.3 ml of a 10% NaCl solution, then 46.4% of 1N $H_2SO_4$ and further 0.012 g of Compound (X). Then the temperature of the solution in the reaction vessel was adjusted to 60° C. Immediately thereafter, 0.1 mole of silver nitrate and 0.1 mole of NaCl were added to the solution over a period of 10 minutes while stirring the solution at a high speed. Then, 1.5 moles of silver nitrate and a NaCl solution were further added over a period of 60 minutes in accordance with a flow rate acceleration method wherein the final addition speed reached four times the initial addition speed. Furthermore, 0.2 mole % of silver halide and a NaCl solution were added at a constant speed over a period of 6 minutes. In the NaCl solution added herein, $K_3IrCl_5(H_2O)$ was contained in an amount of $5\times10^{-7}$ mole per total amount of silver. Thus, the grains formed were doped with the aquo iridium complex salt.

Further, 0.2 mole of silver halide, 0.18 mole of NaCl and 0.02 mole of KBr solutions were added over a 6-minute period. Herein, $K_4Ru(CN)_6$ and $K_4Fe(CN)_6$ were each dissolved in the halogen solutions in an amount corresponding to $0.5\times10^{-5}$ mole per total amount of silver, and added to silver halide grains.

In addition, during the grain growth in the final stage, an aqueous KI solution in an amount corresponding to 0.001 mole per total amount of silver was added to the reaction vessel over a period of 1 minute. As to the timing of the addition, the addition was started at a time when 93% of the whole grain formation process finished.

Thereafter, Compound (Y) as a settling agent was added at 40° C., and the resulting emulsion was adjusted so as to have its pH in the vicinity of 3.5, desalted, and washed.

Compound (X)

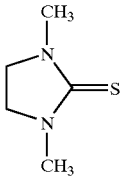

Compound (Y)

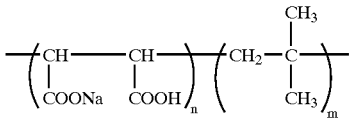

n, m = integer

To the desalted and washed emulsion, demineralized gelatin, an NaCl solution and an aqueous NaOH solution were added, and the resulting admixture was warmed up to 50° C., and adjusted to pAg 7.6 and pH 5.6.

Thus, a gelatin containing silver halide cubic grains was obtained. The composition of these grains was made up of 98.9 mole % of silver chloride, 1 mole % of silver bromide and 0.1 mole % of silver iodide, and the average edge length of these grains was 0.70 μm and the variation coefficient with respect to the edge length was 8%.

The emulsion grains were kept at 60° C., and thereto Spectral Sensitizing Dyes 1 and 2 were added in amounts of $2.5\times10^{-4}$ mole/mole Ag and $2.0\times10^{-4}$ mole/mole Ag, respectively. Further, the resulting emulsion grains were admixed with successive $1\times10^{-5}$ mole/mole Ag of thiosulfonic acid Compound 1 and a fine grain emulsion having an average grain size of 0.05 μm, containing 90 mole % of silver bromide and 10 mole % of silver chloride and being doped with iridium hexachloride, and then ripened for 10 minutes. Furthermore, the emulsion grains were admixed with a fine grain emulsion having an average grain size of 0.05 μm and containing 40 mole % silver bromide and 60 mole % silver chloride and ripened for 10 minutes. The fine grains added were dissolved, and the silver bromide content in the host cubic grains was increased to 1.3 moles. Additionally, the amount of iridium hexachloride with which the host cubic grains were doped was $1\times10^{-7}$ mole/mole Ag.

Successively, $1\times10^{-5}$ mole/mole Ag of sodium thiosulfate and $2\times10^{-5}$ mole/mole Ag of Gold Sensitizer 1 were added. Immediately thereafter, the temperature was raised to 60° C. and the ripening was continued for additional 40 minutes, and then the temperature was lowered to 50° C. Just after lowering the temperature, Mercapto Compounds 1 and 2 were each added so as to have a content of $6\times10^{-4}$ mole per mole Ag. After 10 minutes' ripening, an aqueous KBr solution was added in an amount of 0.008 mole per silver and ripening was continued for additional 10 minutes. Then, the emulsion thus ripened was cooled, and stored.

Thus, a high-speed Emulsion A-1 was prepared.

Under the same conditions as the above except the temperature during the grain formation, cubic emulsion grains having an average edge length of 0.55 μm and a variation coefficient of 9% with respect to the edge length were formed. The temperature during the grain formation was 55° C.

The grains thus formed were subjected to spectral sensitization and chemical sensitization under the same conditions as mentioned above, except that the corrections for specific surface area (edge length ratio=0.7/0.55=1.27) were made respectively on the amounts of the sensitizers used. In this manner, a low-speed Emulsion A-2 was prepared.

Spectral Sensitizing Dye 1

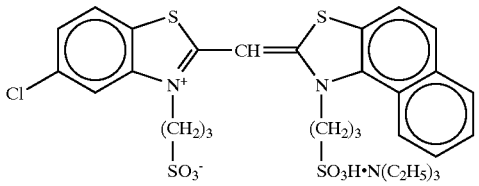

Spectral Sensitizing Dye 2

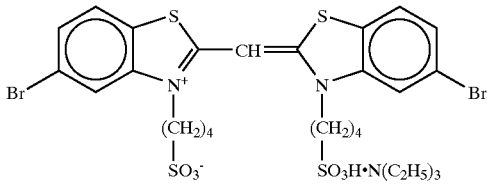

Thiosulfonic Acid Compund 1

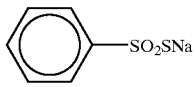

Mercapto Compound 1

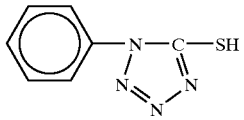

Mercapto Compound 2

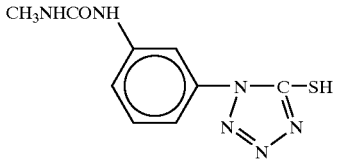

Gold Sensitizer 1

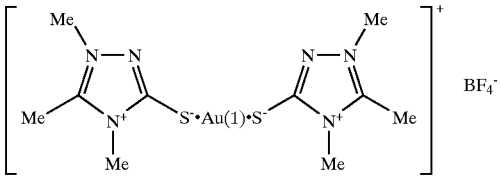

(Making of Blue-Sensitive Emulsion B)

Of the conditions for making the Emulsion A-1, the temperature at the time of grain formation was raised to 68° C., and thereby the emulsion grains having an average edge length of 0.85 μm was formed. The variation coefficient with respect to the edge length was 12%. In addition, chloride ion instead of iodide ion was introduced in the final stage of grain formation. Thus, the halide composition at the conclusion of grain formation was 99 mole % chloride and 1 mole % bromide. The amounts of Spectral Sensitizing Dyes 1 and 2 added were 1.25 times as large as in making the Emulsion A-1, and the amount of thiosulfonic acid Compound 1 used was the same as in making the Emulsion A-1.

To chemical sensitization, the following modifications were made.

Fine grain emulsions having an average grain size of 0.05 μm, containing 90 mole % silver bromide and 10 mole % silver chloride and being doped with iridium hexachloride were added, and ripening was carried out for 10 minutes. Further, fine grains having an average grain size of 0.05 μm and containing 40 mole % silver chloride and 60 mole % silver chloride were added and ripening was carried out for 10 minutes. As a result, the fine grains dissolved, and the bromide content in the host cubic grains was increased to 2.0 mole %. Additionally, the host grains were doped with $2\times10^{-7}$ mole/mole Ag of iridium hexachloride.

Subsequently thereto, sodium thiosulfate was added in an amount of $1\times10^{-5}$ mole/mole Ag. Immediately thereafter, the temperature was raised to 55° C., and ripening was continued for additional 70 minutes. Then, the temperature was lowered to 50° C. Therein, no gold sensitizer was added. Just after the drop in temperature, the mercapto Compounds 1 and 2 each were added in the amount of $4\times10^{-4}$ mole/mole Ag. After 10 minutes' ripening, a KBr solution was added in a proportion of 0.010 mole to silver, and ripening was carried out for additional 10 minutes. The thus ripened emulsion was cooled, and then stored. In the manner as mentioned above, a high-speed Emulsion B-1 was made.

Grains having an average edge length of 0.68 μm and a variation coefficient of 12% with respect to the edge length were formed in the same manner as the grains in Emulsion B-1, except that the temperature at the time of grain formation was lowered.

The amounts of the spectral sensitizers and the chemical sensitizers used for the grains thus formed were 1.25 times as large as those used in making Emulsion B-1 in consideration of specific surface area. Thus, Emulsion B-2 was obtained.

(Making of Green-Sensitive Emulsion C)

A high-speed Emulsion C-1 and a low-speed Emulsion C-2 were prepared in the same manner under the same conditions as Emulsion A-1 and Emulsion A-2 respectively, except that the grain formation was performed at a low temperature, compared with the case of Emulsion A-1, and the sensitizing dyes were replaced by those illustrated below.

Sensitizing Dye D

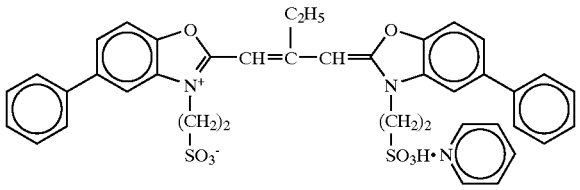

Sensitizing Dye E

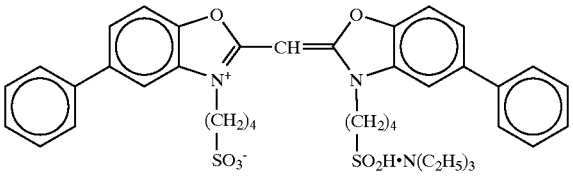

As to the grain sizes, the average edge length of the high-speed emulsion was 0.40 μm and that of the low-speed emulsion was 0.30 μm. The variation coefficients with respect to the edge length were both 8%.

Additionally, the amounts of spectral sensitizing Dye D added to the large-sized emulsion and the small-sized emulsion were $3.0\times10^{-4}$ mole/mole Ag and $3.6\times10^{-4}$ mole/mole Ag, respectively. And the amounts of spectral sensitizing Dye E added to the large-sized emulsion and the small-sized emulsion were $4.0\times10^{-5}$ mole/mole Ag and $7.0\times10^{-5}$ mole/mole Ag, respectively.

(Making of Green-Sensitive Emulsion D)

A high-speed, green-sensitive Emulsion D-1 and a low-speed, green-sensitive Emulsion D-2 were prepared in the same manner under the same conditions as Emulsion B-1 and Emulsion B-2 respectively, except that the grain formation was performed at a low temperature, compared with the case of Emulsion B-1, and the sensitizing dyes were replaced by Sensitizing Dyes D and E Illustrated Above.

As to the grain sizes, the average edge length of the high-speed emulsion was 0.50 μm and that of the low-speed emulsion was 0.40 μm. The variation coefficients with respect to the edge length were both 10%.

Additionally, the amounts of sensitizing Dye D added to the large-sized emulsion and the small-sized emulsion were $4.0\times10^{-4}$ mole/mole Ag and $4.5\times10^{-4}$ mole/mole Ag, respectively. And the amounts of sensitizing Dye E added to the large-sized emulsion and the small-sized emulsion were $5.0\times10^{-5}$ mole/mole Ag and $8.8\times10^{-5}$ mole/mole Ag, respectively.

(Making of Red-Sensitive Emulsion E)

A high-speed Emulsion E-1 and a low-speed Emulsion E-2 were prepared in the same manner under the same conditions as Emulsion A-1 and Emulsion A-2 respectively, except that the grain formation was performed at a low temperature, compared with the case of Emulsion A-1, and the sensitizing dyes were replaced by those illustrated below.

Sensitizing Dye G

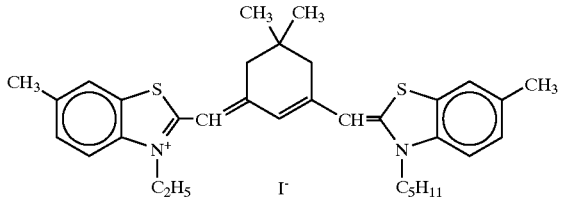

Sensitizing Dye H

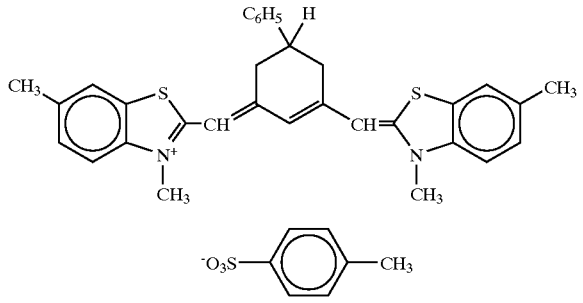

As to the grain sizes, the average edge length of the high-speed emulsion was 0.38 μm and that of the low-speed emulsion was 0.32 μm. And the variation coefficient with respect to the edge length was 9% in the case of the high-speed emulsion, and it was 10% in the case of the low-speed emulsion.

Additionally, the amounts of sensitizing Dyes G and H added to the large-sized emulsion were each $8.0\times10^{-5}$ mole/mole Ag, and the amounts of spectral sensitizing Dyes G and H added to the small-sized emulsion were each $10.7\times10^{-5}$ mole/mole Ag.

Further, Compound I illustrated below was added to the red-sensitive emulsion in an amount of $3.0\times10^{-3}$ mole per mole of silver halide.

(Compound I)

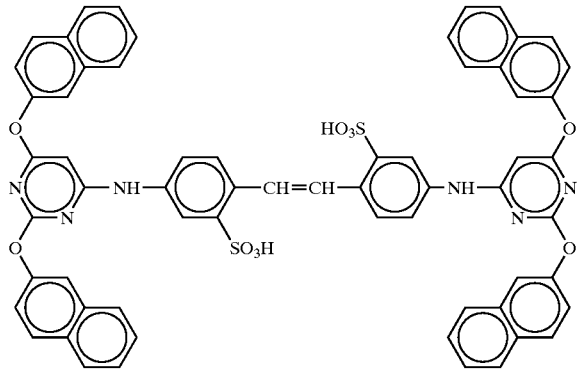

(Making of Red-Sensitive Emulsion F)

A high-speed Emulsion F-1 and a low-speed Emulsion F-2 were prepared in the same manner under the same conditions as Emulsion B-1 and Emulsion B-2 respectively, except that the grain formation was performed at a low temperature, compared with the case of Emulsion B-1, and the sensitizing dyes were replaced by Sensitizing Dyes G and H illustrated above.

As to the grain sizes, the average edge length of the high-speed emulsion was 0.38 μm and that of the low-speed emulsion was 0.32 μm. And the variation coefficient with respect to the edge length was 9% in the case of the high-speed emulsion, and it was 10% in the case of the low-speed emulsion.

Additionally, the amounts of sensitizing Dyes G and H added to the large-sized emulsion were each $8.0\times10^{-5}$ mole/mole Ag, and the amounts of spectral sensitizing Dyes G and H added to the small-sized emulsion were each $10.7\times10^{-5}$ mole/mole Ag.

Further, Compound I illustrated below was added to the red-sensitive emulsion in an amount of $3.0\times10^{-3}$ mole per mole of silver halide.

Preparation of Coating Solution for First Layer:

A yellow coupler (ExY) in the amount of 57 g, 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in a mixture of 21 g of a solvent (Solv-1) and 80 ml of ethyl acetate, and then dispersed in an emulsified condition into 220 g of a 23.5 weight % aqueous gelatin solution containing 4 g of sodium dodecylbenzenesulfonate by use of a high speed agitation emulsification apparatus (dissolver), and further thereto 900 g of water was added. Thus, emulsified Dispersion A was prepared.

The emulsified Dispersion A thus prepared was mixed homogeneously with the Emulsions A-1 and A-2, and thereto were added other ingredients described below so as to obtain the coating solution for the first layer having the following composition. The emulsion coverage is shown on a silver basis.

Preparation of Coating Solutions for Second to Seventh Layers:

Coating solutions for the second to seventh layers were prepared respectively in the same manner as that for the first layer. In each layer, sodium 1-oxy-3,5-dichloro-s-triazine (H-1), Hardener (H-2) and Hardener (H-3) were used as gelatin hardener. In addition, Ab-1, Ab-2, Ab-3 and Ab-4 were added to all layers so that their total coverage values were 15.0 mg/m$^2$, 60.0 mg/m$^2$, 5.0, mg/m$^2$ and 10.0 mg/m$^2$, respectively.

(H-1) Hardener (H-1) Hardener

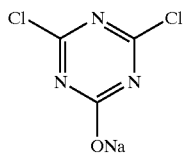

(used in a proportion of 1.4% by weight to gelatin)

(H-2) Hardener $CH_2{=}CHSO_2CH_2CONHCH_2$ $CH_2{=}CHSO_2CH_2CONHCH_2$ (H-3) Hardener

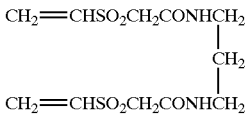

(Ab-1) Antiseptic

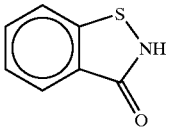

(Ab-2) Antiseptic

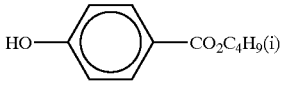

(Ab-3l) Antiseptic

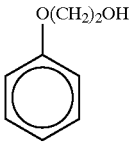

(Ab-4) Antiseptic

1:1:1:1 (by mole) Mixture of a, b, c and d:

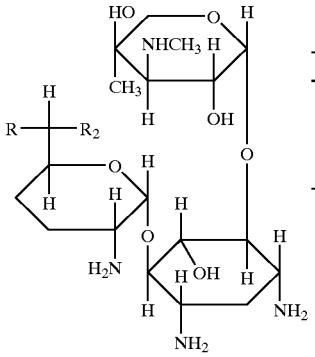

| | $R_1$ | $R_2$ |
|---|---|---|
| a | $-CH_3$ | $-NHCH_3$ |
| b | $-CH_3$ | $-NH_2$ |
| c | $-H$ | $-NH_2$ |
| d | $-H$ | $-NHCH_3$ |

Further, 1-(3-methylureidophenyl)-5-mercaptotetrazole was added to the second layer, the fourth layer, the sixth layer and the seventh layer so as to have coverage values of 0.2 mg/m$^2$, 0.2 mg/m$^2$, 0.6 Mg/m$^2$ and 0.1 mg/m$^2$, respectively.

To the blue-sensitive emulsion layer and the green-sensitive emulsion layer, 4-hydroxy-6-methyl-1, 3, 3a, 7-tetraazaindene was further added in amounts of $1\times10^{-4}$ mole and $2\times10^{-4}$ mole, respectively, per mole of silver halide.

Moreover, methacrylicacid-butylacrylate (1:1 by weight) copolymer latex (average molecular weight: 200,000 to 400,000) was added to the red-sensitive emulsion layer so as to have coverage of 0.05 g/m$^2$.

In addition, disodium catechol-3,5-disulfonate was added to the second layer, the fourth layer and the sixth layer so as to have coverage values of 6 mg/m$^2$, 6 Mg/m$^2$ and 18 mg/m$^2$, respectively.

For preventing irradiation, the following dyes were added (each figure in parentheses designates the coverage).

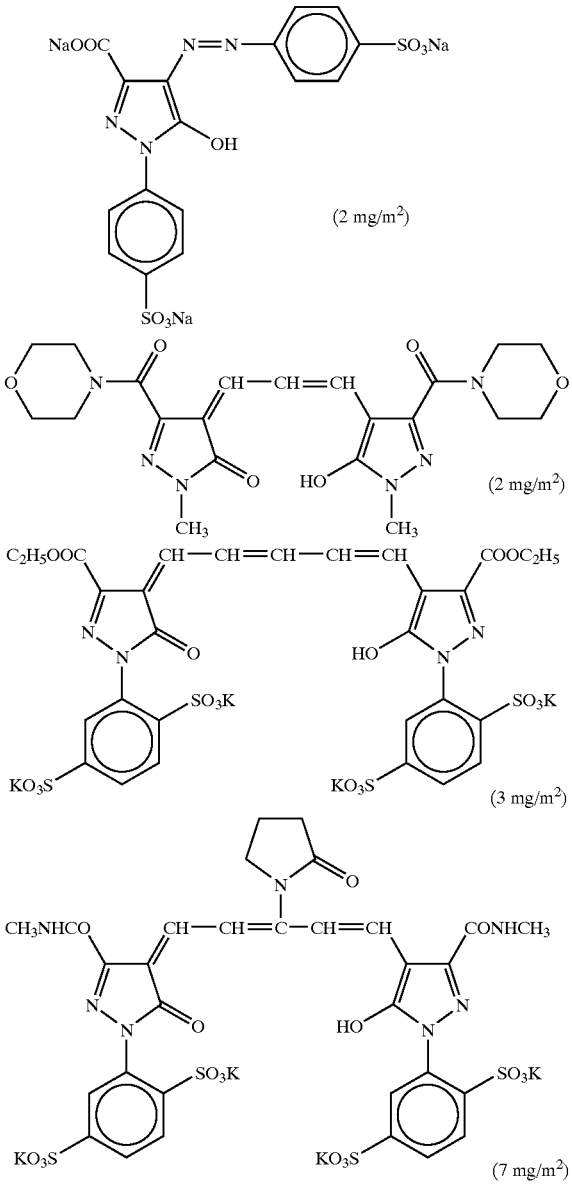

Preparation of Sample No. 101:

(Layer Structure)

The composition of each constituent layer is described below. Each figure on the right side designates the coverage (g/m$^2$) of the ingredient corresponding there to. As to the silver halide emulsion, the figure represents the coverage based on silver.

Support:

Polyethylene resin-laminated paper which contained white pigments ($TiO_2$: content 16 weight %, ZnO: content 4 weight %), a brightening agent (4,4'-bis(5-methylbenzoxazolyl)-stilbene: content 0.03 weight %) and a bluish dye (ultramarin: content 0.33 weight %) in the polyethylene resin on the side of the first layer, and has the polyethylene resin coverage of 29.2 g/m2.

First Layer (Blue-Sensitive Emulsion Layer):

| | |
|---|---|
| Silver chloride Emulsion A (containing gold-sulfur sensitized cubic grains and being a 3:7 (by mole on a silver basis) mixture of large-sized Emulsion A-1 and small-sized Emulsion A-2) having an average emulsified particle size of 0.15 μm | 0.20 |
| Gelatin | 1.31 |
| Yellow coupler (Y-1) | 0.42 |
| Color image stabilizer (ST-23) | 0.48 |
| Tributyl citrate | 0.48 |
| Color image stabilizer (ST-24) | 0.12 |
| Color image stabilizer (ST-16) | 0.01 |
| Piperidinohexose reductone | 0.002 |
| Surfactant (SF-1) | 0.02 |
| Dye-1 | 0.01 |

Second Layer (Color Mixing Inhibiting Layer):

| | |
|---|---|
| Gelatin | 0.75 |
| Color mixing inhibitor (ST-4) | 0.10 |
| Solvent (diundecyl phosphate) | 0.11 |
| Surfactant (SF-1) | 0.008 |

Third Layer (Green-Sensitive Emulsion Layer):

| | |
|---|---|
| Silver chlorobromide Emulsion C (containing gold-sulfur sensitized cubic grains and being a 1:3 (by mole on a silver basis) mixture of large-sized Emulsion C-1 and small-sized Emulsion C-2) having an average emulsified particle size of 0.25 μm | 0.10 |
| Gelatin | 1.19 |
| Magenta coupler (Ma-48) | 0.21 |
| Oleyl alcohol | 0.22 |
| Solvent (diundecyl phosphate) | 0.11 |
| Color image stabilizer (ST-21) | 0.04 |
| Color image stabilizer (ST-22) | 0.28 |
| Dye-2 | 0.007 |
| Surfactant (SF-1) | 0.023 |
| Potassium chloride | 0.02 |
| Sodium phenylmercaptotetrazole | 0.0007 |

Fourth Layer (Color Mixing Inhibiting Layer):

| | |
|---|---|
| Gelatin | 0.75 |
| Color mixing inhibitor (ST-4) | 0.11 |
| Solvent (diundecyl phosphate) | 0.20 |
| Acrylamide/t-butylacrylamide sulfonate copolymer | 0.05 |
| Bis-vinylsulfonylmethane | 0.14 |
| Catechol disulfonate | 0.03 |

Fifth Layer (Red-Sensitive Emulsion Layer):

| | |
|---|---|
| Silver chlorobromide Emulsion E (containing gold-sulfur sensitized cubic grains and being a 5:5 (by mole on a silver basis) mixture of large-sized Emulsion E-1 and small-sized Emulsion E-2) having an average emulsified particle size of 0.19 μm | 0.19 |
| Gelatin | 1.36 |
| Cyan coupler (IC-23) | 0.23 |

-continued

| | |
|---|---|
| Cyan coupler (IC-24) | 0.02 |
| Ultraviolet absorbent (UV-2) | 0.36 |
| Dibutyl sebacate | 0.44 |
| Solvent (tris(2-ethylhexyl) phosphate) | 0.15 |
| Dye-3 | 0.02 |
| Sodium phenylmercaptotetrazole | 0.0005 |
| Surfactant (SF-1) | 0.05 |

Sixth Layer (Ultraviolet Absorsbing Layer):

| | |
|---|---|
| Gelatin | 0.82 |
| Ultraviolet absorbent (UV-1) | 0.035 |
| Ultraviolet absorbent (UV-2) | 0.20 |
| Solvent (tris(2-ethylhexyl) phosphate) | 0.08 |
| Surfactant (SF-1) | 0.01 |

Seventh Layer (Protective Layer):

| | |
|---|---|
| Gelatin | 0.64 |
| Ludox AM (trade name) (colloidal silica) | 0.16 |
| Polydimethylsiloxane DC200 (trade name) | 0.02 |
| Surfactant (SF-2) | 0.003 |
| Surfactant (SF-13) | 0.003 |
| Surfactant Tergitol 15-S-5 (trade name) | 0.002 |
| Surfactant (SF-1) | 0.008 |
| Surfactant Aerosol OT (trade name) | 0.003 |

In the foregoing manner, Sample No. 101 was prepared.

Preparation of Sample No. 001:

Sample No. 001 was prepared in the same manner as Sample No. 101, except that the compositions of the third layer and the fifth layer were changed as shown below.

Third Layer (Green-Sensitive Emulsion Layer):

| | |
|---|---|
| Silver chlorobromide Emulsion C (containing gold-sulfur sensitized cubic grains and being a 1:3 (by mole on a silver basis) mixture of large-sized Emulsion C-1 and small-sized Emulsion C-2) having an average emulsified particle size of 0.25 μm | 0.13 |
| Gelatin | 1.10 |
| Magenta coupler (Ma-7) | 0.27 |
| Solvent (dibutyl phosphate) | 0.08 |
| Solvent (diundecyl phosphate) | 0.03 |
| Color image stabilizer (ST-8) | 0.02 |
| Color image stabilizer (ST-21) | 0.17 |
| Color image stabilizer (ST-22) | 0.53 |
| Dye-2 | 0.007 |
| Surfactant (SF-1) | 0.023 |
| Potassium chloride | 0.02 |
| Sodium phenylmercaptotetrazole | 0.0007 |

Fifth Layer (Red-Sensitive Emulsion Layer):

| | |
|---|---|
| Silver chlorobromide Emulsion E (containing gold-sulfur sensitized cubic grains and being a 5:5 (by mole on a silver basis) mixture of large-sized Emulsion E-1 and small-sized Emulsion E-2) having an average emulsified particle size of 0.19 μm | 0.18 |
| Gelatin | 1.20 |
| Cyan coupler (C-1) | 0.37 |
| Ultraviolet absorbent (UV-2) | 0.24 |

-continued

| | |
|---|---|
| Solvent (dibutyl phosphate) | 0.36 |
| Solvent (2(2-butoxyethoxy)ethyl acetate) | 0.03 |
| Dye-3 | 0.02 |
| Sodium phenylmercaptotetrazole | 0.0005 |
| Surfactant (SF-1) | 0.05 |

Preparation of Sample No. 102:

Sample No. 102 was prepared in the same manner as Sample No. 101, except that the compositions of the third layer and the fifth layer were changed as shown below.

Third Layer (Green-Sensitive Emulsion Layer):

| | |
|---|---|
| Silver chlorobromide Emulsion C (containing gold-sulfur sensitized cubic grains and being a 1:3 (by mole on a silver basis) mixture of large-sized Emulsion C-1 and small-sized Emulsion C-2) having an average emulsified particle size of 0.25 μm | 0.08 |
| Gelatin | 1.25 |
| Magenta coupler (Ma-48) | 0.21 |
| Oleyl alcohol | 0.33 |
| Color image stabilizer (ST-21) | 0.04 |
| Color image stabilizer (ST-22) | 0.28 |
| Dye-2 | 0.007 |
| Surfactant (SF-1) | 0.035 |
| Potassium chloride | 0.02 |
| Sodium phenylmercaptotetrazole | 0.0007 |

Fifth Layer (Red-Sensitive Emulsion Layer):

| | |
|---|---|
| Silver chlorobromide Emulsion E (containing gold-sulfur sensitized cubic grains and being a 5:5 (by mole on a silver basis) mixture of large-sized Emulsion E-1 and small-sized Emulsion E-2) having an average emulsified particle size of 0.19 μm | 0.14 |
| Gelatin | 1.36 |
| Cyan coupler (IC-23) | 0.30 |
| Ultraviolet absorbent (UV-2) | 0.36 |
| Dibutyl sebacate | 0.44 |
| Solvent (tris(2-ethylhexyl) phosphate) | 0.15 |
| Dye-3 | 0.02 |
| Sodium phenylmercaptotetrazole | 0.0005 |
| Surfactant (SF-1) | 0.05 |

Preparation of Sample No. 103:

Sample No. 103 was prepared in the same manner as Sample No. 101, except that the composition of the third layer was changed as shown below.

Third Layer (Green-Sensitive Emulsion Layer):

| | |
|---|---|
| Silver chlorobromide Emulsion C (containing gold-sulfur sensitized cubic grains and being a 1:3 (by mole on a silver basis) mixture of large-sized Emulsion C-1 and small-sized Emulsion C-2) having an average emulsified particle size of 0.25 μm | 0.08 |
| Gelatin | 1.25 |
| Magenta coupler (ExM) | 0.15 |
| Oleyl alcohol | 0.55 |
| Color image stabilizer (ST-21) | 0.04 |
| Color image stabilizer (ST-22) | 0.28 |
| Dye-2 | 0.007 |
| Surfactant (SF-1) | 0.040 |

-continued

| | |
|---|---|
| Potassium chloride | 0.02 |
| Sodium phenylmercaptotetrazole | 0.0007 |

The structural formulae of the compounds used in each of samples prepared above are shown below:

(Y-1)

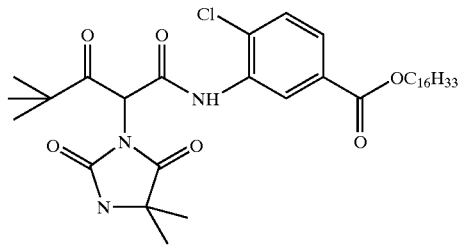

(C-1)

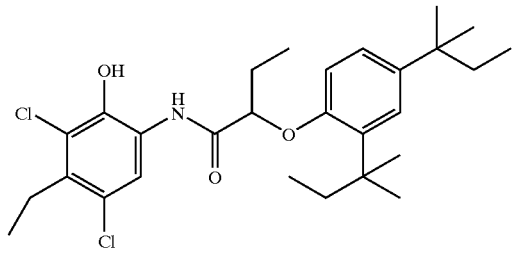

(ExM) Magenta coupler

50:50 (by mole) mixture of

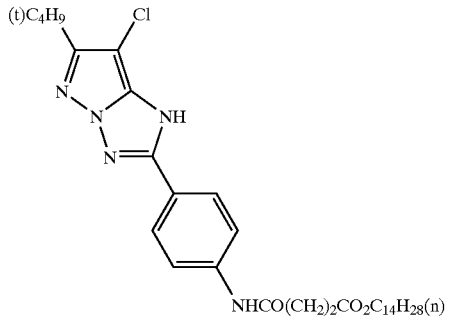

and

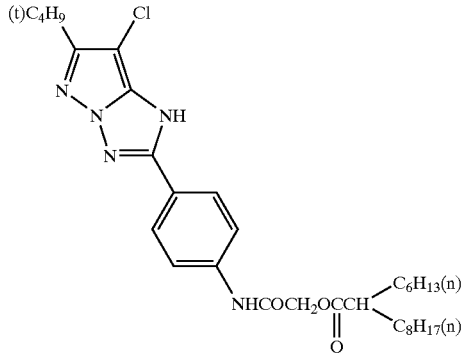

-continued
ST-4
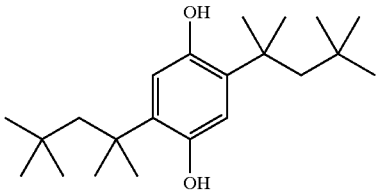
ST-8
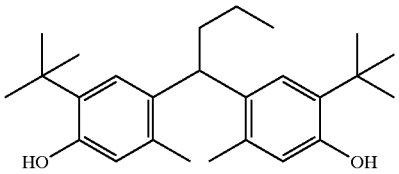
ST-16
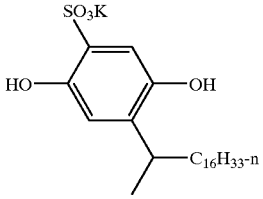
ST-21
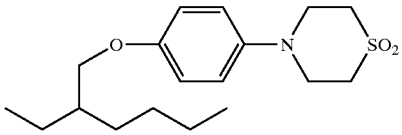
ST-22
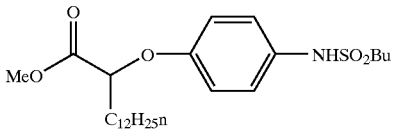
ST-23
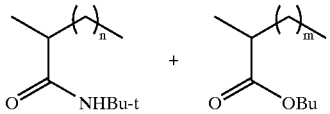
n:m 1:1 mw = 75–100,000
ST-24
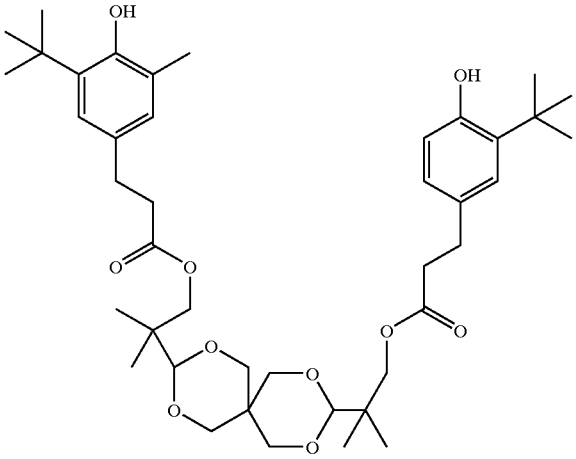
-continued
UV-1
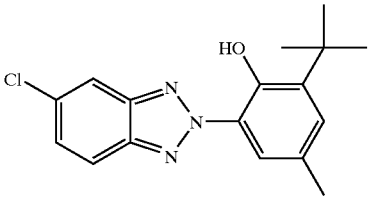
UV-2
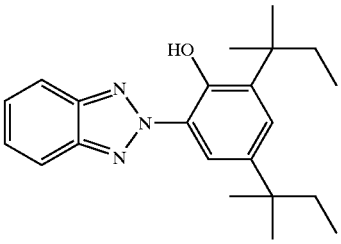
SF-1
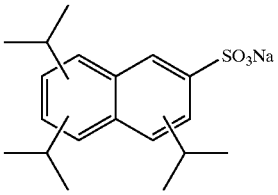
SF-2
$CF_3{\bullet}(CF_2)_7{\bullet}SO_3Na$
SF-13
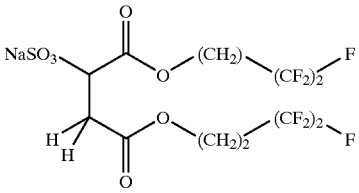
Dye-1
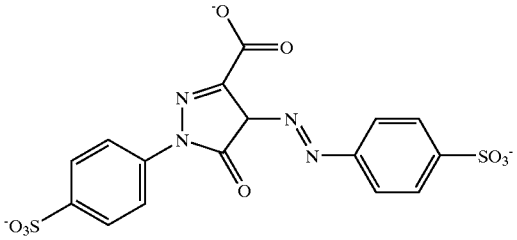
Dye-2
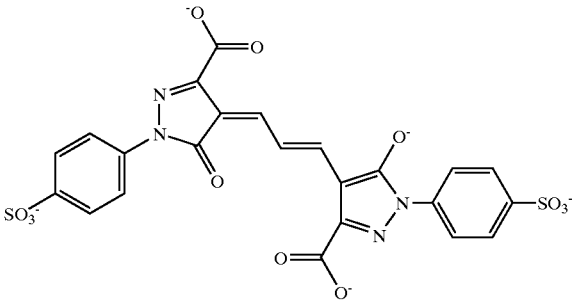
Dye-3

-continued

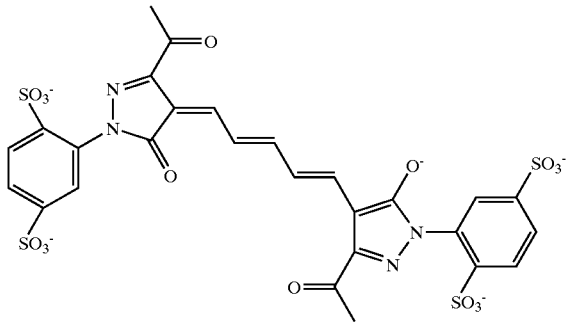

Sample Nos. 001-1, Sample Nos. 101-1 to 101-6, Sample Nos. 102-1 and 102-2, and Sample Nos. 103-1 to 103-3 were prepared in the same manner as Sample No. 001, Sample No. 101, Sample No. 102 and sample No. 103, respectively, except that the magenta couplers in their respective third layers and the cyan couplers in their respective fifth layers were replaced with the couplers set forth in Table 4, respectively, in equimolecular amounts, and besides, the total silver overage values of some samples were changed to those set forth in Table 4, respectively. In changing the total silver coverage, the change was made depending on the ratio between the silver coverage values of constituent layers.

The photographic processing testing described below was carried out for each sample.

Color Photographic Processing A:

After coating operations, each sample was stored for 10 days in the atmosphere of 25° C.–55% RH. Then, each sample was cut into sheets in a minilabo printer processor Frontier 330, made by Fuji Photo Film Co., Ltd., and subjected to continuous processing using the following processing compositions and being performed in accordance with the following processing process until the replenisher volume reached three times the liquid volume in the color developing tank. This processing was referred to as "Processing A". Additionally, the transport speed of Frontier 330 was increased to 27.9 mm/sec, and the processing racks in the color developing and bleach-fix processing tanks were modified. Further, the rinse processing tank and the processing rack were adapted for the blade transport system disclosed in JP-A-2002-55422, the direction of liquid circulation was changed to the downward direction (following the form described in Japanese Patent Application No. 2001-147814), and a circulation filter with pleats was installed at the tank bottom.

Processing Condition-A

| Processing Step | Temperature | Time | Replenishment rate |
|---|---|---|---|
| Color development | 45.0° C. | 25 sec | 45 ml/m$^2$ |
| Bleach-fix | 40.0° C. | 25 sec | Replenisher A 17.5 ml/m$^2$ Replenisher B ml/m$^2$ |
| Rinse (1) | 40.0° C. | 7 sec | |
| Rinse (2) | 40.0° C. | 4 sec | |
| Rinse (3) | 40.0° C. | 4 sec | |
| Rinse (4) | 40.0° C. | 7 sec | 175 ml/m$^2$ |
| Drying | 80.0° C. | 20 sec | |

Color Developer

| | Tank Solution | Replenisher |
|---|---|---|
| Cation-exchanged water | 800 ml | 800 ml |
| Dimethylpolysiloxane surfactant (Silicone KF351A, produced by Shin-Etsu Chemical Co., Ltd.) | 0.05 g | 0.05 g |
| Potassium hydroxide | 4.0 g | 9.0 g |
| Sodium hydroxide | 2.0 g | 6.0 g |
| Ethylenediaminetetraacetic acid | 4.0 g | 4.0 g |
| Tylon | 0.5 g | 0.5 g |
| Potassium chloride | 19.0 g | — |
| Sodium bromide | 0.036 g | — |
| P-1 (illustrated below) | 1.5 g | 2.9 g |
| S-1 (illustrated below) | 3.5 g | 9.0 g |
| Sodium p-toluenesulfonate | 15.0 g | 15.0 g |
| Sodium sulfite | 0.2 g | 0.2 g |
| m-Carboxybenzenesulfinic acid | 2.0 g | 3.6 g |
| Disodium N,N-bis(sulfonatoethyl)-hydroxylamine | 5.0 g | 10.8 g |
| N-Ethyl-N-(β-methanesulfonamido-ethyl)-3-methyl-4-aminoaniline 3/2 sulfate monohydrate | 6.7 g | 17.3 g |
| Potassium carbonate | 26.3 g | 26.3 g |
| Water to make | 1,000 ml | 1,000 ml |
| pH (at 25° C., adjusted with potassium hydroxide and sulfuric acid) | 10.12 | 10.26 |

Bleach-Fix Bath

| | Tank solution | Replenisher A | Replenisher B |
|---|---|---|---|
| Water | 650 ml | 300 ml | 300 ml |
| Ammonium thiosulfate (750 g/l) | 97.0 ml | — | 376.0 ml |
| Ammonium bisulfite soln. (65%) | 13.0 g | — | 185.5 ml |
| Ammonium sulfite | 21.0 g | — | — |
| Ammonium ethylenediamine-tetraacetatoferrate (III) | 37.0 g | 184.0 g | — |
| Ethylenediaminetetraacetic acid | 1.6 g | 0.4 g | 10.0 g |
| m-Carboxybenzenesulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Aqueous ammonia (27%) | 3.4 g | — | 36.0 g |
| Water to make | 1,000 ml | 1,000 ml | 1,000 ml |
| pH (at 25° C., adjusted with aqueous ammonia and nitric acid) | 5.9 | 2.5 | 5.75 |

Rinsing Bath (Tank solution=Replenisher)

| | |
|---|---|
| Sodium chloroisocyanurate | 0.02 g |
| Deionized water (conductivity: 5 μs/cm or below) | 1,000 ml |

P-1

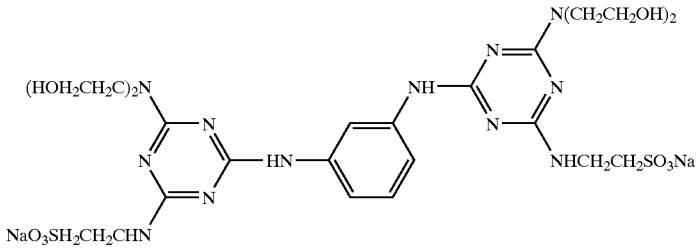

S-1

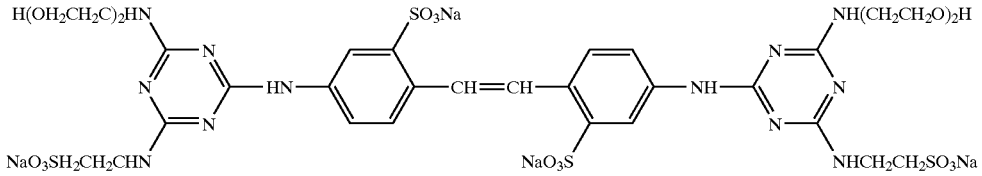

As in the case of the color photographic processing A, the color photographic processing B described below was carried out, and comparisons were made between these processings.

Color Photographic Processing B:

As in the case of Processing A, each sample was stored in the atmosphere of 25° C.–55% RH for 10 days after coating, and then subjected to continuous processing using a minilabo printer processor, Frontier 330, made by Fuji Photo Film Co., Ltd. and the following processing compositions and being performed in accordance with the following processing process until the replenisher volume reached three times the liquid volume in the color developing tank. In contrast to Processing A, no modification was made to the printer processor.

| Processing Step | Temperature | Time | Amount* replenished |
|---|---|---|---|
| Color development | 38.5° C. | 45 sec | 45 mL |
| Bleach-fix | 38.0° C. | 45 sec | 35 mL |
| Rinse 1 | 38.0° C. | 20 sec | — |
| Rinse 2 | 38.0° C. | 20 sec | — |
| Rinse 3** | 38.0° C. | 20 sec | — |
| Rinse 4 | 38.0° C. | 20 sec | 121 mL |
| Drying | 80° C. | | |

(note)
*per $m^2$ of photosensitive material
**A rinse cleaning system RC50D made by Fuji Photo Film Co., Ltd. was attached to Rinse 3, the rinsing solution was taken out of the rinse 3 and sent into the reverse osmosis module (RC50D) by means of a pump. The permeate the module tank sent out was supplied to Rinse 4, and the condensate was sent back to Rinse 3. The permeate volume of the reverse osmosis module was controlled by pump pressure so as to keep the range of 50 to 300 ml/min, and circulation of the solution was continued for 10 hours a day while regulating the temperature. The rinsing order was 1-2-3-4, and 4-stage counter-current system was applied to the rinse-processing.

Compositions of the processing solutions used are as follows:

Color Developer

| | Tank Solution | Replenisher |
|---|---|---|
| Water | 800 ml | 800 ml |
| Brightening agent (FL-1) | 2.2 g | 5.1 g |
| Brightening agent (FL-2) | 0.35 g | 1.75 g |
| Triisopropanolamine | 8.8 g | 8.8 g |
| Polyethylene glycol (average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium N,N-bis(sulfonatoethyl)-hydroxylamine | 8.5 g | 14.0 g |
| 4-Amino-3-methyl-N-ethyl-N-(β-methanesulfonamidoethyl)aniline 3/2 sulfate monohydrate | 4.8 g | 14.0 g |
| Potassium carbonate | 26.3 g | 26.3 g |
| Water to make | 1,000 ml | 1,000 ml |
| pH (at 25° C., adjusted with sulfuric acid and potassium hydroxide) | 10.15 | |

Bleach-Fix Bath

| | Tank solution | Replenisher |
|---|---|---|
| Water | 800 ml | 800 ml |
| Ammonium thiosulfate (750 g/L) | 107 ml | 214 ml |
| m-Carboxybenzenesulfinic acid | 8.3 g | 16.5 g |
| Ammonium ethylenediaminetetra-acetatoferrate (III) | 47.0 g | 94.0 g |
| Ethylenediaminetetraacetic acid | 1.4 g | 2.8 g |
| Nitric acid (67%) | 16.5 g | 33.0 g |

-continued

| | Tank solution | Replenisher |
|---|---|---|
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (at 25° C., adjusted with nitric acid and aqueous ammonia) | 6.5 | 6.5 |

Rinsing Bath

| | Tank solution | Replenisher |
|---|---|---|
| Sodium chloroisocyanurate | 0.02 g | 0.02 g |
| Deionized water (conductivity: 5 μs/cm or below) | 1,000 ml | 1,000 ml |
| pH (25° C.) | 6.5 | 6.5 |

FL-1

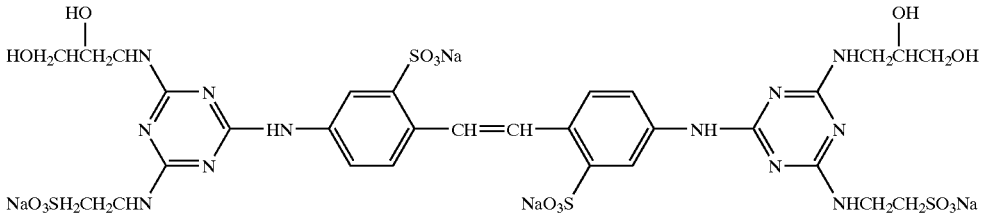

FL-2

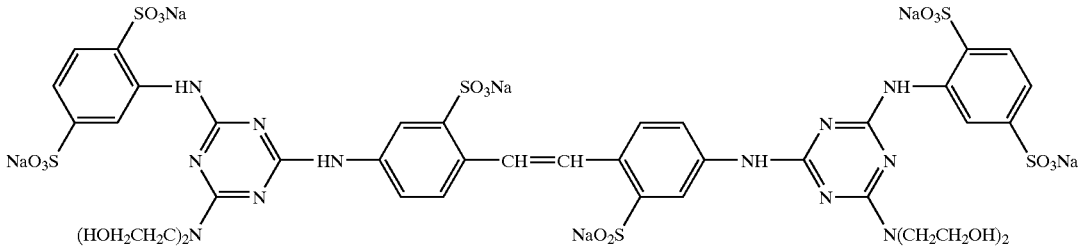

For each of the photosensitive material samples prepared, Sample Nos. 001 to 103-3, calibration operation was performed five times using each of the modified Frontier 330 and the unmodified Frontier 300. Then, 300 sheets of even gray samples having 2L size were made in a condition that their R, G and B densities determined by a X-rite densitometer (equipped with Status A-R, G, B filters) having a ISO 5-defined reflection optical system were all 1.0. The image input data used herein was formed by use of Photoshop made by Adobe Systems Incorporated.

Evaluation of Uneven Density

Among the 2L-size samples made, samples having developed uneven density streaks in a direction perpendicular to the transport direction were counted by eyes, and the probability of developing streaks (Sa) was calculated from the following equation:

$$Sa=(\text{number of sheets having streaks})/300\ (\text{volume})\times 100(\%)$$

Evaluation of Colored Dye Remaining Rate After Storage in the Dark Under Condition of Accelerated Aging After coating, the samples prepared underwent 10 days' storage under ambient conditions of 25° C. and 50% RH. In these samples each, solidly developed cyan-color areas having the X-rite R density of 2.0 were formed by use of Photoshop made by Adobe Systems Incorporated. The resulting samples were stored for 60 days in 80° C. and 30% surroundings, and thereafter underwent density measurement once again. From these measurements, colored dye remaining rate C(dry) (on a percentage basis) of each sample was determined.

Evaluation of Colored Dye Remaining Rate After Irradiation with Light

As in th case with the evaluation of colored dye remaining rate after storage in the dark under the accelerated aging condition, samples having solidly developed cyan-color areas were made and subjected to 30 days' irradiation with 100 klux light from a Xe irradiation device Whetherometer Model Ci5000 made by Atlas Electronic Device. In this case also, the colored dye remaining rate C(lig) (on a percentage basis) was determined in the same way as C(dry). The results obtained are shown in Table 4.

TABLE 4

| Sample No. | Sample No. on which modification was based | Cyan coupler in fifth layer | Magenta coupler in third layer | Silver coverage ($g/m^2$) | Color photographic processing | Sa (%) | C (dry) (%) | C (lig) (%) | Note |
|---|---|---|---|---|---|---|---|---|---|
| 001 | — | C-1 | Ma-7 | 0.51 | A | 23 | 68 | 64 | comparison |
| 001-1 | 001 | C-1 | Ma-7 | 0.51 | B | 0 | 75 | 71 | comparison |
| 101-1 | 101 | IC-23, IC-24 | Ma-48 | 0.49 | A | 13 | 95 | 85 | invention |
| 101-2 | 101 | IC-23, IC-24 | Ma-48 | 0.46 | A | 9 | 96 | 86 | invention |
| 101-3 | 101 | IC-23, IC-24 | Ma-1 | 0.42 | A | 3 | 95 | 86 | invention |
| 101-4 | 101 | IC-23, IC-24 | Ma-47 | 0.42 | A | 0 | 97 | 85 | invention |
| 101-5 | 101 | IC-22 | Ma-25 | 0.49 | A | 0 | 97 | 86 | invention |
| 101-6 | 101 | IC-6 | Ma-21 | 0.40 | A | 0 | 97 | 87 | invention |
| 102 | — | IC-23 | Ma-48 | 0.42 | A | 6 | 96 | 87 | invention |
| 102-1 | 102 | IC-23 | Ma-25 | 0.42 | A | 1 | 97 | 86 | invention |
| 102-2 | 102 | IC-23 | Ma-21 | 0.42 | A | 0 | 95 | 85 | invention |
| 103 | — | IC-23 | Ma-48 | 0.42 | A | 3 | 96 | 86 | invention |
| 103-1 | 103 | IC-23 | Ma-25 | 0.40 | A | 0 | 96 | 87 | invention |
| 103-2 | 103 | IC-22 | Ma-21 | 0.40 | A | 0 | 95 | 88 | invention |
| 103-3 | 103 | IC-6 | Ma-47 | 0.40 | A | 0 | 97 | 87 | invention |

As can be seen from comparison between comparative Sample Nos. 001 and 001-1, uneven density streaks developed frequently when the color photographic processing A increased in rapid productivity was performed. In contrast to these cases, the present cases in which the cyan coupler in the fifth layer was replaced with diacyl aminophenol couplers represented by formula (IA) demonstrate that the Sa value was greatly reduced and significant improvement in uneven density streaks was achieved. Further, the data in Table 4 shows that the extent of improvement in uneven density streaks was increased by reduction in silver coverage and further by using magenta couplers represented by formula (M-II) in particular. Moreover, it can be seen from Table 4 that the deterioration caused in dark-keeping quality and light fastness by sheet-transport, high-productivity rapid processing was decreased by using the diacylaminophenol couplers.

EXAMPLE 3

Each of the photosensitive material samples prepared in Example 2, Sample Nos. 001 to 103-3, was subjected to the following color photographic Processing C.

Color Photographic Processing C:

Continuous processing was performed using the following processing compositions and a minilabo printer processor, Frontier 350, made by Fuji Photo Film Co., Ltd. in the following processing process until the replenisher volume reached three times the liquid volume in the color developing tank. This processing was referred to as "Processing C". Additionally, the transport speed of Frontier 350 was increased to 39.3 mm/sec, and the processing racks in the color developing and bleach-fix processing tanks were modified. Further, the rinse processing tank and the processing rack were adapted for the blade transport system disclosed in JP-A-2002-55422, the direction of liquid circulation was changed to the downward direction (following the form described in Japanese Patent Application No. 2001-147814), and a circulation filter with pleats was installed at the tank bottom.

Processing C

| Processing Step | Temperature | Time | Replenishment rate |
|---|---|---|---|
| Color development | 45.0° C. | 16 sec | 45 $ml/m^2$ |
| Bleach-fix | 40.0° C. | 16 sec | Replenisher A 17.5 $ml/m^2$ Replenisher B 17.5 $ml/m^2$ |
| Rinse (1) | 40.0° C. | 5 sec | — |
| Rinse (2) | 40.0° C. | 3 sec | — |
| Rinse (3) | 40.0° C. | 3 sec | — |
| Rinse (4) | 40.0° C. | 5 sec | 175 $ml/m^2$ |
| Drying | 80.0° C. | 16 sec | |

The processing compositions used were the same as in Processing A of Example 2, respectively.

As in the case of Example 2, Color Processing B was also carried out, and comparison between Color Processing C and Color Processing B was made. After each sample under went 5 calibration operations by means of Frontier 330, calibration patterns were output thereto again. The batch having the highest density value of these outputs when measured with a Status A-red filter light-utilized X-rite densitometer was subjected to 10 density measurements within 3 minutes after drying subsequent to the photographic processing. The average value of these measured values was symbolized by Dc(Fr). This batch was stored for 3 months under the atmosphere of 30° C.–55% RH in a dark place favored with cross ventilation, and then underwent density measurements in the same way as in the determination of Dc(Fr). Therefrom, Dc(3m) was determined. And ΔDc was calculated from those measured values in accordance with the following equation:

$$\Delta Dc = Dc(3m) - Dc(Fr)$$

Further, color batches of 5 cm square were formed using 8 bits×3 of Photoshop made by Adobe Systems, and underwent sensory evaluation of vividness of the colors formed and rated on a 1-to-5 scale (5 being best). As the color batches were used saturated cyan color ((R,G,B)=(0,255,255)), saturated green color ((R,G,B)=(0,255,0)), saturated blue color ((R,G,B)=(0,0,255)) and saturated red color ((R,G,B)=(255,0,0)) (wherein the figures are input chromaticity values of Photoshop) The results obtained are shown in Table 5.

TABLE 5

| Sample No. | Sample No. on which modification was based | Cyan coupler in fifth layer | Magenta coupler in third layer | Silver coverage ($g/m^2$) | Color photographic processing | ΔDc | Color purity | Note |
|---|---|---|---|---|---|---|---|---|
| 001 | — | C-1 | Ma-7 | 0.51 | C | 0.06 | 3 | comparison |
| 001-1 | 001 | C-1 | Ma-7 | 0.51 | B | 0.04 | 2 | comparison |
| 101-1 | 101 | IC-23, IC-24 | Ma-48 | 0.49 | C | 0.02 | 4 | invention |
| 101-2 | 101 | IC-23, IC-24 | Ma-48 | 0.46 | C | 0.02 | 5 | invention |
| 101-3 | 101 | IC-23, IC-24 | Ma-1 | 0.42 | C | 0.01 | 5 | invention |
| 101-4 | 101 | IC-23, IC-24 | Ma-47 | 0.42 | C | 0.01 | 5 | invention |
| 101-5 | 101 | IC-22 | Ma-25 | 0.49 | C | 0.01 | 5 | invention |
| 101-6 | 101 | IC-6 | Ma-21 | 0.40 | C | 0.01 | 5 | invention |
| 102 | — | IC-23 | Ma-48 | 0.42 | C | 0.02 | 4 | invention |
| 102-1 | 102 | IC-23 | Ma-25 | 0.42 | C | 0.01 | 5 | invention |
| 102-2 | 102 | IC-23 | Ma-21 | 0.42 | C | 0.01 | 5 | invention |
| 103 | — | IC-23 | Ma-48 | 0.42 | C | 0.01 | 4 | invention |
| 103-1 | 103 | IC-23 | Ma-25 | 0.40 | C | 0.00 | 5 | invention |
| 103-2 | 103 | IC-22 | Ma-21 | 0.40 | C | 0.01 | 5 | invention |
| 103-3 | 103 | IC-6 | Ma-47 | 0.40 | C | 0.00 | 5 | invention |

It can be seen from Table 5 as in the case of Example 2 that comparative samples No. 001 and 001-1 caused a large drop in cyan density by storage when subjected to highly productive photographic Processing C which was further increased in processing speed, compared with Processing A in Example 2. On the other hand, it is also found that such a drop was significantly reduced by replacement of the cyan coupler in the fifth layer with the diacylaminophenol couplers represented by formula (IA). Moreover, improvement in color purity resulting from this replacement is also noticed.

The present silver halide color photographic materials having high silver chloride contents and containing 2,5-diacylamino-4-Z-phenol cyan couplers represented by formula (IA) and the present image formation method in which the present photographic materials undergo rapid processing as they are transported in a sheet form at a high speed can ensure high productivity and, at the same time, enable suppression of defects resulting from rapid processing, namely reduction in finished image quality including lowering of developed color density, insufficiency of leuco dye reciprocity characteristics and silver removal inadecuacy.

In other words, compatibility between an automatic processing system of the high-speed sheet transport type, which has easy operability in exposure and development processing processes and high productivity, and excellent image quality free of reduction in developed color density, insufficiency of leuco dye reciprocity characteristics and silver removal inadecuacy becomes possible by use of the present image formation method and the present silver halide photographic materials.

EXAMPLE 4

(Preparation of Emulsion B-1)

By a usual method of adding silver nitrate and sodium chloride simultaneously to an aqueous gelatin solution with stirring and mixing them, an emulsion with a high content of cubic silver chloride grains having a sphere-equivalent diameter of 0.54 μm and a variation coefficient of 10% was prepared. In the course of preparation, specifically over a period of time when from 80% to 90% of silver nitrate addition was in progress, potassium bromide (in a proportion of 2.5 mole % to 1 mole of finished silver halide) and $K_4[Ru(CN)_6]$ in an amount of $2\times10^{-5}$ mole, based on Ru, per mole of finished silver halide were added. Further, over a period of time when from 83% to 88% of silver nitrate addition was in progress, $K_2[IrCl_6]$ was added in an amount of $6\times10^{-9}$ mole, based on Ir, per mole of finished silver halide. Furthermore, over a period of time when from 92% to 98% of silver nitrate addition was in progress, a water solution of $K_2[Ir(5\text{-methylthiazole})Cl_5]$ in an amount of $1\times10^{-7}$ mole, based on Ir, per mole of finished silver halide and a water solution of $K_2[Ir(H_2O)Cl_5]$ in an amount of $2.2\times10^{-6}$ mole, based on Ir, per mole of finished silver halide were added. The emulsion obtained was subjected to desalting treatment, and then admixed with gelatin and dispersed again. Thereto, sodium benzenethiosulfonate, Sensitizing Dye A and Sensitizing Dye B illustrated below were added. Further, the resulting emulsion was admixed with a colloidal dispersion of gold sulfide as a sensitizer and ripened to an optimal extent. The thus obtained emulsion was referred to as "Emulsion B-1".

Sensitizing Dye A

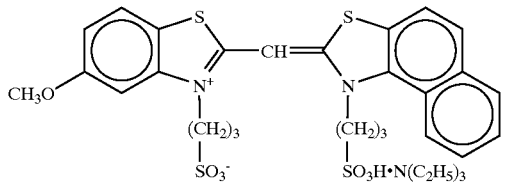

Sensitizing Dye B

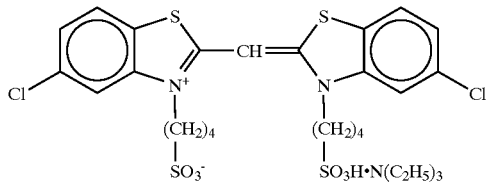

(Preparation of Emulsion B-2)

An emulsion was prepared in the same manner as Emulsion B-1, except that potassium iodide (in a proportion of 0.3 mole % to 1 mole of finished silver halide) was added at a time when 94% of silver nitrate addition was concluded. The emulsion thus prepared was referred to as Emulsion B-2.

(Preparation of Emulsion B-3)

An emulsion was prepared in the same manner as Emulsion B-1, except that 1-phenyl-5-mercaptotetrazole, 1-(5-methylureidophenyl)-5-mercaptotetrazole and 1-(4-methoxyphenyl)-5-mercaptotetrazole were further added at the conclusion of chemical sensitization. The emulsion thus prepared was referred to as Emulsion B-3.

(Preparation of Emulsion B-4)

An emulsion was prepared in the same manner as Emulsion B-2, except that 1-phenyl-5-mercaptotetrazole, 1-(5-methylureidophenyl)-5-mercaptotetrazole and 1-(4-methoxyphenyl)-5-mercaptotetrazole were further added at the conclusion of chemical sensitization. The emulsion thus prepared was referred to as Emulsion B-4.

(Preparation of Emulsion G-1)

By a usual method of adding silver nitrate and sodium chloride simultaneously to an aqueous gelatin solution with stirring and mixing them, an emulsion with a high content of cubic silver chloride grains having a sphere-equivalent diameter of 0.40 $\mu$m and a variation coefficient of 10% was prepared. In the course of preparation, specifically over a period of time when from 80% to 90% of silver nitrate addition was in progress, $K_4(Ru(CN)_6]$ in an amount of $3.0\times10^{-5}$ mole, based on Ru, per mole of finished silver halide was added. And over a period of time when from 80% to 100% of silver nitrate addition was in progress, potassiumbromide (in a proportion of 4 mole % to 1 mole of finished silver halide) was added. Further, over a period of time when from 83% to 88% of silver nitrate addition was in progress, $K_2[IrCl_6]$ was added in an amount of $6\times10^{-9}$ mole, based on Ir, per mole of finished silver halide. Furthermore, over a period of time when from 92% to 98% of silver nitrate addition was in progress, a water solution of $K_2[Ir(5\text{-methylthiazole})Cl_5]$ in an amount of $5.4\times10^{-7}$ mole, based on Ir, per mole of finished silver halide and a water solution of $K_2[Ir(H_2O)Cl_5]$ in an amount of $2.2\times10^{-6}$ mole, based on Ir, per mole of finished silver halide were added. The emulsion obtained was subjected to desalting treatment, and then admixed with gelatin and dispersed again. Further, the resulting emulsion was admixed with sodium benzenethiosulfonate, and ripened to an optimal extent by using a colloidal dispersion of gold sulfide as a sensitizer. Thereto, Sensitizing Dye D and potassium bromide were added. The thus obtained emulsion was referred to as "Emulsion G-1".

Sensitizing Dye D

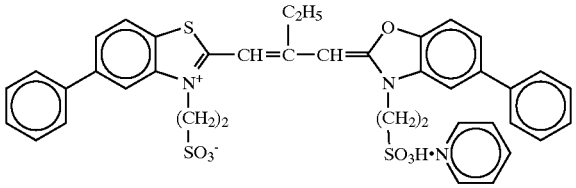

(Preparation of Emulsion G-2)

An emulsion was prepared in the same manner as Emulsion G-1, except that potassium iodide (in a proportion of 0.2 mole % to 1 mole of finished silver halide) was added at a time when 91% of silver nitrate addition was concluded. The emulsion thus prepared was referred to as Emulsion G-2.

(Preparation of Emulsion G-3)

An emulsion was prepared in the same manner as Emulsion G-1, except that 1-phenyl-5-mercaptotetrazole, 1-(5-methylureidophenyl)-5-mercaptotetrazole and 1-(4-methoxyphenyl)-5-mercaptotetrazole were further added at the conclusion of chemical sensitization. The emulsion thus prepared was referred to as Emulsion G-3.

(Preparation of Emulsion G-4)

An emulsion was prepared in the same manner as Emulsion G-2, except that 1-phenyl-5-mercaptotetrazole, 1-(5-methylureidophenyl)-5-mercaptotetrazole and 1-(4-methoxyphenyl)-5-mercaptotetrazole were further added at the conclusion of chemical sensitization. The emulsion thus prepared was referred to as Emulsion G-4.

(Preparation of Emulsion R-1)

By a usual method of adding silver nitrate and sodium chloride simultaneously to an aqueous gelatin solution with stirring and mixing them, an emulsion with a high content of cubic silver chloride grains having a sphere-equivalent diameter of 0.35 $\mu$m and a variation coefficient of 10% was prepared. In the course of preparation, specifically over a period of time when from 80% to 90% of silver nitrate addition was in progress, $K_4[Ru(CN)_6$ in an amount of $3.0\times10^{-5}$ mole, based on Ru, per mole of finished silver halide was added. And over a period of time when from 80% to 100% of silver nitrate addition was in progress, potassiumbromide (in a proportion of 4 mole % to 1 mole of finished silver halide) was added. Further, over a period of time when from 83% to 88% of silver nitrate addition was in progress, $K_2[IrCl_6]$ was added in an amount of $1\times10^{-9}$ mole, based on Ir, per mole of finished silver halide. Furthermore, over a period of time when from 92% to 98% of silver nitrate addition was in progress, a water solution of $K_2[Ir(5\text{-methylthiazole})Cl_5]$ in an amount of $5.4\times10^{-7}$ mole, based on Ir, per mole of finished silver halide and a water solution of $K_2[Ir(H_2O)Cl_5]$ in an amount of $2.2\times10^{-6}$ mole, based on Ir, per mole of finished silver halide were added. The emulsion obtained was subjected to desalting treatment, and then admixed with gelatin and dispersed again. Further, the resulting emulsion was admixed with sodium benzenethiosulfonate, and ripened to an optimal extent by using sodium thiosulfate pentahydrate as a sulfur sensitizer and bis(1,4,5-trimethyl-1,2,4-triazolium-3-thiolato)aurate(I) tetrafluoroborate as a gold sensitizer. Thereto, Sensitizing Dye H, Compound I and potassium bromide were further added. The thus obtained emulsion was referred to as "Emulsion R-1".

Sensitizing Dye H

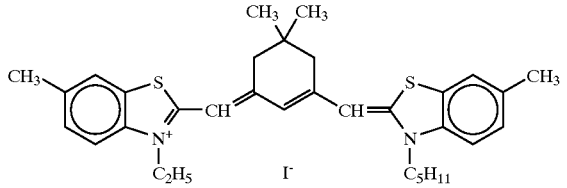

Compound I

-continued

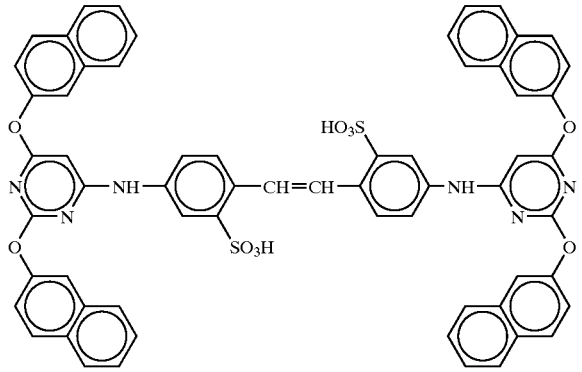

(Preparation of Emulsion R-2)

An emulsion was prepared in the same manner as Emulsion R-1, except that potassium iodide (in a proportion of 0.2 mole % to 1 mole of finished silver halide) was added at a time when 91% of silver nitrate addition was concluded. The emulsion thus prepared was referred to as Emulsion R-2.

(Preparation of Emulsion R-3)

An emulsion was prepared in the same manner as Emulsion R-1, except that 1-phenyl-5-mercaptotetrazole, 1-(5-methylureidophenyl)-5-mercaptotetrazole and 1-(4-methoxyphenyl)-5-mercaptotetrazole were further added at the conclusion of chemical sensitization. The emulsion thus prepared was referred to as Emulsion R-3.

(Preparation of Emulsion R-4)

An emulsion was prepared in the same manner as Emulsion R-2, except that 1-phenyl-5-mercaptotetrazole, 1-(5-methylureidophenyl)-5-mercaptotetrazole and 1-(4-methoxyphenyl)-5-mercaptotetrazole were further added at the conclusion of chemical sensitization. The emulsion thus prepared was referred to as Emulsion R-4.

The surface of a paper support covered with polyethylene resin on both sides was subjected to a corona discharge operation, provided with a gelatin subbing layer containing sodium dodecylbenzenesulfonate, and further coated with first to seventh photographic constituent layers to prepare a silver halide color photographic material sample having the following layer structure. Coating compositions used were prepared in the manner described below.

Preparation of Coating Solution for First Layer:

A yellow coupler (ExY-1) in the amount of 57 g, 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in a mixture of 21 g of a solvent (Solv-1) and 80 ml of ethyl acetate, and then dispersed in an emulsified condition into 220 g of a 23.5 weight % aqueous gelatin solution containing 4 g of sodium dodecylbenzenesulfonate by use of a high speed agitation emulsification apparatus (dissolver), and further thereto 900 g of water was added. Thus, emulsified Dispersion A was prepared.

The emulsified Dispersion A thus prepared was mixed homogeneously with the Emulsion B-1, and thereto were added other ingredients described below so as to obtain the coating solution for the first layer having the following composition. The emulsion coverage is shown on a silver basis.

Coating solutions for the second to seventh layers were prepared respectively in the same manner as that for the first layer. In each layer, sodium 1-oxy-3,5-dichloro-s-triazine (H-1), Hardener (H-2) and Hardener (H-3) were used as gelatin hardener. In addition, Ab-1, Ab-2, Ab-3 and Ab-4 were added to all layers so that their total coverage values were 15.0 mg/m$^2$, 60.0 mg/m$^2$, 5.0 mg/m$^2$ and 10.0 mg/m$^2$, respectively.

(H-1) Hardener

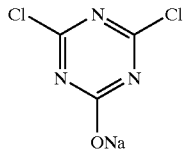

(used in a proportion of 1.4% by weight to gelatin)

(H-2) Hardener

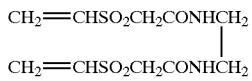

(H-3) Hardener

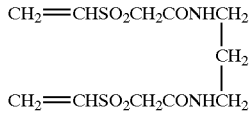

(Ab-1) Antispetic

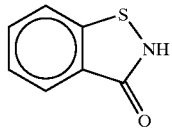

(Ab-2) Antiseptic

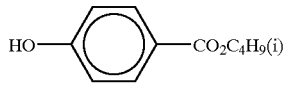

(Ab-3) Antiseptic

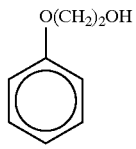

(Ab-4) Antiseptic

1:1:1:1 (by mole) Mixture of a, b, c and d

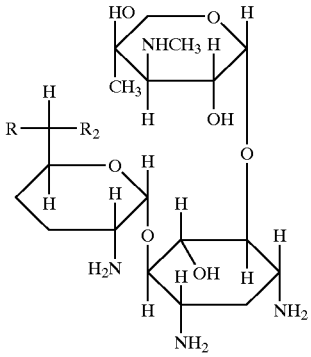

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Further, 1-phenyl-5-mercaptotetrazole was added to the green-sensitive emulsion layer and the red-sensitive emulsion layer in amounts of $1.0\times10^{-3}$ mole and $5.9\times10^{-4}$ mole, respectively, per mole of silver halide. Furthermore, 1-phenyl-5-mercaptotetrazole was added to the second layer, the fourth layer and the sixth layer so as to have coverage values of 0.2 mg/m$^2$, 0.2 mg/m$^2$ and 0.6 mg/m$^2$, respectively.

Moreover, methacrylic acid-butylacrylate (1:1 by weight) copolymer latex (average molecular weight: 200,000 to 400,000) was added to the red-sensitive emulsion layer so as to have coverage of 0.05 g/m$^2$.

In addition, disodium catechol-3,5-disulfonate was added to the second layer, the fourth layer and the sixth layer so as to have values of 6 mg/m $^2$, 6 mg/m$^2$ and 18 mg/m$^2$, respectively.

For preventing irradiation, the following dyes were added (each figure in parentheses designates the coverage).

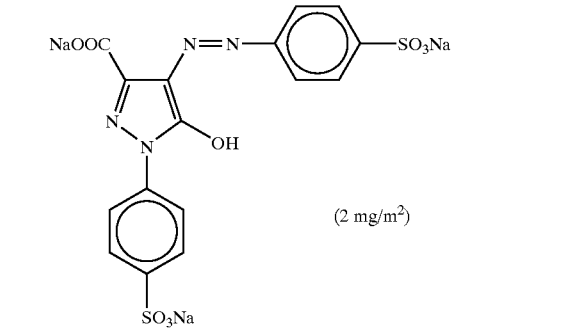

(2 mg/m$^2$)

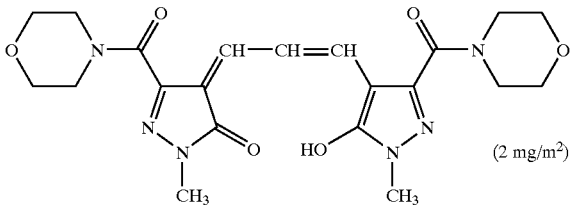

(2 mg/m$^2$)

-continued

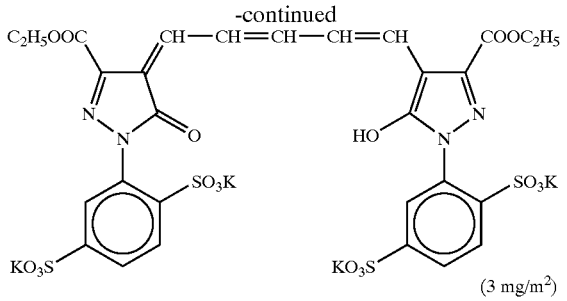

(3 mg/m$^2$)

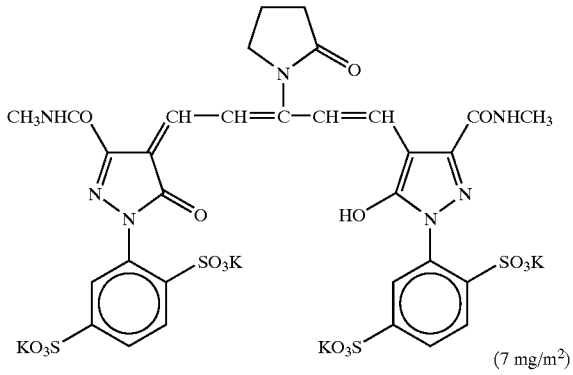

(7 mg/m$^2$)

(Layer Structure)

The composition of each constituent layer is described below. Each figure on the right side designates the coverage (g/m$^2$) of the ingredient corresponding thereto. As to the silver halide emulsion, the figure represents the coverage based on silver.

Support:

Polyethylene resin-laminated paper which contained white pigments ($TiO_2$: content 16 weight %, ZnO: content 4 weight %), a brightening agent (4,4'-bis(5-methylbenzoxazolyl)-stilbene: content 0.03 weight %) and a bluish dye (ultramarin) in the polyethylene resin on the side of the first layer.

First Layer (Blue-Sensitive Emulsion Layer):

| | |
|---|---|
| Emulsion B-1 | 0.24 |
| Gelatin | 1.00 |
| Yellow coupler (ExY) | 0.46 |
| Color image stabilizer (Cpd-1) | 0.06 |
| Color image stabilizer (Cpd-2) | 0.03 |
| Color image stabilizer (Cpd-3) | 0.06 |
| Color image stabilizer (Cpd-8) | 0.02 |
| Solvent (Solv-1) | 0.17 |

Second Layer (Color Mixing Inhibiting Layer):

| | |
|---|---|
| Gelatin | 0.50 |
| Color mixing inhibitor (Cpd-4) | 0.05 |
| Color image stabilizer (Cpd-5) | 0.01 |
| Color image stabilizer (Cpd-6) | 0.06 |
| Color image stabilizer (Cpd-7) | 0.01 |
| Solvent (Solv-1) | 0.03 |
| Solvent (Solv-2) | 0.11 |

Third Layer (Green-Sensitive Emulsion Layer):

| | |
|---|---|
| Emulsion G-1 | 0.14 |
| Gelatin | 1.36 |
| Magenta coupler (ExM) | 0.15 |
| Ultraviolet absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |

Fourth Layer (Color Mixing Inhibiting Layer):

| | |
|---|---|
| Gelatin | 0.36 |
| Color mixing inhibitor (Cpd-4) | 0.03 |
| Color image stabilizer (Cpd-5) | 0.006 |
| Color image stabilizer (Cpd-6) | 0.05 |
| Color image stabilizer (Cpd-7) | 0.004 |
| Solvent (Solv-1) | 0.02 |
| Solvent (Solv-2) | 0.08 |

Fifth Layer (Red-Sensitive Emulsion Layer):

| | |
|---|---|
| Emulsion R-1 | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |

Sixth Layer (Ultraviolet Absorbing Layer):

| | |
|---|---|
| Gelatin | 0.46 |
| Ultraviolet absorbent (UV-B) | 0.45 |
| Compound (S1-4) | 0.0015 |
| Solvent (Solv-7) | 0.25 |

Seventh Layer (Protective Layer):

| | |
|---|---|
| Gelatin | 1.00 |
| Acryl-modified polyvinyl alcohol (modification degree: 17%) | 0.04 |
| Liquid paraffin | 0.02 |
| Surfactant (Cpd-13) | 0.01 |

The structural formulae of the compounds used herein are illustrated below:

(ExY-1) Yellow coupler

70:30 (by mole) Mixture of (1) and (2):

(1)

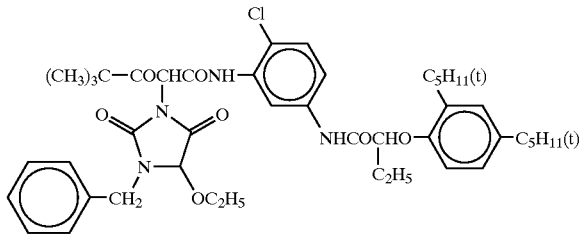

(2)

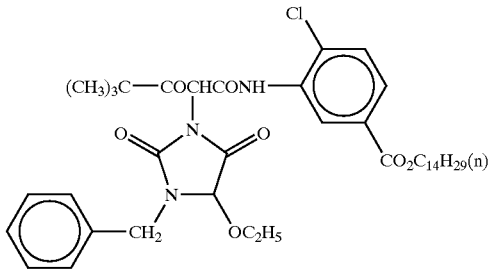

(ExM) Magenta coupler

40:40:20 (by mole) Mixture of (1), (2) and (3):

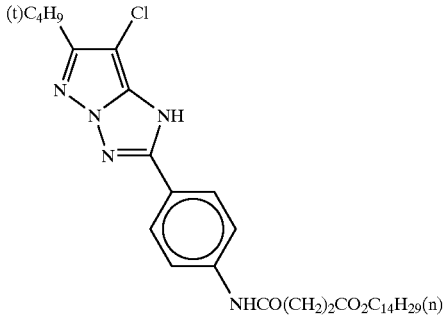

(2)

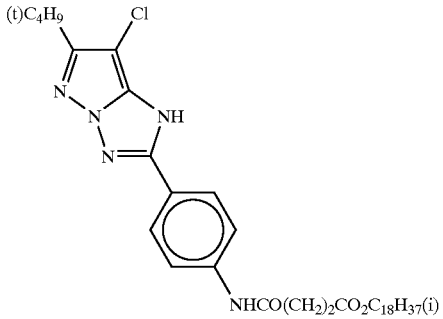

(3)

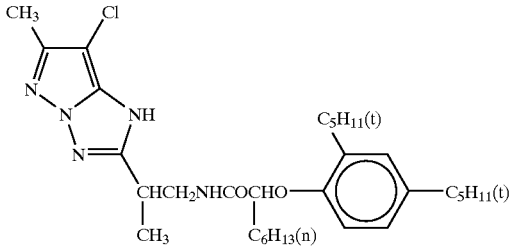

(ExC-2) Cayn coupler
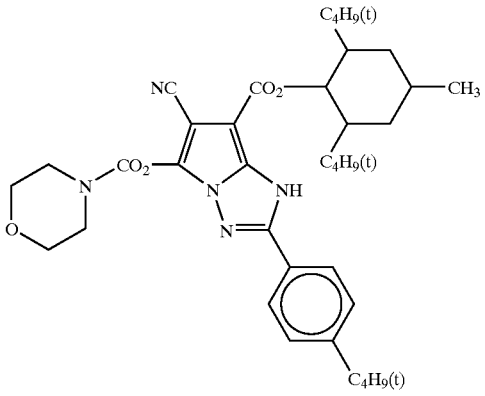
(ExC-3) Cyan couple
50:25:25 (by mole) Mixture of (1), (2) and (3):
(1)
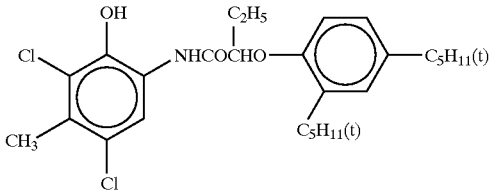
(2)
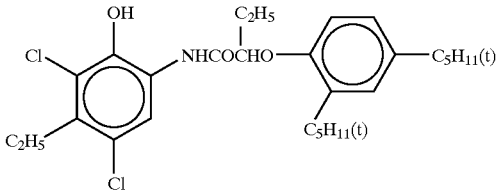
(3)
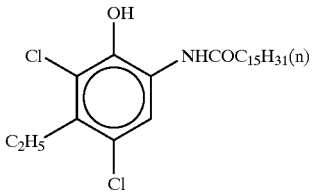
(Cpd-1) Color image stabilizer
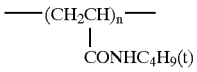
(Cpd-2) Color image stabilizer
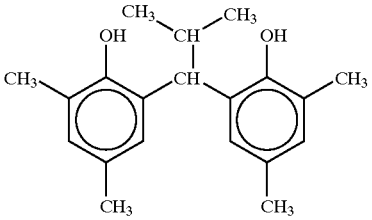
(Cpd-3) Color image stabilizer
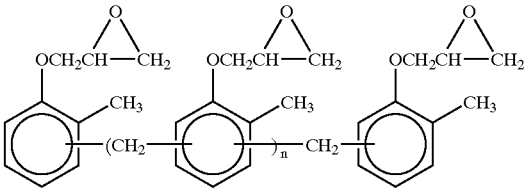
n = 7–8 (on average)
(Cpd-4) Color mixing inhibitor
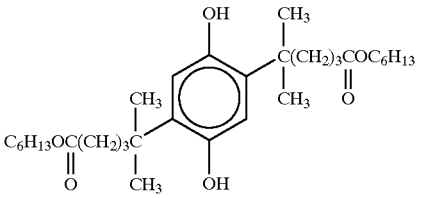
(Cpd-5) Color image stabilizer
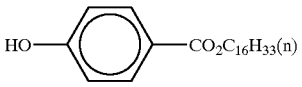
(Cpd-6) Color image stabilizer
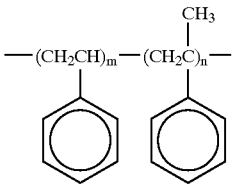
number average molecular weight: 600
m/n = 10/90

(Cpd-7) Color image stabilizer
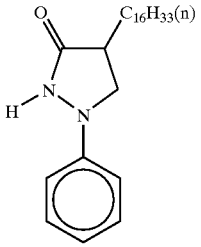
(Cpd-8) Color iamge stabilizer
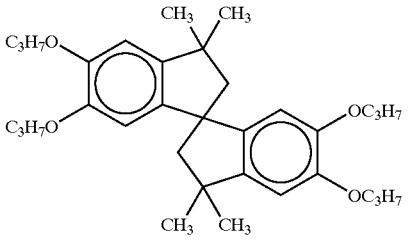
(Cpd-9) Color image stabilizer
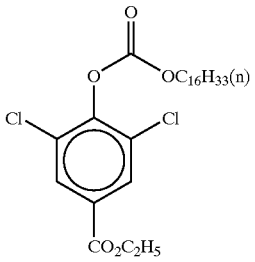
(Cpd-10) Color image stabilizer
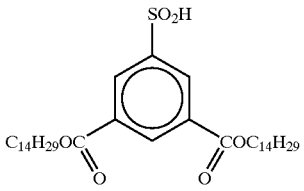
(Cpd-11)
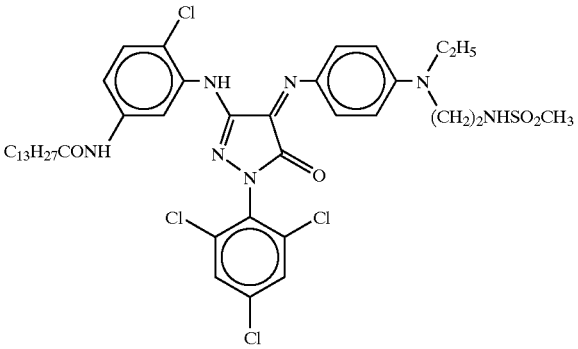
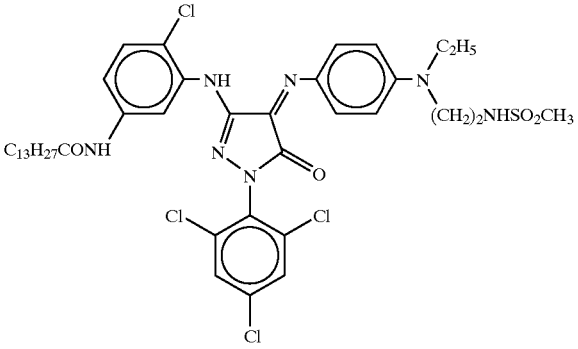
(Cpd-13)
7:3 (by mole) Mixture of
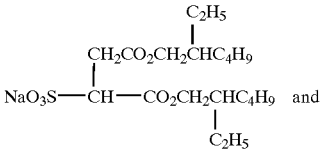
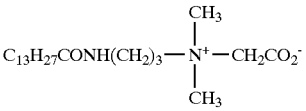
(Cpd-14)
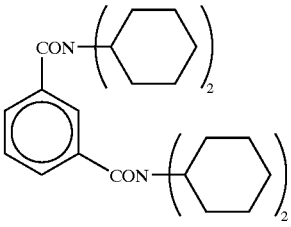

(Cpd-15)
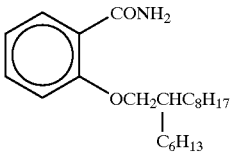
(Cpd-16)
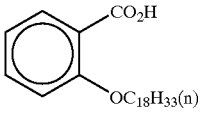
(Cpd-17)
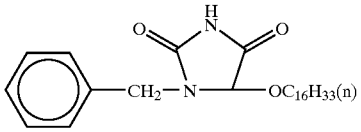
(Cpd-18)
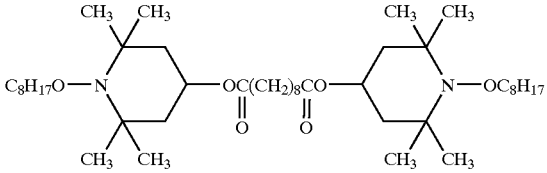
(Cpd-19) Color mixing inhibitor
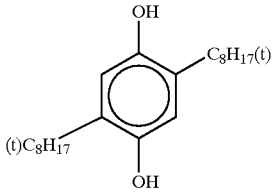
(UV-1) Ultraviolet absorbent
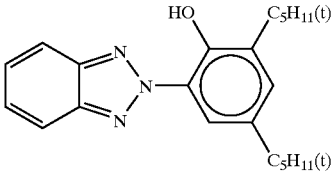
(UV-2) Ultraviolet absorbent
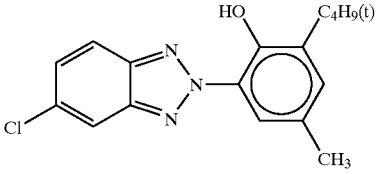
(UV-3) Ultraviolet absorbent
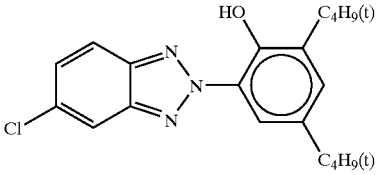
(UV-4) Ultraviolet absorbent
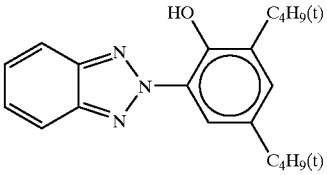
(UV-5) Ultraviolet absorbent
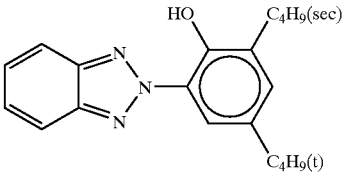
(UV-6) Ultraviolet absorbent
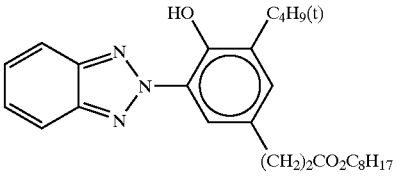

(UV-7) Ultraviolet absorbent

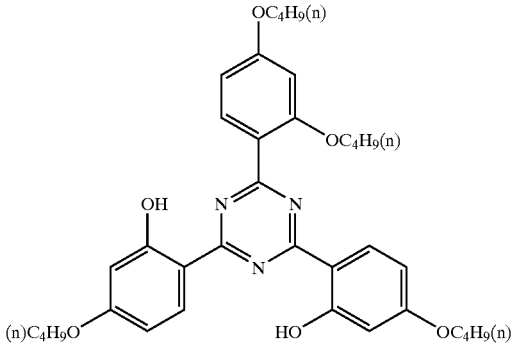

UV-A: 4:2:2:3 (by weight) mixture of UV-1, UV-2, UV-3 and UV-4

UV-B: 9:3:3:4:5:3 (by weight) mixture of UV-1, UV-2, UV-3,
UV-4, UV-5 and UV-6

UV-C: 1:1:1:2 (by weight) mixture of UV-2, UV-3, UV-6 and UV-7

(Solv-1)

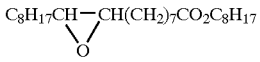

(Solv-2)

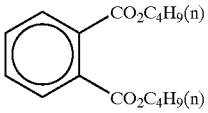

(Solv-3)

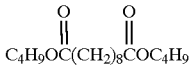

(Solv-4)

-continued (Solv-5)

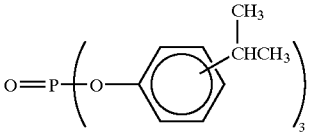

(Solv-7)

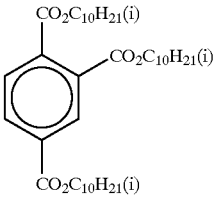

(Solv-8)

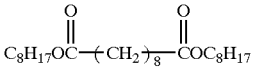

(S1-4)

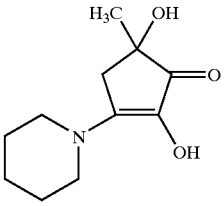

The sample prepared in the foregoing manner was referred Sample No. 101.

Sample Nos. 102 to 108 were prepared in the same manner as Sample No. 101, except that the emulsions in the emulsion layers of Sample No. 101 were changed to those shown below.

TABLE 6

| | BL Emulsion g/m$^2$ | | GL Emulsion g/m$^2$ | | RL Emulsion g/m$^2$ | | |
|---|---|---|---|---|---|---|---|
| Sample No. | Emulsion name | Coverage on silver basis | Emulsion name | Coverage on silver basis | Emulsion name | Coverage on silver basis | Total silver coverage g/m$^2$ |
| 101 | B-1 | 0.24 | G-1 | 0.14 | R-1 | 0.12 | 0.50 |
| 102 | B-1 | 0.19 | G-1 | 0.12 | R-1 | 0.10 | 0.41 |
| 103 | B-2 | 0.24 | G-2 | 0.14 | R-2 | 0.12 | 0.50 |
| 104 | B-2 | 0.19 | G-2 | 0.12 | R-2 | 0.10 | 0.41 |
| 105 | B-3 | 0.24 | G-3 | 0.14 | R-3 | 0.12 | 0.50 |
| 106 | B-3 | 0.19 | G-3 | 0.12 | R-3 | 0.10 | 0.41 |
| 107 | B-4 | 0.24 | G-4 | 0.14 | R-4 | 0.12 | 0.50 |
| 108 | B-4 | 0.19 | G-4 | 0.12 | R-4 | 0.10 | 0.41 |

Each of photosensitive material samples prepared by applying coating solutions for photographic constituent layers was stored for 10 days under a condition of 25° C.–55% RH, cut into sheet, and subjected to successive exposure and photographic processing, and further to evaluation of unevenness caused by image processing.

(Light Source A)

Blue laser of about 470 nm taken out by wavelength conversion of semiconductor laser (lasing wavelength: about 940 nm) through the use of an SHG crystal of $LiNbO_3$ having a waveguide-form reverse domain structure, green laser of about 530 nm taken out by wavelength conversion of semiconductor laser (lasing wavelength: about 1060 nm) through the use of an SHG crystal of $LiNbO_3$ having a waveguide-form reverse domain structure, and red semiconductor laser of about 650 nm (Hitachi type No. HL6501MG) were used as sources of laser beams. Each of these three-color laser beams was moved in a direction perpendicular to the scanning direction by means of a polygon mirror to enable the sequential scanning of samples. Variations in the light quantity of semiconductor laser due to fluctuation of temperature were suppressed by keeping the temperature constant by use of a Peltier device. The effective beam diameter was 80 $\mu$m, the scanning pitch was 42.3 $\mu$m (600 dpi), and the average exposure time per pixel was $1.7\times10^{-7}$ sec (Frontier 370 made by Fuji Photo Film Co., Ltd.)

The calibration for standard gray output was carried out in advance, and on the basis of this calibration data each sample was exposed so as to have uniform gray density.

The processing processes are described below.

(Processing)

Continuous processing was performed using Sample No. 101 until the volume of a replenisher used for color development reached one-half the liquid volume in the color developing tank.

| Processing Step | Temperature | Time | Amount* replenished |
|---|---|---|---|
| Color development | 45.0° C. | 16 sec | 45 mL |
| Bleach-fix | 40.0° C. | 16 sec | 35 mL |
| Rinse 1 | 40.0° C. | 8 sec | — |
| Rinse 2 | 40.0° C. | 8 sec | — |
| Rinse 3** | 40.0° C. | 8 sec | — |
| Rinse 4 | 38.0° C. | 8 sec | 121 mL |
| Drying | 80.0° C. | 16 sec | |

(note)

*per $m^2$ of photosensitive material

**A rinse cleaning system RC50D made by Fuji Photo Film Co., Ltd. was attached to Rinse 3, the rinsing solution was taken out of the rinse 3 and sent into the reverse osmosis module (RC50D) by means of a pump. The permeate the module tank sent out was supplied to Rinse 4, and the condensate was sent back to Rinse 3. The permeate volume of the reverse osmosis module was controlled by pump pressure so as to keep the range of 50 to 300 ml/min, and circulation of the solution was continued for 10 hours a day while regulating the temperature. The rinsing order was 1-2-3-4, and 4-stage counter-current system was applied to the rinse-processing.

Compositions of the processing solutions used are as follows:

Color Developer

| | Tank Solution | Replenisher |
|---|---|---|
| Water | 800 ml | 800 ml |
| Brightening agent (FL-1) | 5.0 g | 8.5 g |
| Triisopropanolamine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium N,N-bis(sulfonatoethyl)-hydroxylamine | 8.5 g | 14.5 g |
| 4-Amino-3-methyl-N-ethyl-N-(β-methanesulfonamidoethyl)aniline 3/2 sulfate monohydrate | 10.0 g | 22.0 g |
| Potassium carbonate | 26.3 g | 26.3 g |
| Water to make | 1,000 ml | 1,000 ml |
| pH (at 25° C., adjusted with sulfuric acid and potassium hydroxide) | 10.35 | 12.6 |

Bleach-Fix Bath

| | Tank solution | Replenisher |
|---|---|---|
| Water | 800 ml | 800 ml |
| Ammonium thiosulfate (750 g/L) | 107 ml | 214 ml |
| Succinic acid | 29.5 g | 59.0 g |
| Ammonium ethylenediaminetetra-acetatoferrate (III) | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (at 25° C., adjusted with nitric acid and aqueous ammonia) | 6.00 | 6.00 |

Rinsing Bath

| | Tank solution | Replenisher |
|---|---|---|
| Sodium chloroisocyanurate | 0.02 g | 0.02 g |
| Deionized water (conductivity: 5 $\mu$s/cm or below) | 1,000 ml | 1,000 ml |
| pH (25° C.) | 6.5 | 6.5 |

FL-1

-continued

| | Tank solution | Replenisher |
|---|---|---|

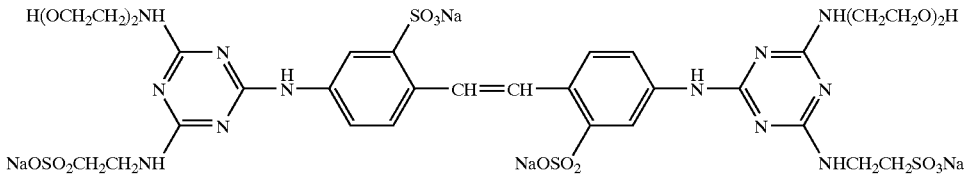

A minilabo printer processor Frontier 330 made by Fuji Photo Film Co., Ltd. was used. In this printer processor, a sheet transport system is adopted and the scanning exposure device described above is mounted. In order to render the process times variable, however, adaptations were made on racks, if needed. In this example, the transport speed was changed on a photographic processing basis, keeping the color development time and the bleach-fix time at a constant value (16 sec), and unevenness of density was evaluated with each change in transport speed.

Additionally, the rinse processing tank and the processing rack were adapted for the blade transport system disclosed in JP-A-2002-55422, the direction of liquid circulation was changed to the downward direction, and a circulation filter with pleats was installed at the tank bottom.

With each change in transport speed, uneven density evaluation of each sample was made in the following way. The results obtained are shown in Table 7.

20 sheets with gray images were formed from each sample, and the gray images underwent sensory evaluation in accordance with the criterion described below and rated on a 1-to-6 scale (6 being best):

6: The gray images are uniform on the whole and almost free of unevenness, or the proportion of sample sheets having perceivable image unevenness is lower than 10%.

5: The proportion of sample sheets having perceivable unevenness in the images is of the order of 10%, but the unevenness is not on the level affecting the quality of finished print.

4: Image unevenness is found among about 10% of the sample sheets processed.

3: Image unevenness is found among higher than 10% of the sample sheets processed.

2: Image unevenness is found among higher than 30% of the sample sheets processed.

1: Image unevenness is found among higher than 50% of the sample sheets processed.

The results shown in Table 7 indicate that, when Sample Nos. 101 to 104 for comparison, which were free of compounds represented by formula (I), were subjected to high-speed (at least 27.8 mm/sec) transport processing by means of the present high-speed transport processing system, image unevenness developed to a considerable extent, but Sample Nos. 105 to 108 according to the invention produced images free of unevenness (specifically, Sample No. 105 was rated as 5 and the others were rated as 6) and can provide prints consistent in quality.

TABLE 7

| | Sheet Transport Speed (mm/sec) | | | |
|---|---|---|---|---|
| Sample No. | 25.0 | 27.8 | 36.0 | 50.0 |
| 101 | 2 | 1 | 1 | 1 |
| 102 | 3 | 2 | 1 | 1 |
| 103 | 3 | 2 | 2 | 1 |
| 104 | 3 | 2 | 2 | 2 |
| 105 | 3 | 5 | 5 | 5 |
| 106 | 3 | 6 | 6 | 6 |
| 107 | 4 | 6 | 6 | 6 |
| 108 | 4 | 6 | 6 | 6 |

EXAMPLE 5

Each of the same samples as prepared in Example 4 was processed in the same manner as in Example 4, except that the sample sheets were transported at a constant speed of 27.8 mm/sec in every photographic processing and the bleach-fix time was changed on a photographic processing basis by use of modified racks, and on the thus processed samples the uneven density evaluation was performed in according to the same criterion. As a result, it was found that the present samples were rated as 6 or 5 as far as the bleach-fix time was within 30 seconds. Therefore, it can be said that the invention is highly beneficial to speed-up of bleach-fix processing.

EXAMPLE 6

The same experiments as in Example 4 were performed on the same samples as prepared in Example 4, except that the colloidal dispersion of gold sulfide or bis(1,4,5-trimethyl-1,2,4-triazolium-3-thiolato)aurate(I) tetrafluoroborate used as gold sensitizer in each of the emulsions was replaced by (thiomannose)gold(I). As a result, it was found that the unevenness of density the samples each developed was reduced further as compared with Example 4.

The present photosensitive materials, which each contain 1-phenyl-5-mercaptotetrazole in their individual emulsion layers and have high silver chloride contents, can provide color prints reduced in density unevenness even when the present image formation method characterized by the photographic processing performed under sheet-form, high-speed transport is applied thereto. Moreover, they can ensure features of the photographic processing performed in a sheet form at high transport speed, namely high productivity and low cost in production of color prints.

EXAMPLE 7

(Preparation of Emulsion B-1)

By a usual method of adding silver nitrate and sodium chloride simultaneously to an aqueous gelatin solution with stirring and mixing them, an emulsion with a high content of cubic silver chloride grains having a volume weighted average sphere-equivalent diameter of 0.54 μm and a variation coefficient of 10% was prepared. In the course of preparation, specifically over a period of time when from 60% to 80% of silver nitrate addition was in progress, a water solution of $Cs_2[Os(NO)Cl_5]$ was added in an amount of $1\times10^{-9}$ mole, based on Os, per mole of finished silver halide and, over a period of time when from 80% to 90% of silver nitrate addition was in progress, potassium bromide (in a proportion of 2.5 mole % to 1 mole of finished silver halide) and $K_4(Ru(CN)_6]$ in an amount of $2\times10^{-5}$ mole, based on Ru, per mole of finished silver halide were added. Further, over a period of time when from 83% to 88% of silver nitrate addition was in progress, $K_2[IrCl_6]$ was added in an amount of $4.8\times10^{-8}$ mole, based on Ir, per mole of finished silver halide. The emulsion obtained was subjected to desalting treatment, and then admixed with gelatin and dispersed again. Thereto, sodium benzenethiosulfonate, Sensitizing Dye A and Sensitizing Dye B illustrated below were added. Further, the resulting emulsion was admixed with a colloidal dispersion of gold sulfide as a sensitizer and ripened to an optimal extent. Furthermore thereto, 1-phenyl-5-mercaptotetrazole and 1-(5-methylureidophenyl)-5-mercapto-tetrazole as compounds of formula (III) according to the invention were each added in the amount of $1.8\times10^{-4}$ mole per mole of silver halide. The thus obtained emulsion was referred to as "Emulsion B-1".

Sensitizing Dye A

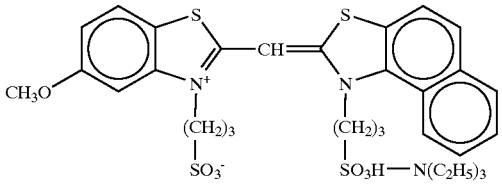

Sensitizing Dye B

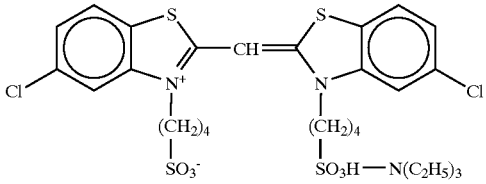

(Preparation of Emulsion B-2)

An emulsion was prepared in the same manner as Emulsion B-1, except that potassium iodide (in a proportion of 0.3 mole % to 1 mole of finished silver halide) was added at a time when 94% of silver nitrate addition was concluded. The emulsion thus prepared was referred to as Emulsion B-2.

(Preparation of Emulsion B-3)

An emulsion was prepared in the same manner as Emulsion B-1, except that the amount of the water solution of $K_2[IrCl_6]$ added over a period of time when from 82% to 88% of silver nitrate addition was in progress was changed to $2.3\times10^{-8}$ mole, based on Ir, per mole of finished silver halide and a water solution of $K_2[Ir(H_2O)Cl_5]$ was further added in an amount of $3.2\times10^{-6}$ mole, based on Ir, per mole of finished silver halide over a period of time when from 92% to 98% of silver nitrate addition was in progress. The emulsion thus prepared was referred to as "Emulsion B-3".

(Preparation of Emulsion B-4)

An emulsion was prepared in the same manner as Emulsion B-1, except that the amount of the water solution of $K_2[IrCl_6]$ added over a period of time when from 82% to 88% of silver nitrate addition was in progress was changed to $1.0\times10^{-8}$ mole, based on Ir, permole of finished silver halide and a water solution of $K_2[Ir(H_2O)Cl_5]$ was further added in an amount of $6.7\times10^{-7}$ mole, based on Ir, per mole of finished silver halide over a period of time when from 92% to 98% of silver nitrate addition was in progress. The emulsion thus prepared was referred to as "Emulsion B-4".

(Preparation of Emulsion B-5)

An emulsion was prepared in the same manner as Emulsion B-1, except that the amount of the water solution of $K_2[IrCl_6]$ added over a period of time when from 82% to 88% of silver nitrate addition was in progress was changed to $1.0\times10^{-8}$ mole, based on Ir, per mole of finished silver halide and a water solution of $K_2[Ir(methylthiazole)Cl_5$ was further added in an amount of $6.7\times10^{-7}$ mole, based on Ir, per mole of finished silver halide over a period of time when from 92% to 98% of silver nitrate addition was in progress. The emulsion thus prepared was referred to as "Emulsion B-5".

(Preparation of Emulsion B-6)

An emulsion was prepared in the same manner as Emulsion B-1, except that the amount of the water solution of $K_2[IrCl_6]$ added over a period of time when from 82% to 88% of silver nitrate addition was in progress was changed to $1.0\times10^{-8}$ mole, based on Ir, per mole of finished silver halide and a water solution of $K_2[Ir(2\text{-chloro-}5\text{-fluorothiazole-}5\text{-methylthiazole})Cl_5]$ was further added in an amount of $6.7\times10^{-7}$ mole, based on Ir, per mole of finished silver halide over a period of time when from 92% to 98% of silver nitrate addition was in progress. The emulsion thus prepared was referred to as "Emulsion B-6".

(Preparation of Emulsion B-7)

An emulsion was prepared in the same manner as Emulsion B-3, except that potassium iodide (in a proportion of 0.3 mole % to 1 mole of finished silver halide) was added at a time when 94% of silver nitrate addition was concluded. The emulsion thus prepared was referred to as Emulsion B-7.

(Preparation of Emulsion B-8)

An emulsion was prepared in the same manner as Emulsion B-4, except that potassium iodide (in a proportion of 0.3 mole % to 1 mole of finished silver halide) was added at a time when 94% of silver nitrate addition was concluded. The emulsion thus prepared was referred to as Emulsion B-8.

(Preparation of Emulsion B-9)

An emulsion was prepared in the same manner as Emulsion B-5, except that potassium iodide (in a proportion of 0.3 mole % to 1 mole of finished silver halide) was added at a time when 94% of silver nitrate addition was concluded. The emulsion thus prepared was referred to as Emulsion B-9.

(Preparation of Emulsion B-10)

An emulsion was prepared in the same manner as Emulsion B-6, except that potassium iodide (in a proportion of 0.3 mole % to 1 mole of finished silver halide) was added at a time when 94% of silver nitrate addition was concluded. The emulsion thus prepared was referred to as Emulsion B-10.

(Preparation of Emulsion B-11)

An emulsion was prepared in the same manner as Emulsion B-1, except that potassium iodide (in a proportion of 0.3 mole % to 1 mole of finished silver halide) was added at a time when 44% of silver nitrate addition was concluded. The emulsion thus prepared was referred to as Emulsion B-11.

(Preparation of Emulsion G-1)

By a usual method of adding silver nitrate and sodium chloride simultaneously to an aqueous gelatin solution with stirring and mixing them, an emulsion with a high content of cubic silver chloride grains having a sphere-equivalent diameter of 0.40 $\mu$m and a variation coefficient of 10% was prepared. In the course of preparation, specifically over a period of time when from 80% to 90% of silver nitrate addition was in progress, $K_4[Ru(CN)_6]$ in an amount of $3.0\times10^{-5}$ mole, based on Ru, per mole of finished silver halide was added. And over a period of time when from 80% to 100% of silver nitrate addition was in progress, potassiumbromide (in a proportion of 4 mole % to 1 mole of finished silver halide) was added. Further, over a period of time when from 83% to 88% of silver nitrate addition was in progress, $K_2[IrCl_6]$ was added in an amount of $5.0\times10^{-8}$ mole, based on Ir, per mole of finished silver halide. Furthermore, potassium iodide (in a proportion of 0.2 mole % to one mole of finished silver halide) was added at a time when 90% of silver nitrate addition was concluded. The emulsion obtained was subjected to desalting treatment, and then admixed with gelatin and dispersed again. Further, the resulting emulsion was admixed with sodium benzenethiosulfonate, and ripened to an optimal extent by use of a colloidal dispersion of gold sulfide as a sensitizer. Thereto, Sensitizing Dye D, 1-phenyl-5-mercaptotetrazole, 1-(5-methylureidophenyl)-5-mercapto-tetrazole and potassium bromide were added. The thus obtained emulsion was referred to as "Emulsion G-1".

Sensitizing Dye D

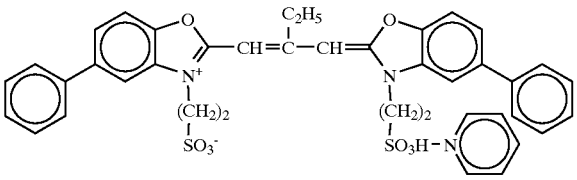

(Preparation of Emulsion R-1)

By a usual method of adding silver nitrate and sodium chloride simultaneously to an aqueous gelatin solution with stirring and mixing them, an emulsion with a high content of cubic silver chloride grains having a sphere-equivalent diameter of 0.35 $\mu$m and a variation coefficient of 10% was prepared. In the course of preparation, specifically over a period of time when from 80% to 90% of silver nitrate addition was in progress, $K_4[Ru(CN)_6]$ in an amount of $3\times10^{-5}$ mole, based on Ru, per mole of finished silver halide was added. And over a period of time when from 80% to 100% of silver nitrate addition was in progress, potassium bromide (in a proportion of 4.3 mole % to 1 mole of finished silver halide) was added. Further, over a period of time when from 83% to 88% of silver nitrate addition was in progress, $K_2[IrCl_6]$ was added in an amount of $5\times10^{-9}$ mole, based on Ir, per mole of finished silver halide. Furthermore, potassium iodide (in a proportion of 0.15 mole % to 1 mole of finished silver halide) was added at a time when 90% of silver nitrate addition was concluded. The emulsion obtained was subjected to desalting treatment, and then admixed with gelatin and dispersed again. Further, the resulting emulsion was admixed with sodium benzenethiosulfonate, and ripened to an optimal extent by using sodium thiosulfate pentahydrate as a sulfur sensitizer and bis(1,4,5-trimethyl-1,2,4-triazolium-3-thiolato)aurate(I) tetrafluoroborate as a gold sensitizer. Thereto were further added Sensitizing Dye H, 1-phenyl-5-mercaptotetrazole, 1-(5-methylureidophenyl)-5-mercapto-tetrazole, Compound I and potassium bromide. The thus obtained emulsion was referred to as "Emulsion R-1".

Sensitizing Dye H

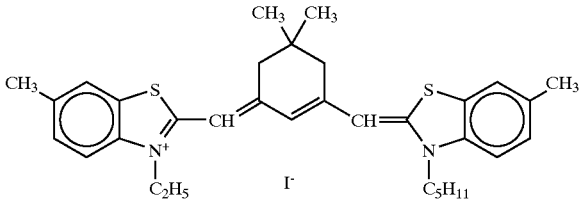

Compound I

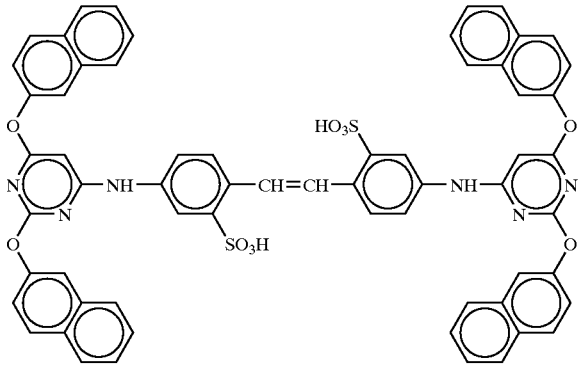

The surface of a paper support covered with polyethylene resin on both sides was subjected to a corona discharge operation, provided with a gelatin subbing layer containing sodium dodecylbenzenesulfonate, and further coated with first to seventh photographic constituent layers to prepare a silver halide color photographic material sample having the following layer structure. Coating compositions used were prepared in the manner described below.

Preparation of Coating Solution for First Layer:

A yellow coupler (ExY) in the amount of 57 g, 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in a mixture of 21 g of a solvent (Solv-1) and 80 ml of ethyl acetate, and then dispersed in an emulsified condition into 220 g of a 23.5 weight % aqueous gelatin solution containing 4 g of sodium dodecylbenzenesulfonate by use of a high speed agitation emulsification apparatus (dissolver), and further thereto 900 g of water was added. Thus, emulsified Dispersion A was prepared.

The emulsified Dispersion A thus prepared was mixed homogeneously with the Emulsion B-1, and thereto were added other ingredients described below so as to obtain the coating solution for the first layer having the following composition. The emulsion coverage is shown on a silver basis.

Coating solutions for the second to seventh layers were prepared respectively in the same manner as that for the first layer. In each layer, sodium 1-oxy-3,5-dichloro-s-triazine (H-1), Hardener (H-2) and Hardener (H-3) were used as gelatin hardener. In addition, Ab-1, Ab-2, Ab-3 and Ab-4 were added to all layers so that their total coverage values were 15.0 mg/m$^2$, 60.0 mg/m$^2$, 5.0 mg/m$^2$ and 10.0 mg/m$^2$, respectively.

(H-1) Hardener

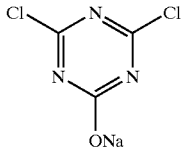

(used in a proportion of 1.4% by weight to gelatin)

(H-2) Hardener

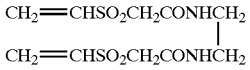

(H-3) Hardener

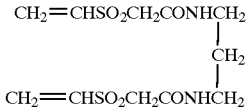

(Ab-1) Antiseptic

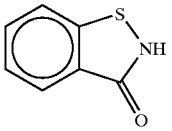

(Ab-2) Antiseptic

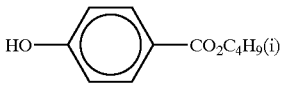

(Ab-3) Antiseptic

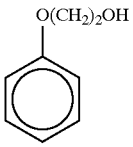

(Ab-4) Antiseptic
1:1:1:1 (by mole) Mixture of a, b, c and d

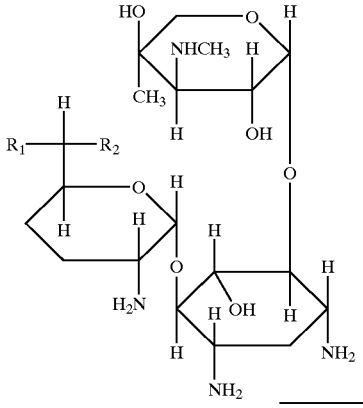

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Further, 1-phenyl-5-mercaptotetrazole was added to the green-sensitive emulsion layer and the red-sensitive emulsion layer in amounts of $1.0\times10^{-3}$ mole and $5.9\times10^{-4}$ mole, respectively, per mole of silver halide. Furthermore, 1-phenyl-5-mercaptotetrazole was added to the second layer, the fourth layer and the sixth layer so as to have coverage values of 0.2 mg/m $^2$, 0.2 Mg/m$^2$ and 0.6 mg/m$^2$ respectively.

Moreover, methacrylic acid-butylacrylate (1:1 by weight) copolymer latex (average molecular weight: 200,000 to 400,000) was added to the red-sensitive emulsion layer so as to have coverage of 0.05 g/m$^2$.

In addition, disodium catechol-3,5-disulfonate was added to the second layer, the fourth layer and the sixth layer so as to have coverage values of 6 mg/m$^2$, 6 Mg/m$^2$ and 18 mg/m$^2$, respectively. For preventing irradiation, the following dyes were further added (each figure in parentheses designates the coverage).

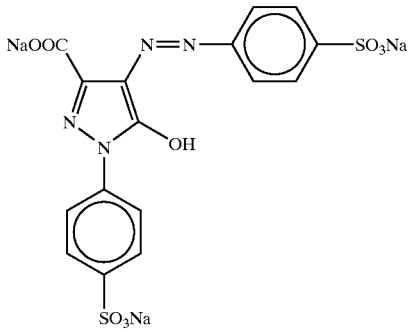

(2mg/m$^2$)

-continued

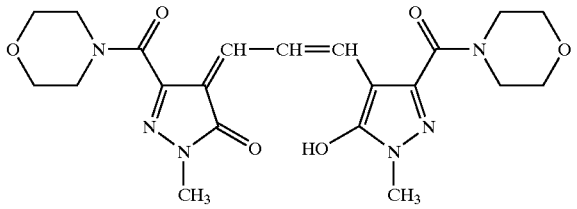

(2mg/m$^2$)

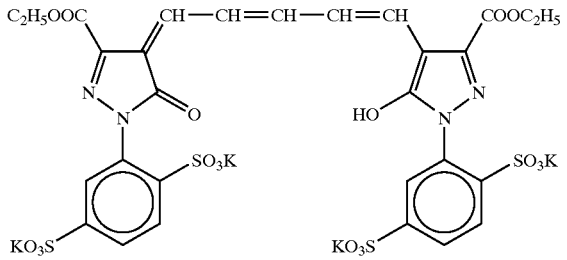

(3mg/m$^2$)

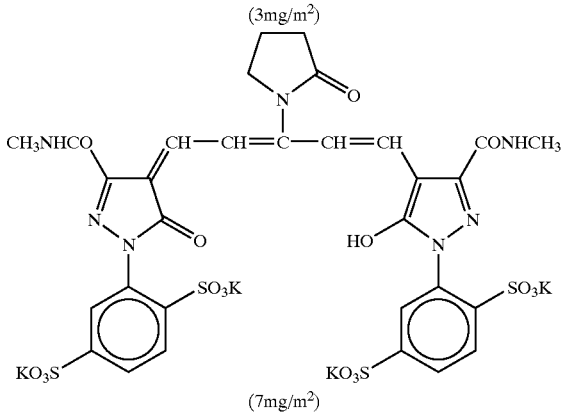

(7mg/m$^2$)

(Layer Structure)

The composition of each constituent layer is described below. Each figure on the right side designates the coverage (g/m$^2$) of the ingredient corresponding thereto. As to the silver halide emulsion, the figure represents the coverage based on silver.

Support:

Polyethylene resin-laminated paper which contained white pigments ($TiO_2$: content 16 weight %, ZnO: content 4 weight %), a brightening agent (4,4'-bis(5-methylbenzoxazolyl)-stilbene: content 0.03 weight %) and a bluish dye (ultramarin) in the polyethylene resin on the side of the first layer.

First Layer (Blue-Sensitive Emulsion Layer):

| | |
|---|---|
| Emulsion B-1 | 0.19 |
| Gelatin | 1.00 |
| Yellow coupler (ExY) | 0.46 |
| Color image stabilizer (Cpd-1) | 0.06 |
| Color image stabilizer (Cpd-2) | 0.03 |
| Color image stabilizer (Cpd-3) | 0.06 |
| Color image stabilizer (Cpd-8) | 0.02 |
| Solvent (Solv-1) | 0.17 |

Second Layer (Color Mixing Inhibiting Layer):

| | |
|---|---|
| Gelatin | 0.50 |
| Color mixing inhibitor (Cpd-4) | 0.05 |
| Color image stabilizer (Cpd-5) | 0.01 |
| Color image stabilizer (Cpd-6) | 0.06 |
| Color image stabilizer (Cpd-7) | 0.01 |
| Solvent (Solv-1) | 0.03 |
| Solvent (Solv-2) | 0.11 |

Third Layer (Green-Sensitive Emulsion Layer):

| | |
|---|---|
| Emulsion G-1 | 0.12 |
| Gelatin | 1.36 |
| Magenta coupler (ExM) | 0.15 |
| Ultraviolet absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |

Fourth Layer (Color Mixing Inhibiting Layer):

| | |
|---|---|
| Gelatin | 0.36 |
| Color mixing inhibitor (Cpd-4) | 0.03 |
| Color image stabilizer (Cpd-5) | 0.006 |
| Color image stabilizer (Cpd-6) | 0.05 |
| Color image stabilizer (Cpd-7) | 0.004 |
| Solvent (Solv-1) | 0.02 |
| Solvent (Solv-2) | 0.08 |

Fifth Layer (Red-Sensitive Emulsion Layer):

| | |
|---|---|
| Emulsion R-1 | 0.10 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |

Sixth Layer (Ultraviolet Absorbing Layer):

| | |
|---|---|
| Gelatin | 0.46 |
| Ultraviolet absorbent (UV-B) | 0.45 |
| Compound (S1-4) | 0.0015 |
| Solvent (Solv-7) | 0.25 |

Seventh Layer (Protective Layer):

| | |
|---|---|
| Gelatin | 1.00 |
| Acryl-modified polyvinyl alcohol (modification degree: 17%) | 0.04 |
| Liquid paraffin | 0.02 |
| Surfactant (Cpd-13) | 0.01 |

The structural formulae of the compounds used herein are illustrated below:

(ExY) Yellow coupler

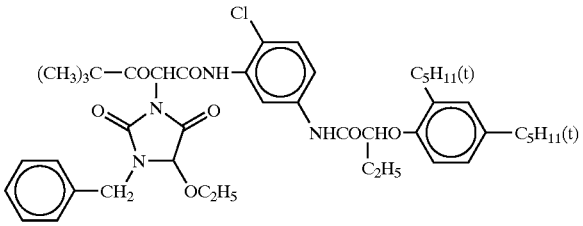

(ExM) Magenta coupler

40:40:20 (by mole) Mixture of (1), (2) and (3)

(1)

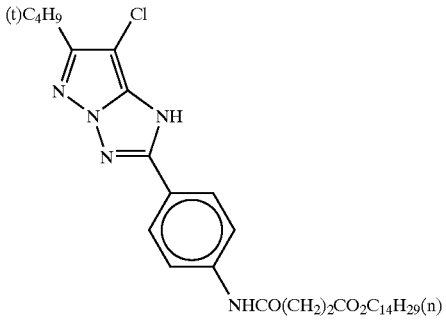

(2)

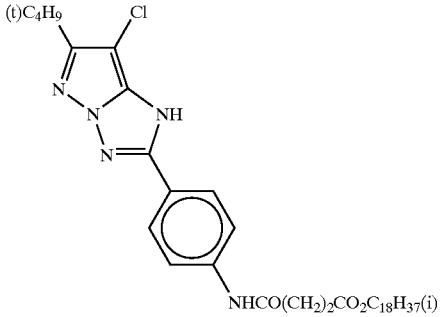

(3)

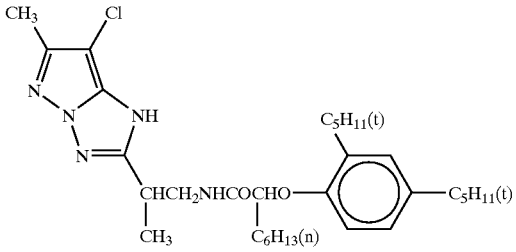

(ExC-2) Cayn coupler

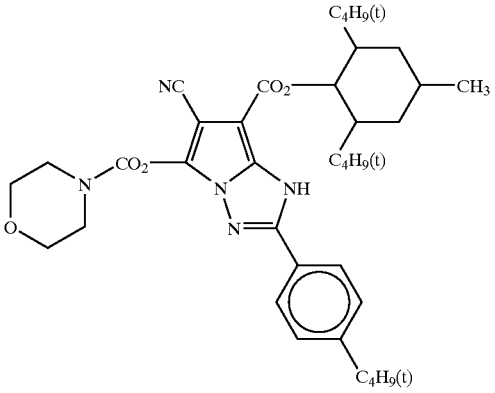

(ExC-3) Cyan coupler

50:25:25 (by mole) Mixture of (1), (2) and (3):

(1)

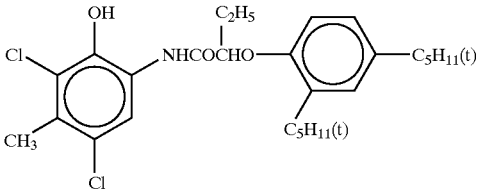

(2)

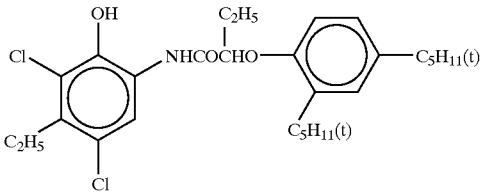

(3)

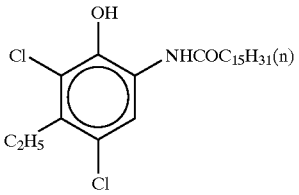

(Cpd-1) Color image stabilizer

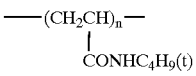

number average molecular weight: 60,000

(Cpd-2) Color image stabilizer
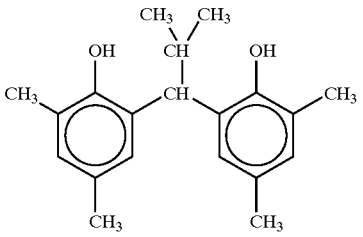
(Cpd-3) Color image stabilizer
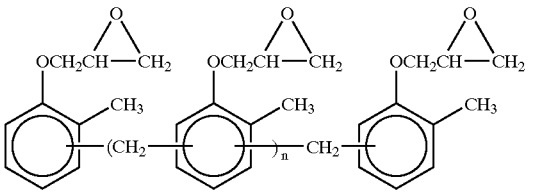
n = 7–8 (on average)
(Cpd-4) Color mixing inhibitor
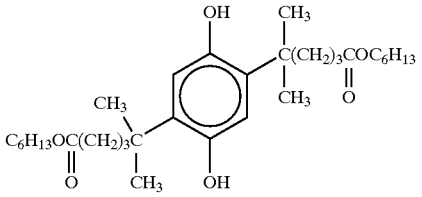
(Cpd-5) Color image stabilizer
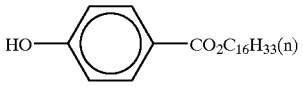
(Cpd-6) Color image stabilizer
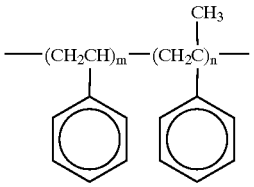
number average molecular weight: 600 m/n = 10/90
(Cpd-7) Color image stabilizer
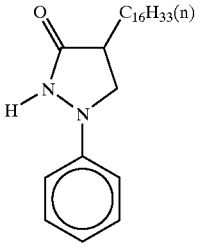
(Cpd-8) Color image stabilizer
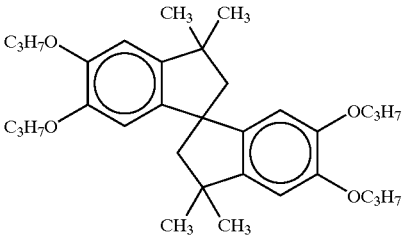
(Cpd-9) Color image stabilizer
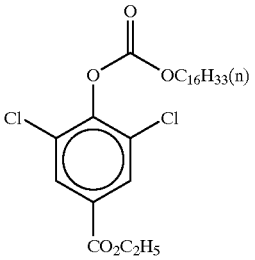
(Cpd-10) Color image stabilizer
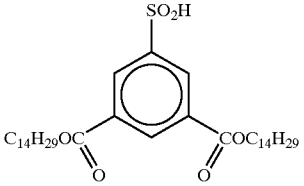
(Cpd-11)

-continued
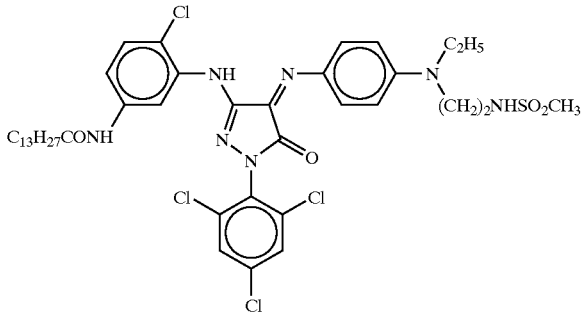
(Cpd-13)
7:3 (by mole) Mixture
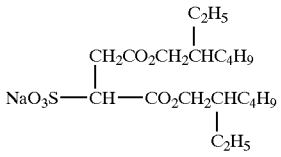
and
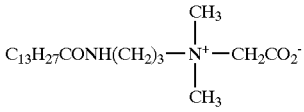
(Cpd-14)
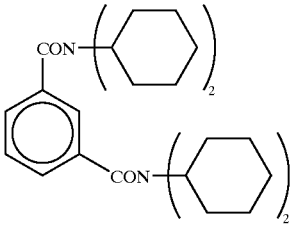
(Cpd-15)
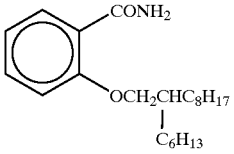
(Cpd-16)
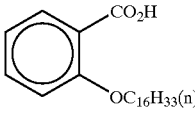
(Cpd-17)
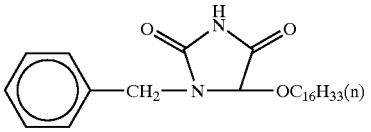
(Cpd-18)
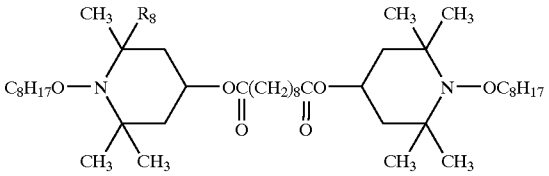
(Cpd-19) Color mixing inhibitor
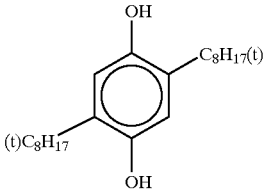
(UV-1) Ultraviolet absorbent
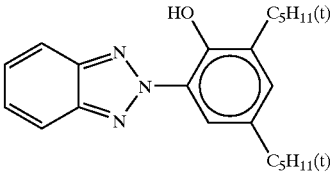
(UV-2) Ultraviolet absorbent
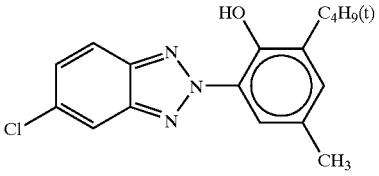
(UV-3) Ultraviolet absorbent
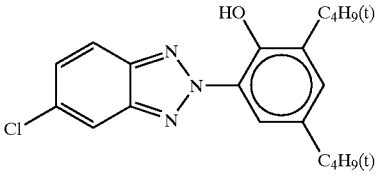

(UV-4) Ultraviolet absorbent

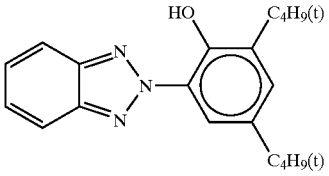

(UV-5) Ultraviolet absorbent

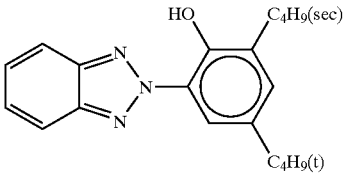

(UV-6) Ultraviolet absorbent

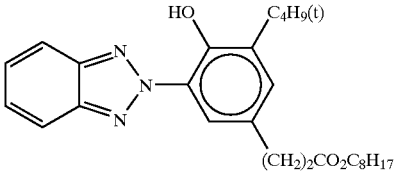

(UV-7) Ultraviolet absorbent

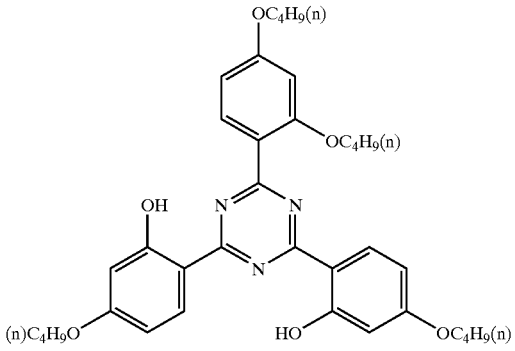

UV-A: 4:2:2:3 (by weight) mixture of UV-1, UV-2, UV-3 and UV-4

UV-B: 9:3:3:4:5:3 (by weight) mixture of UV-1, UV-2, UV-3,

UV-4, UV-5 and UV-6

UV-C: 1:1:1:2 (by weight) mixture of UV-2, UV-3, UV-6 and UV-7

(Solv-1)

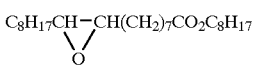

-continued (Solv-2)

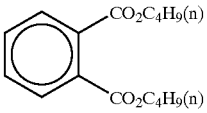

(Solv-3)

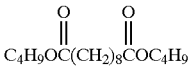

(Solv-4)

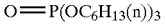

(Solv-5)

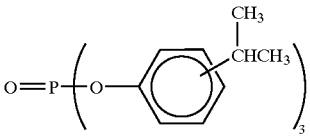

(Solv-7)

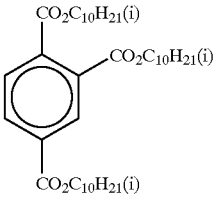

(Solv-8)

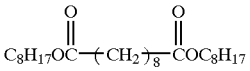

(Sl-4)

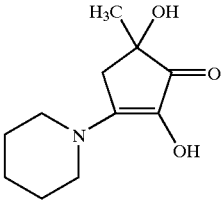

The sample prepared in the foregoing manner was referred to as Sample No. 101.

Sample Nos. 102 to 112 were prepared in the same manner as Sample No. 101, except that the emulsions in the blue-sensitive emulsion layer was changed to those shown below, respectively.

While being transported, each sample in a state of being cut into sheets was subjected to exposure corresponding to medium-density gray, and then to continuous processing in accordance with the processing process described below, thereby preparing processing solutions in running equilibrium. After the continuous processing, each sample further underwent the exposure for evaluation of pressure sensitization streaks, which is described below, and then processed with the processing solutions prepared. The processing performed herein was Processing A described below.

Photographic Processing A:

Continuous processing was performed using the following processing compositions and a minilabo printer processor, Frontier 330, made by Fuji Photo Film Co., Ltd. in the following processing process until the replenisher volume reached three times the liquid volume in the color developing tank. This processing is referred to as "Processing A". Additionally, the transport speed of Frontier 330 was increased to 27.9 mm/sec, and the processing racks in the color development and bleach-fix processing tanks were modified. Further, the rinse processing tank and the processing rack were adapted for the blade transport system disclosed in JP-A-2002-55422, the direction of liquid circulation was changed to the downward direction (following the form described in Japanese Patent Application No. 2001-147814), and a circulation filter with pleats was installed at the tank bottom.

<Photographic Processing Condition A>

| Processing Steps | Temperature | Time | Amount replenished |
|---|---|---|---|
| Color development | 45.0° C. | 25 sec | 45 ml/m$^2$ |
| Bleach-fix | 40.0° C. | 25 sec | Replenisher A 17.5 ml/m$^2$ Replenisher B 17.5 ml/m$^2$ |
| Rinse (1) | 40.0° C. | 7 sec | — |
| Rinse (2) | 40.0° C. | 4 sec | — |
| Rinse (3) | 40.0° C. | 4 sec | — |
| Rinse (4) | 40.0° C. | 7 sec | 175 ml/m$^2$ |
| Drying | 80° C. | 20 sec | |

<Color Developer>

| | Tank Solution | Replenisher |
|---|---|---|
| Cation-exchanged water | 800 ml | 800 ml |
| Dimethylpolysiloxane surfactant (Silicone KF351A, produced by Shin-Etsu Chemical Co., Ltd.) | 0.05 g | 0.05 g |
| Potassium hydroxide | 4.0 g | 9.0 g |
| Sodium hydroxide | 2.0 g | 6.0 g |
| Ethylenediaminetetraacetic acid | 4.0 g | 4.0 g |
| Tylon | 0.5 g | 0.5 g |

-continued

| | | |
|---|---|---|
| Potassium chloride | 19.0 g | — |
| Sodium bromide | 0.036 g | — |
| P-1 (illustrated below) | 1.5 g | 2.9 g |
| S-1 (illustrated below) | 3.5 g | 9.0 g |
| Sodium p-toluenesulfonate | 15.0 g | 15.0 g |
| Sodium sulfite | 0.2 g | 0.2 g |
| m-Carboxybenzenesulfinic acid | 2.0 g | 3.6 g |
| Disodium N,N-bis(sulfonatoethyl)-hydroxylamine | 5.0 g | 10.8 g |
| N-Ethyl-N-(β-methanesulfonamido-ethyl)-3-methyl-4-aminoaniline 3/2 sulfate monohydrate | 6.7 g | 17.3 g |
| Potassium carbonate | 26.3 g | 26.3 g |
| Water to make | 1,000 ml | 1,000 ml |
| pH (at 25° C., adjusted with potassium hydroxide and sulfuric acid) | 10.12 | 10.26 |

<Bleach-Fix Bath>

| | Tank solution | Replenisher A | Replenisher B |
|---|---|---|---|
| Water | 650 ml | 300 ml | 300 ml |
| Ammonium thiosulfate (750 g/l) | 97.0 ml | — | 376.0 ml |
| Ammonium bisulfite soln. (65%) | 13.0 g | — | 185.5 ml |
| Ammonium sulfite | 21.0 g | — | — |
| Ammonium ethylenediaminetetra-acetatoferrate (III) | 37.0 g | 184.0 g | — |
| Ethylenediaminetetraacetic acid | 1.6 g | 0.4 g | 10.0 g |
| m-Carboxybenzenesulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Aqueous ammonia (27%) | 3.4 g | — | 36.0 g |
| Water to make | 1,000 ml | 1,000 ml | 1,000 ml |
| pH (at 25° C., adjusted with aqueous ammonia and nitric acid) | 5.9 | 2.5 | 5.75 |

<Rinsing Bath (Tank solution = Replenisher)>

| | |
|---|---|
| Sodium chloroisocyanurate | 0.02 g |
| Deionized water (conductivity: 5 μs/cm or below) | 1,000 ml |

P-1

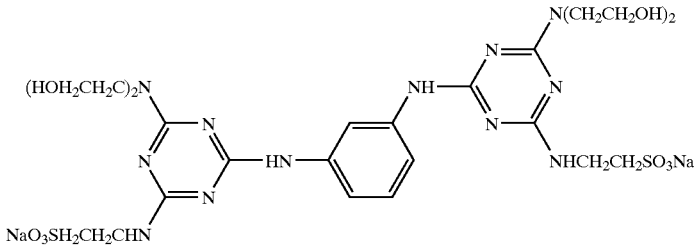

S-1

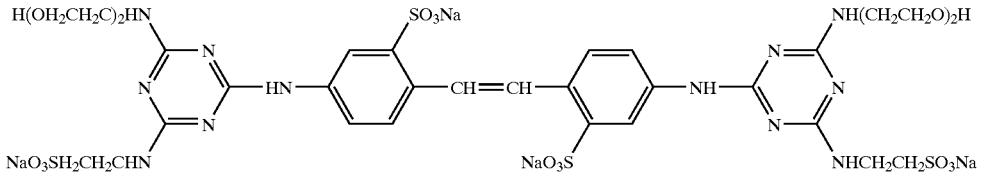

Additionally, the replenisher for color development was prepared by diluting a concentrated prepared liquid chemical with 3.84 parts of water by menas of an automatic dilution device mounted in an automatic developing machine. Similarly to the replenisher for color development, the replenishers A and B for bleach-fix were prepared by diluting concentrated prepared liquid chemicals part A and part B for bleach-fix, respectively, with 1.5 parts of water.

After exposure was performed so that the samples each showed step yellow-color formation, the samples thus exposed were each processing in accordance with the foregoing Processing A. The evaluation of pressure sensitization level was performed on the processed samples each. The results obtained are shown in Table 8. Herein, the transport of each sample in Processing A was carried out in a state of sheets. Ten evaluators marked pressure sensitization streaks in accordance with the following criterion, and the average marking of them was calculated. Therein, every sample had no yellow streaks in the unexposed areas. Accordingly, the evaluation result of every sample was not concerned with pressure fog but pressure sensitization. Pressure sensitization streaks resulting from another processing referred to as Processing A', which differed from Processing A only in its having the transport speed and the processing temperature changed to 15 mm/sec and 38.5° C., respectively, were evaluated in the same way as in the case of Processing A. The results obtained are also shown in Table 8.

The evaluation of pressure sensitization level was made in accordance with the criterion described below:

Criterion of Pressure Sensitization Level Judgment

5: No yellow sensitization streak is observed at all

4: Few yellow sensitizaion streaks are observed, but the number thereof is at a satisfactory level 3: Yellow sensitization streaks are observed, but they present no problem from a practical point of view 2: Yellow sensitization streaks are observed at a problematic level 1: Yellow sensitization streaks are observed notably and they are at a seriously problematic level

TABLE B

| Sample | Emulsion | Silver iodide phase (time at which it was formed) | Compound of formula (I) | Level of pressure sensitization streaks: Processing A | Level of pressure sensitization streaks: Processing A' | note |
|---|---|---|---|---|---|---|
| 101 | B-1 | absent | not added | 1.6 | 3.7 | comparison |
| 102 | B-2 | present (after 94% formation of grains) | not added | 3.5 | 3.7 | invention |
| 103 | B-3 | absent | $K_2$ [Ir(5-methylthiazole)$Cl_5$] | 3.8 | 4.2 | invention |
| 104 | B-4 | absent | $K_2$ [Ir($H_2O$)$Cl_5$] | 3.5 | 3.8 | invention |
| 105 | B-5 | absent | $K_2$ [Ir(methylthioazole)$Cl_5$] | 3.4 | 3.7 | invention |
| 106 | B-6 | absent | $K_2$ [Ir(2-chloro-5-fluorothiazole-5-methylthiazole)$Cl_5$] | 4.1 | 4.3 | invention |
| 107 | B-7 | present (after 94% formation of grains) | $K_2$ [Ir(5-methylthiazole)$Cl_5$] | 4.2 | 4.3 | invention |
| 108 | B-8 | present (after 94% formation of grains) | $K_2$ [Ir($H_2O$)$Cl_5$] | 4.0 | 4.2 | invention |
| 109 | B-9 | present (after 94% formation of grains) | $K_2$ [Ir(methylthiazole)$Cl_5$] | 4.0 | 4.1 | invention |
| 110 | B-10 | present (after 94% formation of grains) | $K_2$ [Ir(2-chloro-5-fluorothiazole-5-methylthiazole)$Cl_5$] | 4.2 | 4.3 | invention |
| 111 | B-11 | present (after 44% formation of grains) | not added | 3.0 | 3.7 | invention |

The effect of the invention is clear from the data shown in Table B. More specifically, it can be seen from Table 8 that Sample Nos. 101 and 111 using the emulsions containing the present silver iodide, Sample Nos. 103 to 105 using the silver halide grains containing the present compounds of formula (I) and Sample Nos. 106 to 110 using the silver halide emulsions containing both the present silver iodide and compounds of formula (I) were all improved in pressure sensitization streaks, compared with Sample No. 101 using the silver halide emulsion containing neither silver ioide nor present compound of formula (I). Of these samples, Sample Nos. 106 to 110 using the silver halide emulsions containing both the silver iodide and the present compounds of formula (I) have proved to be highly effective in achieving improvement of pressure sensitization streaks. In addition, it can be seen from the comparison between Sample No. 102 and Sample No. 111 that the formation of silver iodide phase in locations near the surface of silver halide grains had greater effect upon the improvement.

EXAMPLE 8

Emulsions were prepared in the same manners as Emulsions B-1, B-7, B-8, B-9 and B-10 prepared in Example 7, except that the amount in which 1-phenyl-5-mercaptotetrazole and 1-(5-methylureidophenyl)-5-mercaptotetrazole as the present compounds of formula (III) were each added was changed to $0.75\times10^{-4}$ mole per mole of silver halide, and referred to as Emulsions B-21, B-27, B-28, B-29 and B-30, respectively.

Further, other emulsions were prepared in the same manners as Emulsions B-1, B-7, B-8, B-9 and B-10 prepared in Example 7, except that the amount in which 1-phenyl-5-mercaptotetrazole and 1-(5-methylureidophenyl)-5-mercaptotetrazole as the present compounds of formula (III) were each added was changed to $3.6\times10^{-4}$ mole per mole of silver halide, and referred to as Emulsions B-31, B-37, B-38, B-39 and B-40, respectively.

Samples were prepared in the same manners as the samples prepared in Example 7, except that the emulsions in their respective first layers were changed as shown in Table 9, and on these samples an evaluation of pressure sensitization streaks was performed as in accordance with the same criterion as in Example 7. In evaluating the pressure sensitization streaks developing in the samples used just after preparation and after storage, respectively, the samples stored at 25° C. for one week after coating operations and the samples stored at 25° C. for one week after coating operations and further stored at 40° C. for two weeks were prepared. The evaluation results obtained are shown in Table 9.

As can be seen from Table 9, the present samples containing compounds represented by formula (III) in amounts falling within the range preferred by the invention (specifically, $1.0\times10^{-4}<M\cdot1<2.5\times10^{-4}$ in the case where the compounds of formula (III) are added in a total amount of M moles per mole of silver halide and the volume weighted average sphere-equivalent diameter of silver halide grains is denoted by 1 ($\mu$m)) had satisfactory effect upon improvement in pressure sensitization streaks, irrespective of whether they underwent photographic processing after one-week storage at 25° C. or after two-week storage at 40° C. subsequent to one-week storage at 25° C. On the other hand, it can be seen that the samples containing Compounds of formula (III) in amounts larger than the range preferred by the invention had somewhat reduced effect upon improvement in pressure sensitization streaks even when they were processed after one-week storage at 25° C. after coating operations. Further, it can also be seen that the samples containing Compounds of formula (III) in amounts smaller than the range preferred by the invention had satisfactory effect on improvement in pressure sensitization streaks when they were processed after one-week storage at 25° C., but their effects upon improvement in pressure sensitization streaks were somewhat reduced by additional two-week storage at 40° C. In other words, table 9 indicates that it is better to add the compounds represented by formula (III) in amounts falling within the range preferred by the invention.

TABLE 9

| Sample | Emulsion | Amount of Compound of formula (III) added | Amount of Ccompound of formula (III) added × volume weighted average sphere-equivalent diameter ($\times10^{-4}$ mol/mol Ag) | Level of pressure sensitization streaks: One-week storage at 25° C. after coating | Level of pressure sensitization streaks: One-week storage at 25° C. after coating plus two-week storage at 40° C. | note |
|---|---|---|---|---|---|---|
| 101 | B-1 | $3.6\times10^{-4}$ mol/mol Ag | 3.6 | 1.6 | 1.1 | comparison |
| 107 | B-7 | $3.6\times10^{-4}$ mol/mol Ag | 3.6 | 4.2 | 4.1 | invention |
| 108 | B-8 | $3.6\times10^{-4}$ mol/mol Ag | 3.6 | 4.0 | 4.1 | invention |
| 109 | B-9 | $3.6\times10^{-4}$ mol/mol Ag | 3.6 | 4.0 | 4.1 | invention |
| 110 | B-10 | $3.6\times10^{-4}$ mol/mol Ag | 3.6 | 4.2 | 4.3 | invention |
| 111 | B-21 | $1.5\times10^{-4}$ mol/mol Ag | 1.5 | 1.4 | 1.2 | comparison |

TABLE 9-continued

| Sample | Emulsion | Amount of Compound of formula (III) added | Amount of Ccompound of formula (III) added × volume weighted average sphere-equivalent diameter ($\times10^{-4}$ mol/mol Ag) | Level of pressure sensitization streaks: One-week storage at 25° C. after coating | Level of pressure sensitization streaks: One-week storage at 25° C. after coating plus two-week storage at 40° C. | note |
|---|---|---|---|---|---|---|
| 117 | B-27 | $1.5\times10^{-4}$ mol/mol Ag | 1.5 | 4.4 | 3.2 | invention |
| 118 | B-28 | $1.5\times10^{-4}$ mol/mol Ag | 1.5 | 4.2 | 3.1 | invention |
| 119 | B-29 | $1.5\times10^{-4}$ mol/mol Ag | 1.5 | 3.9 | 3.0 | invention |
| 120 | B-30 | $1.5\times10^{-4}$ mol/mol Ag | 1.5 | 4.1 | 3.2 | invention |
| 121 | B-31 | $7.2\times10^{-4}$ mol/mol Ag | 7.2 | 1.1 | 1.1 | comparison |
| 127 | B-37 | $7.2\times10^{-4}$ mol/mol Ag | 7.2 | 2.8 | 2.9 | invention |
| 128 | B-38 | $7.2\times10^{-4}$ mol/mol Ag | 7.2 | 2.8 | 2.8 | invention |
| 129 | B-39 | $7.2\times10^{-4}$ mol/mol Ag | 7.2 | 3.0 | 2.8 | invention |
| 130 | B-40 | $7.2\times10^{-4}$ mol/mol Ag | 7.2 | 3.1 | 3.0 | invention |

EXAMPLE 9

(Preparation of Emulsion B-H1)

By a usual method of adding silver nitrate and sodium chloride simultaneously to an aqueous gelatin solution with stirring and mixing them, an emulsion with a high content of cubic silver chloride grains having a volume weighted average sphere-equivalent diameter of 0.53 $\mu$m and a variation coefficient of 10% was prepared. In the course of preparation, specifically over a period of time when from 50% to 80% of silver nitrate addition was in progress, a water solution of $Cs_2[OsCl_5(NO)]$ was added in an amount of $2\times10^{-9}$ mole, based on Os, per mole of finished silver halide and, over a period of time when from 80% to 90% of silver nitrate addition was in progress, potassium bromide (in a proportion of 2 mole % to one mole of finished silver halide) and $K_4[Ru(CN)_6]$ were added. Further, over a period of time when from 83% to 88% of silver nitrate addition was in progress, $K_2(IrCl_6]$ was added. The emulsion obtained was subjected to desalting treatment, and then admixed with gelatin and dispersed again. Thereto, sodium benzenethiosulfonate, Sensitizing Dye A and Sensitizing Dye B were added. Further, the resulting emulsion was admixed with thioglucosegold as a sensitizer and ripened to an optimal extent. Furthermore thereto, 1-phenyl-5-mercaptotetrazole and 1-(5-methylureidophenyl)-5-mercaptotetrazole as compounds represented by formula (III) according to the invention were each added in the amount of $1.8\times10^{-4}$ mole per mole of silver halide. The thus obtained emulsion was referred to as "Emulsion B-H1".

(Preparation of Emulsion B-L1)

By a usual method of adding silver nitrate and sodium chloride simultaneously to an aqueous gelatin solution with stirring and mixing them, an emulsion with a high content of cubic silver chloride grains having a volume weighted average sphere-equivalent diameter of 0.43 μm and a variation coefficient of 10% was prepared. In the course of preparation, specifically over a period of time when from 50% to 80% of silver nitrate addition was in progress, a water solution of $Cs_2[OsCl_5(NO)]$ was added in an amount of $5\times10^{-9}$ mole, based on Os, per mole of finished silver halide and, over a period of time when from 80% to 90% of silver nitrate addition was in progress, potassium bromide (in a proportion of 2 mole % to one mole of finished silver halide) and $K_4[Ru(CN)_6]$ were added. Further, over a period of time when from 83% to 88% of silver nitrate addition was in progress, $K_2[IrCl_6]$ was added. The emulsion obtained was subjected to desalting treatment, and then admixed with gelatin and dispersed again. Thereto, sodium benzenethiosulfonate, Sensitizing Dye A and Sensitizing Dye B were added. Further, the resulting emulsion was admixed with thioglucosegold as a sensitizer and ripened to an optimal extent. Furthermore thereto, 1-phenyl-5-mercaptotetrazole and 1-(5-methylureidophenyl)-5-mercaptotetrazole as compounds represented by formula (III) according to the invention were each added in the amount of $3\times10^{-4}$ mole per mole of silver halide. The thus obtained emulsion was referred to as "Emulsion B-L1".

(Preparation of Emulsion B-H2)

An emulsion was prepared in the same manner as Emulsion B-H1, except that potassiumiodide (in a proportion of 0.23 mole % to one mole of finished silver halide) was added at a time when 90% of silver nitrate addition was concluded, and besides, $K_2[Ir(methylthiazole)Cl_5]$ was added in an amount of $2\times10^{-7}$ mole, based on Ir, per mole of finished silver halide over a period of time when from 92% to 98% of silver nitrate addition was in progress. The thus obtained emulsion was referred to as "Emulsion B-H2".

(Preparation of Emulsion B-L2)

An emulsion was prepared in the same manner as Emulsion B-H1, except that potassium iodide (in a proportion of 0.23 mole % to one mole of finished silver halide) was added at a time when 90% of silver nitrate addition was concluded, and besides, $K_2[Ir(methylthiazole)Cl_5]$ was added in an amount of $5\times10^{-7}$ mole, based on Ir, per mole of finished silver halide over a period of time when from 92% to 98% of silver nitrate addition was in progress. The thus obtained emulsion was referred to as "Emulsion B-L2".

(Preparation of Emulsion G-H1)

By a usual method of adding silver nitrate and sodium chloride simultaneously to an aqueous gelatin solution with stirring and mixing them, an emulsion with a high content of cubic silver chloride grains having a sphere-equivalent diameter of 0.38 μm and a variation coefficient of 10% was prepared. In the course of preparation, specifically over a period of time when from 80% to 90% of silver nitrate addition was in progress, $K_4[Ru(CN)_6]$ was added. And over a period of time when from 80% to 100% of silver nitrate addition was in progress, potassium bromide (in a proportion of 3 mole % to one mole of finished silver halide) was added. Further, over a period of time when from 83% to 88% of silver nitrate addition was in progress, $K_2[IrCl_6]$ was added. The emulsion obtained was subjected to desalting treatment, and then admixed with gelatin and dispersed again. Further, the resulting emulsion was admixed with sodium benzenethiosulfonate, and ripened to an optimal extent by use of a colloidal dispersion of gold sulfide as a sensitizer. Thereto, Sensitizing Dye D, 1-phenyl-5-mercaptotetrazole, 1-(5-methylureidophenyl)-5-mercaptotetrazole and potassium bromide were added. The thus obtained emulsion was referred to as "Emulsion G-H1".

(Preparation of Emulsion G-L1)

By a usual method of adding silver nitrate and sodium chloride simultaneously to an aqueous gelatin solution with stirring and mixing them, an emulsion with a high content of cubic silver chloride grains having a sphere-equivalent diameter of 0.28 μm and a variation coefficient of 10% was prepared. In the course of preparation, specifically over a period of time when from 80% to 90% of silver nitrate addition was in progress, $K_4[Ru(CN)_6]$ was added. And over a period of time when from 80% to 100% of silver nitrate addition was in progress, potassium bromide (in a proportion of 3 mole % to one mole of finished silver halide) was added. Further, over a period of time when from 83% to 88% of silver nitrate addition was in progress, $K_2[IrCl_6]$ was added. The emulsion obtained was subjected to desalting treatment, and then admixed with gelatin and dispersed again. Further, the resulting emulsion was admixed with sodium benzenethiosulfonate, and ripened to an optimal extent by use of a colloidal dispersion of gold sulfide as a sensitizer. Thereto, Sensitizing Dye D, 1-phenyl-5-mercaptotetrazole, 1-(5-methylureidophenyl)-5-mercaptotetrazole and potassium bromide were added. The thus obtained emulsion was referred to as "Emulsion G-L1".

(Preparation of Emulsion R—H1)

By a usual method of adding silver nitrate and sodium chloride simultaneously to an aqueous gelatin solution with stirring and mixing them, an emulsion with a high content of cubic silver chloride grains having a sphere-equivalent diameter of 0.38 μm and a variation coefficient of 10% was prepared. In the course of preparation, specifically over a period of time when from 80% to 90% of silver nitrate addition was in progress, $K_4[Ru(CN)_6]$ was added. And over a period of time when from 80% to 100% of silver nitrate addition was in progress, potassium bromide (in a proportion of 3 mole % to one mole of finished silver halide) was added. Further, over a period of time when from 83% to 88% of silver nitrate addition was in progress, $K_2[IrCl_6]$ was added. The emulsion obtained was subjected to desalting treatment, and then admixed with gelatin and dispersed again. Further, the resulting emulsion was admixed with sodium benzenethiosulfonate, and ripened to an optimal extent by using sodium thiosulfate pentahydrate as a sulfur sensitizer and bis(1,4,5-trimethyl-1,2,4-triazolium-3-thiolato)aurate(I) tetrafluoroborate as a gold sensitizer. Thereto, Sensitizing Dye H, 1-phenyl-5-mercaptotetrazole, 1-(5-methylureidophenyl)-5-mercaptotetrazole, Compound I and potassium bromide were further added. The thus obtained emulsion was referred to as "Emulsion R-H1".

(Preparation of Emulsion R-L1)

By a usual method of adding silver nitrate and sodium chloride simultaneously to an aqueous gelatin solution with stirring and mixing them, an emulsion with a high content of cubic silver chloride grains having a sphere-equivalent diameter of 0.28 μm and a variation coefficient of 10% was prepared. In the course of preparation, specifically over a period of time when from 80% to 90% of silver nitrate addition was in progress, $K_4[Ru(CN)_6]$ was added. And over a period of time when from 80% to 100% of silver nitrate addition was in progress, potassium bromide (in a proportion of 3 mole % to one mole of finished silver halide) was added. Further, over a period of time when from 83% to 88% of silver nitrate addition was in progress, $K_2[IrCl_6]$ was added. The emulsion obtained was subjected to desalting treatment, and then admixed with gelatin and dispersed again. Further, the resulting emulsion was admixed with sodium benzenethiosulfonate, and ripened to an optimal extent by using sodium thiosulfate pentahydrate as a sulfur sensitizer and bis(1,4,5-trimethyl-1,2,4-triazolium-3-thiolato)aurate(I) tetrafluoroborate as a gold sensitizer. Thereto, Sensitizing Dye H, 1-phenyl-5-mercaptotetrazole, 1-(5-methylureidophenyl)-5-mercaptotetrazole, Compound I and potassium bromide were further added. The thus obtained emulsion was referred to as "Emulsion R-L1".

By use of these emulsions, a sample having the following layer structure was prepared.

First Layer (Blue-Sensitive Emulsion Layer):

| | |
|---|---|
| Emulsion B-H1 | 0.07 |
| Emulsion B-L1 | 0.07 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |

Second Layer (Color Mixing Inhibiting Layer):

| | |
|---|---|
| Gelatin | 0.60 |
| Color mixing inhibitor (Cpd-19) | 0.09 |
| Color image stabilizer (Cpd-5) | 0.007 |
| Color image stabilizer (Cpd-7) | 0.007 |
| UV absorbent (UV-C) | 0.05 |
| Solvent (Solv-5) | 0.11 |

Third Layer (Green-Sensitive Emulsion Layer):

| | |
|---|---|
| Emulsion G-H1 | 0.06 |
| Emulsion G-L1 | 0.06 |
| Gelatin | 0.73 |
| Magenta coupler (ExM) | 0.15 |
| Ultraviolet absorbent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |

Fourth Layer (Color Mixing Inhibiting Layer):

| | |
|---|---|
| Gelatin | 0.48 |
| Color mixing inhibitor (Cpd-4) | 0.07 |
| Color image stabilizer (Cpd-5) | 0.006 |
| Color image stabilizer (Cpd-7) | 0.006 |
| Ultraviolet absorbent (UV-C) | 0.04 |
| Solvent (Solv-5) | 0.09 |

Fifth Layer (Red-Sensitive Emulsion Layer):

| | |
|---|---|
| Emulsion R-H1 | 0.05 |
| Emulsion R-L1 | 0.05 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorbent (UV-7) | 0.02 |
| Solvent (Solv-5) | 0.09 |

Sixth Layer (Ultraviolet Absorbing Layer):

| | |
|---|---|
| Gelatin | 0.32 |
| Ultraviolet absorbent (UV-C) | 0.42 |
| Solvent (Solv-7) | 0.08 |

Seventh Layer (Protective Layer):

| | |
|---|---|
| Gelatin | 0.70 |
| Acryl-modified polyvinyl alcohol (modification degree: 17%) | 0.04 |
| Liquid paraffin | 0.01 |
| Surfactant (Cpd-13) | 0.01 |
| Polydimethylsiloxane | 0.01 |
| Silicon dioxide | 0.003 |

The structural formulae of the ingredients used herein are the same as those having the same designations as in Example 7, respectively, while the structural formulae of the ingredients used herein but not used in Example 7 are illustrated below:

(ExY-2) Yellow coupler

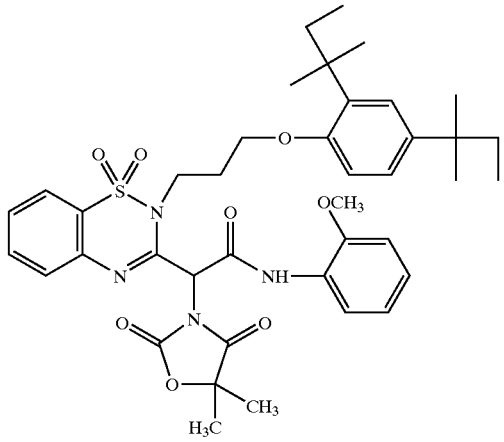

(UV-C)

1:1:1::2 (by weight) Mixture of UV-2, UV-3, UV-6 and UV-7

The sample having the foregoing layer structure was referred to as Sample No. 201.

Another sample was prepared in the same manner as Sample No. 201, except that Emulsions B-H1 and B-L1 were replaced by Emulsions B-H2 and B-L2, respectively, and ref erred to as "Sample No. 202".

These samples were each processed in accordance with the following rapid short-duration Processing B which was reduced further in processing times, compared with Processing A. Additionally, the processing compositions before continuous processing were the same as those used in Processing A, respectively.

On the thus processes samples, evaluations of yellow streaks by pressure sensitization were performed in the same way as in Example 7. As a result, it was shown that the present Sample No. 202 having the foregoing photographic constituent layers was reduced in yellow streaks attributed to pressure sensitization although it underwent rapid processing and the present effect was achieved by this sample also.

Photographic Processing B:

Continuous processing was performed using the same processing compositions as used in Example 7 and a minilabo printer processor, Frontier 350, made by Fuji Photo Film Co., Ltd. in the following processing process until the replenisher volume reached three times the liquid volume in the color developing tank. This processing is referred to as "Processing B". Additionally, the transport speed of Frontier 350 was increased to 39.3 mm/sec, and the processing racks in the color development and bleach-fix processing tanks were modified. Further, the rinse processing tank and the processing rack were adapted for the blade transport system disclosed in JP-A-2002-55422, the direction of liquid circulation was changed to the downward direction (following the form described in Japanese Patent Application No. 2001-147814), and a circulation filter with pleats was installed at the tank bottom.

Processing B

| Processing Steps | Temperature | Time | Amount replenished |
|---|---|---|---|
| Color development | 45.0° C. | 16 sec | 45 ml/m$^2$ |
| Bleach-fix | 40.0° C. | 16 sec | Replenisher A 17.5 ml/m$^2$ Replenisher B 17.5 ml/m$^2$ |
| Rinse (1) | 40.0° C. | 5 sec | — |
| Rinse (2) | 40.0° C. | 3 sec | — |
| Rinse (3) | 40.0° C. | 3 sec | — |
| Rinse (4) | 40.0° C. | 5 sec | 175 ml/m$^2$ |
| Drying | 80° C. | 16 sec | |

In accordance with the present image formation method characterized in that the present silver halide photographic materials having high silver chloride contents and containing silver iodide in proportions ranging from 0.05 to 1 mole % and halo-Ir-complex salts of specific structures undergo color development in a short time below 27 seconds as they are transported at a high speed in a state of being cut into sheets, reduction of fog and improvement in pressure sensitization streaks can be achieved even in the case of high-temperature rapid processing and color photographic images of good quality can be obtained.

The entire disclosure of each and every foreign patent application: Japanese Patent Application Nos. 2002-211459, 2002-212476 and 2002-212676, from which the benefit of foreign priority has been claimed in the present application is incorporated herein by reference, as if fully set forth.

What is claimed is:

1. A color image formation method comprising;

cutting a silver halide color photographic material into sheets, the photographic material having on a support photographic constituent layers including at least one blue-sensitive silver halide emulsion layer containing a yellow dye-forming coupler, at least one green-sensitive silver halide emulsion layer containing a magenta dye-forming coupler, at least one red-sensitive silver halide emulsion layer containing a cyan dye-forming coupler and at least one light-insensitive hydrophilic colloid layer;

subjecting the photographic material cut into sheets to imagewise exposure; and subjecting the photographic material exposed imagewise to a photographic processing including a color development step, a bleach-fix step and a rinse step, wherein the transport of the photographic material during the photographic processing is performed at a speed of 27.8 mm/sec to 100 mm/sec, the bleach-fix step has a processing time of 1 to 30 seconds and at least one of the silver halide emulsion layers comprises a silver halide emulsion containing at least one compound represented by the following formula (I) and having a silver chloride content of at least 90 mole %;

(I)

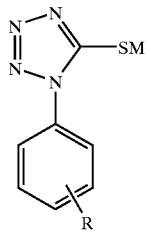

wherein M represents a cation, and R represents an atom having an atomic weight of not more than 100 or a group having a total atomic weight of not more than 100.

2. The color image formation method according to claim 1, wherein the silver halide emulsion layer contains silver halide grains having a silver chloride content of at least 90 mole % and a silver iodide content of from 0.05 to 1 mole %.

3. The color image formation method according to claim 1, having a total silver content of from 0.01 to 0.45 g/m$^2$.

4. A silver halide color photographic material comprising photographic constituent layers including at least one yellow dye-forming coupler containing blue-sensitive silver halide emulsion layer, at least one magenta dye-forming coupler containing green-sensitive silver halide emulsion layer, at least one cyan dye-forming coupler containing red-sensitive silver halide emulsion layer and at least one light-insensitive hydrophilic colloid layer, wherein a color image is formed by an imagewise exposure and a photographic processing subsequent thereto, which the photographic processing includes a color development step, a bleach-fix step having a processing time of 1 to 30 seconds and a rinse step, in which the photographic processing is performed while transporting the photographic material cut into sheets at a transport speed of from 27.8 mm/sec to 100 mm/sec by means of transporting rollers, wherein at least one of the silver halide emulsion layers comprises an silver halide emulsion containing at least one compound represented by the following formula (I) and having a silver chloride content of at least 90 mole %:

(I)

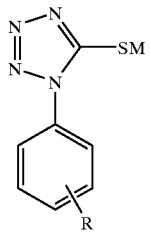

wherein M represents a cation, and R represents an atom having an atomic weight of not more than 100 or a group having a total atomic weight of not more than 100.

5. The silver halide color photographic material according to claim 4, wherein the silver halide emulsion layer contains silver halide grains having a silver chloride content of 90 mole % or higher and a silver iodide content of from 0.05 to 1 mole %.

6. The silver halide color photographic material according to claim 4, having a total silver content of from 0.01 to 0.45 $g/m^2$.

* * * * *